US005602625A

United States Patent [19]

Okamoto et al.

[11] Patent Number: 5,602,625

[45] Date of Patent: Feb. 11, 1997

[54] OPERATION GUIDANCE DISPLAY APPARATUS OF IMAGE FORMING APPARATUS

[75] Inventors: Yuji Okamoto, Nara; Yoshikado Yamada, Kitakatsuragi-gun; Kaoru Ishikura, Yamatokoriyama, all of Japan

[73] Assignee: Sharp Kabushiki Kaisha, Osaka, Japan

[21] Appl. No.: 466,642

[22] Filed: Jun. 6, 1995

[30] Foreign Application Priority Data

Aug. 31, 1994 [JP] Japan ..... 6-207198
Oct. 27, 1994 [JP] Japan ..... 6-264237

[51] Int. Cl.[6] ..... G03G 15/00

[52] U.S. Cl. ..... 399/21; 399/81

[58] Field of Search ..... 355/206, 209, 355/207; 364/146, 188

[56] References Cited

U.S. PATENT DOCUMENTS 4,682,158 7/1987 Ito et al. ..... 355/209 X
4,996,557 2/1991 Takagi ..... 355/206 X
5,081,699 1/1992 Filion et al. ..... 355/206 X

FOREIGN PATENT DOCUMENTS 59-78372 5/1984 Japan .
4-84174 3/1992 Japan .

*Primary Examiner*—Joan H. Pendegrass
*Attorney, Agent, or Firm*—Dike, Bronstein, Roberts & Cushman LLP

[57] ABSTRACT

An operation guidance display apparatus displays dynamic images of operations which are necessary for a display section provided to an image forming apparatus in the case where jam, out of toner, etc. occur in sheet passing sections of the image forming apparatus, and an operation by an operator is required. As a result, even if the operator first performs the necessary operations or it is difficult for the operator to understand the operations, the operator can safely and securely performs the operations. Therefore, operability of the image forming apparatus can be improved by providing the apparatus of the present invention to the image forming apparatus.

36 Claims, 116 Drawing Sheets

SHEETS ARE JAMMED. OPEN FRONT COVER OF MAIN BODY AND REMOVE THE SHEETS. [OPERATION GUIDE] STRIKE (*), THEN PROCEDURE FOR REMOVING IS SUGGESTED.

(CELL 1)

(CELL 2)

(CELL 3)

(CELL 4)

(CELL 5)

(CELL 6)

(CELL 7)

(CELL 8)

(CELL 9)

(CELL 10)

(CELL 11)

(CELL 12)

(CELL 13)

(CELL 14)

(CELL 15)

(CELL 16)

(CELL 17)

(CELL 18)

(CELL 1)

(CELL 2)

(CELL 3)

(CELL 4)

(CELL 5)

(CELL 6)

(CELL 7)

(CELL 8)

(CELL 9)

(CELL 10)

(CELL 11)

(CELL 12)

(CELL 13)

(CELL 14)

(CELL 15)

(CELL 16)

(CELL 17)

(CELL 18)

TURN ROLLER ROTATIONAL KNOB IN THE DIRECTION OF THE ARROW SO AS TO REMOVE A JAMMED SHEET.

FIG.61(a) (CELL 1)
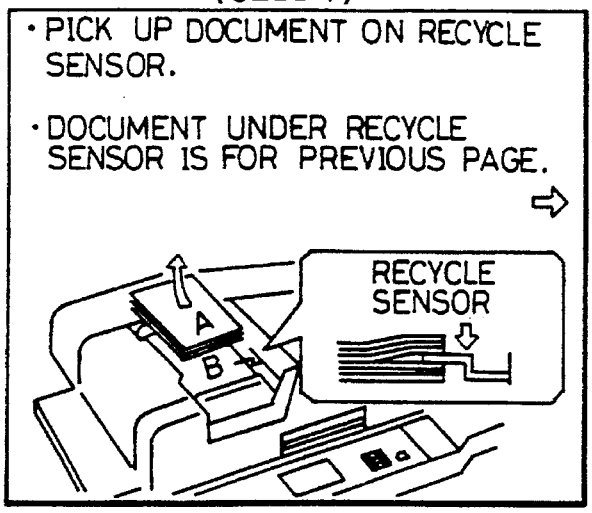
FIG.61(b) (CELL 2)
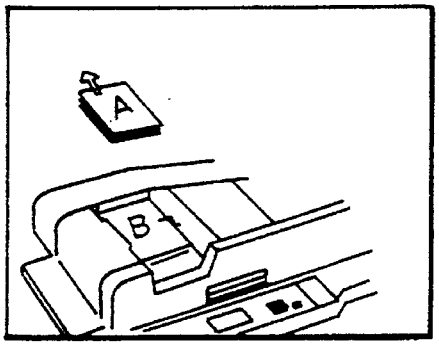
FIG.61(d) (CELL 4)
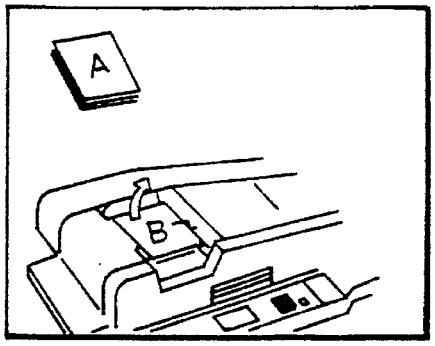
FIG.61(c) (CELL 3)
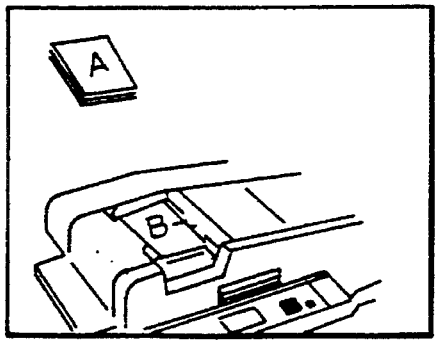

FIG.62(a) (CELL 5)
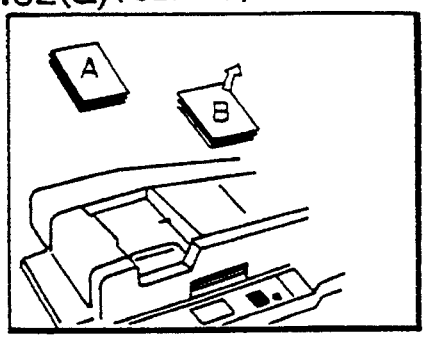
FIG.62(b) (CELL 6)
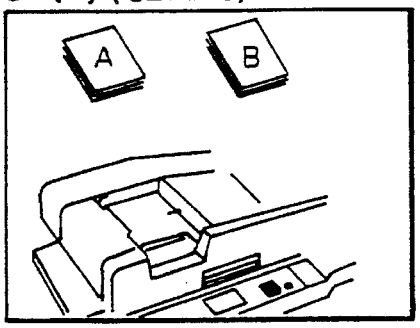
FIG.62(c) (CELL 7)
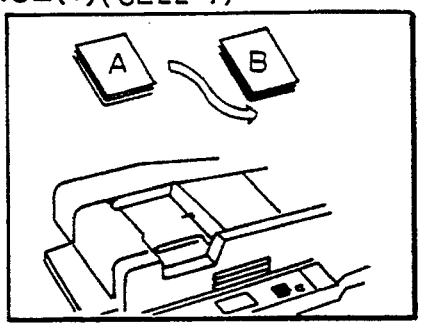
FIG.62(d) (CELL 8)
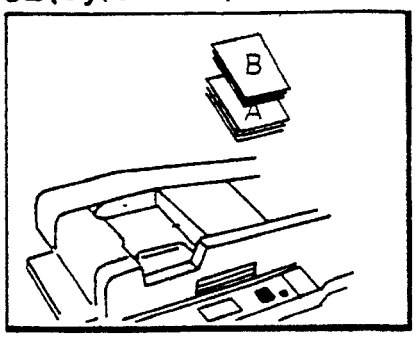
FIG.62(e) (CELL 9)
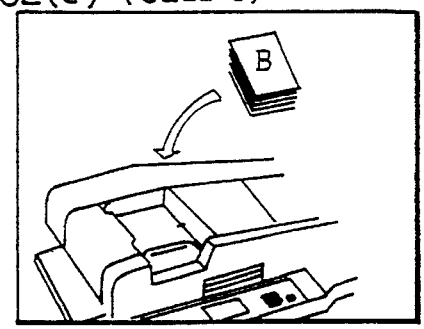
FIG.62(f) (CELL 10)
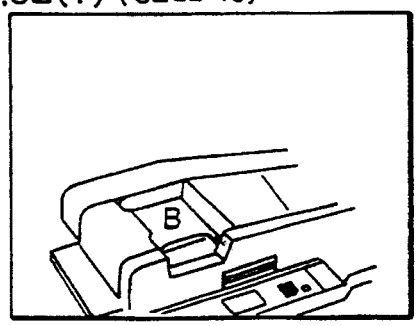

FIG.63(a) (CELL 1)
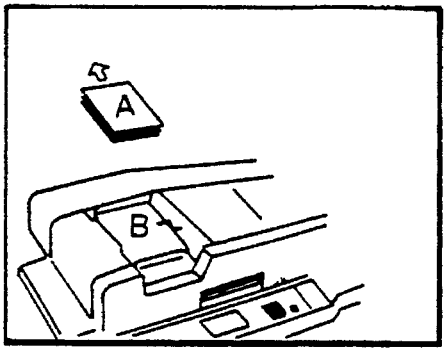
FIG.63(b) (CELL 2)
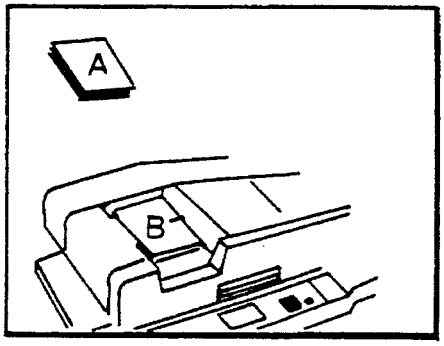
FIG.63(c) (CELL 3)
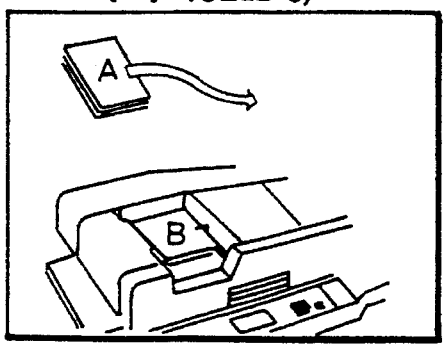
FIG.63(d) (CELL 4)
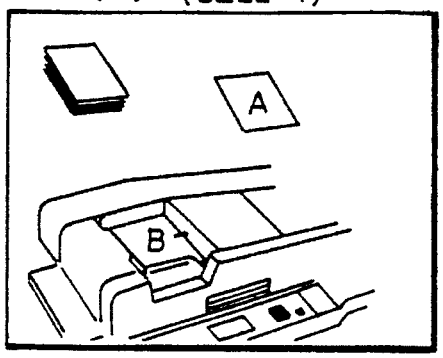
FIG.63(e) (CELL 5)
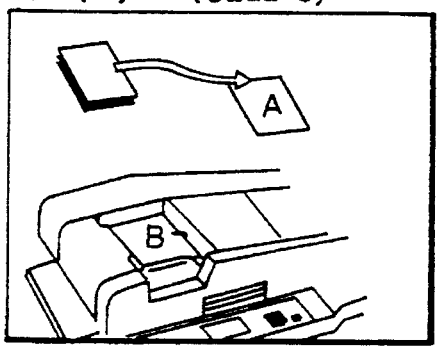
FIG.63(f) (CELL 6)
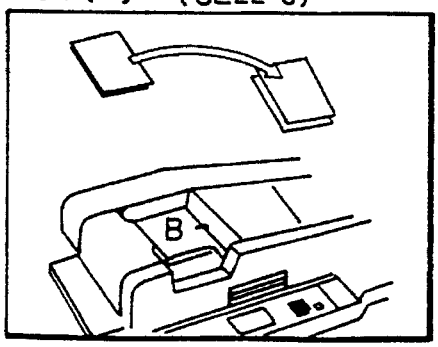

FIG.64(a) (CELL 7)
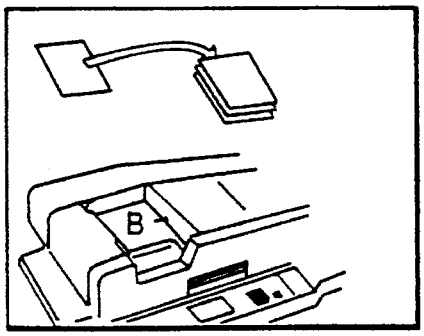
FIG.64(b) (CELL 8)
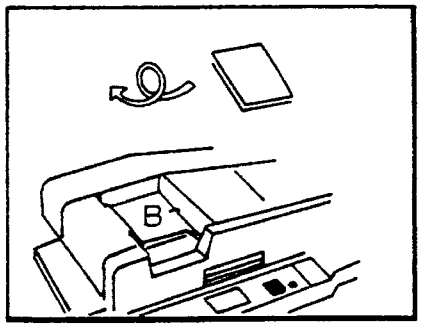
FIG.64(c) (CELL 9)
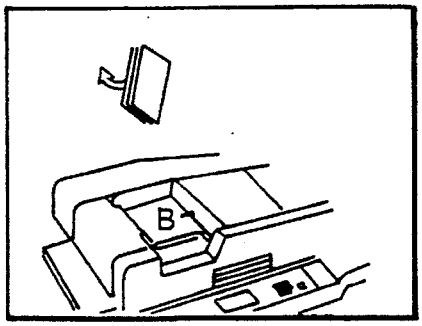
FIG.64(d) (CELL 10)
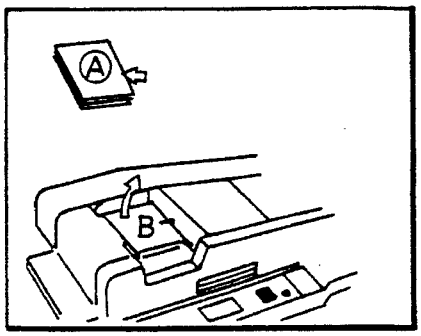
FIG.64(e) (CELL 11)
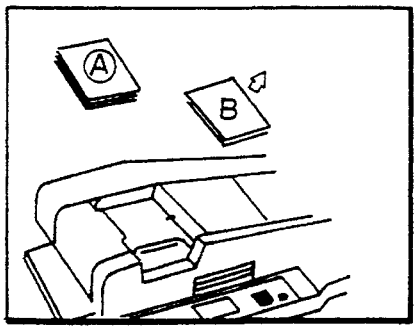
FIG.64(f) (CELL 12)
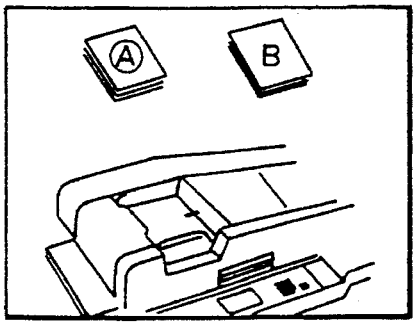

FIG.65(a) (CELL 13)
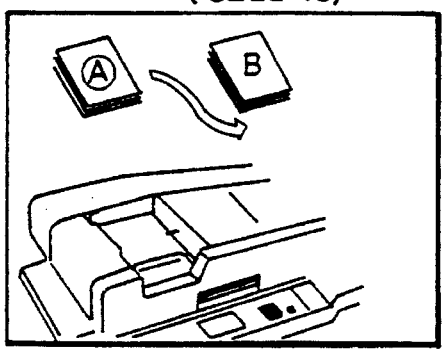
FIG.65(d) (CELL 16)
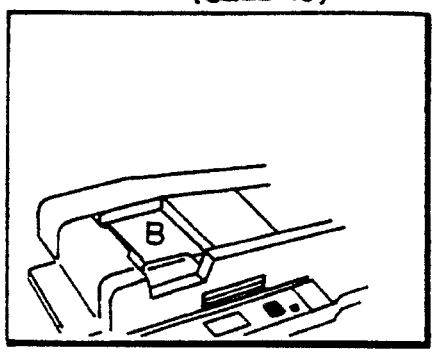
FIG.65(b) (CELL 14)
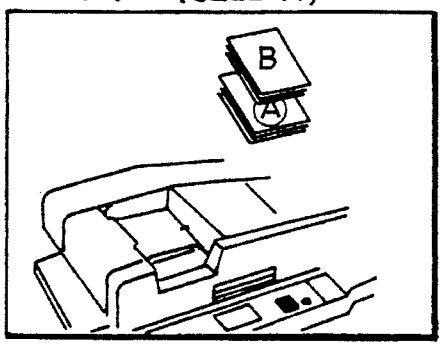
FIG.65(c) (CELL 15)
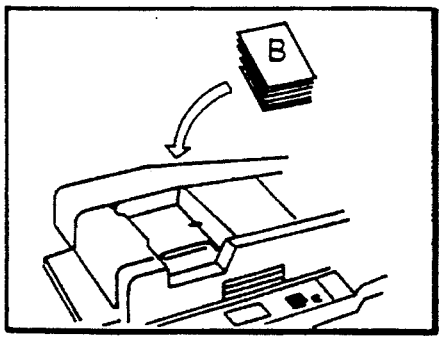

FIG.67(a) (CELL 1)
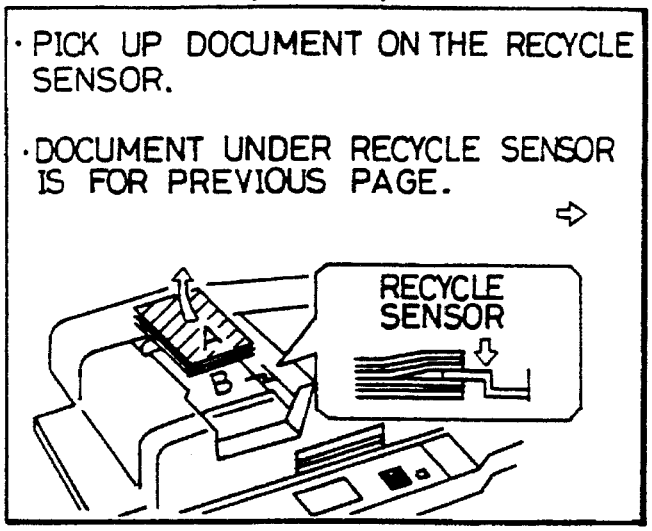
FIG.67(b) (CELL 2)
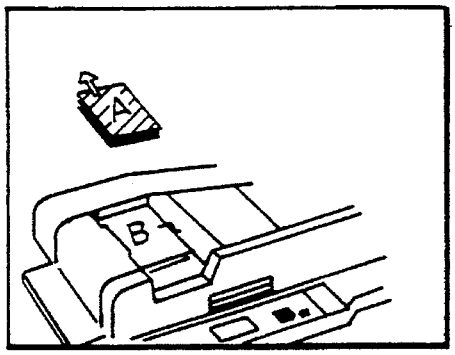
FIG.67(d) (CELL 4)
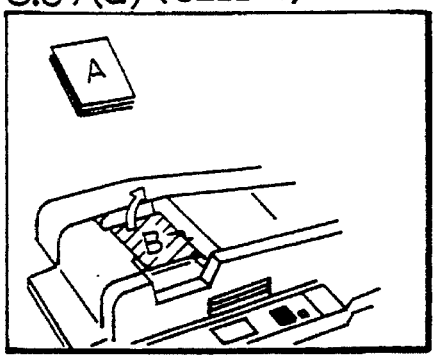
FIG.67(c) (CELL 3)
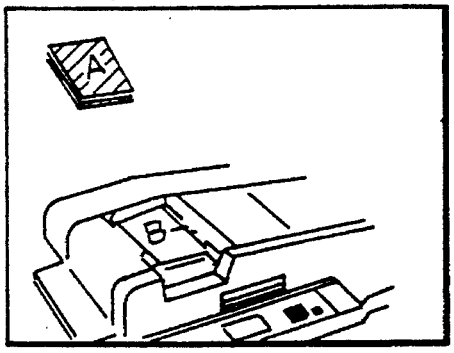

FIG.68(a) (CELL 5)
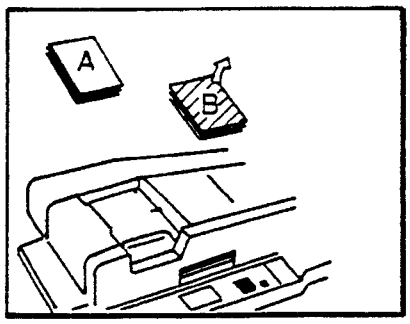
FIG.68(b) (CELL 6)
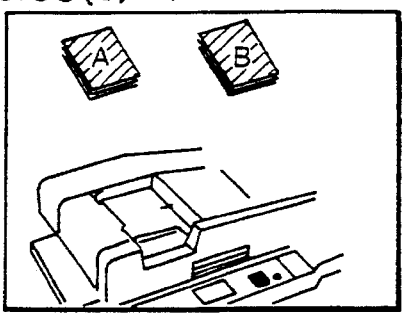
FIG.68(c) (CELL 7)
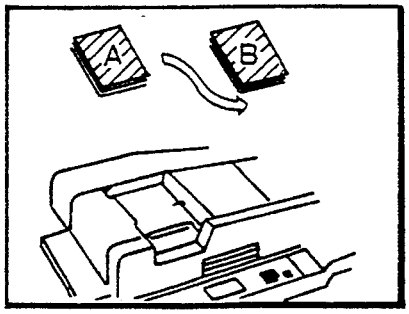
FIG.68(d) (CELL 8)
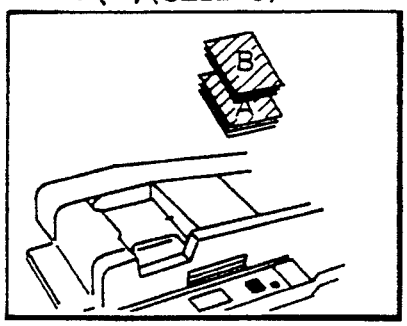
FIG.68(e) (CELL 9)
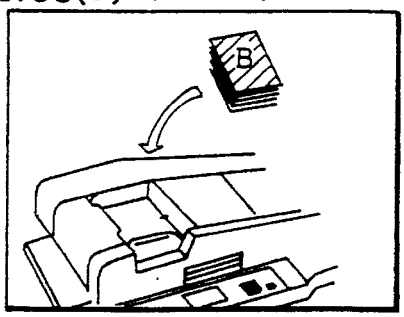
FIG.68(f) (CELL 10)
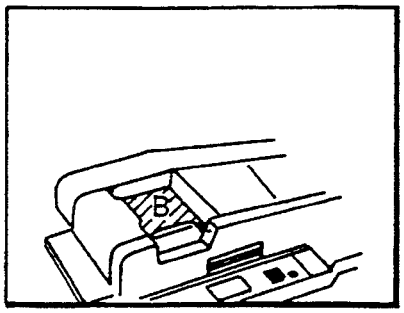

FIG.69(a) (CELL 1)
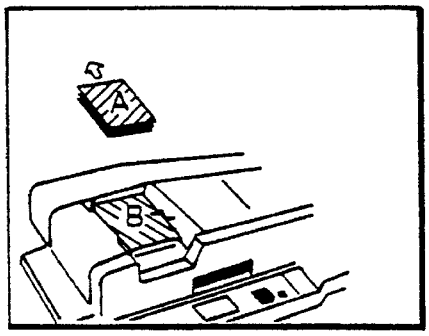
FIG.69(b) (CELL 2)
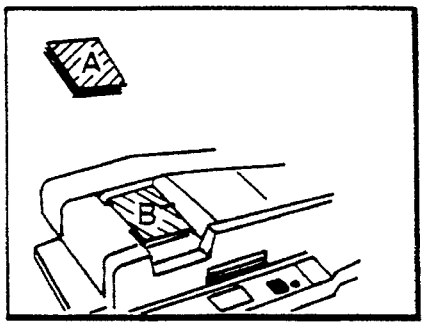
FIG.69(c) (CELL 3)
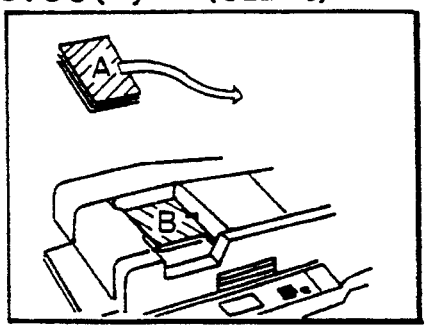
FIG.69(d) (CELL 4)
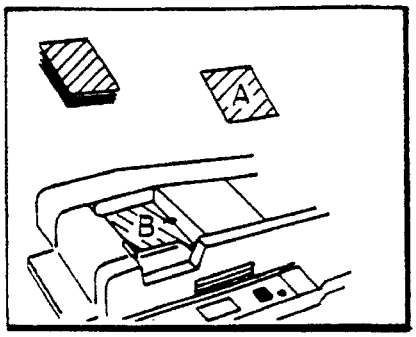
FIG.69(e) (CELL 5)
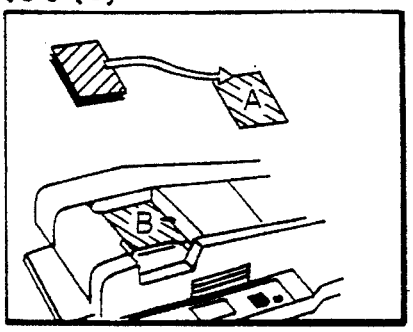
FIG.69(f) (CELL 6)
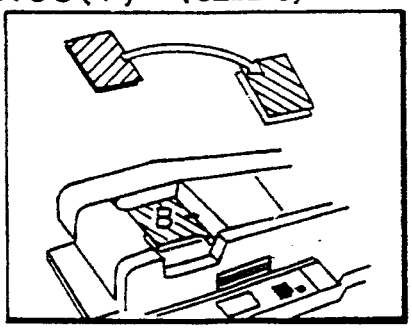

FIG.70(a) (CELL 7)
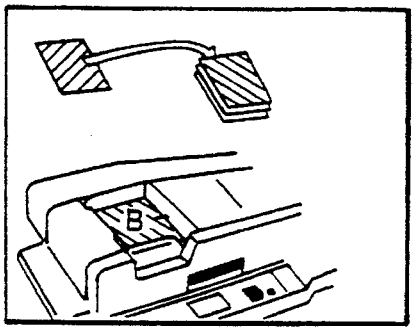
FIG.70(b) (CELL 8)
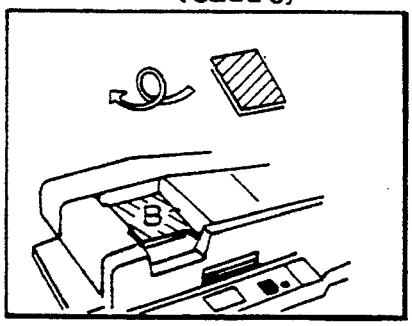
FIG.70(c) (CELL 9)
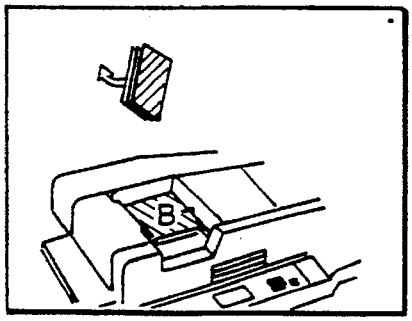
FIG.70(d) (CELL 10)
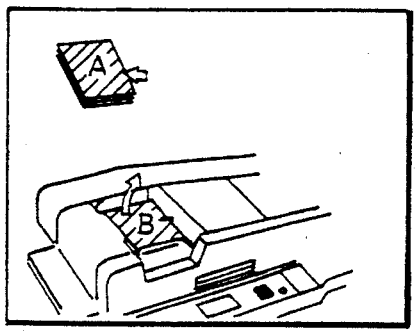
FIG.70(e) (CELL 11)
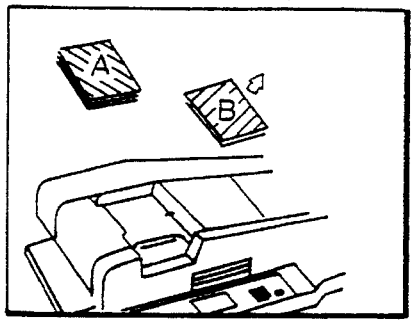
FIG.70(f) (CELL 12)
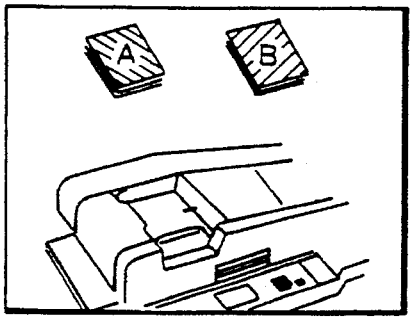

FIG.71(a) (CELL 13)
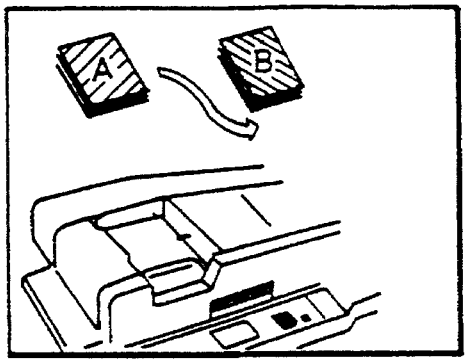
FIG.71(b) (CELL 14)
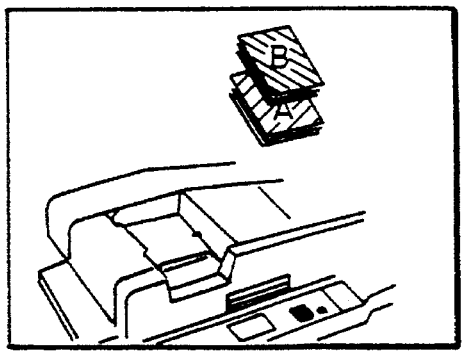
FIG.71(c) (CELL 15)
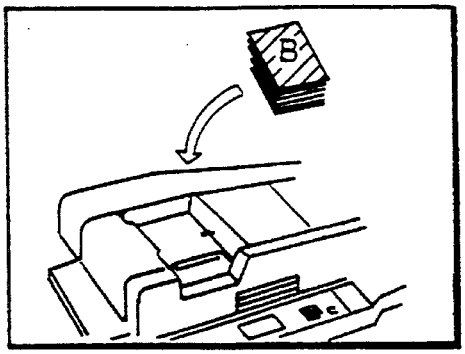
FIG.71(d) (CELL 16)
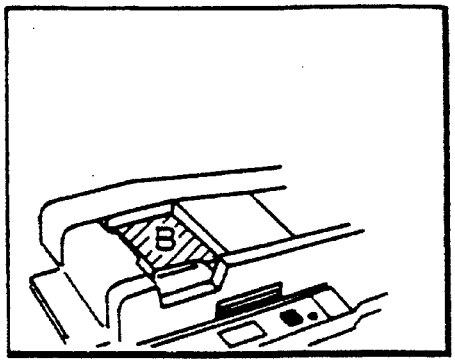

FIG.72(a) (CELL 1)
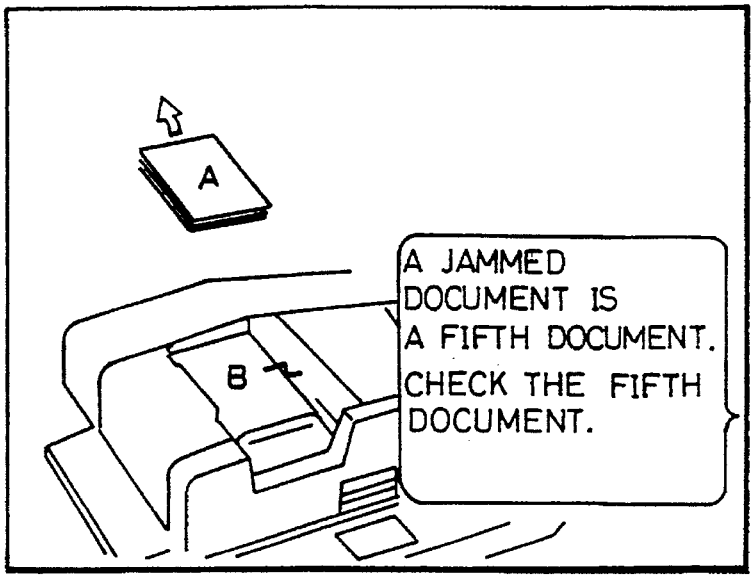
FIG.72(b) (CELL 2)
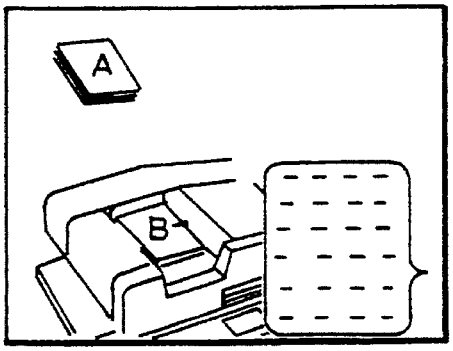
FIG.72(d) (CELL 4)
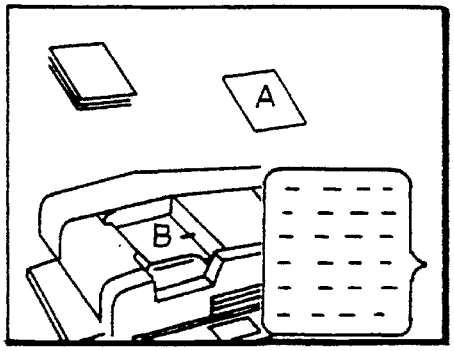
FIG.72(c) (CELL 3)
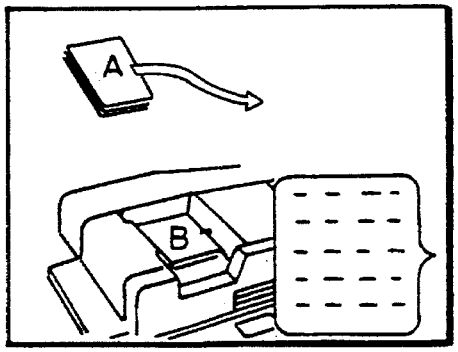

FIG.73(a) (CELL 5)
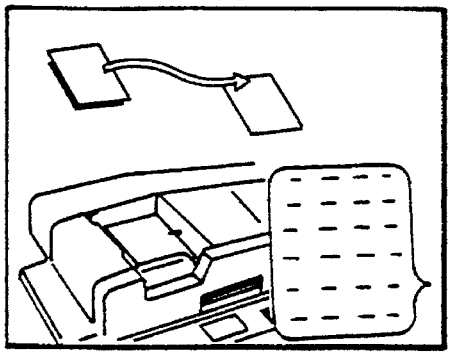
FIG.73(d) (CELL 8)
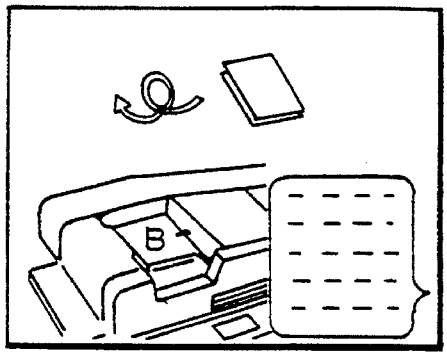
FIG.73(b) (CELL 6)
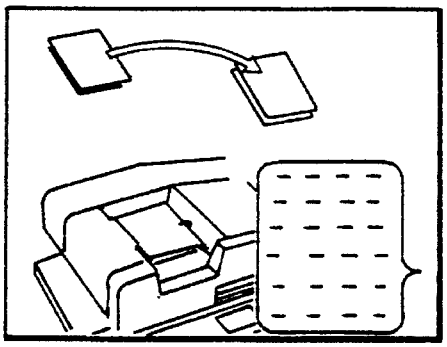
FIG.73(e) (CELL 9)
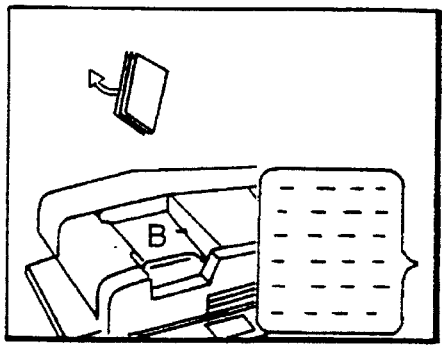
FIG.73(c) (CELL 7)
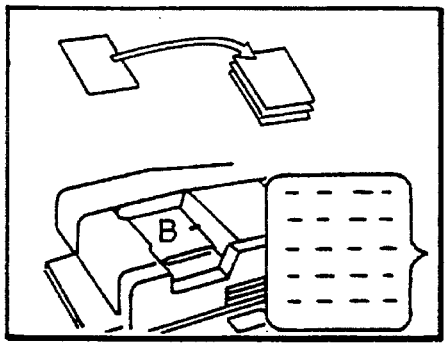
FIG.73(f) (CELL 10)
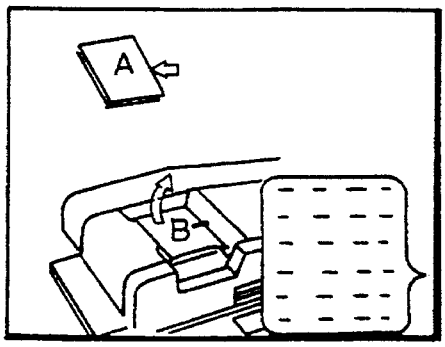

FIG.74(a) (CELL 11)
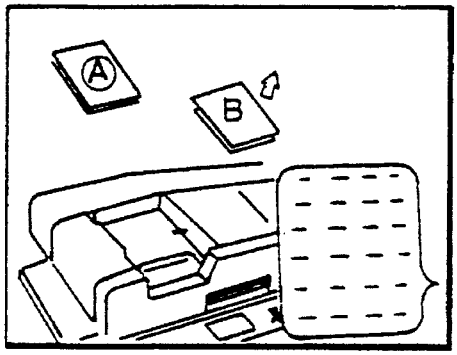
FIG.74(b) (CELL 12)
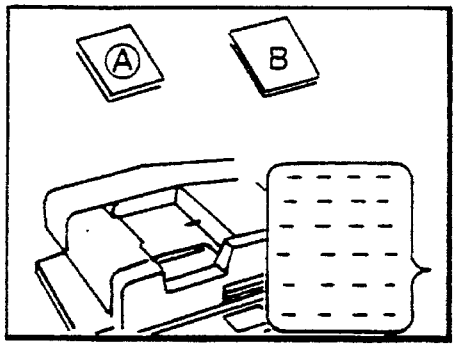
FIG.74(c) (CELL 13)
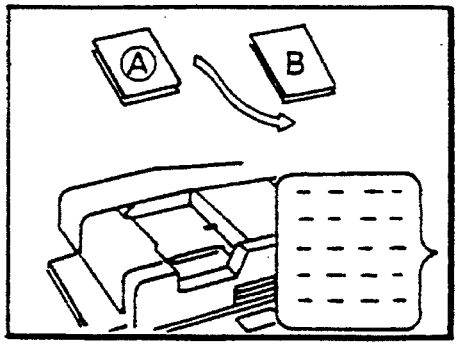
FIG.74(d) (CELL 14)
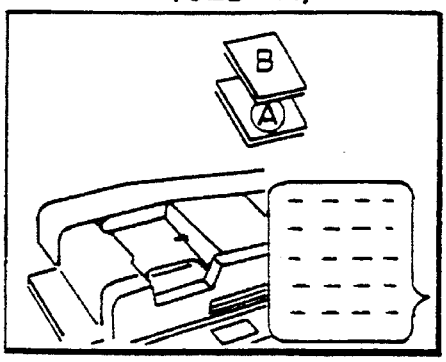
FIG.74(e) (CELL 15)
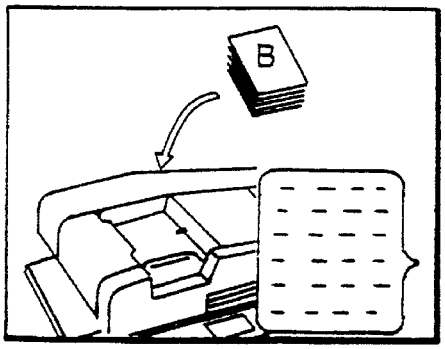
FIG.74(f) (CELL 16)
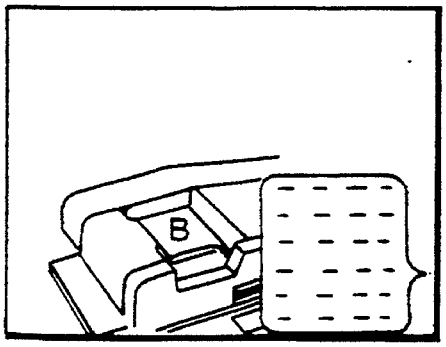

OPERATION GUIDANCE DISPLAY APPARATUS OF IMAGE FORMING APPARATUS

FIELD OF THE INVENTION

The present invention relates to an operation guidance display apparatus an image forming apparatus for displaying necessary operating procedure information, such as a jam removing procedure, which is provided to an image forming apparatus, such as a copying apparatus, a printer.

BACKGROUND OF THE INVENTION

In a conventional copying apparatus, for example, as an image forming apparatus, when troubles, such as out-of-sheets and jam, occurs, a message which represents such troubles is displayed in a displaying section provided on an operation panel, or a place where such troubles occur is displayed by a display lamp, for example, so that warning is given to an operator about its countermeasures against the troubles.

However, only if the message or the place where the troubles occurred is displayed, an operator who is inexperienced in the copying apparatus cannot easily deal with the troubles according to the warning. Jam of sheets which relatively occurs at high frequency and of which countermeasures are troublesome is particularly serious.

Therefore, in order to solve such a problem, Japanese Unexamined Patent Publication No. 4-84174/1992 (Tokukaihei 4-84174) suggests an arrangement that when a trouble occurs, a content of the trouble is displayed as a message on a displaying section, and that accordingly the place where the trouble occurred is opened according to the message.

Concretely, when jam and a situation that replacement of a process cartridge is required occur, an image forming operation is suspended at first. Next, a content of a trouble flickers on a display as a message, and according to this, the process cartridge automatically moves to a evacuation position and after an upper cover is released, an unit member on a jam occurring place is directly displayed by a display flickering sign such as an arrow. This makes it possible to easily find a transferring material which has been jammed from an upper position of an apparatus main body and to remove the jammed transferring material.

In addition, Japanese Unexamined Patent Publication No. 59-78372/1984 (Tokukaisho 59-78372) discloses an arrangement that a state of a copying apparatus, such as an open/shut state and failure of a door, and each component of the copying apparatus are graphically displayed and that messages of the above states are displayed.

However, as disclosed in Japanese Unexamined Patent Publication No. 4-84174/1992 (Tokukaihei 4-84174), when a trouble occurring place automatically starts to open according to display of a content of a trouble, the trouble is easily dealt with, but it is difficult especially from its structural aspect to provide an opening structure for carrying out the above opening operation to an image forming apparatus with a complicated arrangement. Moreover, in the case where an operator does not expect the opening operation, the operator is possibly in a danger.

In addition, in the arrangement of Japanese Unexamined Patent Publication No. 59-78372/1984 (Tokukaisho 59-78372), since a state of a copying apparatus, such as a failure, is simply displayed as a static image, in the case where jam occurs in a present copying apparatus which requires a complicated operation for removing jam, such as a high-speed apparatus which is capable of carrying out copying on a plurality of sheets at a high speed, there arises a problem that an operator who is inexperienced in the apparatus cannot easily remove jam based upon the above display.

In addition, in the arrangement of Japanese Unexamined Patent Publication No. 59-78372/1984 (Tokukaisho 59-78372), since a state of a copying apparatus, such as a failure, is simply displayed as a static image, in the present malfunctioned copying apparatus which requires many kinds of and complicated operations to be operated by an operator in order that an image forming apparatus forms a next image, such as supplying of toner, replacing of a disposed toner bottle, supplying of sheets, changing of a document direction in a variable magnification copying mode, installation of an option unit, there arises a problem that an operator who is inexperienced in the apparatus cannot easily perform the operations based upon the above display.

SUMMARY OF THE INVENTION

It is an object of the present invention to provide an operation guidance display apparatus of an image forming apparatus which makes it possible that an operator safely and securely performs an operation and that operability of an image forming apparatus is improved by providing the apparatus of the present invention to the image forming apparatus even if an operator first performs the operation or it is difficult for the operator to understand the operation in the case where the operation by the operator is required during use of the image forming apparatus.

In order to achieve the above object, the operation guidance display apparatus of the image forming apparatus according to the present invention is characterized by comprising:

(1) state detecting means for detecting that the image forming apparatus requires a prescribed operation by an operator;

(2) dynamic image data storing means for storing dynamic image data which show a sequence of a procedure for the prescribed operation to be detected by the state detecting means;

(3) display means for displaying operation guidance; and (4) display control means for when the state detecting means detects that the image forming apparatus requires the prescribed operation, displaying the dynamic image data of necessary operation on the display means as dynamic images.

With the above arrangement, when the image forming apparatus requires a prescribed operation by an operator, this state is detected by the state detecting means and the dynamic images of the necessary operation are displayed by the display control means. Therefore, a portion on which an operation should be performed and a method of performing an operation on the portion become clear. As a result, even if the operator first performs the operation or it is difficult to understand, the operator can safely and securely perform the operation, thereby improving operability of the image forming apparatus by providing the apparatus of the present invention to the image forming apparatus.

It is desirable that the above operation guidance display apparatus displays a procedure for removing jam in the case where jam occurs in sheet passing sections (a procedure for removing sheets jammed in the sheet passing sections). In this case, the operation guidance display apparatus is arranged such that:

the state detecting means includes jam detecting means for detecting jam in a plurality of sheet passing sections, the dynamic image data storing means stores the dynamic image data which show a sequence of a procedure for an operation for removing jam in the sheet passing sections, the display control means displays the dynamic image data which show the procedure for removing jam in the sheet passing sections where the jam detecting means detects remaining of sheets as dynamic images on the display means when the jam detecting means detects jam. This makes it possible to easily and safely carry out a jam removing operation whose procedure is comparatively incomprehensible.

In addition, it is desired that the operation guidance display apparatus for displaying the above procedure for removing jam is arranged so as to include:

a progressive key for switching the dynamic image data to be displayed by the display means, that the display control means successively switches the dynamic image data for each sheet passing section where the jam detecting means detects remaining of sheets each time the progressive key is operated so as to display the dynamic image data on the display means when the jam detecting means detects jam.

With the above arrangement, when jam occurs, dynamic images about the procedure for removing jam for each sheet passing section where remaining of sheets is detected by the jam detecting means, namely, each jam position, are displayed on the display means every time the progressive key is operated. Therefore, when the dynamic images about the procedure for removing jam in the jam positions are switched by the progressive key, the procedure for removing jam in the individual jam positions is easily grasped, thereby making it possible for the operator to perform secure operations.

In addition, it is desirable that the operation guidance display apparatus for displaying the procedure for removing jam is arranged so as to further include:

an automatic progressive key for automatically switching the dynamic image data to be displayed on the display means, that the display control means automatically switches the dynamic image data successively for each sheet passing section where the jam detecting means detects remaining of sheets so as to display the dynamic image data on the display means when the jam detecting means detects jam and the automatic progressive key has been operated.

With the above arrangement, when jam occurs, the dynamic images about the procedure for removing jam for each sheet passing section where remaining of sheets is detected by the jam detecting means are automatically and successively switched by operating the automatic progressive key so as to be displayed on the display means. Therefore, after the occurrence of jam, at first the operator can previously grasp all operations for removing jam by operating the automatic progressive key. As a result, the operator can safely and efficiently performs the operations for removing jam without feeling uneasiness.

In addition, it is desirable that the operation guidance display apparatus for displaying the procedure for removing jam is arranged so as to further include:

operation existence/non-existence detecting means for detecting whether each operation in a series of a procedure for removing jam in each sheet passing section has been performed or not, that the display control means successively switches images which show each operation in a series of the procedure for removing jam in the sheet passing sections where the jam detecting means detects remaining of sheets to an image showing a next operation every time the operation existence/non-existence detecting means detects a performance of each operation so as to display the images on the display means based upon the image data stored in the image data storing means when the jam detecting means detects jam.

With the above arrangement, when jam occurs, images which show each operation in a series of procedures for removing jam in the sheet passing section where the jam detecting means detects remaining of sheets are automatically and successively switched to an image which shows a next operation so as to be displayed every time each operation is performed. Therefore, since the operator easily understand the procedure of operations, the operator hardly make a mistake in performing the operations. As a result, in the case where the operator is inexperienced in the image forming apparatus, even in the case of an image forming apparatus which requires complicated operations for removing jam, or in the case of an image forming apparatus where the operations for removing jam is difficult to understand, operations for removing of jam can be easily and safely performed.

In addition, in the case where the image forming apparatus includes automatic document feeding means for feeding a plurality of document sheets stored in a document storing position to a document reading position and performing a document feeding/collecting operation which collects the document sheets from the document reading position to a collecting position and this automatic document feeding means suspends the document feeding/collecting operation at the time jam occurs during the document feeding/collecting operation or on an image forming apparatus main body side, it is desirable that the operation guidance display apparatus is arranged such that:

the dynamic image data storing means stores the dynamic image data which shows a sequence of a procedure for returning fed and collected document sheets and document sheets before feeding to the document storing position by rearranging them in a correct order at the time of restarting the document feeding/collecting operation when the document feeding/collecting operation of the automatic document feeding means is suspended, said display control means displays the dynamic image data relating to rearrangement of document sheets on said display means as dynamic image when the document feeding/collecting operation of the automatic document feeding means is suspended due to the occurrence of jam.

With the above arrangement, when jam occurs in the automatic document feeding means or in the image forming apparatus main body, the dynamic images which show a series of the procedure of operations for rearranging fed and collected documents sheets and document sheets before feeding in a correct order at the time of restarting the document feeding/collecting operation and for returning the rearranged document sheets to the document storing position are displayed. Therefore, in the case where jam occurs during the image forming operation using the automatic document feeding means, the complicated document returning operation can be easily and accurately performed. In other words, in the case where the document returning method is displayed as messages or static images, since it is difficult for the operator to easily understand the document returning method, the operator easily makes a mistake in performing the operations. This problem and becomes remarkable particularly in operations which require complicated treatment, such as an operation for removing jam in the both-sided mode of a copying apparatus in which both-sided documents are copied on both sides of sheets. On the contrary, when the document returning operation is displayed as dynamic images, the operator can easily understand its procedure and accurately perform the operation.

It is desirable that the display control means displays the dynamic image data relating to the rearrangements of document sheets on the display means as dynamic images after completion of removing the jam.

As a result, after completion of removing of jam, the dynamic images which show a series of the procedure for rearranging the fed and collected document sheets and the document sheets before feeding in the correct order at the time of restarting the document feeding/collecting operation and for returning the rearranged documents to the document storing position are displayed on the display means. Therefore, a series of the procedure from the image forming apparatus main body through the automatic document feeding means which involves the removing of jam can be easily and efficiently performed.

In addition, it is desirable that the display control means displays a page of documents where jam has occurred in the automatic document feeding means side on the display means.

As a result, the page of documents where jam has occurred in the automatic document feeding means side is displayed on the display means. Therefore, since the operator can confirm a state of the document where jam has occurred at the time of the document returning operation, states which causes jam of a document, such as curling, a wrinkle, can be also removed. This makes it possible to prevent a recurrence of jam and makes the document returning operation easier.

In addition, it is desirable that the operation guidance display apparatus:

when the operation guidance is not displayed, displays only image processing information relating to image processing operations on the display means, and when the operation guidance is displayed, (A) displays the dynamic image data about necessary operations in a blank portion of the display means with the dynamic image data being reduced so that the dynamic image data are not superimposed on a display area of the image processing information, or (B) alternately displays the image processing information and the dynamic image data about a necessary operation at prescribed intervals. This makes it possible to confirm the image processing information even while the operation guidance is displayed.

In addition, it is desirable that the operation guidance display apparatus is arranged so as to display also a message according to a necessary operation on said display means together with the dynamic images. When a procedure of operations are additionally described by displaying a message in this manner, the operator can more securely grasp the operation, thereby further improving operability of the image forming apparatus.

In addition, it is desirable that the operation guidance is arranged such that a portion of a display image to be moved and the other portion are displayed in different states on the display means. For example, the portion of a display image to be moved and the other portion can be displayed in different colors. As a result, the operator can accurately grasp the portion to be moved, thereby further improving the operability of the image forming apparatus.

For a fuller understanding of the nature and advantages of the invention, reference should be made to the ensuing detailed description taken in conjunction with the accompanying drawings.

BRIEF DESCRIPTION OF THE DRAWINGS

FIG. 61(*a*) is a view explaining a cell 1 for performing the above document return guidance display; FIG. 61(*b*) is a view explaining a cell 2 for performing the above document return guidance display; FIG. 61(*c*) is a view explaining a cell 3 for performing the above document return guidance display; and FIG. 61(*d*) is a view explaining a cell 4 for performing the above document return guidance display.

FIG. 62(*a*) is a view explaining a cell 5 following the cell 4 shown in FIG. 61(*d*) for performing the above document return guidance display; FIG. 62(*b*) is a view explaining a cell 6 for performing the above document return guidance display; FIG. 62(*c*) is a view explaining a cell 7 for performing the above document return guidance display; FIG. 62(*d*) is a view explaining a cell 8 for performing the above document return guidance display; FIG. 62(*e*) is a view explaining a cell 9 for performing the above document return guidance display; and FIG. 62(*f*) is a view explaining a cell 10 for performing the above document return guidance display.

FIG. 63(*a*) is a view explaining a cell 1 for performing another document return guidance display; FIG. 63(*b*) is a view explaining a cell 2 for performing the other document return guidance display; FIG. 63(*c*) is a view explaining a cell 3 for performing the other document return guidance display; FIG. 63(*d*) is a view explaining a cell 4 for performing the other document return guidance display; FIG. 63(*e*) is a view explaining a cell 5 for performing the other document return guidance display; and FIG. 63(*f*) is a view explaining a cell 6 for performing the other document return guidance display.

FIG. 64(*a*) is a view explaining a cell 7 following the cell 6 shown in FIG. 63(*f*) for performing the other document return guidance display; FIG. 64(*b*) is a view explaining a cell 8 for performing the other document return guidance display; FIG. 64(*c*) is a view explaining a cell 9 for performing the other document return guidance display; FIG. 64(*d*) is a view explaining a cell 10 for performing the other document return guidance display; FIG. 64(*e*) is a view explaining a cell 11 for performing the other document return guidance display; and FIG. 64(*f*) is a view explaining a cell 12 for performing the other document return display.

FIG. 65(*a*) is a view explaining a cell 13 following the cell 12 shown in FIG. 64(*f*) for performing the other document return guidance display; FIG. 65(*b*) is a view explaining a cell 14 for performing the other document return guidance display; FIG. 65(*c*) is a view explaining a cell 15 for performing the other document return guidance display; and FIG. 65(*d*) is a view explaining a cell 16 for performing the other document return guidance display.

FIG. 67(*a*) is a view explaining a cell 1 for performing a document return guidance display by a jam removing procedure display apparatus in accordance with another embodiment of the present invention; FIG. 67(*b*) is a view explaining a cell 2 for performing the document return guidance display in the above embodiment; FIG. 7(*c*) is a view explaining a cell 3 for performing the document return guidance display in the above embodiment; and FIG. 67(*d*) is a view explaining a cell 4 for performing the document return guidance display in the above embodiment.

FIG. 68(*a*) is a view explaining a cell 5 following the cell 4 shown in FIG. 67(*d*) for performing the document return guidance display in the above embodiment; FIG. 68(*b*) is a view explaining a cell 6 for performing the document return guidance display in the above embodiment; FIG. 68(*c*) is a view explaining a cell 7 for performing the document return guidance display in the above embodiment; FIG. 68(*d*) is a view explaining a cell 8 for performing the document return guidance display in the above embodiment; FIG. 68(*e*) is a view explaining a cell 9 for performing the document return guidance display in the above embodiment; and FIG. 68(*f*) is a view explaining a cell 10 for performing the document return guidance display in the above embodiment.

FIG. 69(*a*) is a view explaining a cell 1 for performing another document return guidance display; FIG. 69(*b*) is a view explaining a cell 2 for performing the other document return guidance display; FIG. 69(*c*) is a view explaining a cell 3 for performing the other document return guidance display; FIG. 69(*d*) is a view explaining a cell 4 for performing the other document return guidance display; FIG. 69(*e*) is a view explaining a cell 5 for performing the other document return guidance display; and FIG. 69(*f*) is a view explaining a cell 6 for performing the other document return guidance display.

FIG. 70(*a*) is a view explaining a cell 7 following the cell 6 shown in FIG. 69(*f*) for performing the other document return guidance display; FIG. 70(*b*) is a view explaining a cell 8 for performing the other document return guidance display; FIG. 70(*c*) is a view explaining a cell 9 for performing the other document return guidance display; FIG. 70(*d*) is a view explaining a cell 10 for performing the other document return guidance display; FIG. 70(*e*) is a view explaining a cell 11 for performing the other document return guidance display; and FIG. 70(*f*) is a view explaining a cell 12 for performing the other document return guidance display.

FIG. 71(*a*) is a view explaining a cell 13 following the cell 12 shown in FIG. 70(*f*) for performing the other document return guidance display; FIG. 71(*b*) is a view explaining a cell 14 for performing the other document return guidance display; FIG. 71(*c*) is a view explaining a cell 15 for performing the other document return guidance display; and FIG. 71(*d*) is a view explaining a cell 16 for performing the other document return guidance display.

FIG. 72(*a*) is a view explaining a cell 1 for performing a document return guidance display by a jam removing procedure display apparatus in accordance with another embodiment of the present invention; FIG. 72(*b*) is a view explaining a cell 2 for performing the document return guidance display in the above embodiment; FIG. 72(*c*) is a view explaining a cell 3 for performing the document return guidance display in the above embodiment; and FIG. 72(*d*) is a view explaining a cell 4 for performing the document return guidance display in the above embodiment.

FIG. 73(*a*) is a view explaining a cell 5 following the cell 4 shown in FIG. 72(*d*) for performing the document return guidance display in the above embodiment; FIG. 73(*b*) is a view explaining a cell 6 for performing the document return guidance display in the above embodiment; FIG. 73(*c*) is a view explaining a cell 7 for performing the document return guidance display in the above embodiment; FIG. 73(*d*) is a view explaining a cell 8 for performing the document return guidance display in the above embodiment; FIG. 73(*e*) is a view explaining a cell 9 for performing the document return guidance display in the above embodiment; and FIG. 73(*f*) is a view explaining a cell 10 for performing the document return guidance display in the above embodiment.

FIG. 74(*a*) is a view explaining a cell 11 following the cell 10 shown in FIG. 73(*f*) for performing the document return guidance display in the above embodiment; FIG. 74(*b*) is a view explaining a cell 12 for performing the document return guidance display in the above embodiment; FIG. 74(*c*) is a view explaining a cell 13 for performing the document return guidance display in the above embodiment; FIG. 74(*d*) is a view explaining a cell 14 for performing the document return guidance display in the above embodiment; FIG. 74(*e*) is a view explaining a cell 15 for performing the document return guidance display in the above embodiment; and FIG. 74(*f*) is a view explaining a cell 16 for performing the document return guidance display in the above embodiment.

FIG. 120 is a view explaining a screen displaying a moving picture (S30) showing a staple key pressing operation in the staple supplying operation guidance display shown in FIG. 115.

FIG. 121 is a flowchart detailing a staple returning operation guidance display by the operation guidance display apparatus of the above embodiment.

FIG. 122 is a view explaining a screen displaying a moving picture (S33) showing a cover opening operation in the staple returning operation guidance display shown in FIG. 121.

FIG. 123 is a view explaining a screen displaying a moving picture (S34) showing a stapler unit removing operation in the staple returning operation guidance display shown in FIG. 121.

FIG. 124 is a view explaining a screen displaying the moving picture (S34) showing the stapler unit removing operation in the staple returning operation guidance display shown in FIG. 121.

FIG. 125 is a view explaining a screen displaying a moving picture (S35) showing an operation for opening a driving-in section of the stapler unit in the staple returning operation guidance display shown in FIG. 121.

FIG. 126 is a view explaining a screen displaying a moving picture (S36) showing a jammed staple removing operation in the staple returning operation guidance display shown in FIG. 121.

FIG. 127 is a view explaining a screen displaying a moving picture (S37) showing an operation for returning the driving-in section of the stapler unit to the original position in the staple returning operation guidance display shown in FIG. 121.

FIG. 128 is a view explaining a screen displaying a moving picture (S38) showing an operation for returning the stapler unit to the original position in the staple returning operation guidance display shown in FIG. 121.

FIG. 129 is a view explaining a screen displaying a moving picture (S39) showing a cover closing operation in the staple returning operation guidance display shown in FIG. 121.

FIG. 130 is a view explaining a screen displaying a moving picture (S40) showing a staple key pressing operation in the staple returning operation guidance display shown in FIG. 121.

FIG. 131 is a flowchart detailing a disposed toner bottle replacing operation guidance display by the operation guidance display apparatus of the above embodiment.

Figure 131:
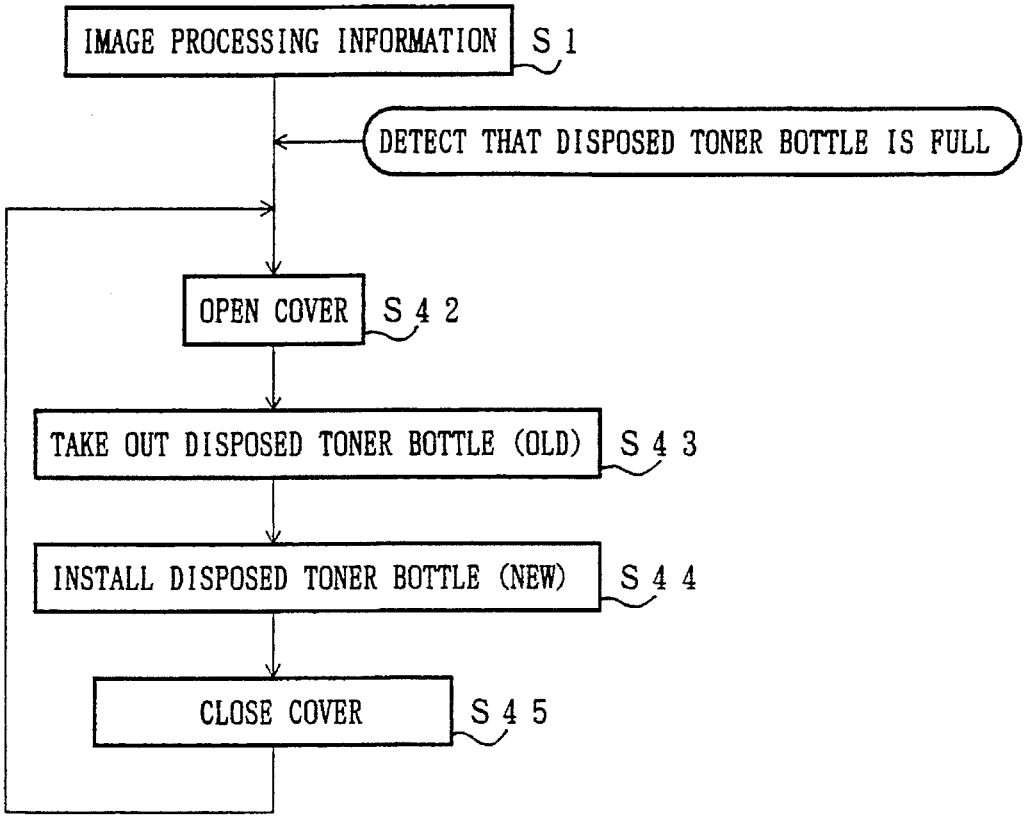
Figure 132:
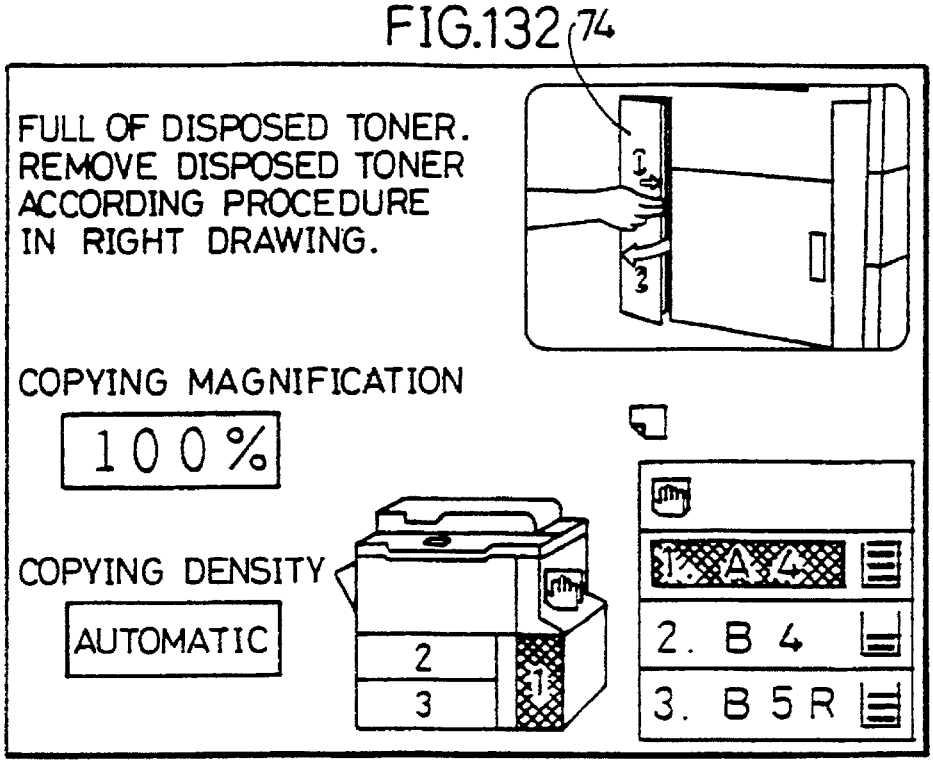

FIG. 132 is a view explaining a screen displaying a moving picture (S42) showing a cover opening operation in the disposed toner bottle replacing operation guidance display shown in FIG. 131.

Figure 133:
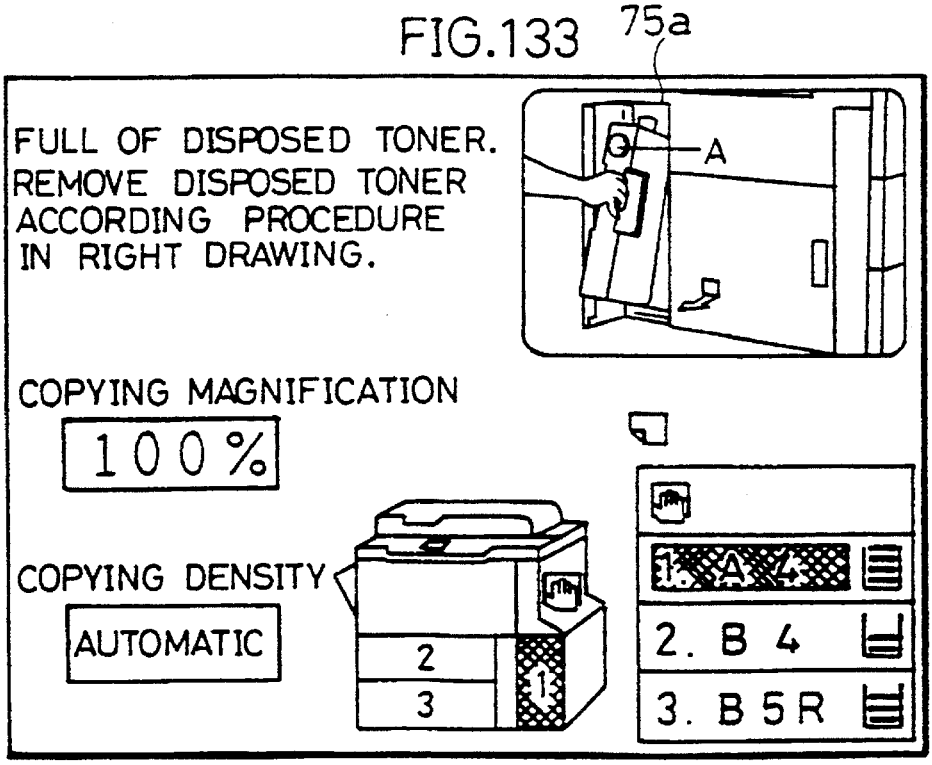

FIG. 133 is a view explaining a screen displaying a moving picture (S43) showing an old disposed toner bottle removing operation in the disposed toner bottle replacing operation guidance display shown in FIG. 131.

Figure 134:
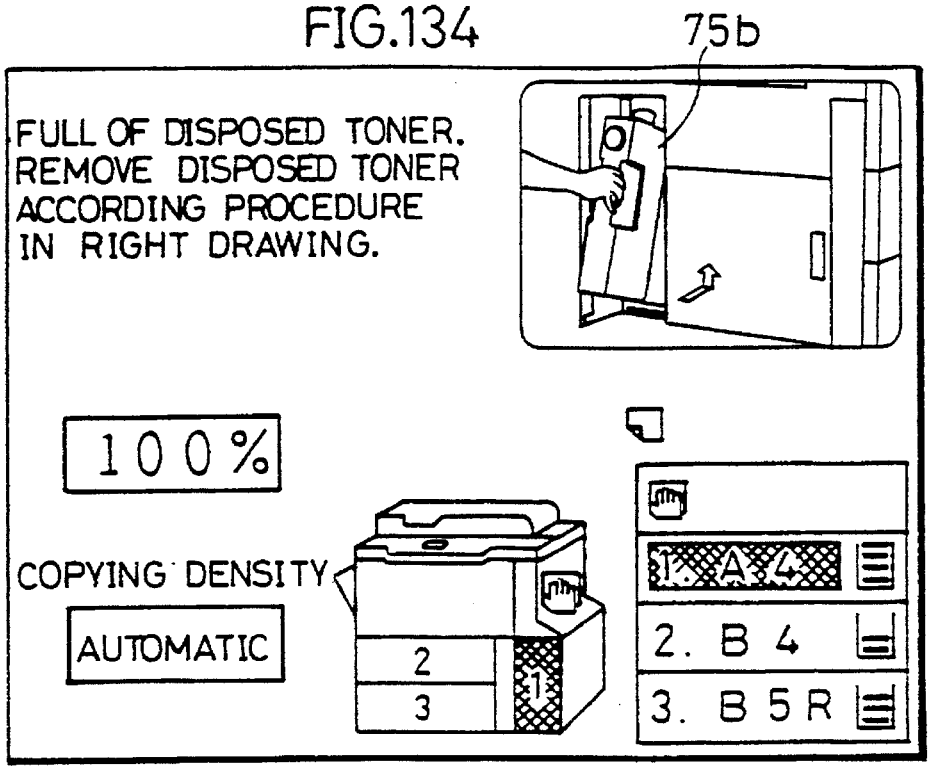

FIG. 134 is a view explaining a screen displaying a moving picture (S44) showing a new disposed toner bottle inserting operation in the disposed toner bottle replacing operation guidance display shown in FIG. 131.

Figure 135:
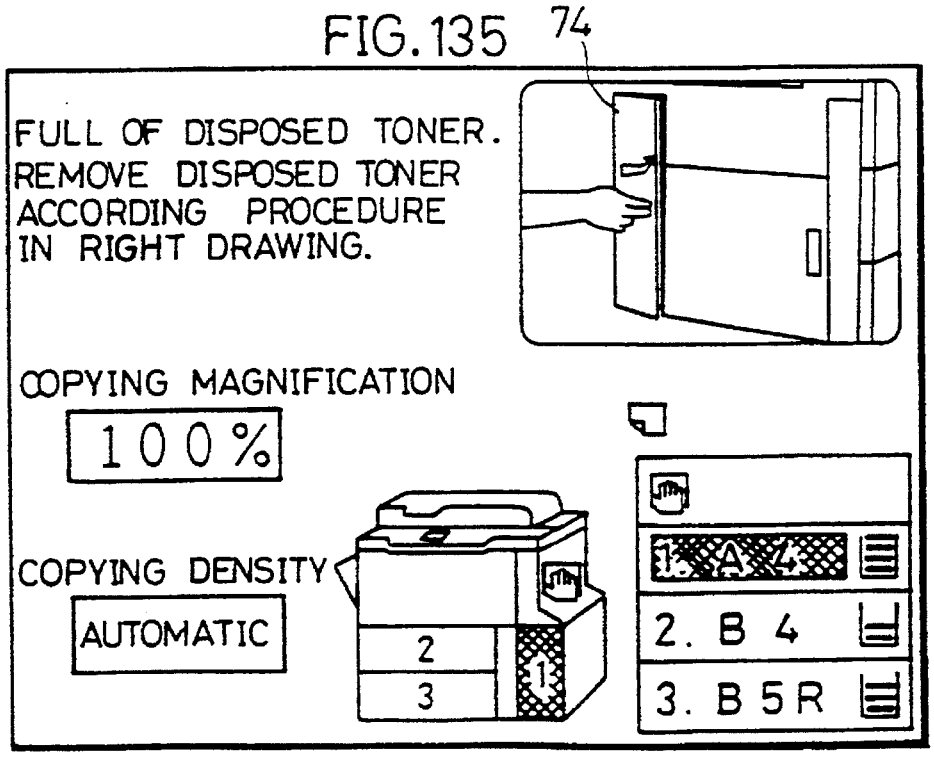

FIG. 135 is a view explaining a screen displaying a moving picture (S45) showing a cover closing operation in the disposed toner bottle replacing operation guidance display shown in FIG. 131.

Figure 136:
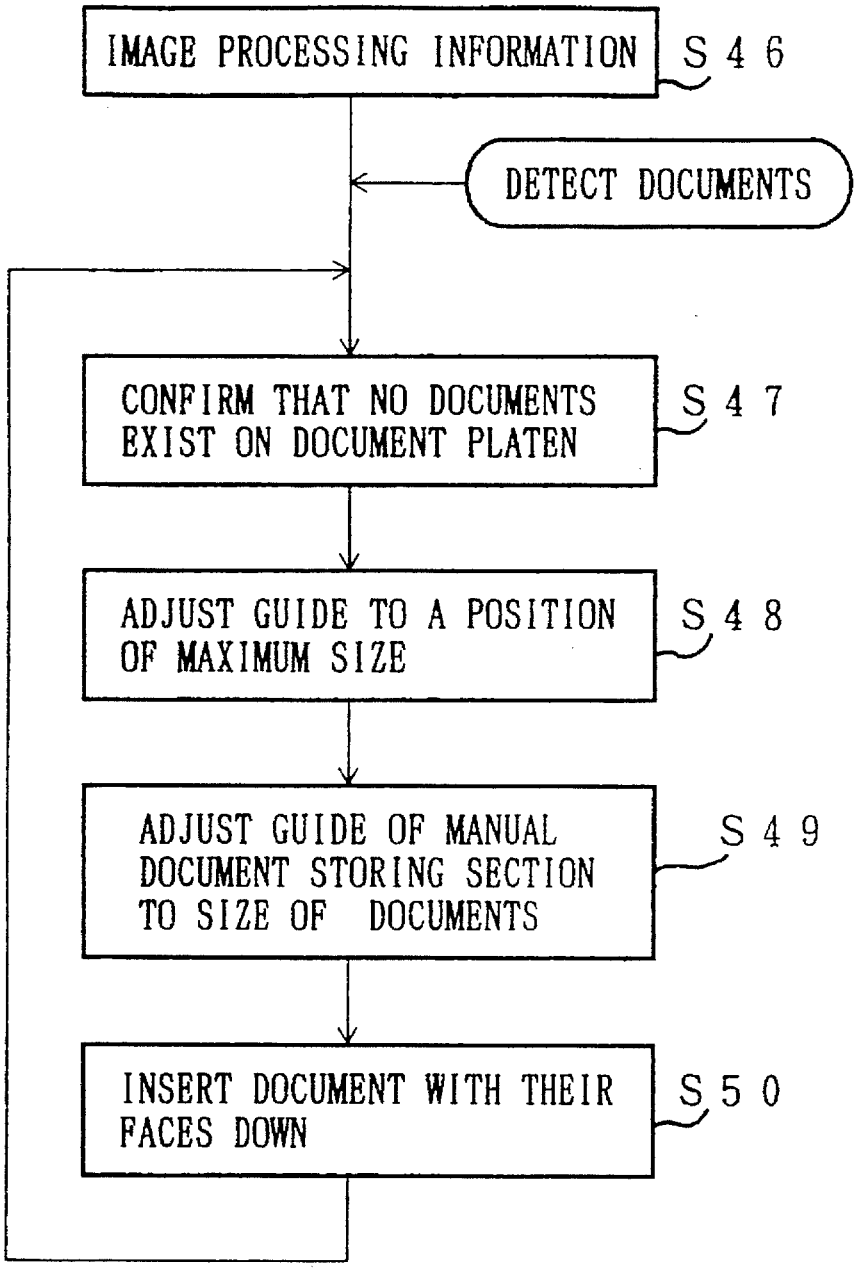

FIG. 136 is a flowchart detailing a document storing state adjusting operation guidance display by the operation guidance display apparatus of the above embodiment.

Figure 137:
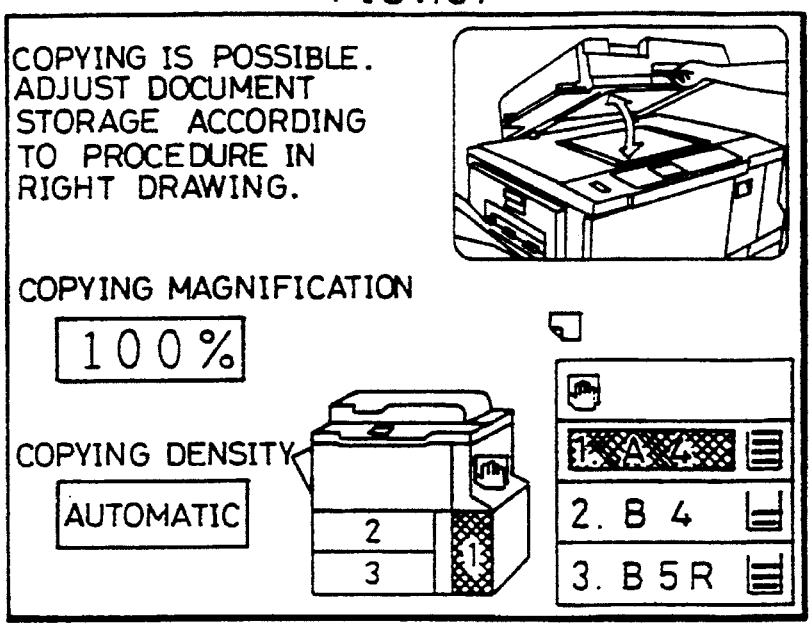

FIG. 137 is a view explaining a screen displaying a moving picture (S47) showing an operation for confirming that no document is left on a document table in the document storing state adjusting operation guidance display shown in FIG. 136.

Figure 138:
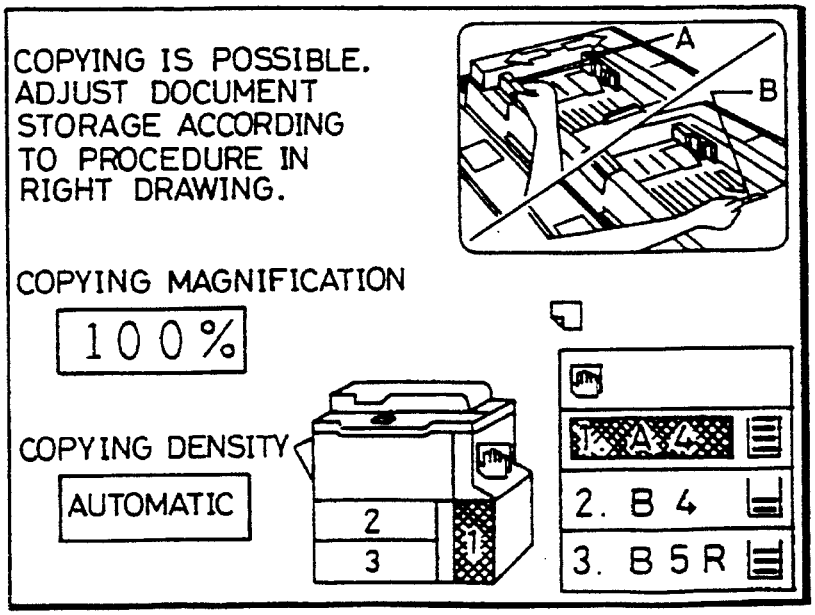

FIG. 138 is a view explaining a screen displaying a moving picture (S48) showing an operation for adjusting the document guide and the document bottom end guide of a document set platen to the maximum size position in the document storing state adjusting operation guidance display shown in FIG. 136.

Figure 139:
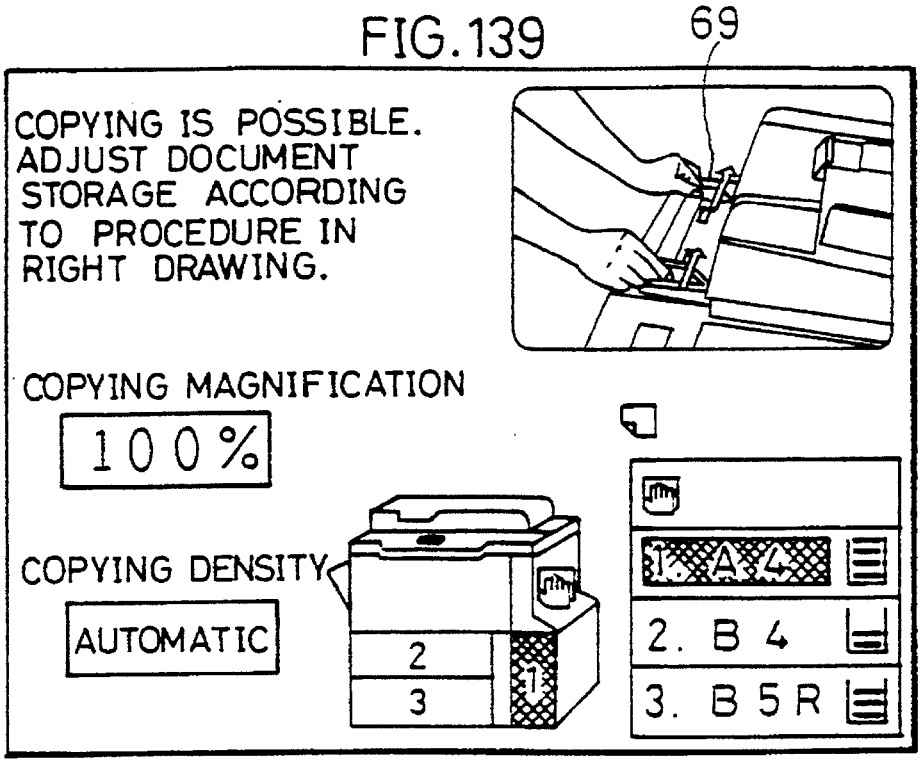

FIG. 139 is a view explaining a screen displaying a moving picture (S49) showing an operation for adjusting a document guide of a manual document set platen to a document size in the document storing state adjusting operation guidance display shown in FIG. 136.

Figure 140:
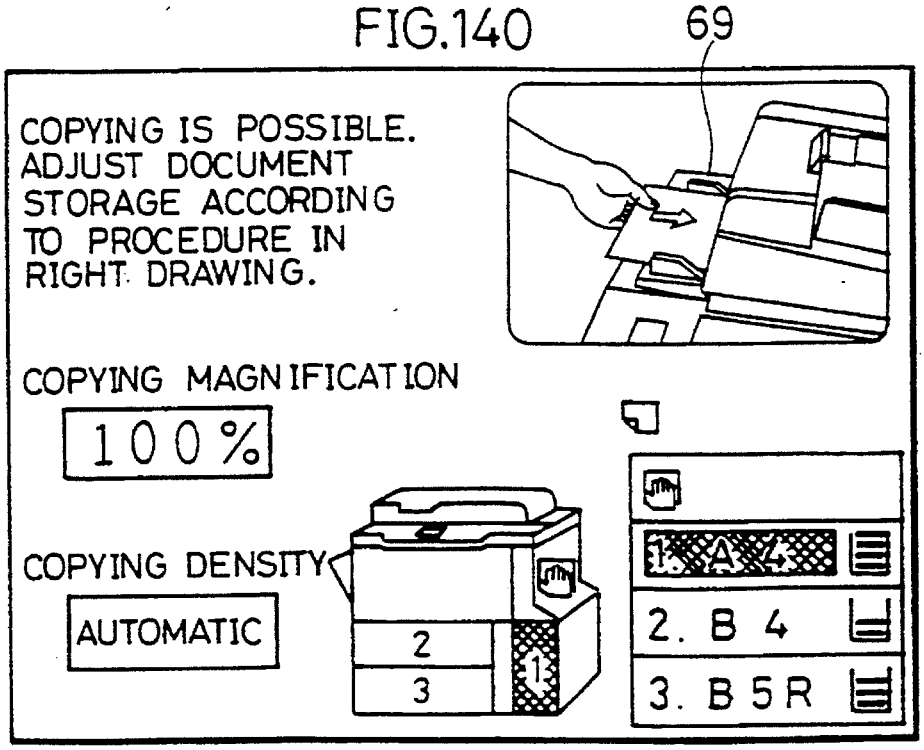

FIG. 140 is a view explaining a screen displaying a moving picture (S50) showing an operation for setting the document with its face downward on the manual document set platen in the document storing state adjusting operation guidance display shown in FIG. 136.

Figure 141:
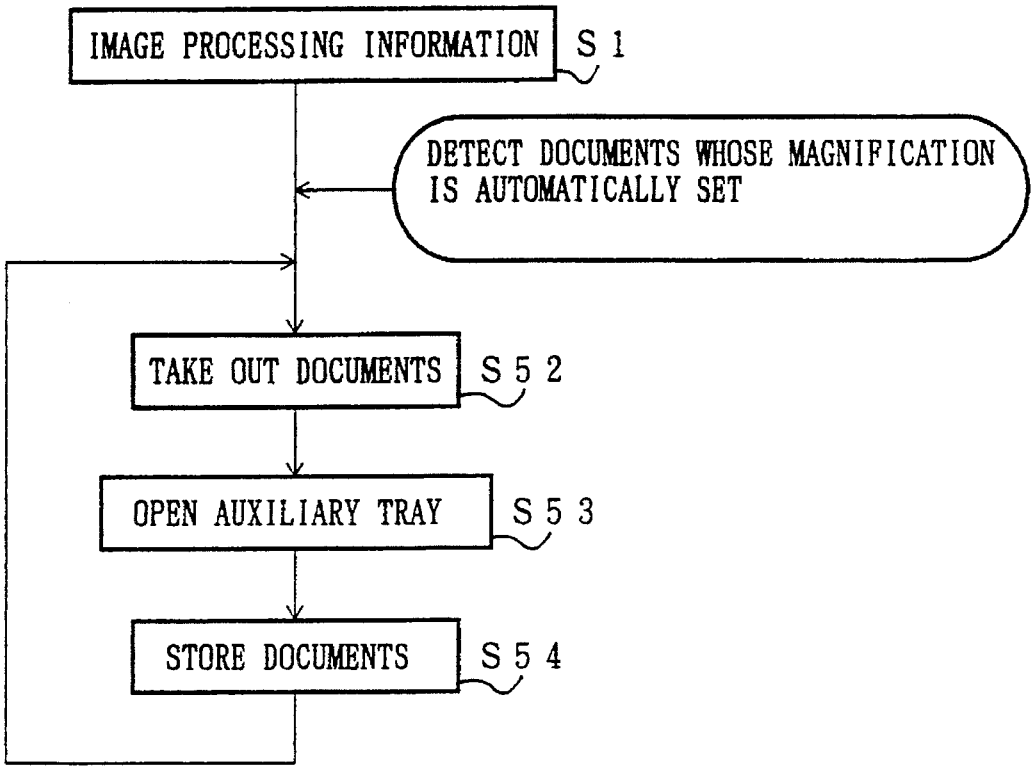

FIG. 141 is a flowchart detailing a document direction changing operation guidance display by the operation guidance display apparatus of the above embodiment.

Figure 142:
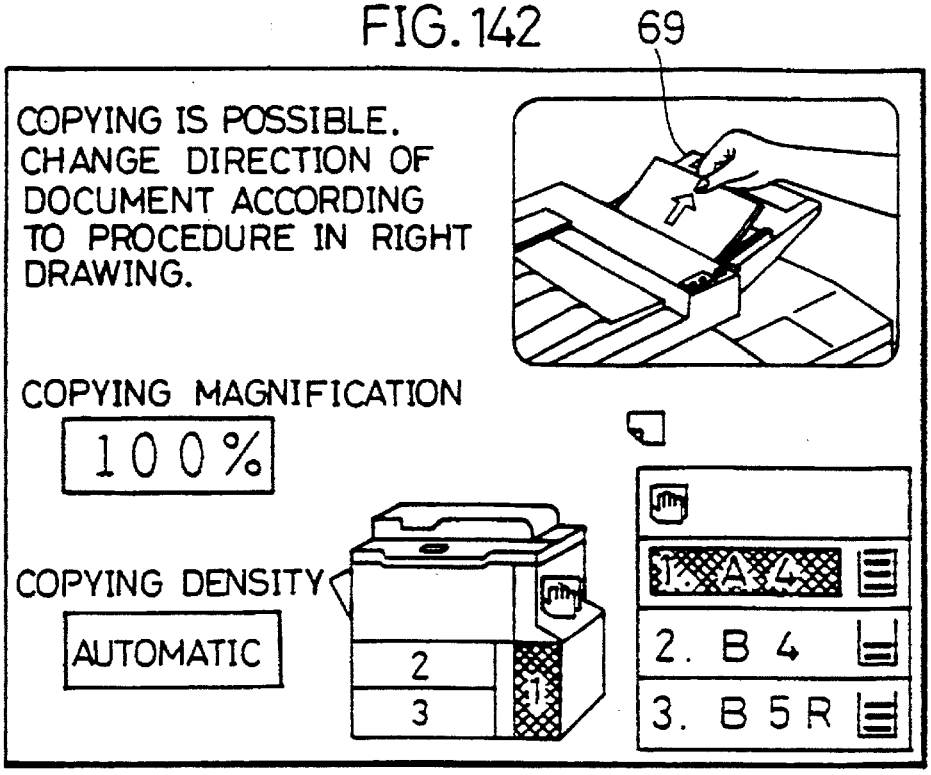

FIG. 142 is a view explaining a screen displaying a moving picture (S52) showing a document removing operation in the document direction changing operation guidance display shown in FIG. 141.

Figure 143:
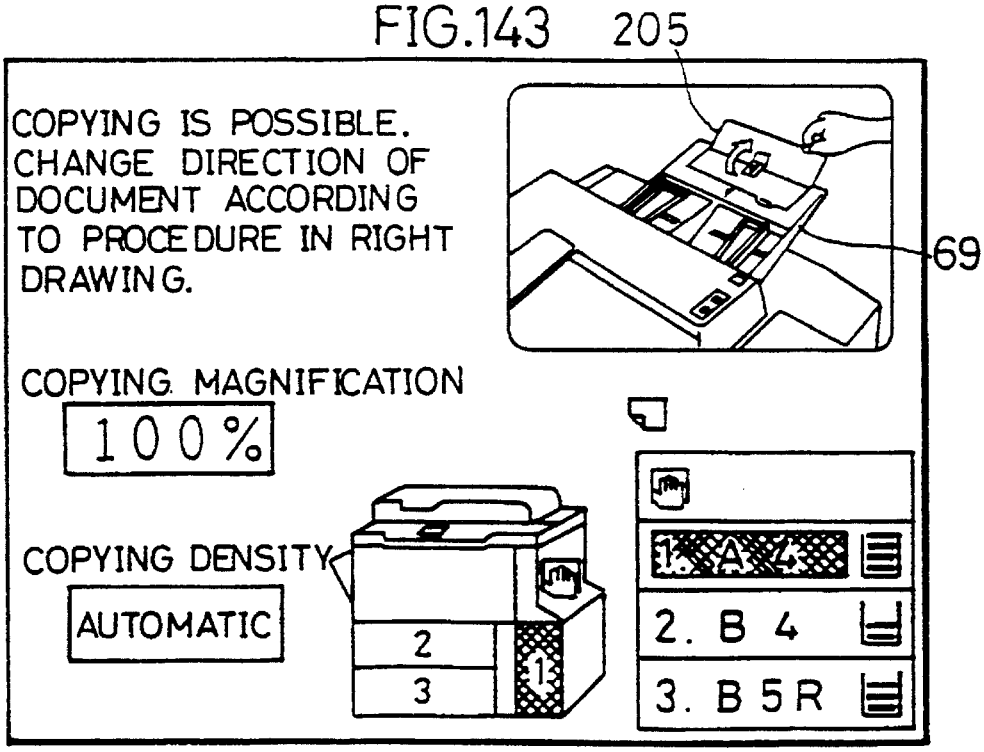

FIG. 143 is a view explaining a screen displaying a moving picture (S53) showing an auxiliary tray opening operation in the document direction changing operation guidance display shown in FIG. 141.

Figure 144:
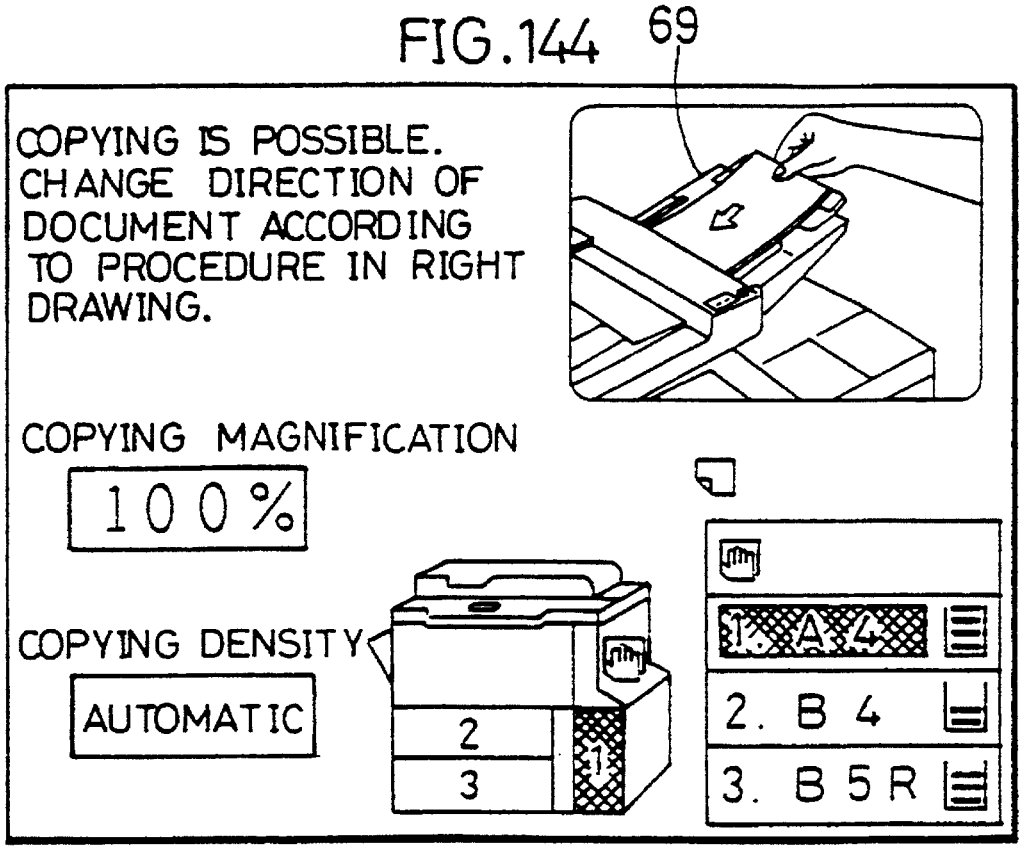

FIG. 144 is a view explaining a screen displaying a moving picture (S54) showing a document setting operation in the document direction changing operation guidance display shown in FIG. 141.

Figure 145:
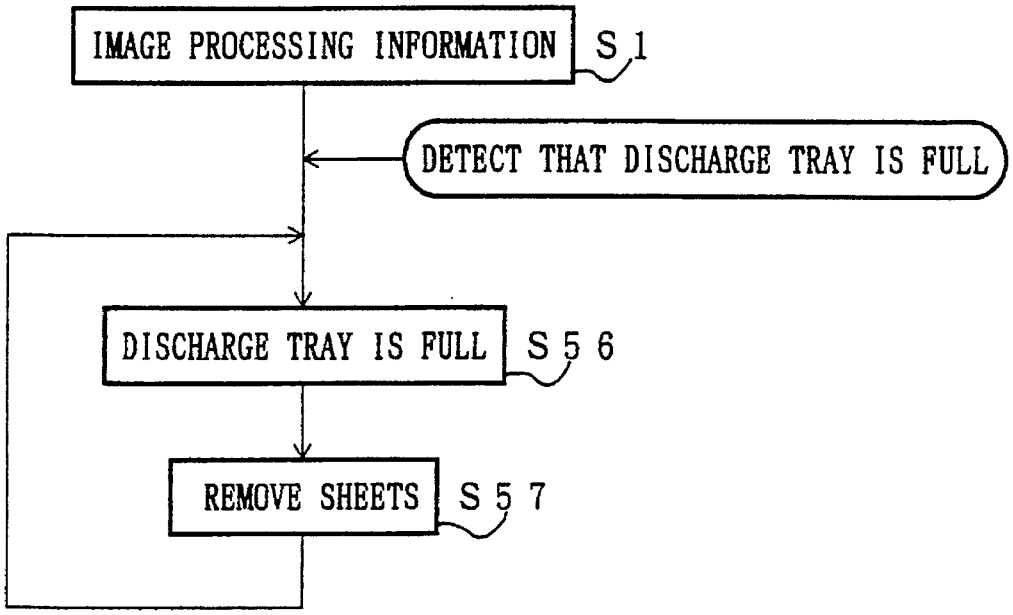

FIG. 145 is a flowchart detailing a second discharged sheet removing operation guidance display by the operation guidance display apparatus of the above embodiment.

Figure 146:
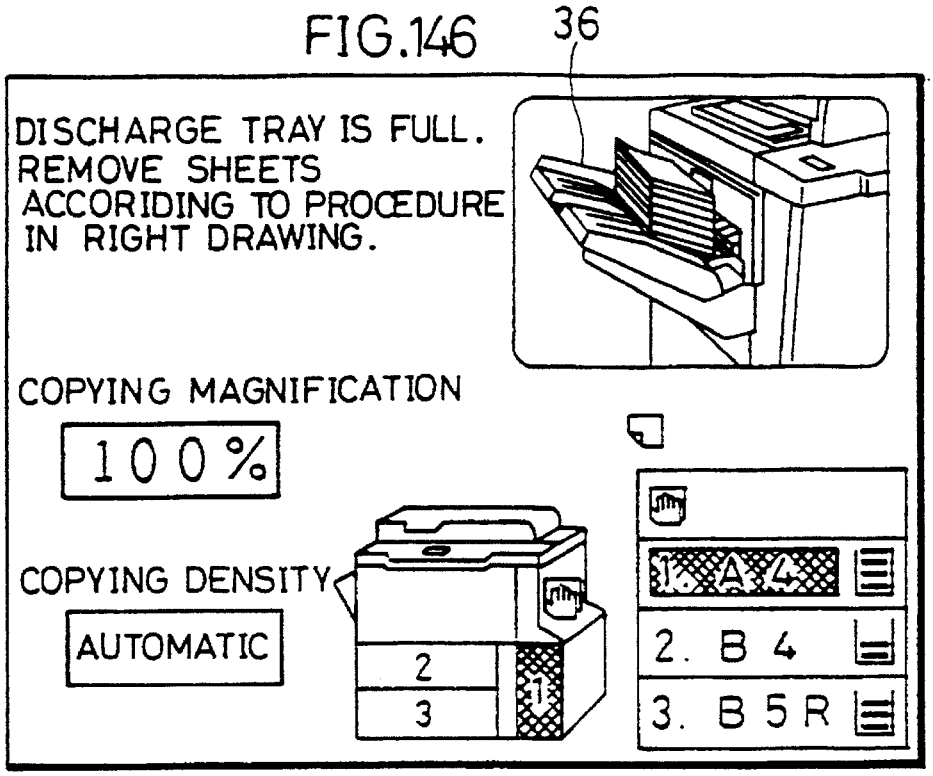

FIG. 146 is a view explaining a screen displaying a moving picture (S56) showing a state that the releasing tray is full in the second discharged sheet removing operation guidance display shown in FIG. 145.

Figure 147:
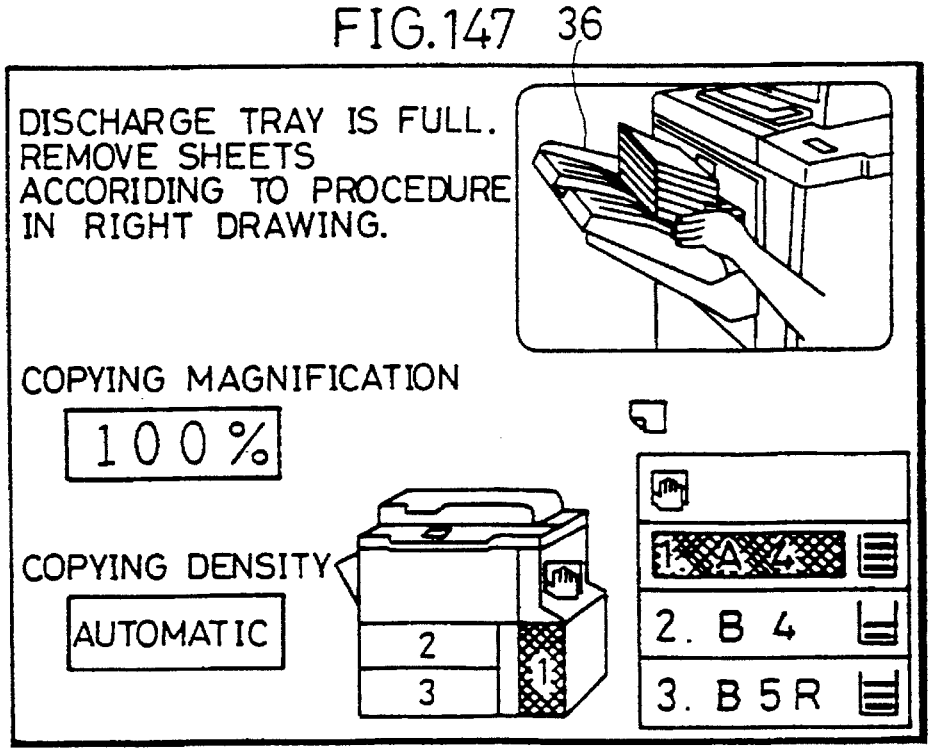

FIG. 147 is a view explaining a screen displaying a moving picture (S57) showing an operation for removing a sheet from the releasing tray in the second discharged sheet removing operation guidance display shown in FIG. 145.

Figure 148:
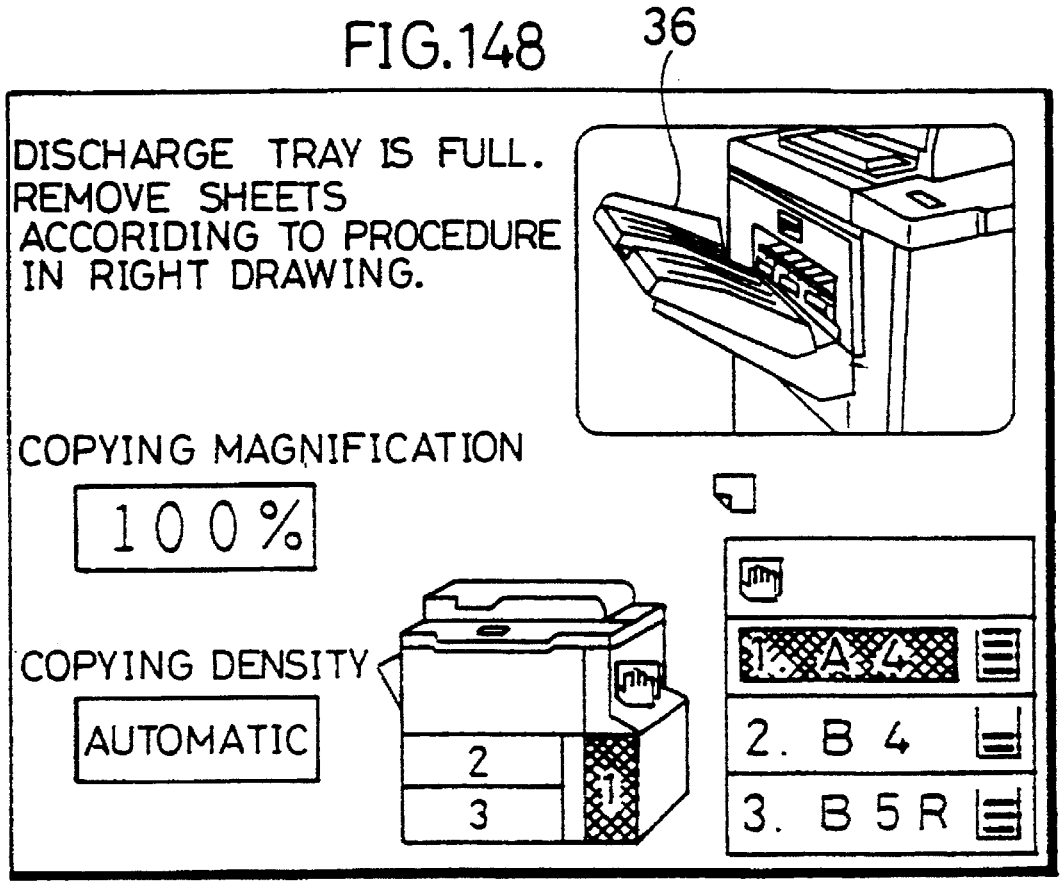

FIG. 148 is a view explaining a screen displaying the moving picture (S57) showing the operation for removing a sheet from the releasing tray in the second discharged sheet removing operation guidance display shown in FIG. 145.

Figure 149:
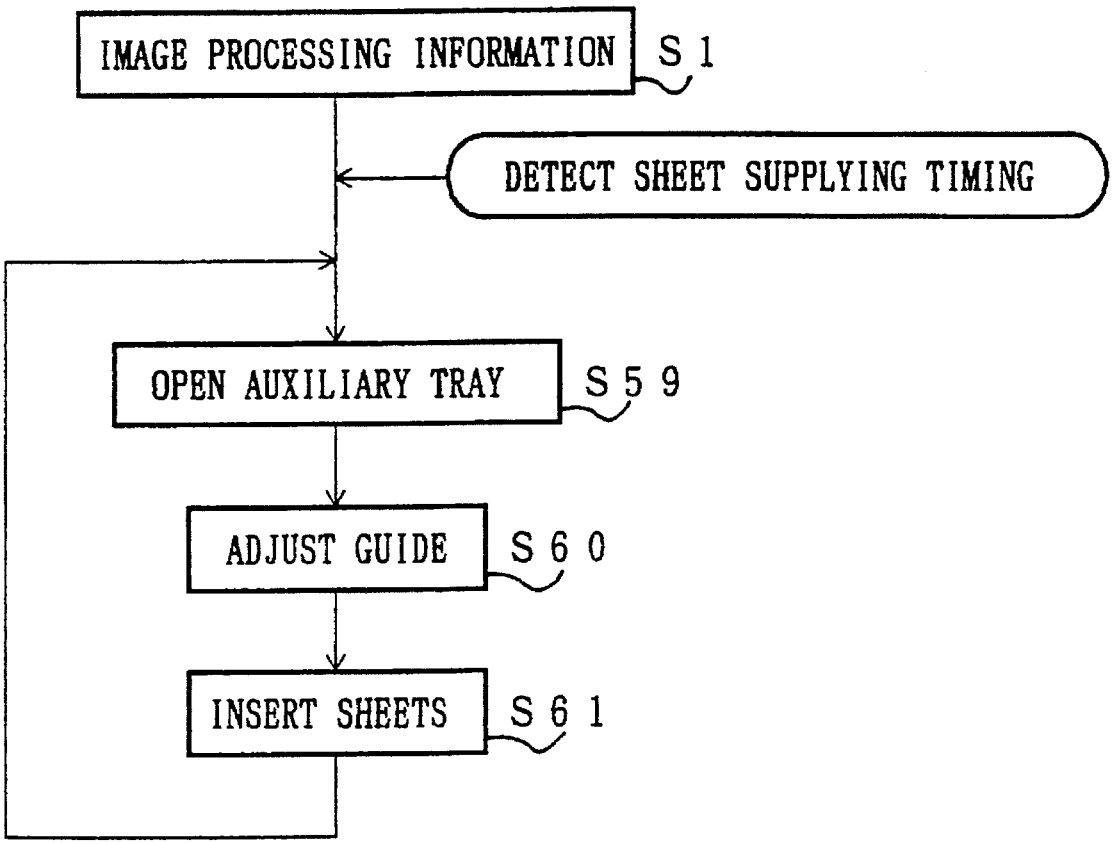

FIG. 149 is a flowchart detailing a cover/interleaf sheet supplying operation guidance display by the operation guidance display apparatus of the above embodiment.

Figure 150:
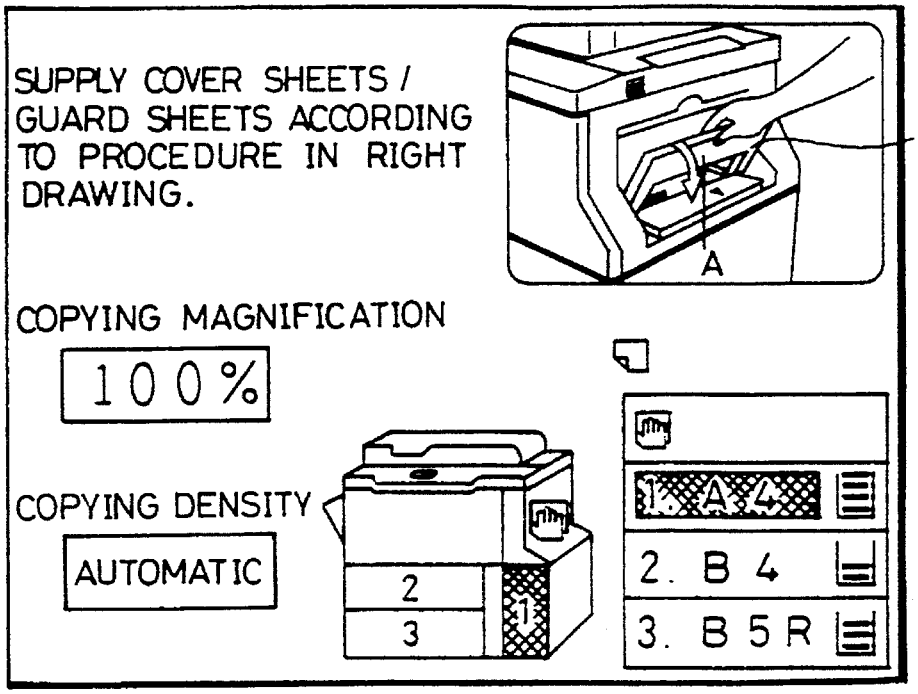

FIG. 150 is a view explaining a screen displaying a moving picture (S59) showing an auxiliary tray opening operation in the cover/interleaf sheet supplying operation guidance display shown in FIG. 149.

Figure 151:
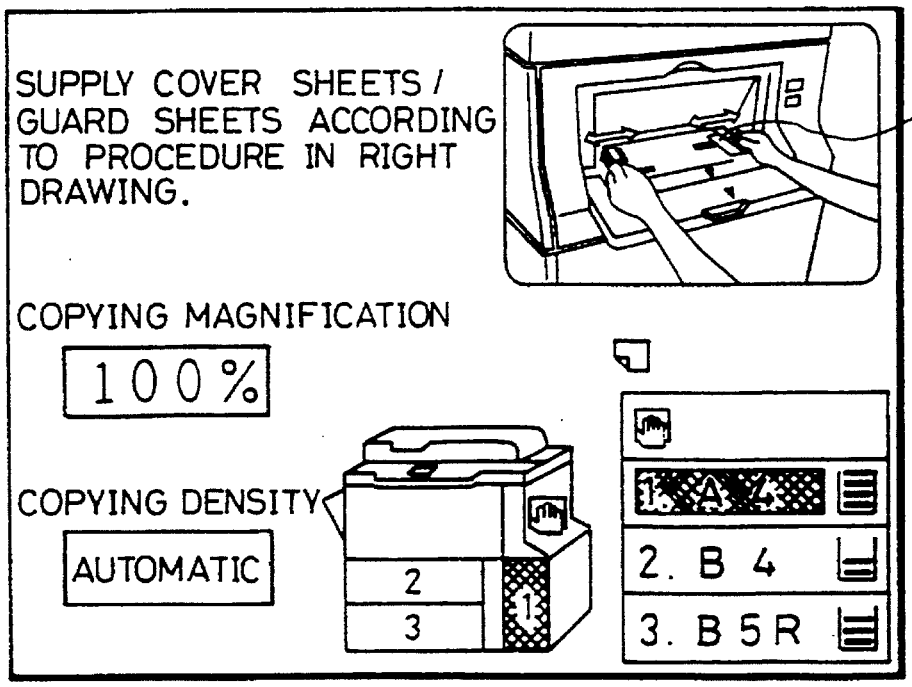

FIG. 151 is a view explaining a screen displaying a moving picture (S60) showing an operation for adjusting a manual sheet feeding guide to a sheet size in the cover/interleaf sheet supplying operation guidance display shown in FIG. 149.

Figure 152:
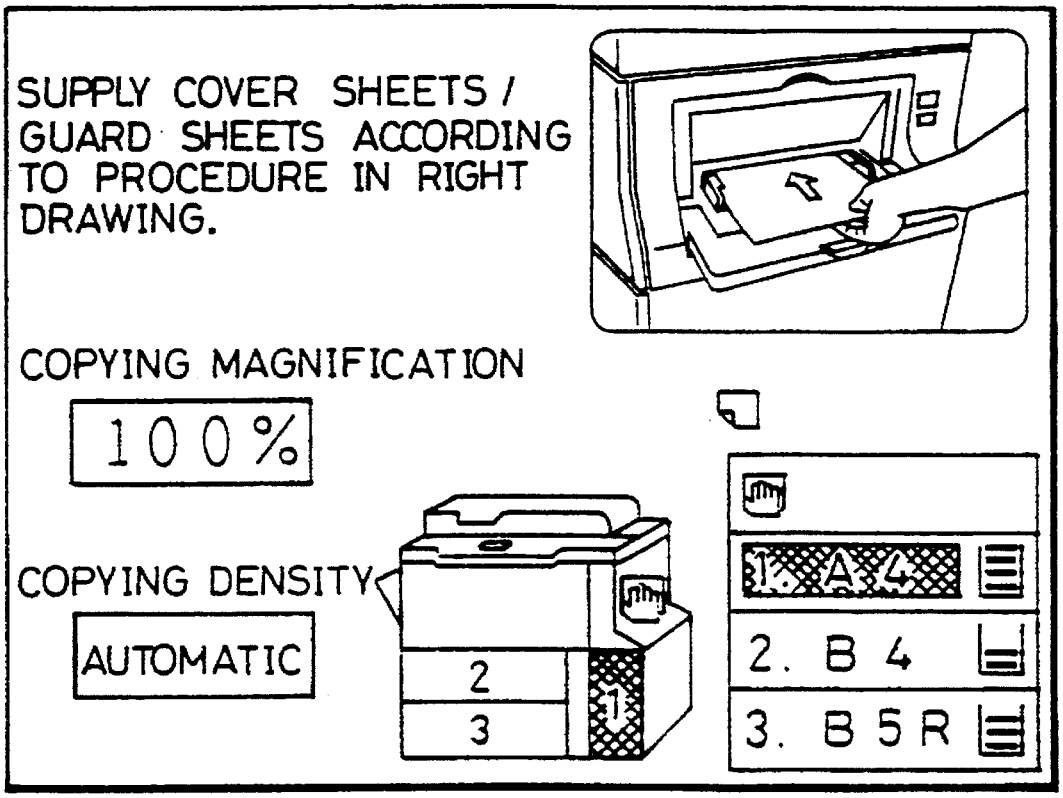

FIG. 152 is a view explaining a screen displaying a moving picture (S61) showing an operation for putting sheets on the manual sheet feeding tray in the cover/interleaf sheet supplying operation guidance display shown in FIG. 149.

Figure 153:
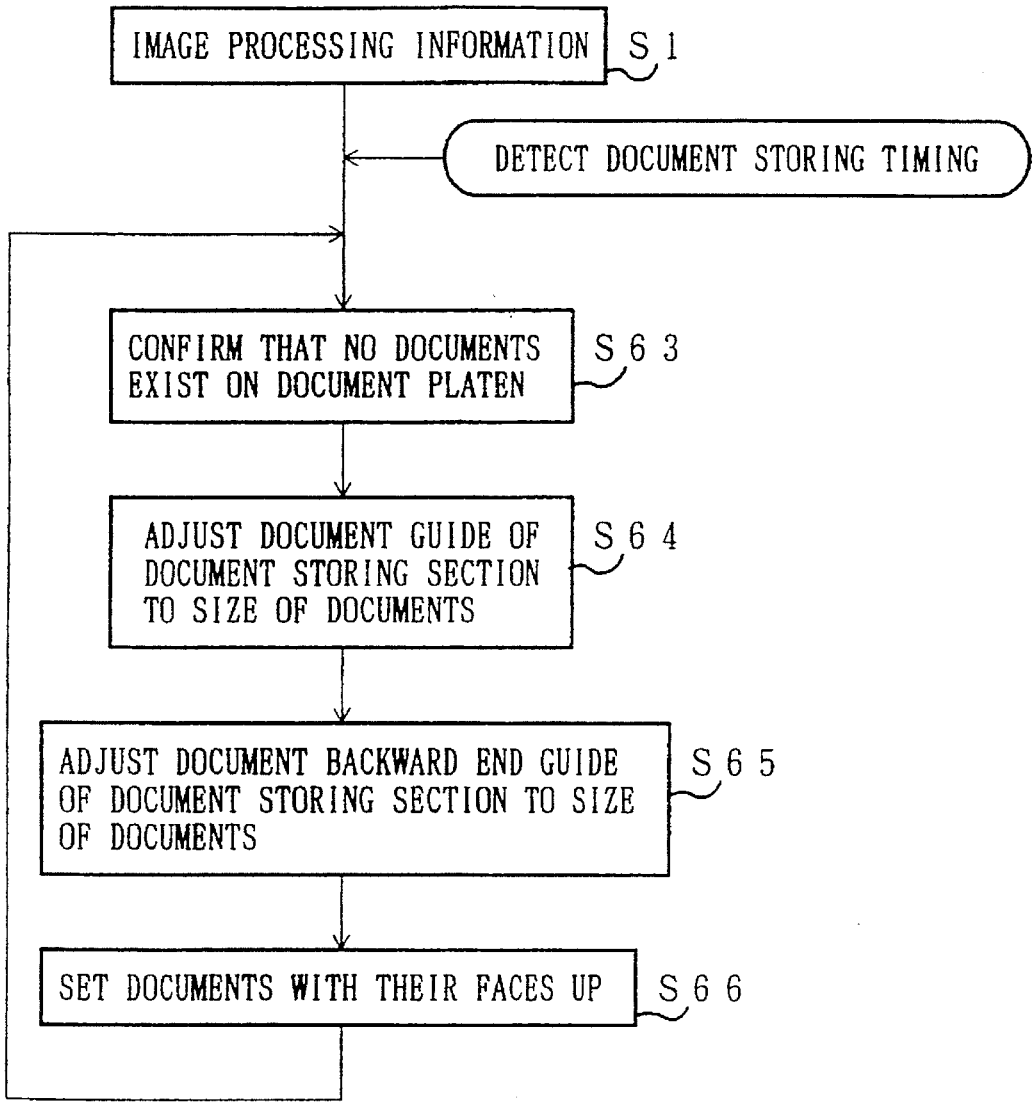

FIG. 153 is a flowchart detailing an RDH document loading operation guidance display by the operation guidance display apparatus of the above embodiment.

Figure 154:
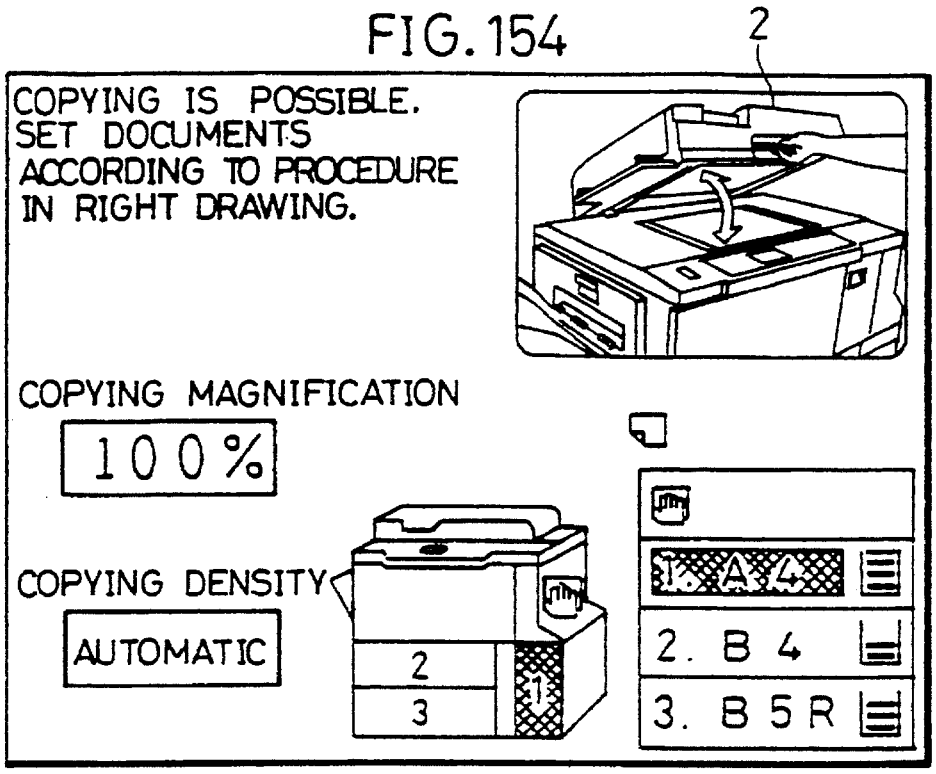

FIG. 154 is a view explaining a screen displaying a moving picture (S63) showing an operation for confirming that no document is left on a document platen in the RDH document loading operation guidance shown in FIG. 153.

Figure 155:
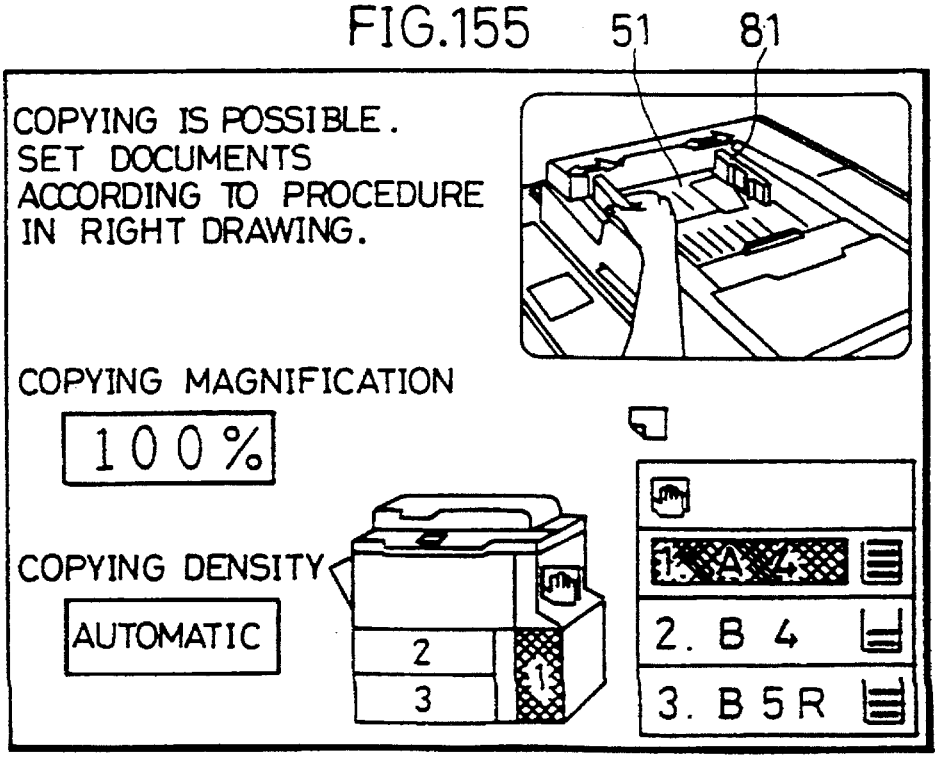

FIG. 155 is a view explaining a screen displaying a moving picture (S64) showing an operation for adjusting a document guide of the document set platen to a document size in the RDH document loading operation guidance shown in FIG. 153.

Figure 156:
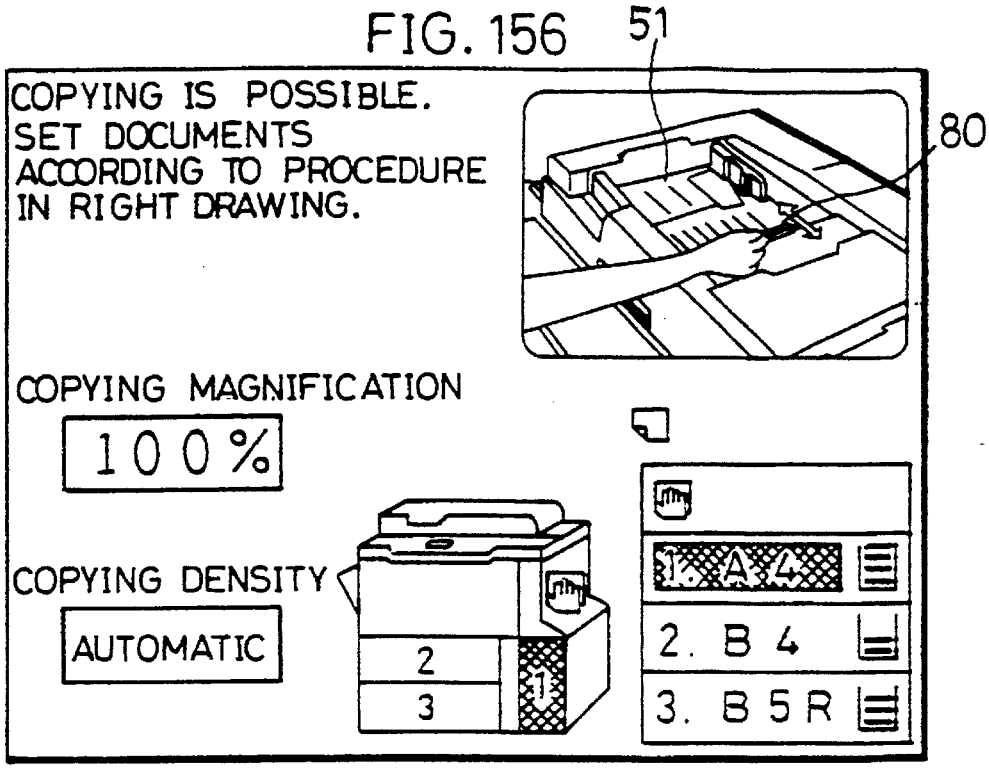

FIG. 156 is a view explaining a screen displaying a moving picture (S65) showing an operation for adjusting the document bottom guide of the document set platen to a document size in the RDH document loading operation guidance shown in FIG. 153.

Figure 157:
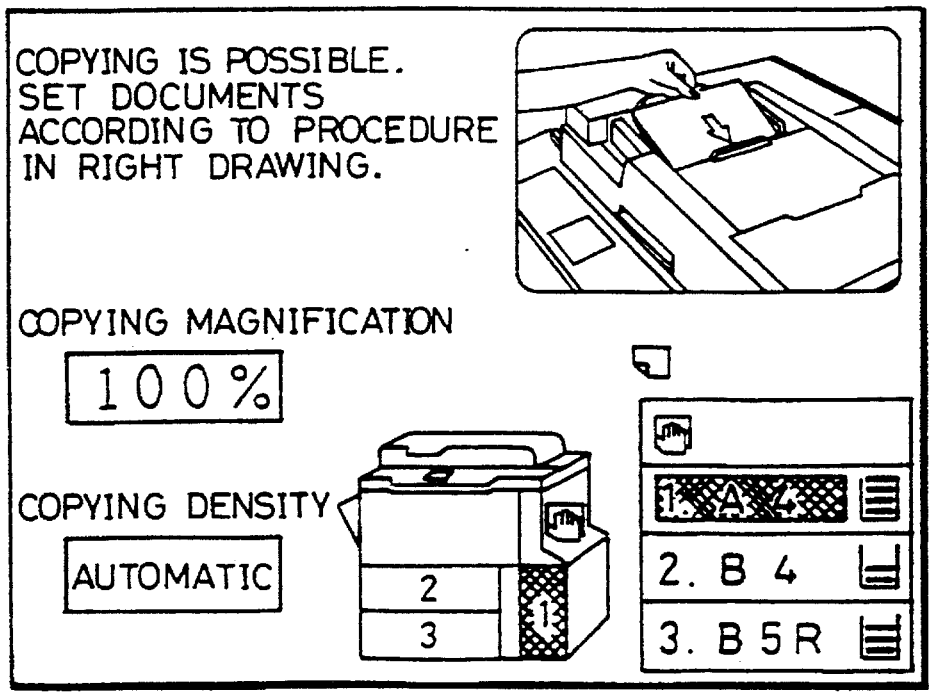

FIG. 157 is a view explaining a screen displaying a moving picture (S66) showing an operation for setting the document with fits face upward on the document set platen in the RDH document loading operation guidance shown in FIG. 153.

Figure 158:
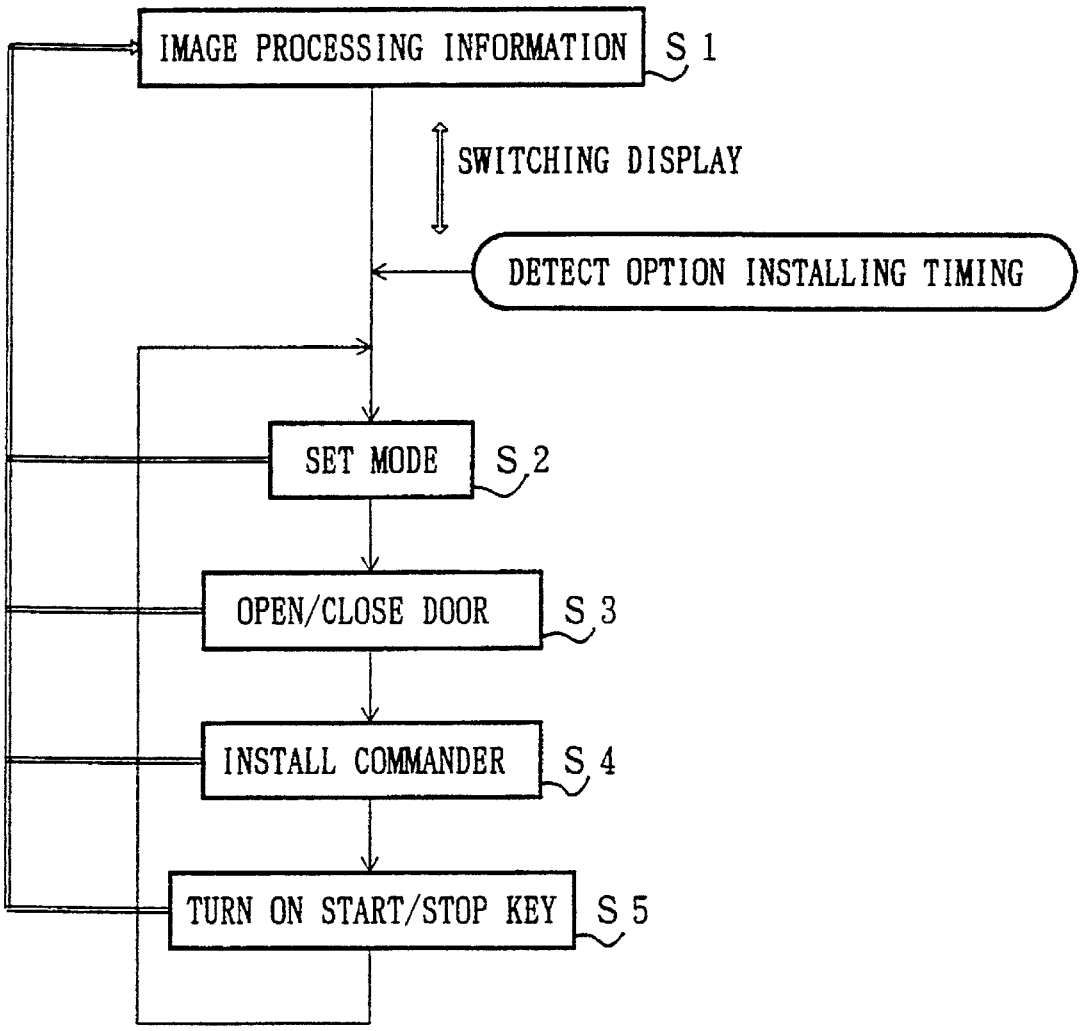

FIG. 158 is a flowchart detailing an option installing operation guidance display by the operation guidance display apparatus in accordance with another embodiment of the present invention.

Figure 159:
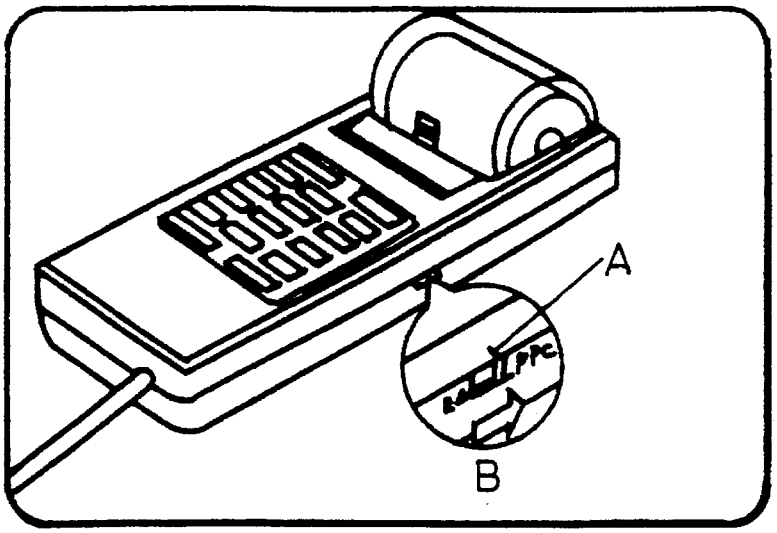

FIG. 159 is a view explaining a screen displaying a moving picture (S2) showing a mode setting operation in the option installing operation guidance display shown in FIG. 158.

Figure 160:
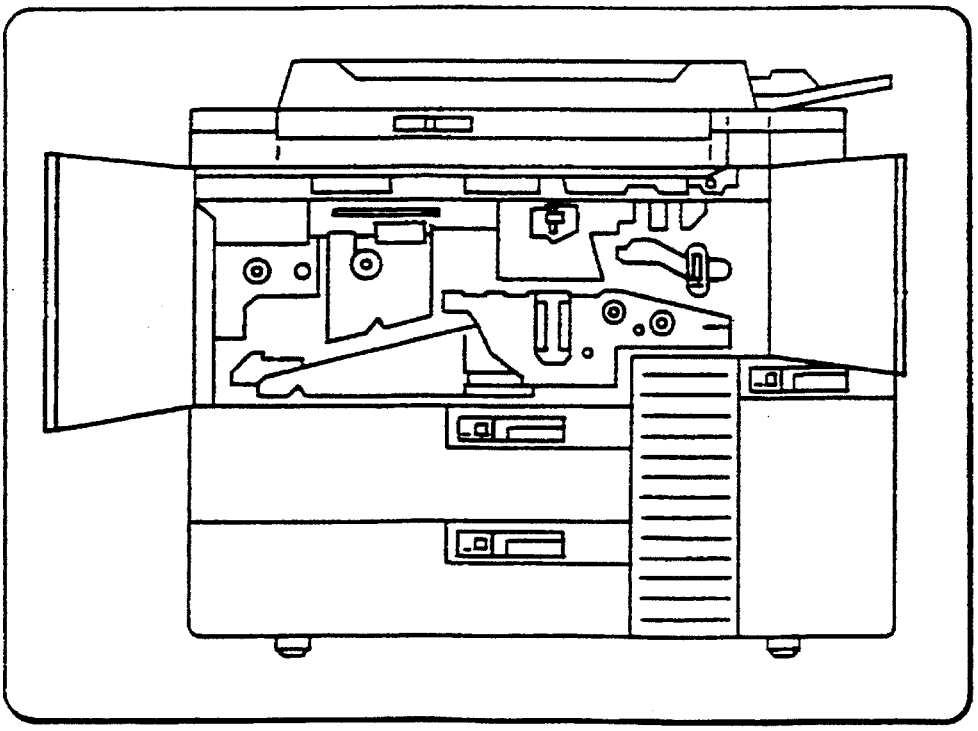

FIG. 160 is a view explaining a screen displaying a moving picture (S3) showing a door opening operation in the option installing operation guidance display shown in FIG. 158.

Figure 161:
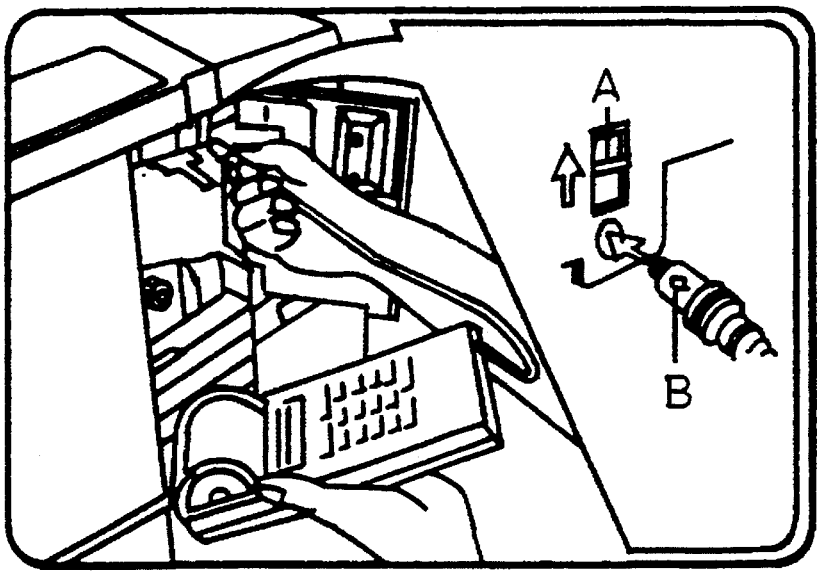

FIG. 161 is a view explaining a screen displaying a moving picture (S4) showing a commander installing operation in the option installing operation guidance display shown in FIG. 158.

Figure 162:
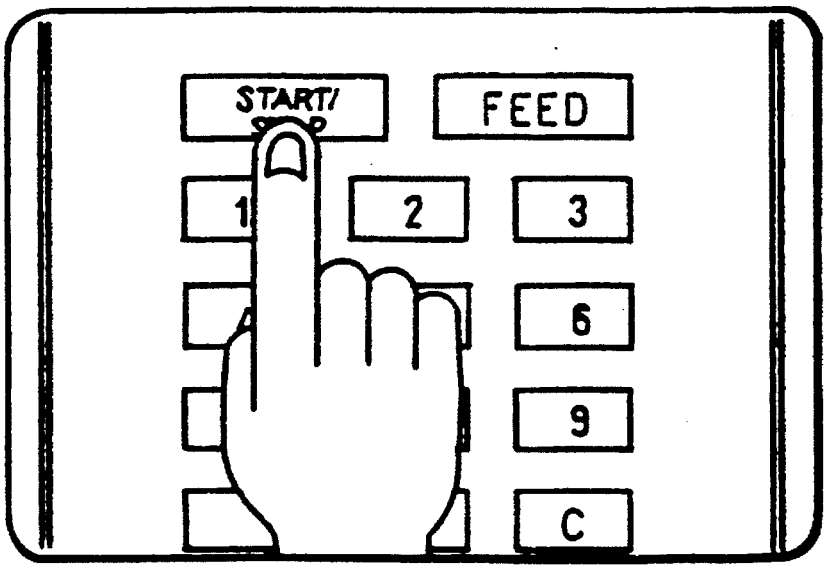

FIG. 162 is a view explaining a screen displaying a moving picture (S5) showing a start/stop key turning on operation in the option installing operation guidance display shown in FIG. 158.

Figure 163:
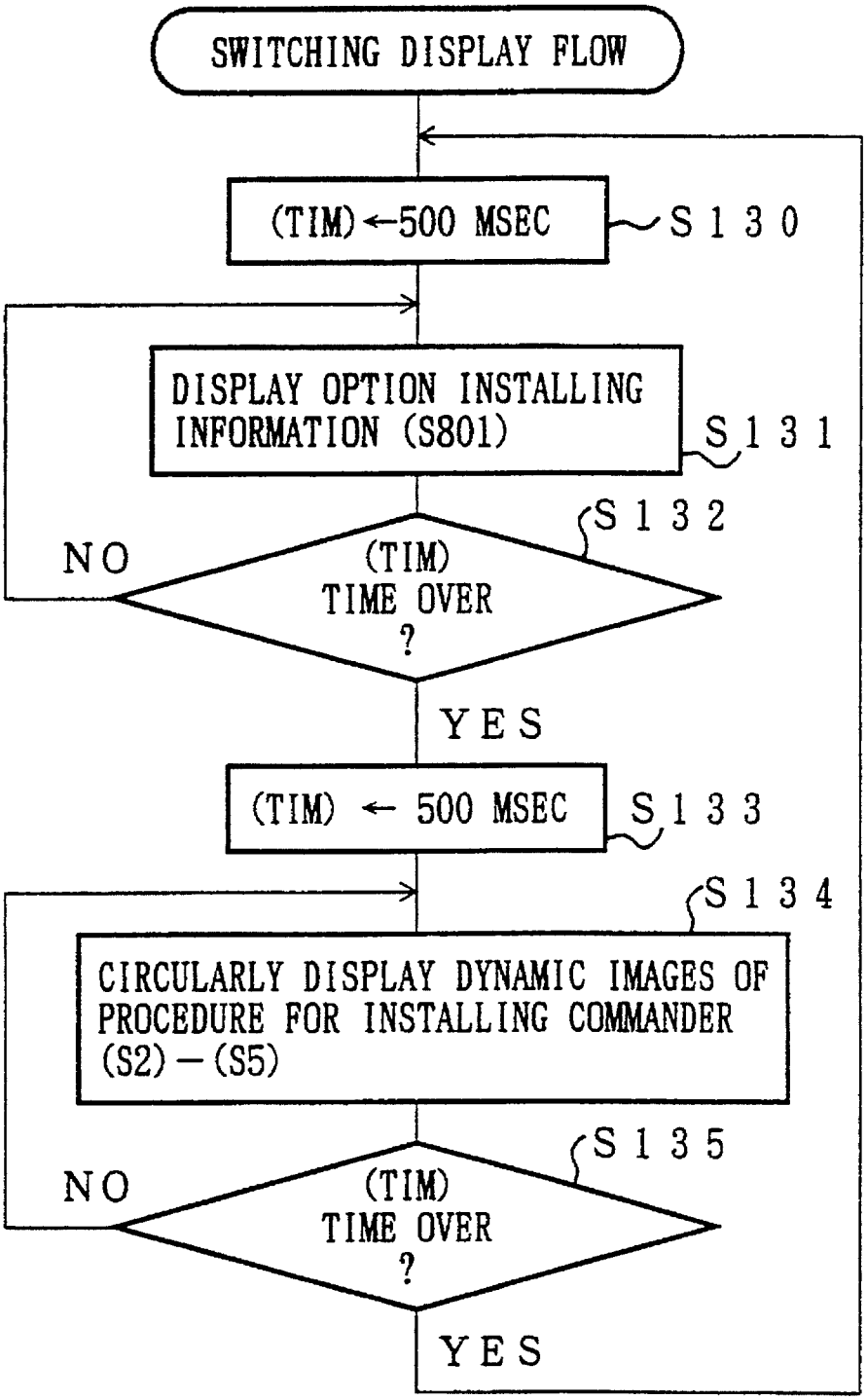

FIG. 163 is a flowchart detailing the procedures for switching the option installing operation guidance shown in FIG. 158 to image processing data.

Figure 164:
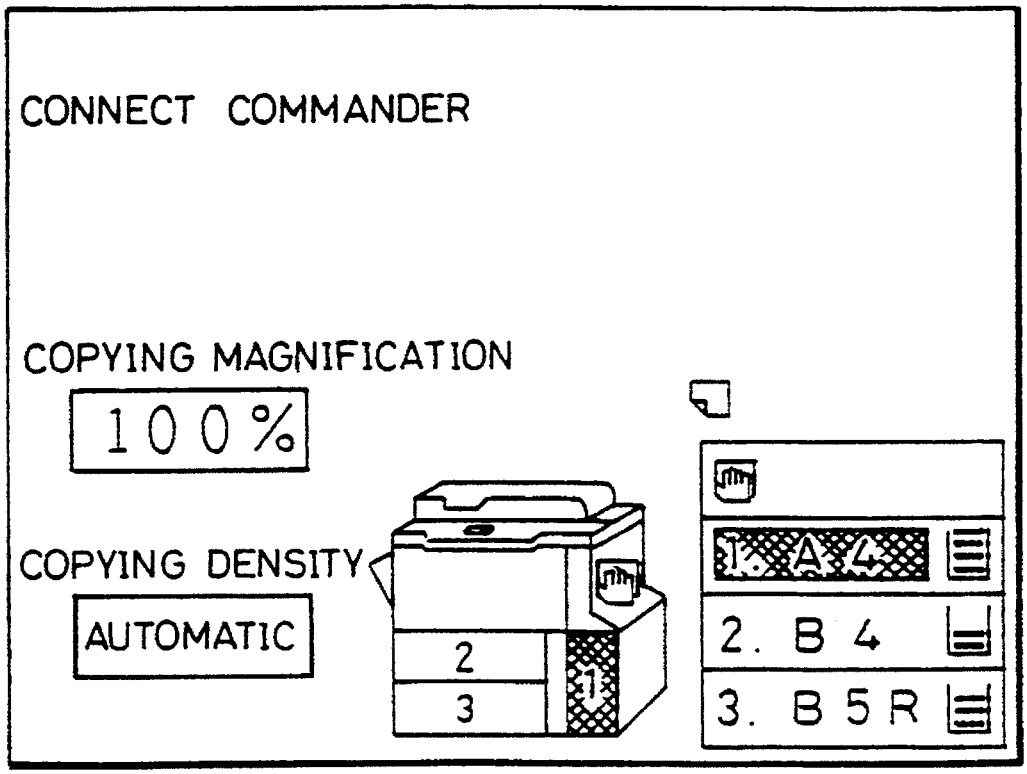

FIG. 164 is a view explaining an image representing option installing data shown in S131 in the flowchart detailing the switching display shown in FIG. 163.

DESCRIPTION OF THE EMBODIMENTS

Embodiment 1

The following will discuss one embodiment of the present invention referring to FIGS. 1 through 40.

Figure 2:
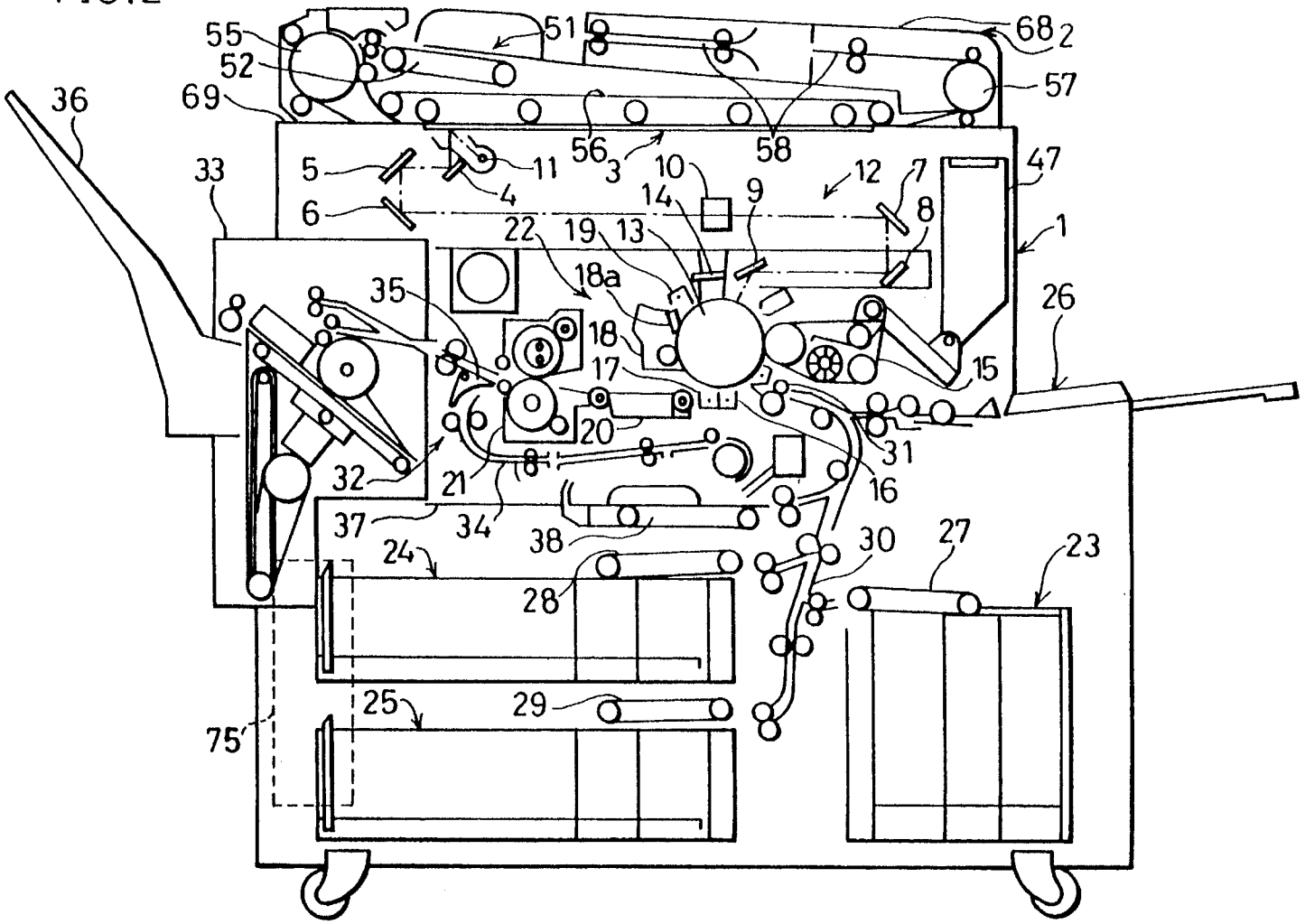
FIG. 2 is a front view which shows an internal structure of a copying apparatus including the jam removing procedure display apparatus.

As shown in FIG. 2, a copying apparatus of the present embodiment as an image forming apparatus having a jam removing procedure display apparatus includes a copying apparatus main body 1 and a recirculating document handler (hereinafter, referred to as an RDH ) 2.

The RDH 2 is arranged so as to feed a document to a document exposing section 3 as a position for reading a document and return the document to an original position where the document is set. The RDH 2 is freely opened and shut for the document exposing section 3 so as to cover the document exposing section 3 while being used. Here, a detailed arrangement of the RDH 2 will be mentioned later.

A copying apparatus main body 1 includes the document exposing section 3 on its upper surface. The document exposing section 3 forms an area where a document is optically scanned and it has a document platen composed of transparent glass. An exposing optical system 12 which is composed of mirrors 4 through 9, a zoom lens 10 and a copy lamp 11 is positioned below the document exposing section 3. The exposing optical system 12 irradiates an emitting light from the copy lamp 11 on a document so as to optically scan the document and guides a reflected light from the document to a photoreceptor drum 13 which is positioned below the exposing optical system 12.

A charger 14, a developing unit 15, a transferring unit 16, a peeling unit 17, a cleaning unit 18, a charge eliminating unit 19, etc. are provided around the photoreceptor drum 13. Meanwhile, a carrying unit 20 and a fixing unit 21 are provided in a sheet carrying direction from the photoreceptor drum 13. The cleaning unit 18 includes a cleaning blade **18*a* for scraping off residual toner by making contact with the photoreceptor drum 13. Moreover, the developing unit 15 is provided with a toner hopper 47 for supplying toner to the developing unit 15** as the occasion demands.

In the copying apparatus main body 1, the photoreceptor drum 13, each means around the photoreceptor drum 13, the carrying unit 20 and the fixing unit 21 constitute a copy processing section 22. As well known, in the copy processing section 22, an electrostatic latent image, which has been formed on the photoreceptor drum 13 by the reflected light from the document guided by the exposing optical system 12, is developed by the developing unit 15 so as to be a toner image and transfers the toner image on a sheet supplied from sheet feeding trays 23 through 25, etc. Moreover, in the copy processing section 22, the sheet, which has been peeled from the surface of the photoreceptor drum 13 by the peeling unit 17, is carried to the fixing unit 21 by the carrying unit 20. Thereafter, the toner image on the sheet is heated and pressurized by the fixing unit 21 so as to be fixed on the sheet.

The sheet feeding tray 23 is positioned below the developing unit 15, while the sheet feeding trays 24 and 25 are positioned adjoining the sheet feeding tray 23. A residual sheets amount detecting unit, not shown, is provided to the respective sheet feeding trays 23 through 25, and an amount of residual sheets on the sheet feeding trays 23 through 25 which has been detected by the residual sheets amount detecting unit is displayed on an operation panel 101. Moreover, a manual sheet feeding tray 26 is provided beside the developing unit 15. The sheet feeding trays 23 through 25 can store a lot of sheets and successively feeds sheets with fixed size starting from a sheet on the top by sheet feeding belts 27 through 29. Meanwhile, the manual sheet feeding tray 26 can store a small amount of sheets with different size, and successively feed these sheets.

A sheet, which has been sent from the sheet feeding trays 23 through 25, the manual sheet feeding tray 26 and an intermediate tray 37 above the sheet feeding tray 24, is carried to the photoreceptor drum 13 through a carrying path 30. Sheets are fed to the photoreceptor drum 13 by a register roller 31 according to prescribed intervals.

A carry switching section 32 including a gate flapper 35 is provided to a discharge side of the fixing unit 21. The gate flapper 35 guides sheets to a finisher 33 in the case where single-sided copying is carried out, and meanwhile, guides sheets to a reverse carrying path 34 in the case where both-sided copying is carried out. The finisher 33 discharges a sheet into a discharge tray 36 and also staples sheets using staples as the occasion demands. The discharge tray 36 can move up and down so as to receive a plurality of sheets which have been stapled by the finisher 33.

The reverse carrying path 34 guides sheets from the carry switching section 32 to the intermediate tray 37. The sheets on the intermediate tray 37 are sent out by a carrying belt 38 and are reversed so as to be fed to the photoreceptor 13.

Figure 3:
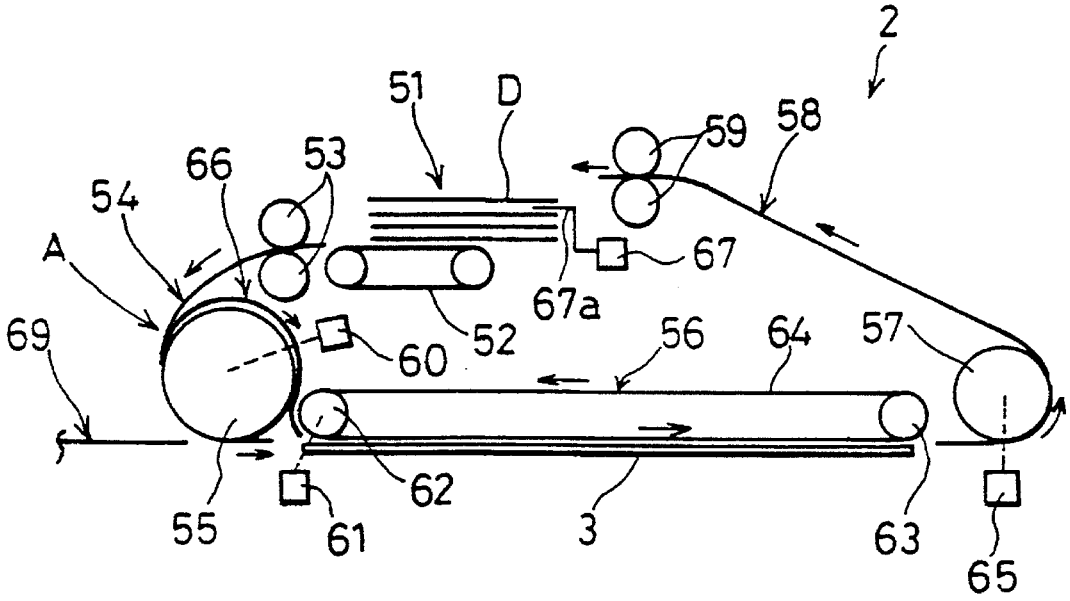
FIG. 3 is an explanatory drawing which schematically shows an arrangement of an automatic recirculating document handler (hereinafter referred to as an RDH) shown in FIG. 2.

FIG. 3 shows an schematically arrangement of the RDH 2 where the arrangement of FIG. 2 is simplified. The RDH 2 can provide a document feeding operation by a circulation-type document feeding mode using a take-out-from-below-and-returning-from-above method (hereinafter, referred to as RDH mode) and a document feeding operation by individual document feeding mode by manual insertion (hereinafter, referred to as SDF mode).

In other words, in the RDH mode, documents D, which have been piled up and placed on a document storing section 51 as a collecting position, are successively sent out by a sending-out belt 52 provided beneath the document storing section 51 starting with the document at the bottom, and carried through the carrying path 54 by a pair of sending-out rollers 53.53 provided on a lower stream side of the sending-out belt 52. Furthermore, the document D is placed on a reading position of the document exposing section 3 by the carrying roller 55 and the carrying belt 56. Thereafter, when scanning by the exposing optical system 12 is completed, the document D is sent out from the reading position by the carrying belt 56 and are reversed by a feeding roller 57 so as to be carried through the carrying path 58. Then, the document D is returned on a topmost document D on the document storing section 51 by carrying rollers 59.59. Moreover, in the SDF mode, one document D placed on a document storing section 69 is carried to the reading position by the carrying roller 55 and the carrying belt 56, and are discharged onto the document storing section 51 similarly in the same manner as in the RDH mode.

The carrying roller 55 is rotated by a motor 60 and a feeding roller 57 is rotated by a motor 65. A carrying belt 56 is composed of a driving roller 62 which is rotated by a motor 61, a driven roller 63 provided opposite to the driving roller 62 and an endless belt 64 installed tightly across both the rollers 62 and 63. The carrying belt 56 absorbs air from a venthole formed in the belt 64 using air absorbing unit, not shown, and attracts a document D to a surface of the belt 64 so as to carry the document D without slip.

During a both side mode for obtaining a both-sided copy from a both-sided document by a RDH mode in the RDH 2, when a first cycle of the documents are sent from the document storing section 51 to the carrying path 54 and a trailing end of the documents reaches a position A, the documents pass through a carrying path 66 and are sent to the reading position by reverse rotation of a carrying roller 55 with a rear side of the documents being opposite to the document exposing section 3 so as to be returned to the document storing section 51. Moreover, after a second cycle of the documents pass from the document storing section 51 only through the carrying path 54 and are sent to the reading position with a front side of the documents being opposite to the document exposing section 3, it is returned to the document storing section 51. In other words, in the first cycle of the documents, only rear faces of all the documents on the document storing section 51 are copied, and sheets where the rear faces have been copied are stocked in the intermediate tray 38. In the second cycle of the documents, front faces of the documents are copied on front faces of the sheets sent out from the intermediate tray 38. Therefore, during the copying apparatus of the present embodiment, in the case of the both-sided mode using the RDH mode, in the case where one set of a plurality of documents placed on the document storing section 51 is copied so as to have a plurality of sets of copies, copies are made one set by one set.

In addition, a recycle sensor 67 is provided to the document storing section 51. When a detecting section **67*a* is provided above a top document on the document storing section 51, namely, a first page of the documents, the recycle sensor 67 detects one cycle of the documents. The recycle sensor 67 can also detect a last document on the document storing section 51, double-documents feeding, etc. The detecting section 67*a* is placed per cycle of document feeding as the need arises. A Rear/front side direction of the documents with respect to the detecting section 67*a*** is same at the time of an one-sided mode and is opposite at the time of a both-sided mode. Here, the one-sided mode copies a one-sided document on a one side of a sheet, and also copies a one-sided document on both sides of a sheet.

Figure 10:
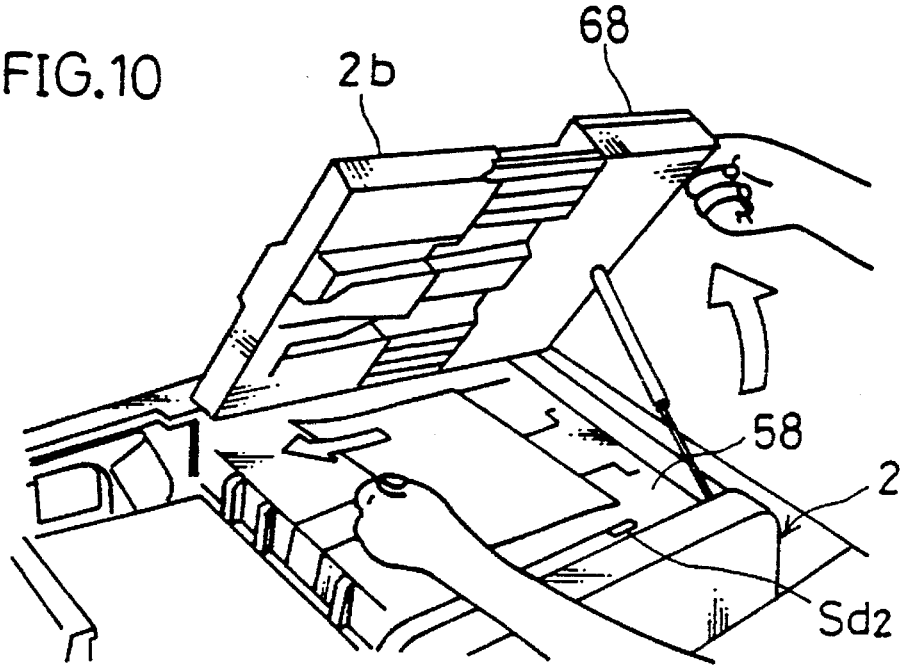
FIG. 10 is an explanatory drawing which shows an arranging position of a cover open/close switch $Sd_2$ of the RDH.
Figure 11:
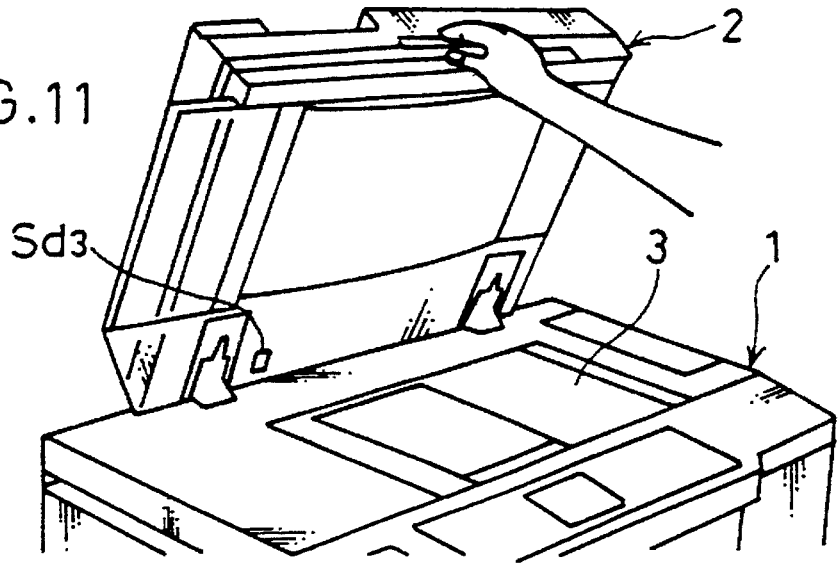
FIG. 11 is an explanatory drawing which shows an arranging position of an RDH open/close switch $Sd_3$ of the RDH.

In addition, the whole RDH 2 freely opens and closes the document exposing section 3 as shown in FIG. 11 centered on an end in an inner side in a vertical direction in FIG. 2. Moreover, since the RDH 2 opens the carrying path 58, an upper cover 68 is freely opened as shown in FIG. 10.

Figure 5:
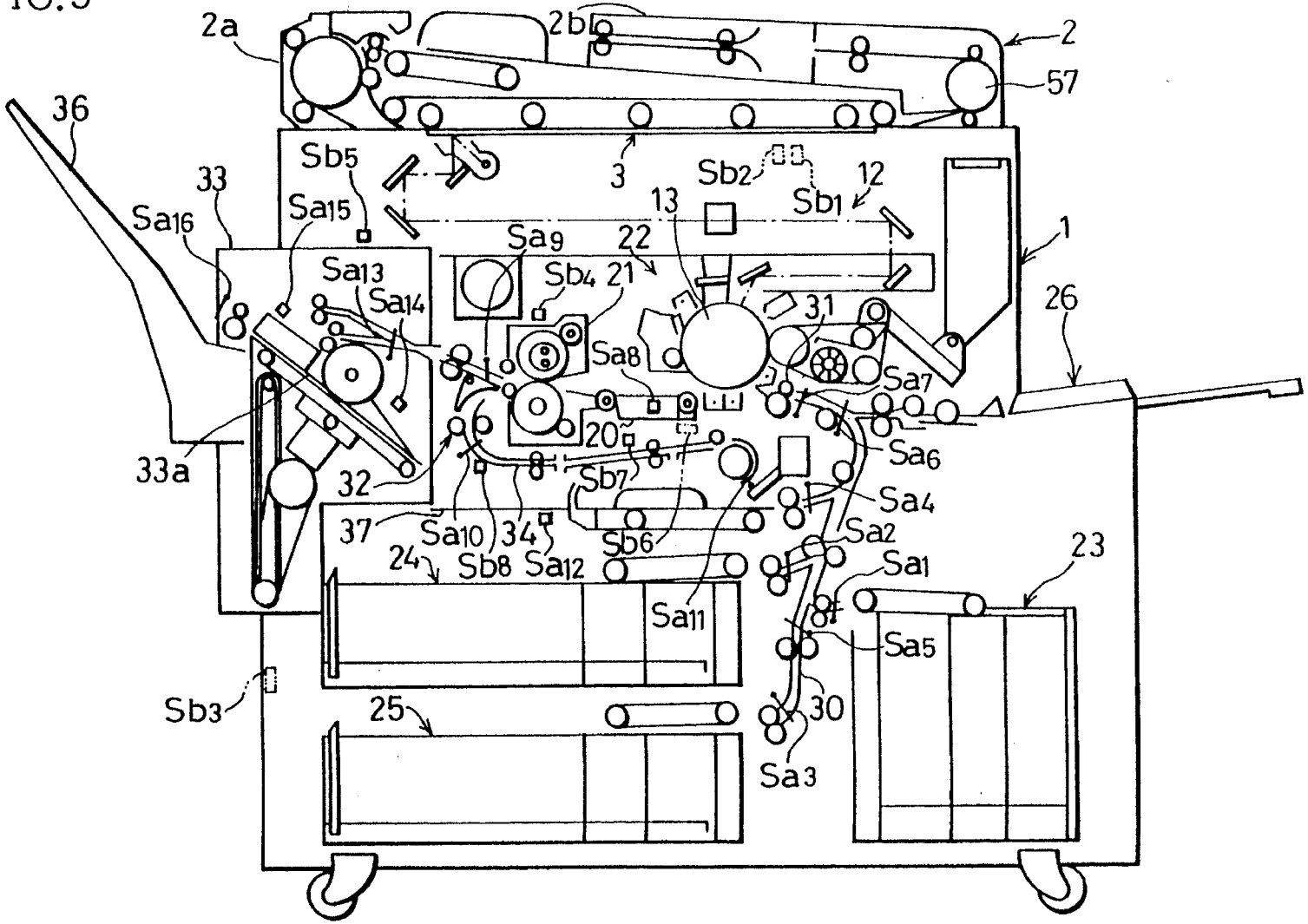
FIG. 5 is an explanatory drawing which shows an arranging position of a sensor in the copying apparatus main body.

In addition, the copying apparatus main body 1 is provided with a plurality of sheet sensors as jam detecting means. As shown in FIG. 5, sheet feeding sensors $Sa_1$ through $Sa_3$ for detecting insertion of paper from the feeding trays 23 through 25 to the carrying path 30, a sheet feeding sensor $Sa_4$ for detecting insertion of paper from the intermediate tray 37 to the carrying path 30, a sheet sensor $Sa_5$ for detecting carrying of sheets inserted from the sheet feeding tray 25 of the carrying path 30, a sheet sensor $Sa_6$ for detecting carrying of sheets inserted from each tray of the carrying path 30, and a sheet sensor $Sa_7$ for detecting carrying of sheets on the carrying path 30 before a register roller are provided on and near the carrying path 30 as the sheet sensor Ls.

In addition, as the sheet sensors, a sheet peeling sensor $Sa_8$ for detecting carrying of sheets after peeling from the photoreceptor 13 is provided in the carrying unit 20. A sheet sensor $Sa_9$ on a discharge side from the fixing unit 21, and a sheet sensor $Sa_{10}$ on the reverse carrying path 34 are provided. Moreover, an intermediate tray sheet entrance sensor $Sa_{11}$ for detecting entrance of sheets to the intermediate tray 37, and an intermediate tray sheet sensor $Sa_{12}$ for detecting existence of sheets on the intermediate tray 37 are provided on and near the intermediate tray 37. Furthermore, a sheet sensor $Sa_{13}$ for detecting carrying of sheets in a finisher 33, a staple processing section sheet sensor $Sa_{14}$ for detecting existence of sheets in a staple processing section, not shown, of the finisher 33, a staple tray sheet sensor $Sa_{15}$ for detecting existence of sheets on the staple tray 33*a* and a discharge sensor $Sa_{16}$ for detecting discharge of sheet from the staple tray onto the discharge tray 36 are provided in the finisher 33.

Figure 6:
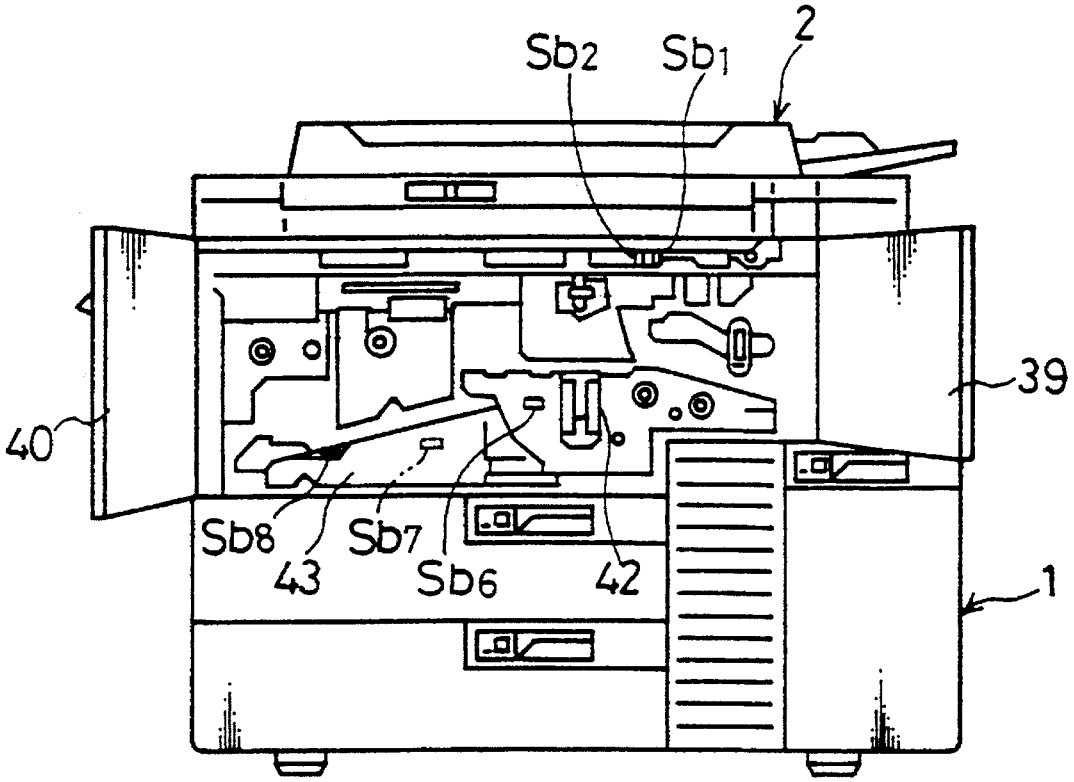
FIG. 6 is an explanatory drawing which shows an arranging position of each sensor inside first and second doors of the copying apparatus main body.
Figure 7:
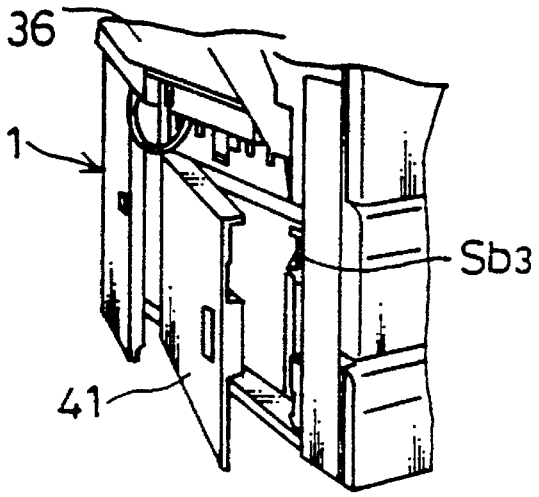
FIG. 7 is an explanatory drawing which shows an arranging position of a sensor in a third door of the copying apparatus main body.

In addition, a plurality of state sensors are provided in the copying apparatus main body 1 as operation/non-operation detecting means which detects a state of each section operated in order to remove jam, etc. As shown in FIG. 6, as the state sensors, a door switch $Sb_1$ which is turned OFF by opening a first door 39 for opening and closing a portion on a front side of the copying apparatus and turned On by closing the first door 39, and a door switch $Sb_2$ which is turned OFF by opening a second door 40 for opening and closing remaining portion on the front side of the copying apparatus and turned ON by closing the second door 40 are provided on an upper portion of the copying apparatus main body 1. Moreover, as the state sensors, as shown in FIG. 7, a door switch $Sb_3$ which is turned OFF by opening a third door 41 for opening and closing a lower portion and is turned ON by closing the third door 41 is provided on a downward portion of the discharge tray 36 on the discharge side of the copying apparatus main body 1.

In addition, as the state sensors, as shown in FIG. 5, a fixing unit installation switch $Sb_4$ which is turned ON/OFF according to whether the fixing unit 21 is installed or not is provided in the fixing unit 21, and a finisher connection/disconnection sensor $Sb_5$ for detecting connection/disconnection of the finisher 33 to/from the copying apparatus main body 1 is provided in a position where the finisher 33 is installed.

Figure 8:
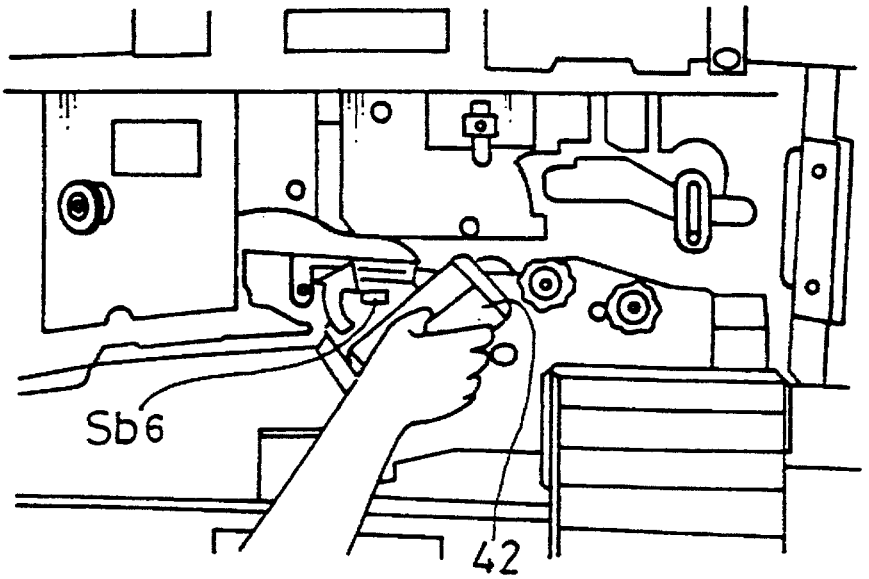
FIG. 8 is an explanatory drawing which shows an arranging position of a feeding section open/close lever operation detecting switch $Sb_6$ of the copying apparatus main body.

In addition, as shown in FIG. 6, as the state sensors, a carrying section open/shut lever operation detecting switch $Sb_6$ for detecting operation/non-operation of a carrying section open/shut lever 42 is provided in the position of the carrying section open/shut lever 42. A carrying unit draw-out detecting switch $Sb_7$ for detecting draw-out/installation of the carrying unit 43 from/to the copying apparatus main body 1 is provided in a proximity of the switch $Sb_6$. A sheet guide open detecting switch $Sb_8$ also shown in FIG. 5 for detecting open of the sheet guide for making it possible to open the reverse carrying path 34 is provided in the reverse carrying path 34. As shown in FIG. 8, the carrying section open/shut lever operation detecting switch $Sb_6$ is turned ON by rotating the carrying section open/shut lever 42 in order to open each carrying path, etc. Moreover, the sheet guide open detecting switch $Sb_8$ detects open of the sheet guide 34*a* shown in FIG. 34 for making it possible to open the reverse carrying path 34.

Figure 9:
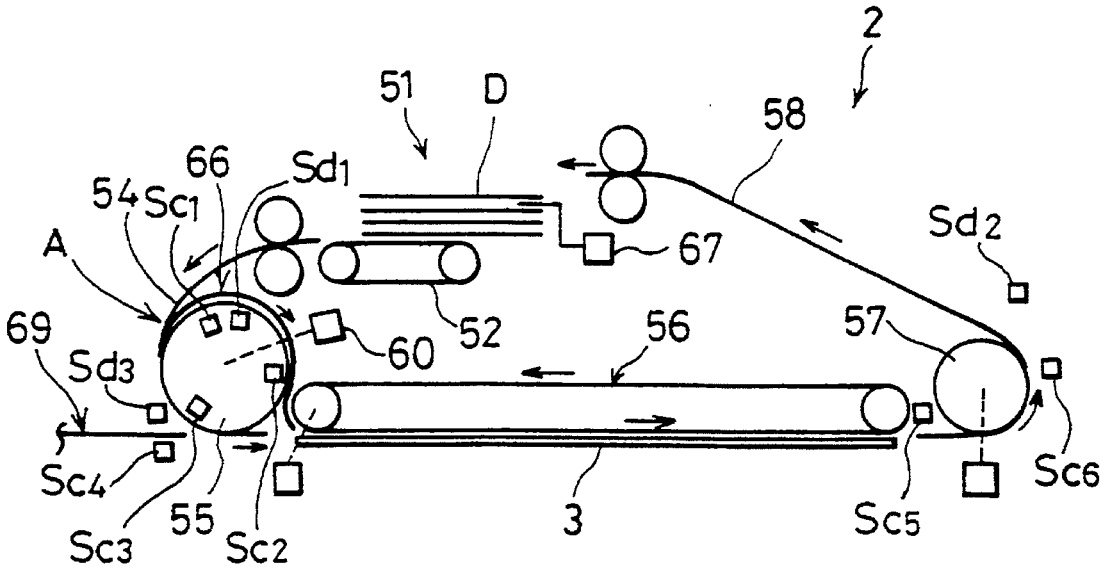
FIG. 9 is an explanatory drawing which shows the arranging positions of each sensor of the RDH shown in FIG. 2.

Meanwhile, RDH 2 is provided with a plurality of document sensors as jam detecting means for performing a similar function as that of the sheet sensor of the copying apparatus main body. As the document sensors, as shown in FIG. 9, a document sensor $Sc_1$ for detecting arrival of documents at the carrying roller 55 from the document storing section 51, a reverse spare sheet feeding position document sensor $Sc_2$ for detecting arrival of the documents at a reverse spare sheet feeding position and a spare sheet feeding position document sensor $Sc_3$ for detecting arrival of the documents at a spare sheet feeding position are provided around the carrying roller 55.

Moreover, as the document sensor, a document storing section document sensor $Sc_4$ for detecting that the documents have stored by manual feeding is provided to the document storing section 69.

In addition, as the documents sensors, a document sensor $Sc_5$ for detecting arrival of the document at the document exposing section 3 is provided in a feeding direction from the feeding belt 56, and a document sensor $Sc_6$ for detecting arrival of the documents at the feeding roller 57 is provided around the feeding roller 57.

In addition, the RDH 2 is provided with a lot of state sensors having a similar function as that of the state sensors of the copying apparatus main body 1. As the state sensors, as shown in FIG. 9, a cover open/shut switch $Sd_1$, which is turned OFF by opening of an open/shut cover 2*a* which can be opened and shut in the RDH 2 shown in FIG. 5 and which is turned ON by shutting of the open/shut cover 2*a*, is provided around the carrying roller 55. The open/shut cover 2*a* opens and shuts the vicinity of the carrying roller 55 for jam removing. Moreover, as shown in FIG. 10, as the state sensor, a cover open/shut switch $Sd_2$, which is turned OFF/ON by opening/closing of an open/shut cover 2*b*, is provided to the proximity of the feeding roller 57. The open/shut cover 2*b* opens and shuts the proximity of the carrying path 58 for jam removing. Moreover, as shown in FIG. 11, a RDH open/shut switch $Sd_3$, which is turned OFF/ON by opening/closing the RDH 2 for the document exposing section 3, is provided to a RDH 2 facing the document exposing section.

Figure 4:
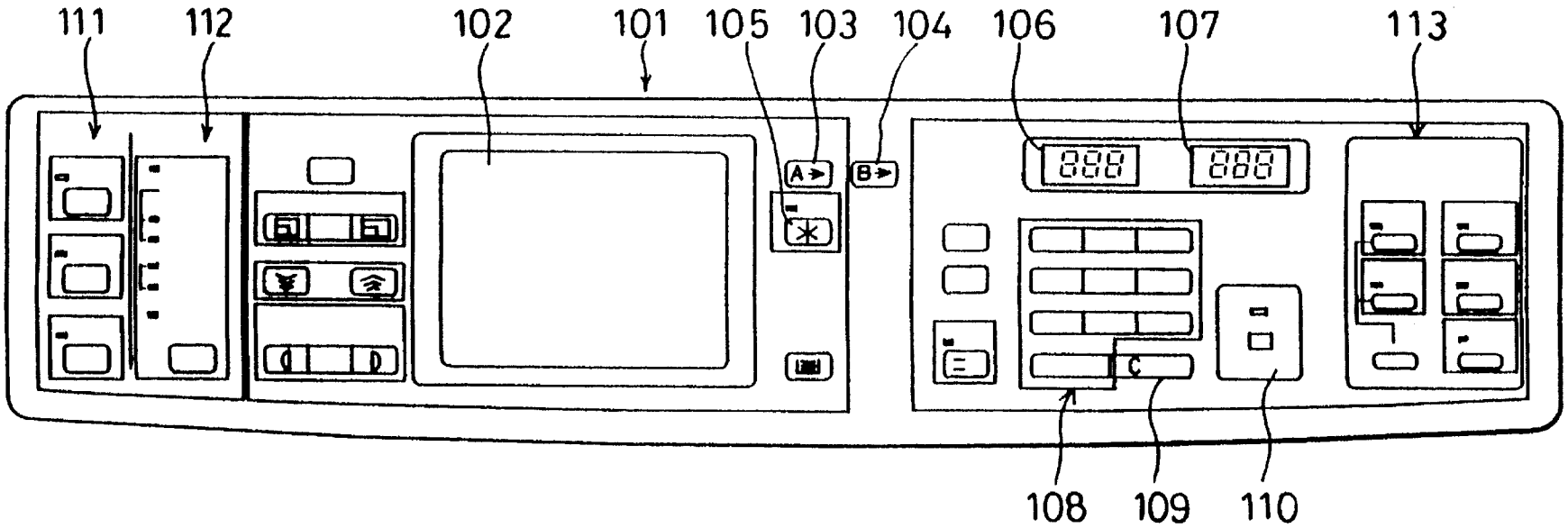
FIG. 4 is a front view of an operation panel including a copying apparatus main body shown in FIG. 2.

In addition, the copying apparatus has an operation panel 101 shown in FIG. 4. The operation panel 101 is provided with a liquid crystal display (hereinafter, referred to as LCD) 102 as display means, a progressive key 103, an automatic progressive key 104, an operation guide key 105, a copy set number display section 106, a copy completion number display section 107, a copy number set key 108 for inputting numerals 0 through 9, a clear key 109 for clearing a set number by the copy number set key 108, and a copy start key 110 for commanding a start of copying. Moreover, the operation panel 101 is provided with a finisher function setting section 111 for setting process in the finisher 33, a copy mode setting section 112 for setting a copy mode, such as the both-sided mode or one-sided mode, a function setting section 113 for setting copying by various functions, such as, copying with a binding margin, etc.

Figure 12:
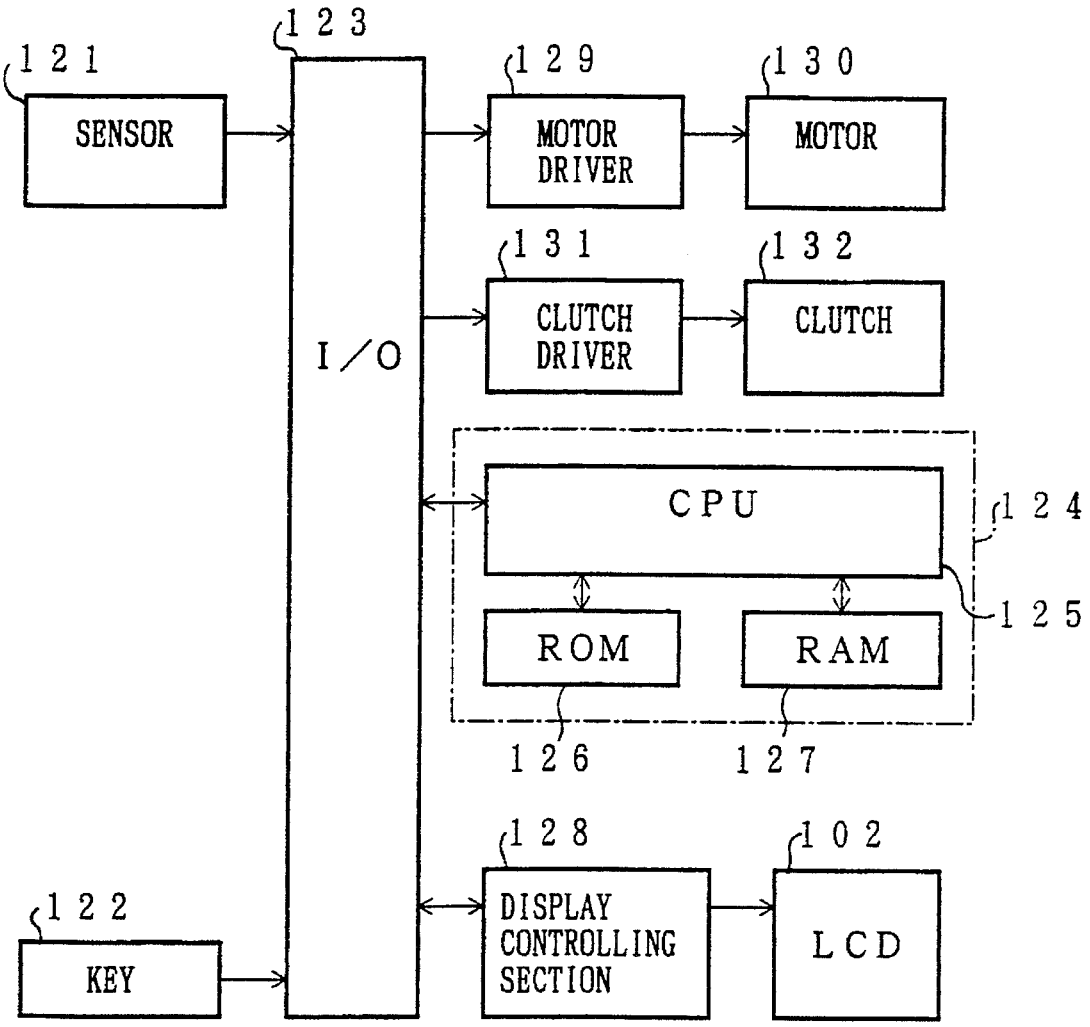
FIG. 12 is a block diagram which schematically shows the arrangement shown in FIG. 1.

In addition, the copying apparatus has a control circuit shown in FIG. 12. In FIG. 12, a sensor 121 is sensors including the sheet sensors Sa.Sc and the state sensors Sb.Sd, and a key 122 is various keys provided on the operation panel 101. The sensors 121 and the keys 122 are connected to a CPU (Central Processing Unit) 125 of an operation controlling section 124 through an input/output (I/O) interface 123. A ROM (Read Only Memory) 126 and a RAM (Random Access Memory) 127 are connected to the CPU 125, and also a display controlling section 128, a motor driver 129 and a clutch driver 131 are connected thereto through the I/O interface 123.

The ROM 126 previously stores a control program of the CPU 125, and according to this program, the CPU 125 controls operations of each means connected thereto based upon input from the sensors 121 and the keys 122. Namely, the CPU 125 controls all the copying operations such as an image forming process, a sheet carrying operation, a fixing operation. The RAM 127 is used as areas for a flag and the other calculation required for a buffer memory, copying control, etc. A motor 130 driven by the motor driver 129 includes each motor provided to the copying apparatus main body 1 and the RDH 2. Moreover, a clutch 132 driven by the clutch driver 131 includes electromagnetic clutches provided between the motor 130 and each means. The display controlling section 128 controls a display driver provided thereinto so as to display a numerical value, a copying condition and a copying function set by the above keys 122, or a state of copying apparatus, such as occurrence of jam, countermeasures against the jam, etc. on the LCD 102, a copy setting number display section 106, a copy completion number display section 107 provided on the operation panel 101.

Figure 1:
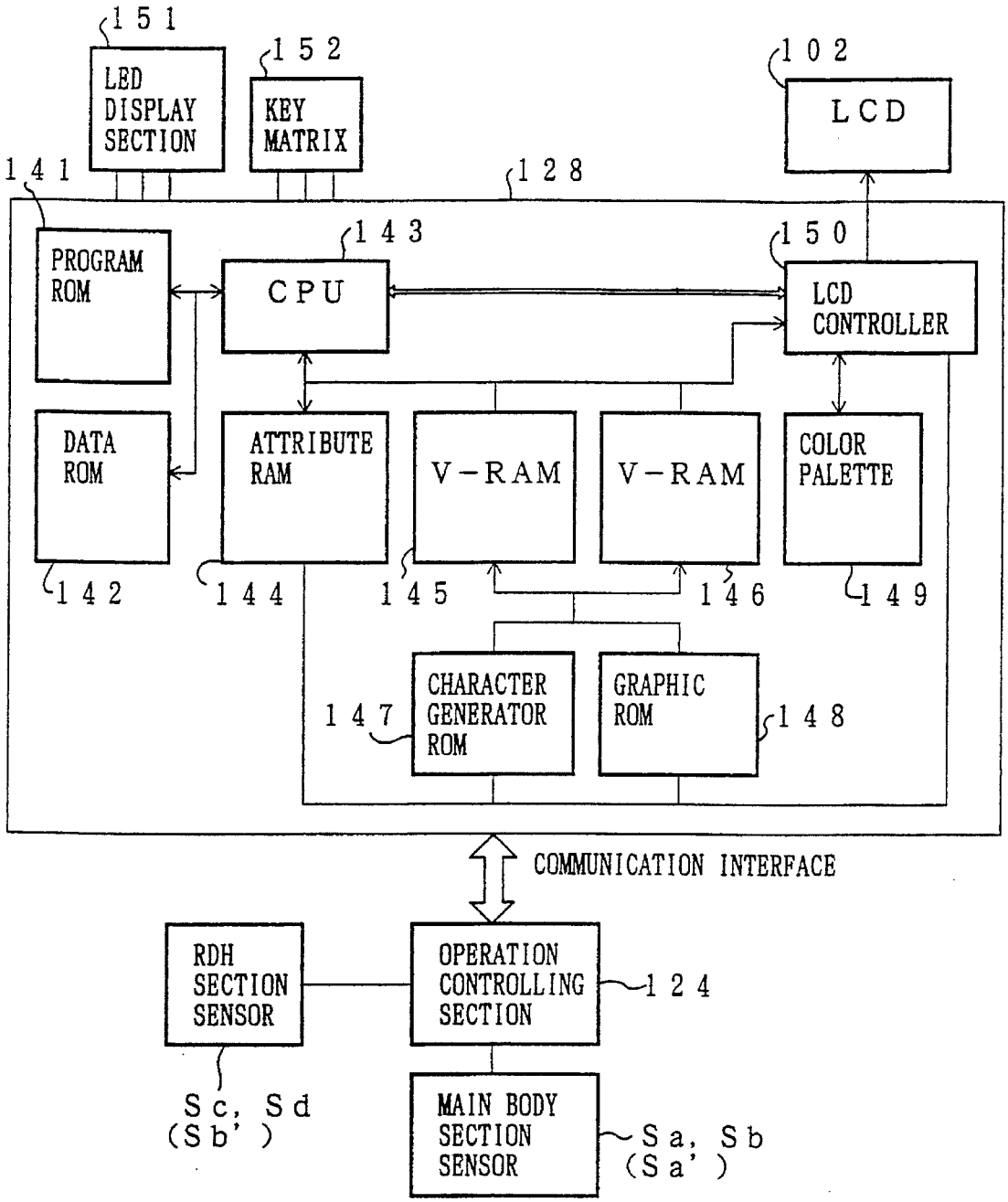
FIG. 1 is a block diagram which shows an arrangement of a jam removing procedure display apparatus in one embodiment of the present invention.

As shown in FIG. 1 which shows the arrangement of the jam removing procedure display apparatus of the present embodiment, the display controlling section 128 which controls the LCD 102 includes a program ROM 141, a data ROM 142, a CPU 143, an attribute RAM 144, V-RAMs 145.146, a character generator ROM (hereinafter, referred to as a CG-ROM) 147, a graphic ROM 148 as dynamic data storing means and image data storing means, a color palette 149, and an LCD controller 150.

The program ROM 141 composes the display control means with the CPU 143 and the LCD controller 150, and preliminarily stores a program for controlling the CPU 143. The data ROM 142 preliminarily stores data of messages represented by characters which show a sequence of procedures for removing jam in each section of the copying apparatus main body 1 and the RDH 2, and an storage address, display color information, etc. of dynamic data in the graphic ROM 148. The CPU 143 is connected to the CPU 125 of the operation controlling section 124 through a communicating interface, and according to input from the CPU 125, the CPU 143 performs control based upon a program of the program ROM 141. The attribute RAM 144 designates indication of blinking or inversion, etc. of a display image, inversion, etc. to the LCD controller 150 so that display data which have been written to the RAM 144 are displayed on an LCD 102. As an LCD controller having such an attribute RAM 144, HD63645F or HD64645F made by Hitachi can be used, for example. The V-RAMs 145.146 are memories where display data such as dynamic data and the message data to be displayed on the LCD 102, are temporarily written. Fonts of each character are stored in the CG-ROM 147. The graphic ROM 148 preliminarily stores dynamic data which show a sequence of procedures for removing jam in each section of the copying apparatus main body 1 and the RDH 2.

The LCD controller 150 takes out display data written into the V-RAMs 145 and 146 through the CG-ROM 147 and the graphic ROM 148 and displays the display data on the LCD 102. In this case, the dynamic data are displayed as a dynamic image. The display of the dynamic image can be realized by changing an address where a cell pattern of the dynamic image in the graphic ROM 148 of the V-RAMs 145 and 146 is stored at a suitable timing by a timer in the program ROM 141. The suitable timing is 70 to 200 ms in the case of display on the LCD such that afterglow does not remain. Moreover, in order to control a capacity of the graphic ROM 148, a cell pattern is set so that only data on a portion corresponding to a portion to be moved in each jam removing operation is changed, and unmoving portion is data of only one pattern. Furthermore, when the display data stored in the V-RAMs 145 and 146 are displayed on the LCD 102, the LCD controller 150 takes out display colors from the color palette 149 based upon color information of a portion of the display data to be displayed on the LCD 102 so that the display data are displayed by using colors.

In addition, the LCD 102 as well as an LED (Light Emitting Diode) display section 151 provided on the operation panel 101 and a key matrix 152 are connected to the display controlling section 128.

In the copying apparatus of the present invention with the above arrangement, when stoppage of feeding paper, namely jam occurs during copying operation, the copying operation is suspended. At this time, heating of the fixing roller in the fixing unit 21 is also suspended. When the operation guide key 105 on the operation panel 101 is turned ON by an operator, operation guidance for removing jam shown in FIG. 13 is displayed on the LCD 102 of the operation panel 101.

Figure 13:
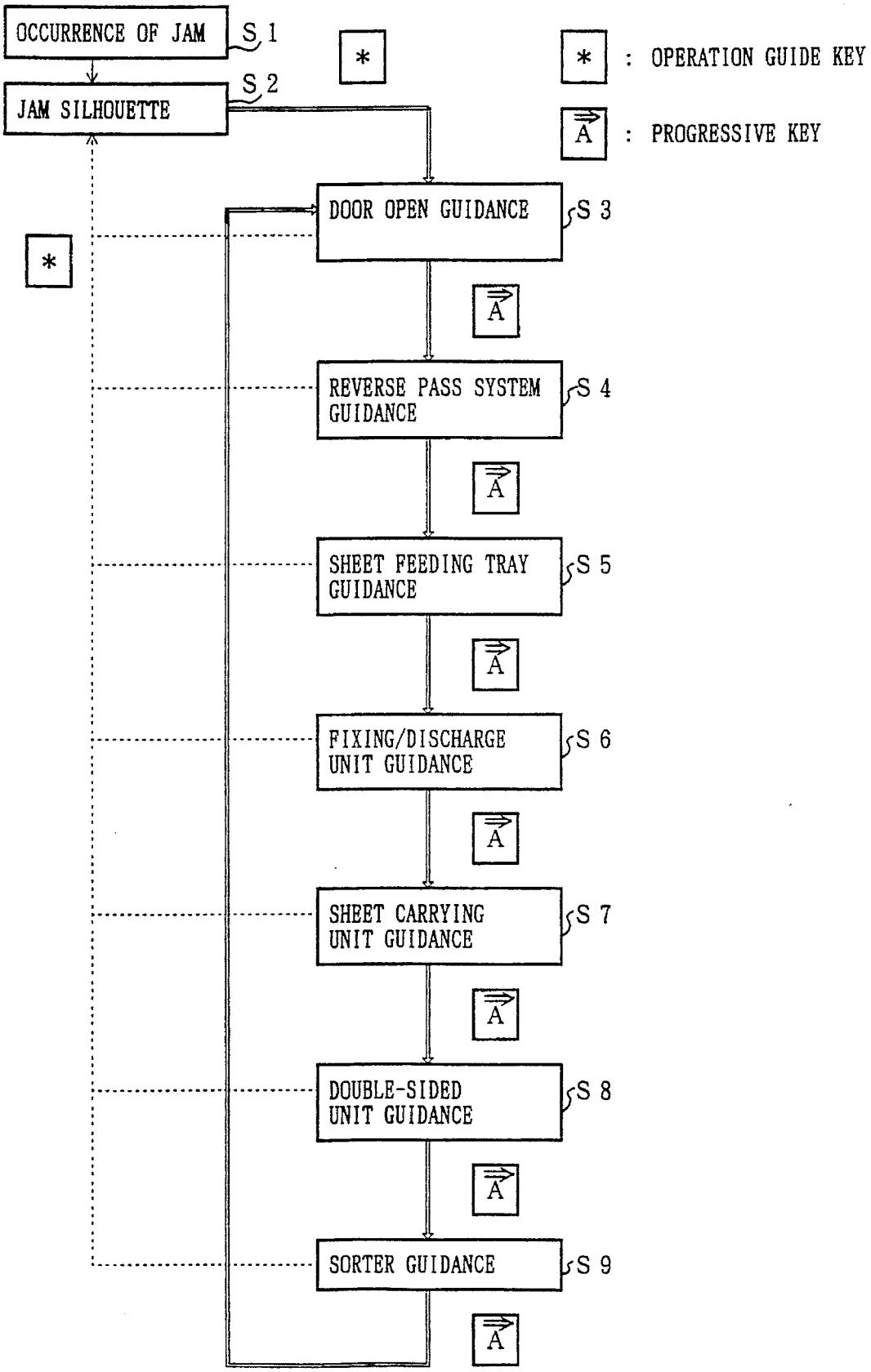
FIG. 13 is a schematic flow chart which shows a display operation by a progressive key shown in FIG. 4 which is jam guidance display operation in the jam removing procedure display apparatus of the present embodiment.

In FIG. 13, occurrence of jam (S1) is detected by the sensors $Sa_1$ through $Sa_{16}$ of the copying apparatus main body 1 or the sensors $Sc_1$ through $Sc_6$ of the RDH2. When jam is detected by these sensors, the operation controlling section 124 commands the display controlling section 128 to display jam through the communicating interface. Successively, the CPU 143 reads out data of a message to be displayed from the data ROM 142 as well as reads out a storage address and information of display colors in the graphic ROM 148 for an image to be displayed so as to write them to the V-RAMs 145.146.

Next, the LCD controller 150 reads out data stored in the V-RAMs 145.146 through the CG-ROM 147 and the graphic ROM 148 so as to display the data on the LCD 102.

Figure 14:
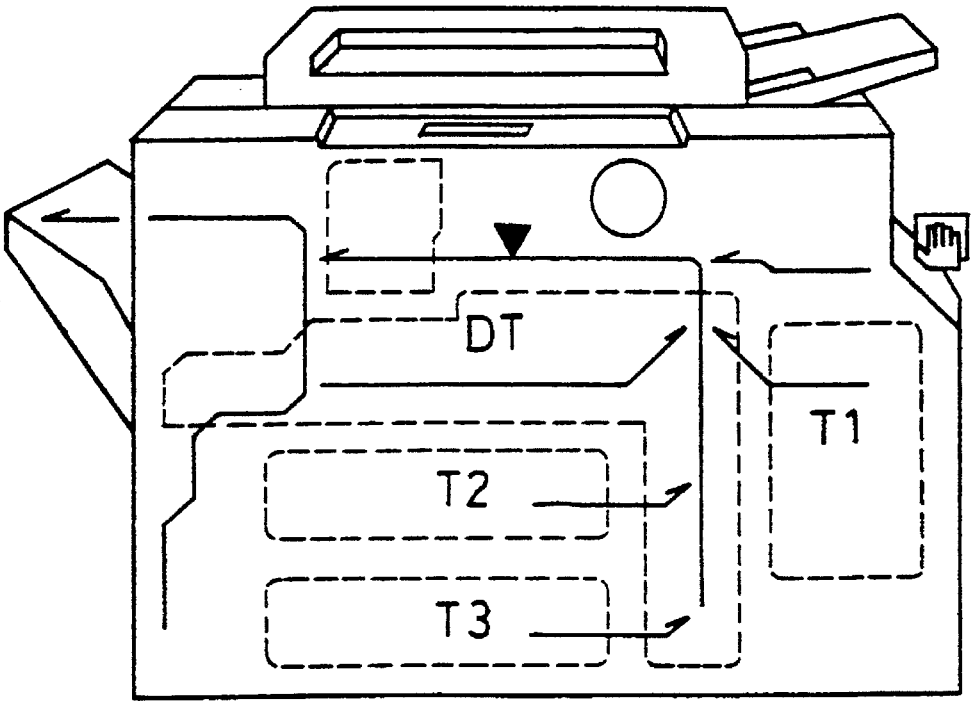
FIG. 14 is an explanatory drawing of a jam silhouette display (S2) shown in FIG. 13.

In this case, in the LCD 102, a message that jam occurred shown in FIG. 14 and graphics of a jam silhouette which represents a jam position of a copying apparatus are displayed (S2). In the drawing, an inverted triangular mark is represents a jam position. Here, a state in the case where jam occurs in one position is shown. The jam is detected by a sheet peeling sensor $Sa_8$ shown in FIG. 5, for example and it is a jam in a sheet carrying unit, mentioned later.

Incidentally, in a copying apparatus which performs a high-speed process, for example, in the case where jam occurs in a lower stream side of a sheet carrying path, a plurality of sheets normally remain on its upper stream side. For this reason, a plurality of positions which require removal of jam, namely, a plurality of jam positions exists, so sheets should be removed in a plurality of jam positions. Therefore, removal of jam in the copying apparatus of the present invention includes removal of sheets in a portion where jam actually occurs and removal of on-carrying sheets in a portion where sheets remain due to occurrence of jam.

Figure 15:
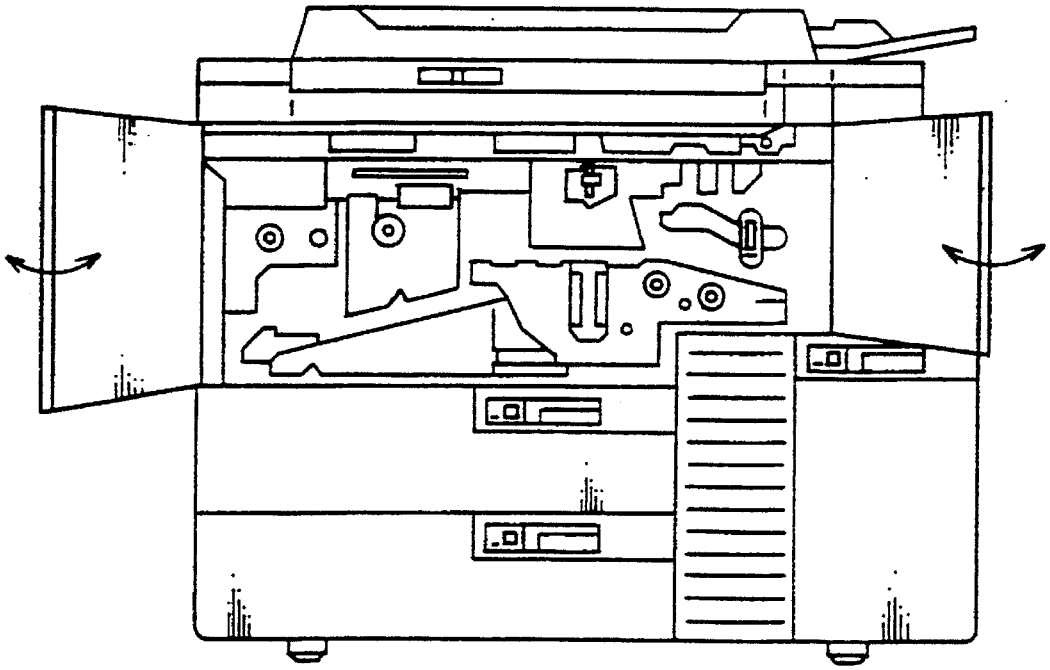
FIG. 15 is an explanatory drawing of a door open guidance display (S3) shown in FIG. 13.
Figure 16:
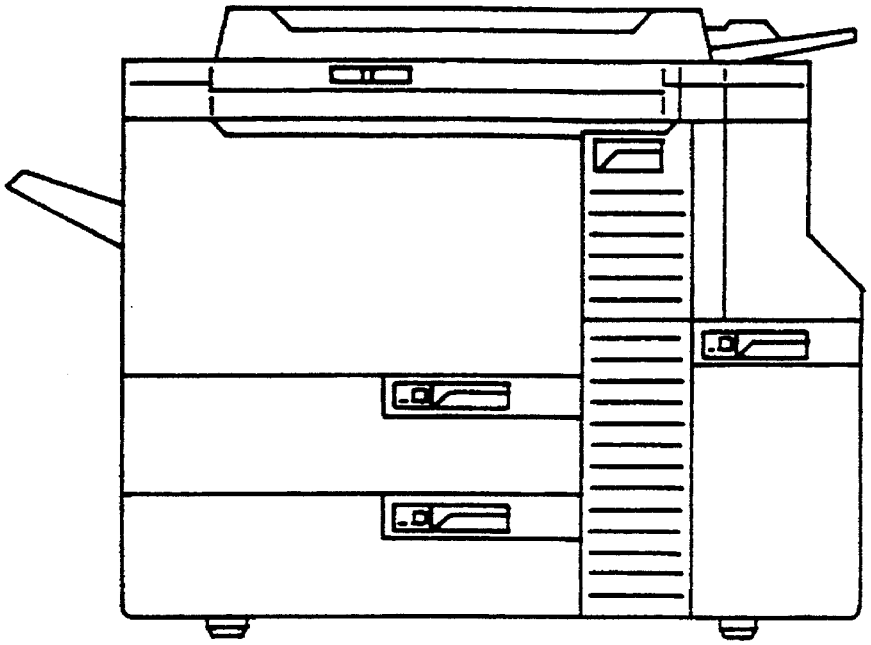
FIG. 16 is an explanatory drawing which shows a cell 1 for displaying the door open guidance.
Figure 17:
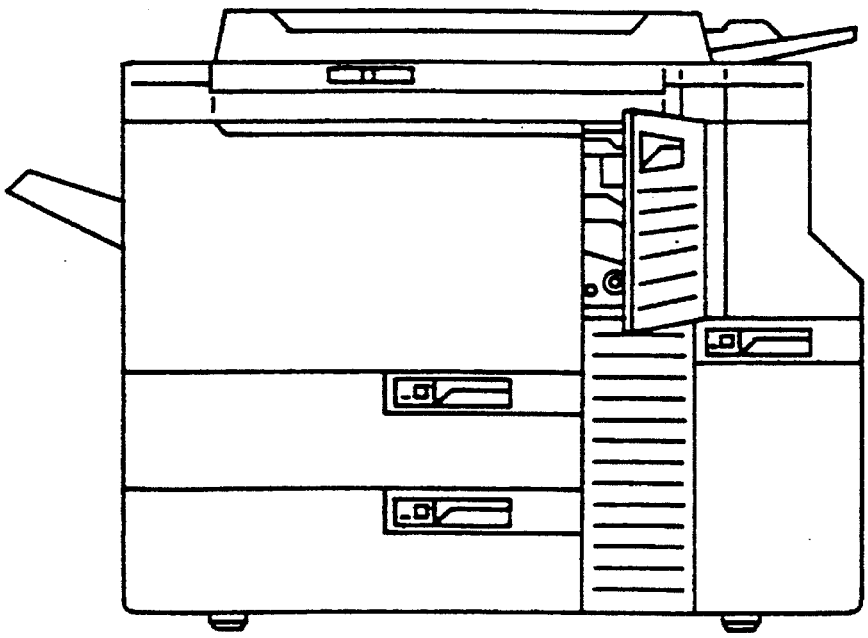
FIG. 17 is an explanatory drawing which shows a cell 2 for displaying the door open guidance.
Figure 18:
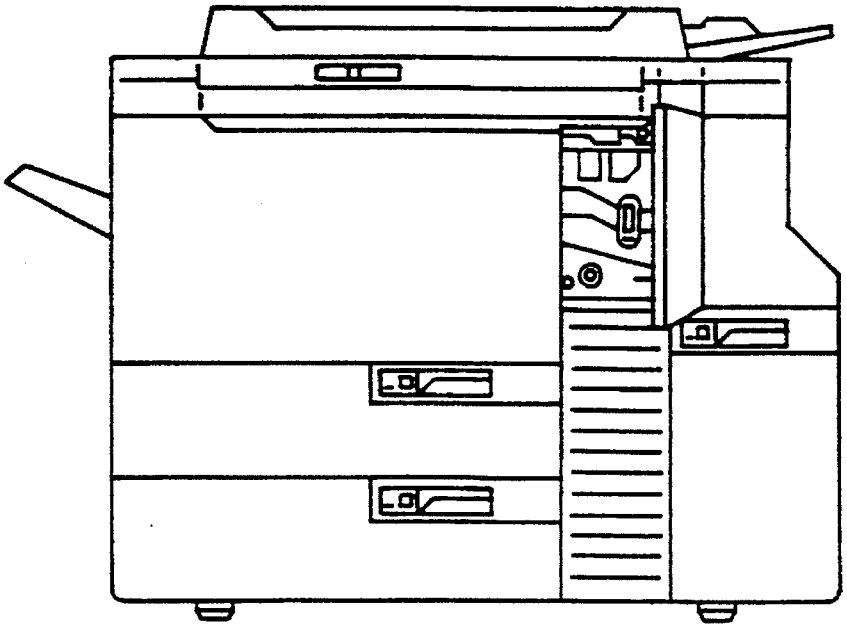
FIG. 18 is an explanatory drawing which shows a cell 3 for displaying the door open guidance.
Figure 19:
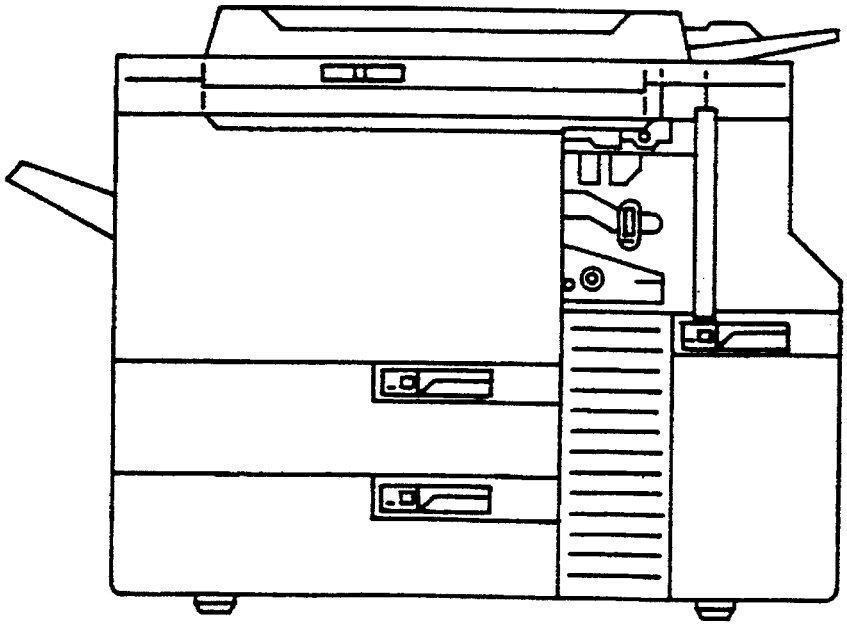
FIG. 19 is an explanatory drawing which shows a cell 4 for displaying the door open guidance.
Figure 20:
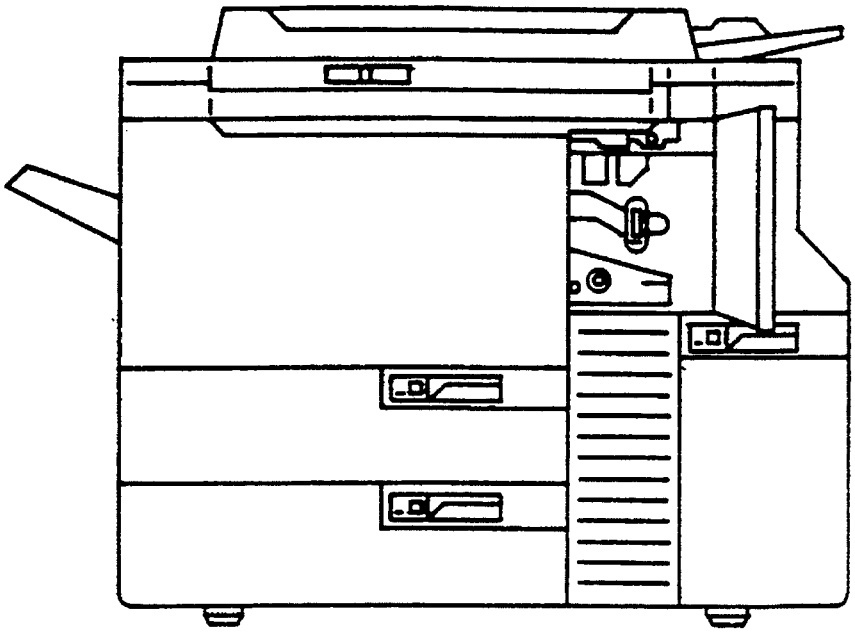
FIG. 20 is an explanatory drawing which shows a cell 5 for displaying the door open guidance.
Figure 21:
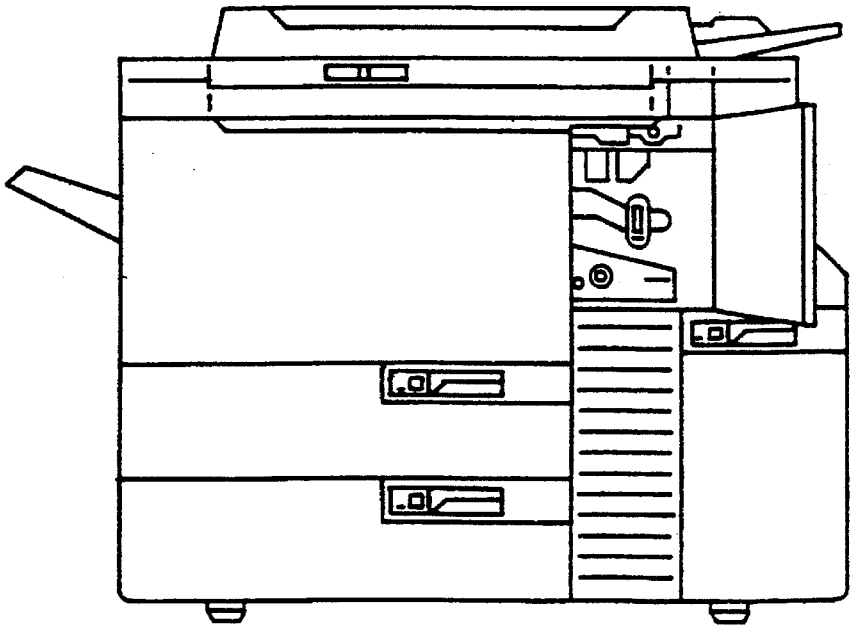
FIG. 21 is an explanatory drawing which shows a cell 6 for displaying the door open guidance.
Figure 22:
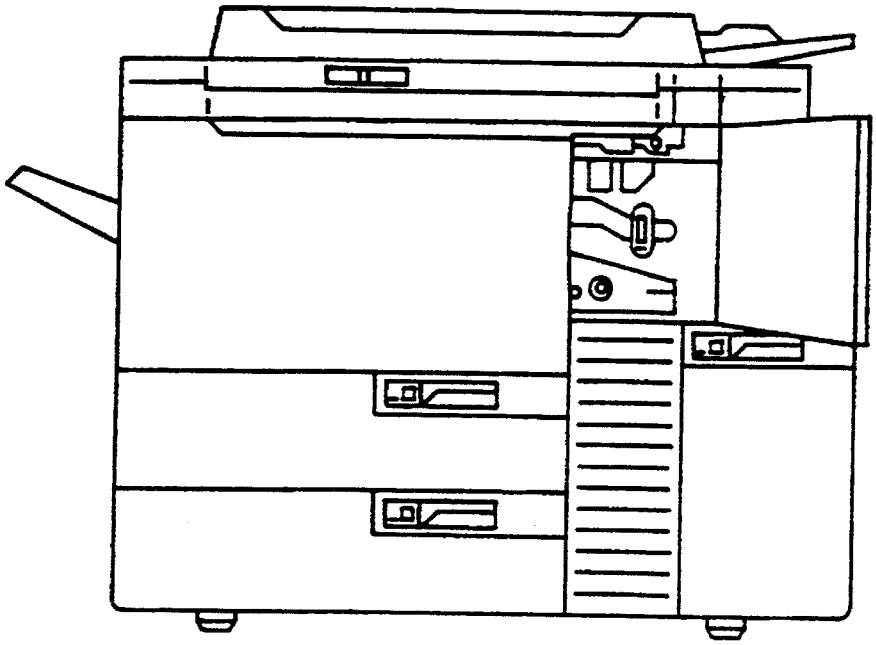
FIG. 22 is an explanatory drawing which shows a cell 7 for displaying the door open guidance.
Figure 23:
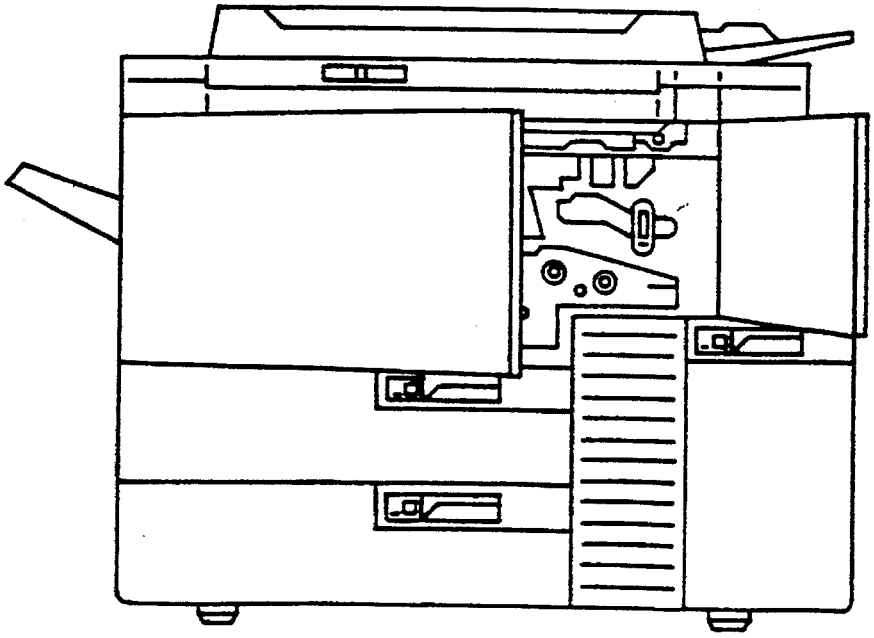
FIG. 23 is an explanatory drawing which shows a cell 8 for displaying the door open guidance.
Figure 24:
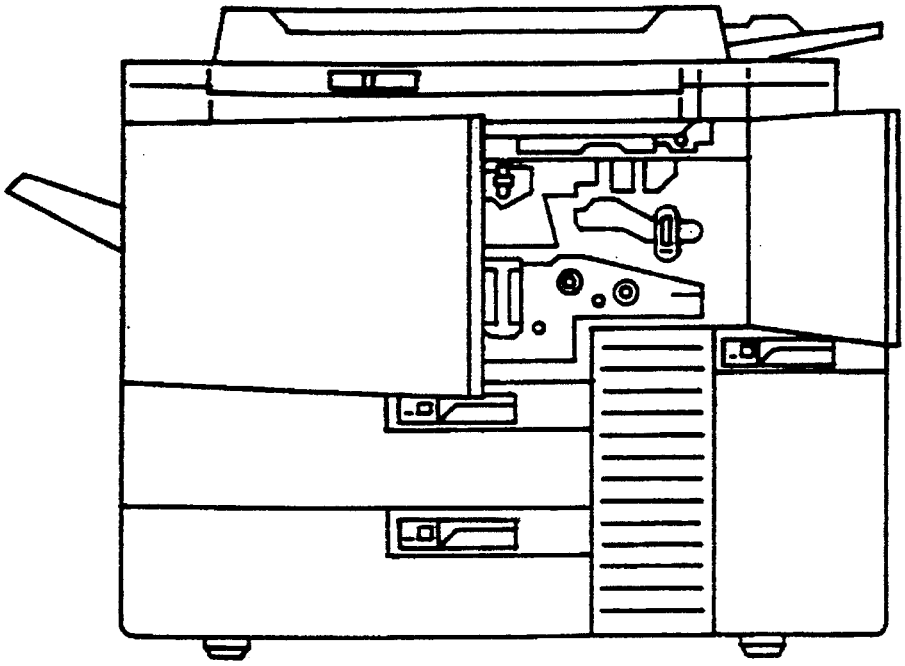
FIG. 24 is an explanatory drawing which shows a cell 9 for displaying the door open guidance.
Figure 25:
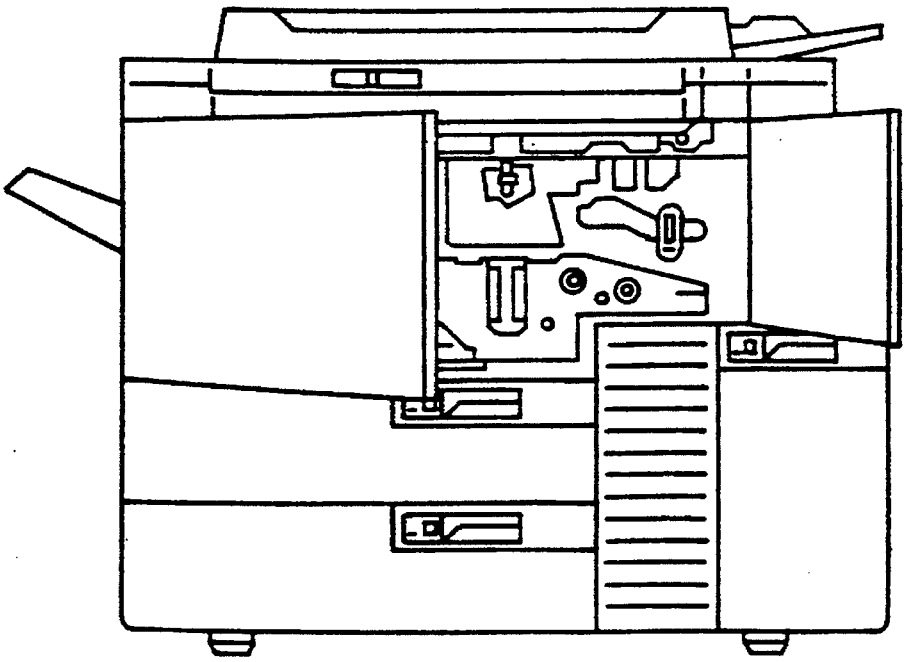
FIG. 25 is an explanatory drawing which shows a cell 10 for displaying the door open guidance.
Figure 26:
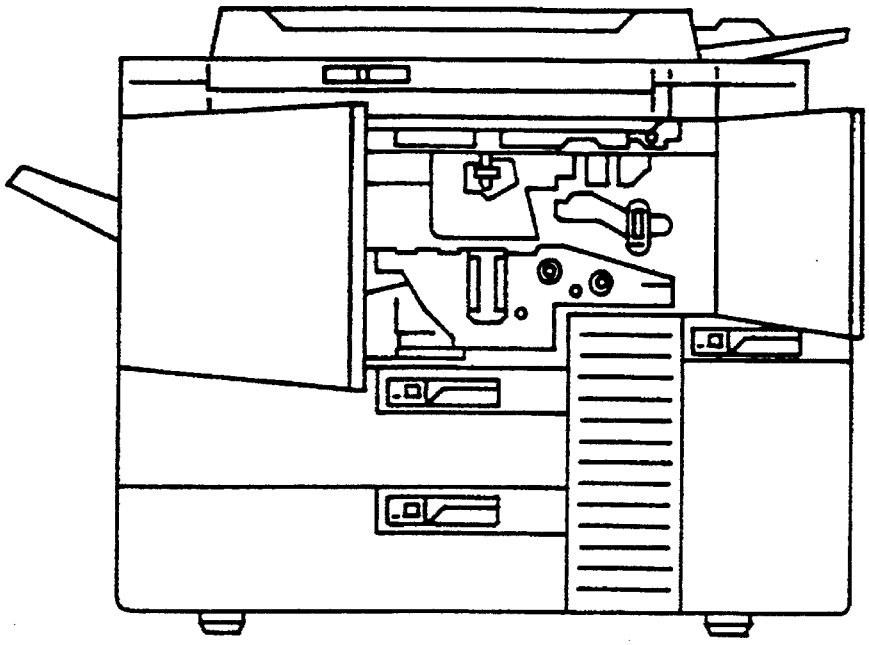
FIG. 26 is an explanatory drawing which shows a cell 11 for displaying the door open guidance.
Figure 27:
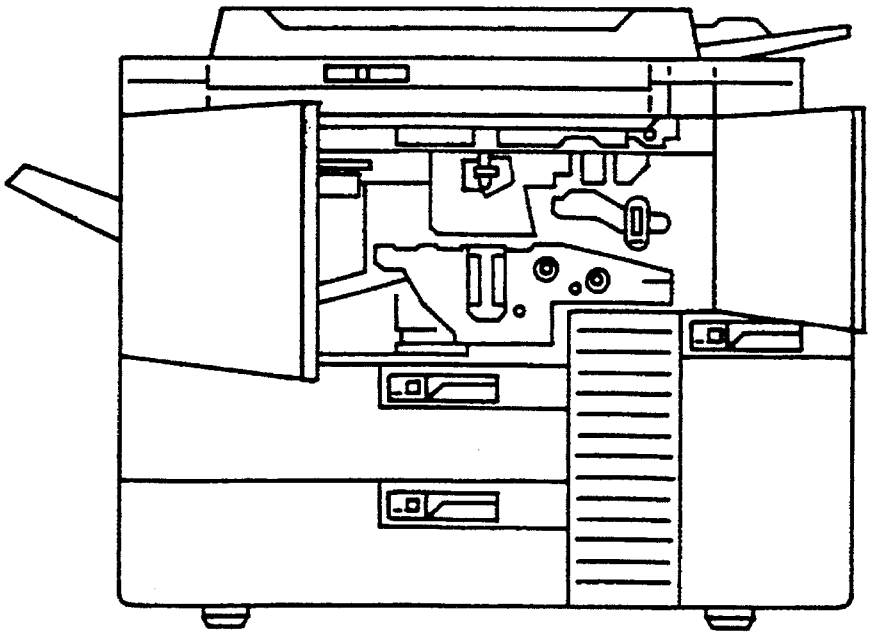
FIG. 27 is an explanatory drawing which shows a cell 12 for displaying the door open guidance.
Figure 28:
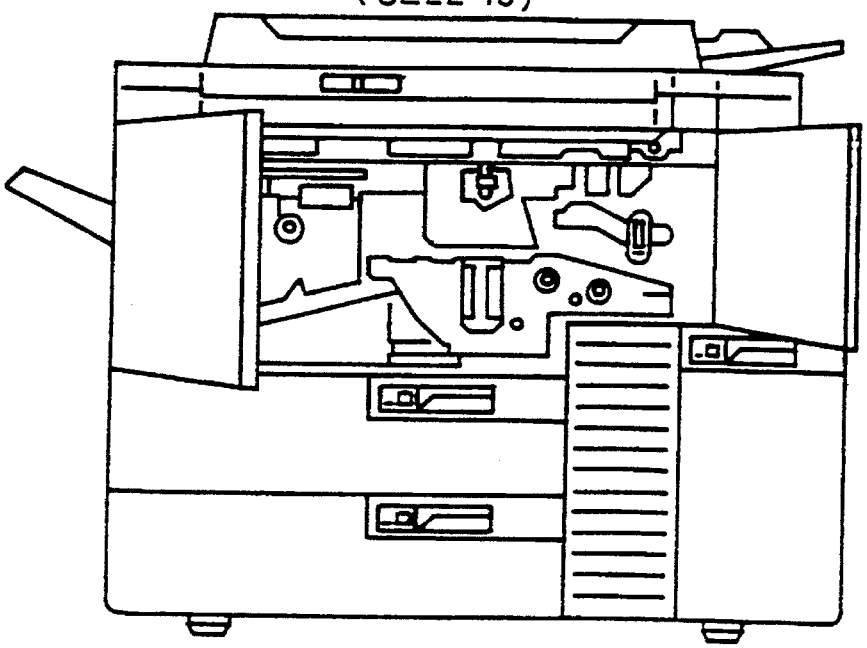
FIG. 28 is an explanatory drawing which shows a cell 13 for displaying the door open guidance.
Figure 29:
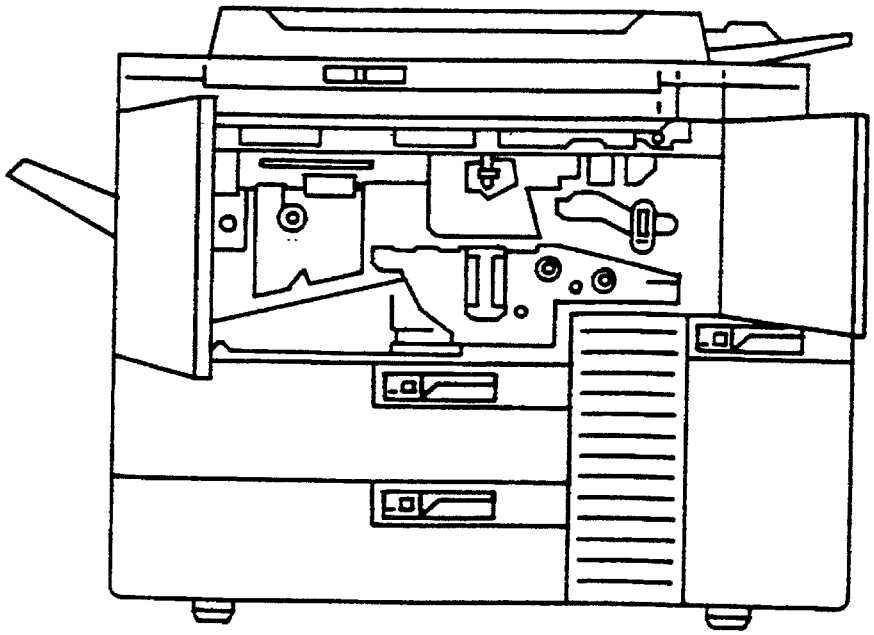
FIG. 29 is an explanatory drawing which shows a cell 14 for displaying the door open guidance.
Figure 30:
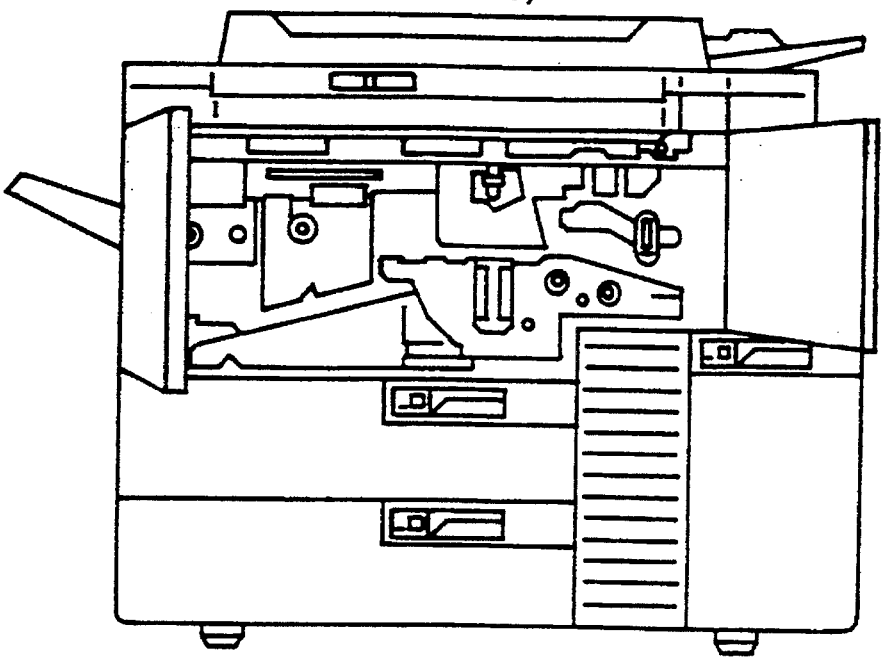
FIG. 30 is an explanatory drawing which shows a cell 15 for displaying the door open guidance.
Figure 31:
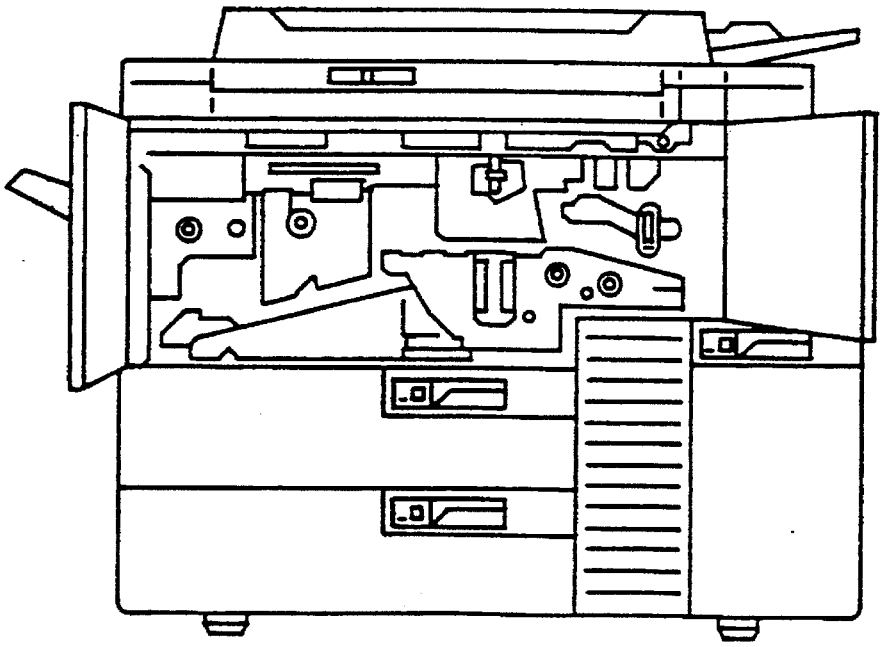
FIG. 31 is an explanatory drawing which shows a cell 16 for displaying the door open guidance.
Figure 32:
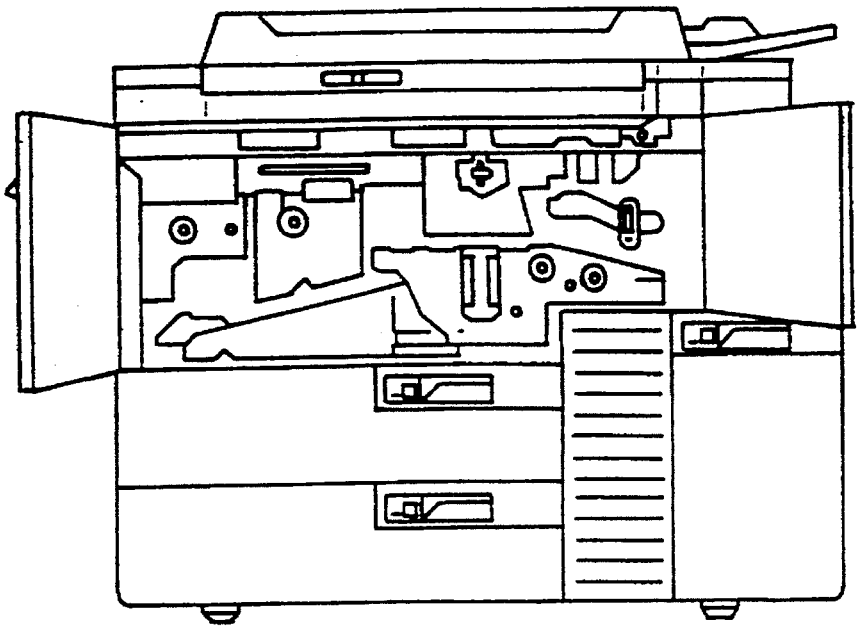
FIG. 32 is an explanatory drawing which shows a cell 17 for displaying the door open guidance.
Figure 33:
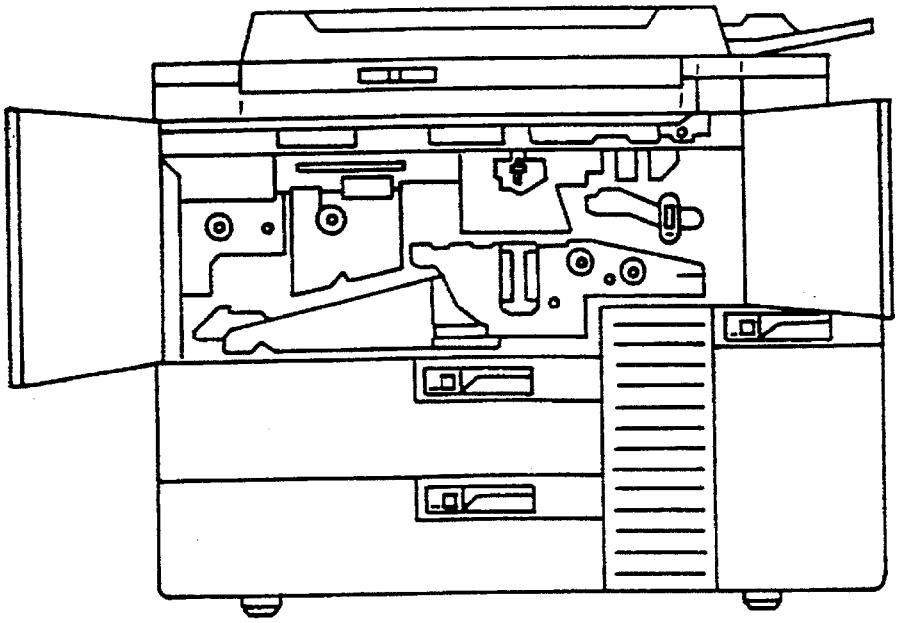
FIG. 33 is an explanatory drawing which shows a cell 18 for displaying the door open guidance.

When the operation guide key 105 is turned ON in this state by an operator, display of the LCD 102 is switched to display of a door open guidance (S3). This display shows a message of instructions that the first door 39 and the second door 40 shown in FIG. 6 are open, and a dynamic image which represents an opening operation of the first door 39 and the second door 40 as shown in FIG. 15.

This dynamic image is an image for showing the opening operation of the first door 39 and the second door 40 as graphics and an image which is obtained by animating cells 1 through 18 shown in FIGS. 16 through 33 by a transition time t. In order to display the dynamic image, data representing an outline of a copying apparatus as well as the cells which are used for a dynamic image of open/close operations of doors are stored in the program ROM 141. The program ROM 141 is controlled so that only a portion of a door in operation is rewritten by a program. Here, as to a value of the transition time t, about 70 to 200 ms mentioned above is suitable so as to obtain a smooth dynamic image.

Next, when the progressive key 103 is turned ON, jam guidance in a portion where sheets exist is shown on the LCD 102. The jam guidance shows procedures for removing sheets which exist in this portion as a message which shows the procedures and a dynamic image of a section which should be operated. The dynamic image is displayed by the same operation as of the above-mentioned door open guidance. Moreover, the jam guidance of each section where sheets remain is successively switched every time the progressive key 103 is turned ON.

In the present embodiment, as shown in FIG. 13, as each jam guidance, besides the door open guidance, reverse pass system guidance (S4) for removing sheets remaining in a reverse pass system including the carrying switch section 32, namely, for removal of jam, sheet feeding tray guidance (S5) for removal of jam on the manual sheet feeding tray 26, fixing/discharge unit guidance (S6) for the removal of jam in the fixing unit 21 and a discharge section therein which constitute one unit, sheet carrying unit guidance (S7) for removal of jam in the reverse carrying path 34 and the carrying path 30 which constitute one unit, guidance for double-surface unit including the intermediate tray 37 (S8), and a sorter guidance (S9) for removal of jam in a sorter in the case where the sorter is provided to the discharge tray 36 are set.

Figure 34:
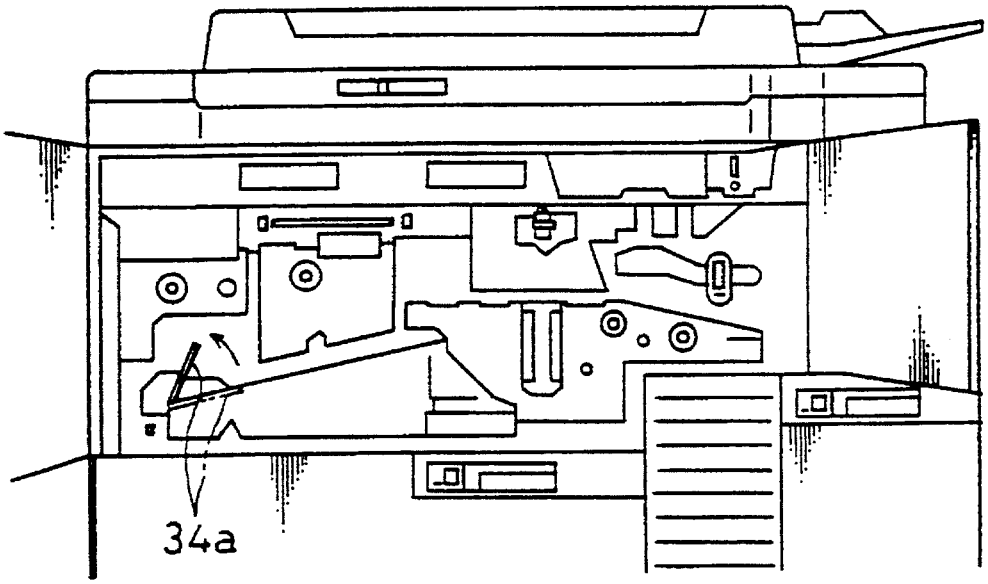
FIG. 34 is an explanatory drawing of a dynamic image display in reverse pass system guidance shown in FIG. 13.

For example, the reverse pass system guidance of S4 shows a message which designates an opening operation of a sheet guide 34*a* shown in FIG. 34. Moreover, as shown in the drawing, the reverse pass system guidance of S4 shows a dynamic image representing the opening operation of the sheet guide 34*a* obtained by enlarging only an upper section of the copying apparatus main body 1 in a state that the first and second doors 39.40 are opened.

Figure 35:
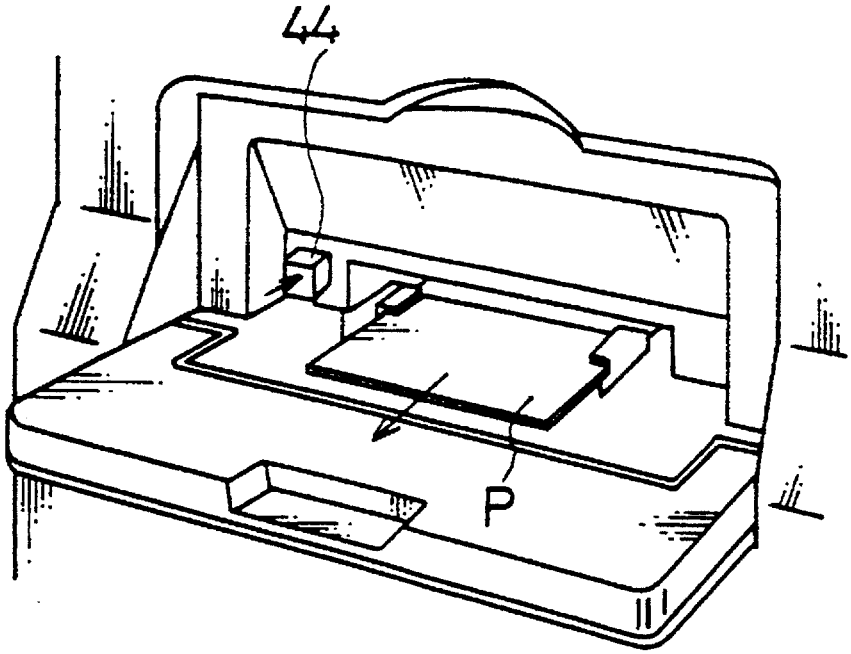
FIG. 35 is an explanatory drawing of a dynamic image display in sheet supplying tray guidance shown in FIG. 13.

In addition, the sheet feeding tray guidance of S5 shows, for example, messages which designate a pressing operation of a pressure release button 44 shown in FIG. 35 and a pulling-out operation of sheets P. Moreover, as shown in the drawing, the sheet feeding tray guidance of S5 shows dynamic images which represent an moving operation of the pressure release button 44 to a pressing-down direction and a moving operation of sheets P to a pulling-out direction.

Figure 36:
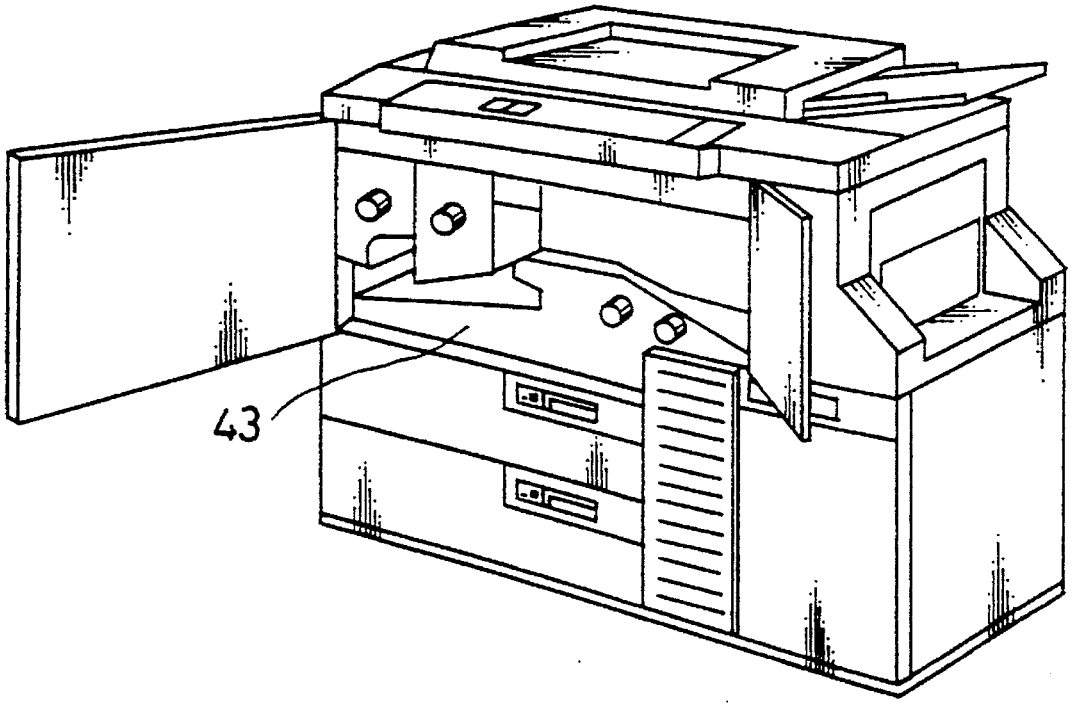
FIG. 36 is an explanatory drawing of dynamic image display in sheet carrying unit guidance shown in FIG. 13.

In addition, the sheet carrying unit guidance of S7 shows a message which designates a pulling-out operation of the carrying unit 43 shown in FIG. 36 from the copying apparatus main body 1. Moreover the sheet carrying unit guidance of S7 shows a dynamic image representing a pulling-out operation of the carrying unit 43 from the copying apparatus main body 1 which is states from of FIG. 36 through FIG. 37 to FIG. 38.

If sheets remain after each guidance is displayed by an operation of the progressive key 103, each jam guidance can be displayed again successively by the operation of the progressive key 103. Moreover, when the operation guide key 105 is turned ON again, the display of the LCD 102 is returned to the jam silhouette of S2.

Figure 39:
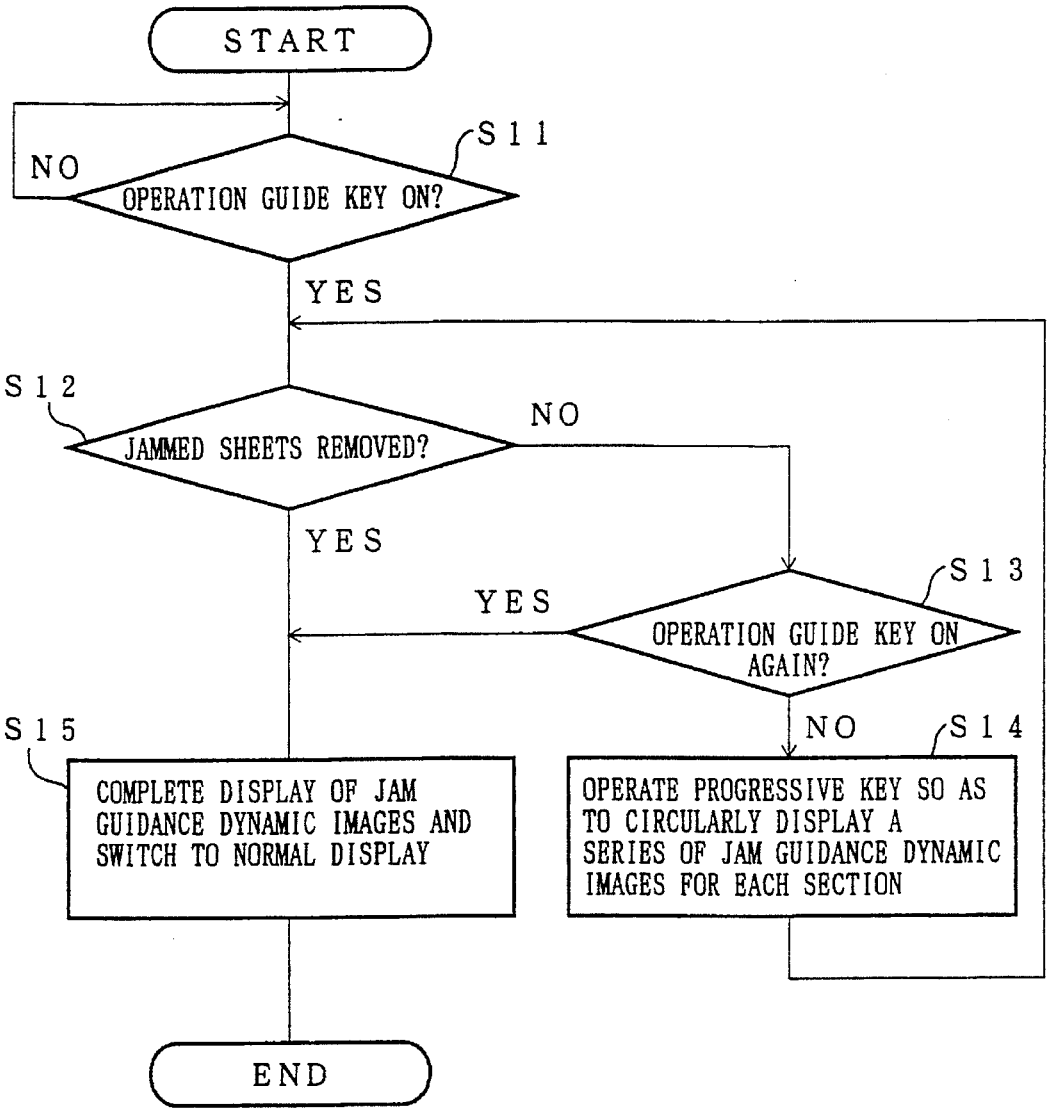
FIG. 39 is a flow chart of jam guidance which shows all operations shown in FIG. 13.

The above displaying operations are shown in FIG. 39 as a flow chart. In other words, when the operation guide key 105 is turned ON (S11) after occurrence of jam, if removal of jammed sheets is not completed (S12), a series of the jam guidance shown by a dynamic image for removal of sheets in each sheet remaining section are successively displayed on the LCD 102 according to the operation of the progressive key 103 (S14). Thereafter, when the removal of remaining sheets is completed (S12) or the operation guide key 105 is turned ON again (S13), display of the jam guidance is ended and a normal image is displayed (S15).

The above normal image at S15 is the jam silhouette. Moreover, judgement as to the completion of removal of jammed sheets at S 12 may be made based upon an ON operation of the door switches $Sb_1$.$Sb_2$ by the closing operation of the first and second doors 39.40.

Figure 40:
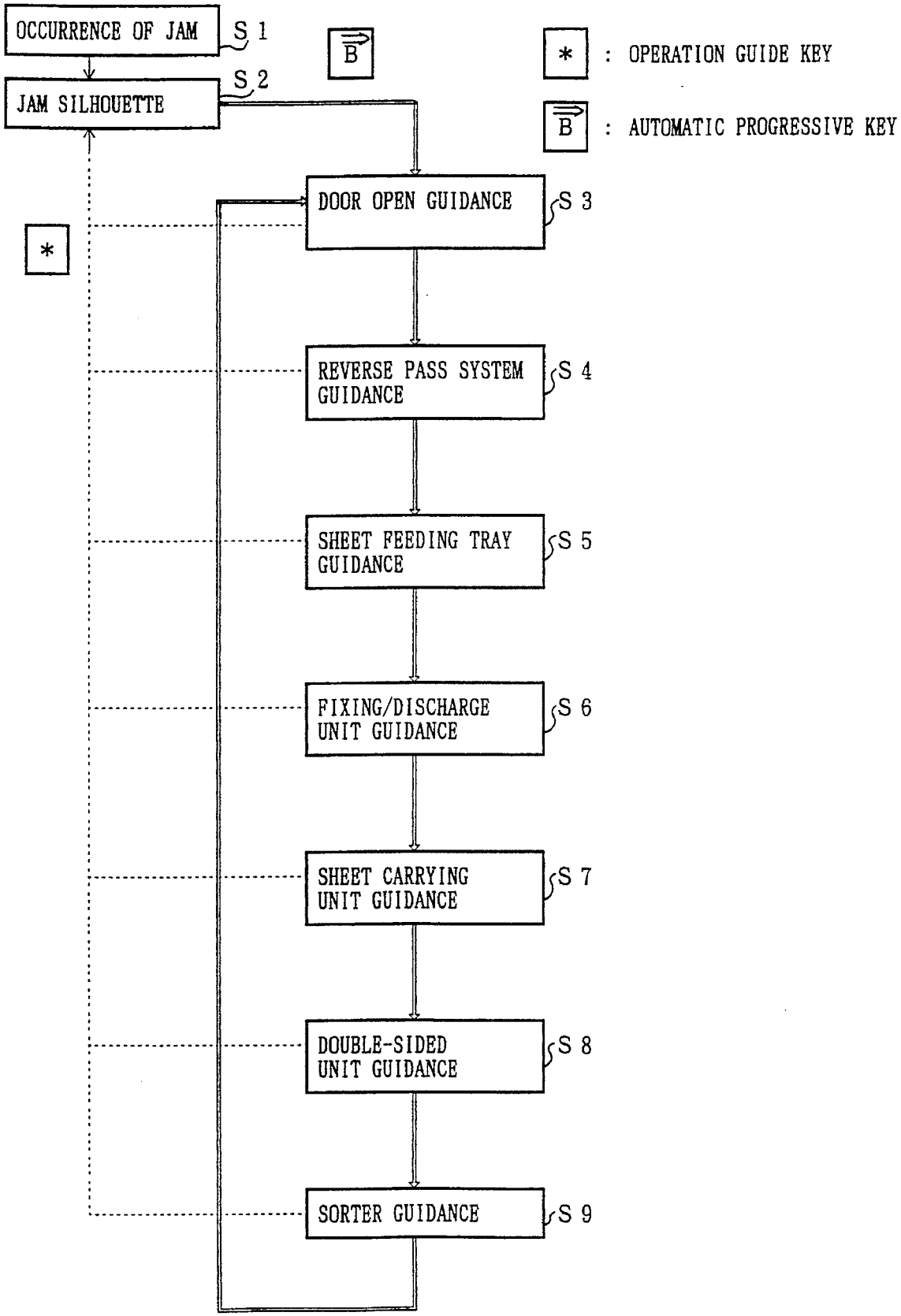
FIG. 40 is a schematic flowchart showing a display operation by manipulation of the automatic progressive key shown in FIG. 4, which is a jam guidance display operation by a jam removing procedure display apparatus in accordance with the above embodiment.
Figure 41:
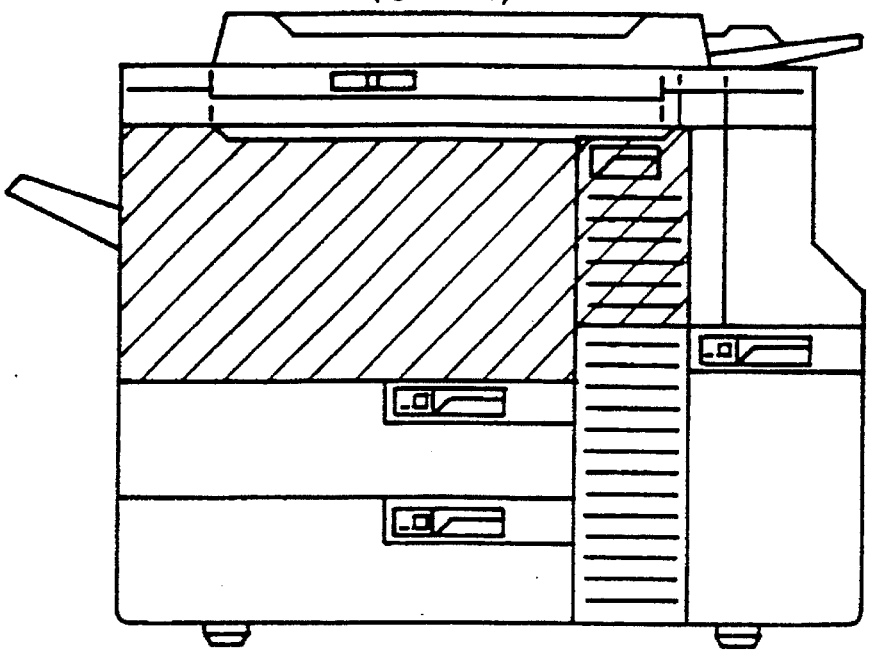
FIG. 41 is a view explaining a cell 1 for performing door open guidance display by a jam removing procedure display apparatus in accordance with another embodiment of the present invention.
Figure 42:
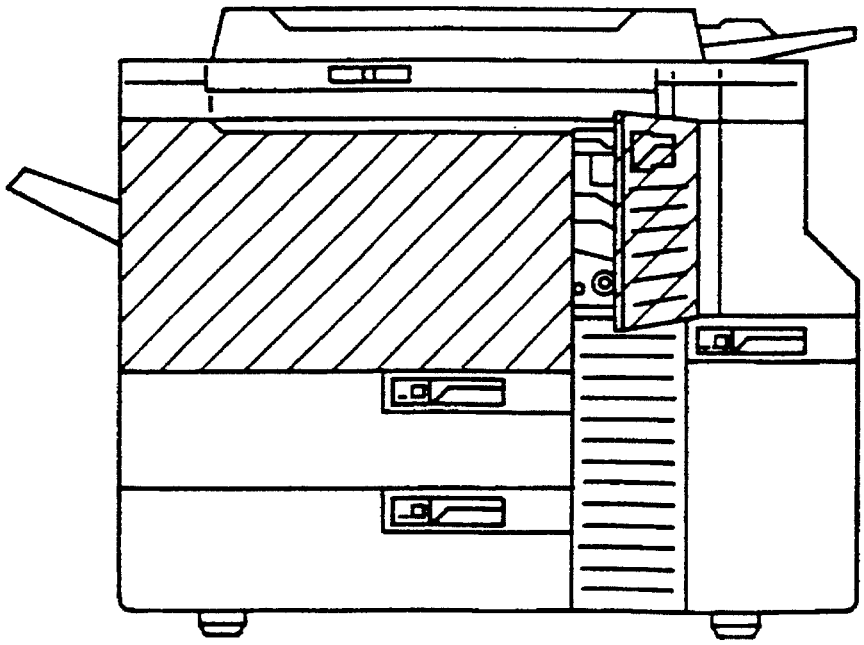
FIG. 42 is a view explaining a cell 2 for performing the door open guidance display by the jam removing procedure display apparatus of the above embodiment.
Figure 43:
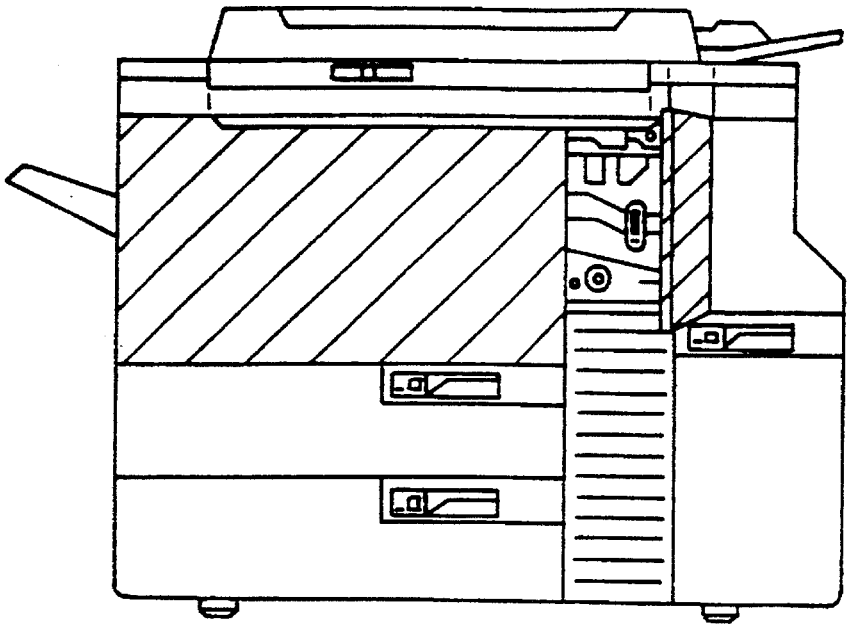
FIG. 43 is a view explaining a cell 3 for performing the door open guidance display by the jam removing procedure display apparatus of the above embodiment.
Figure 44:
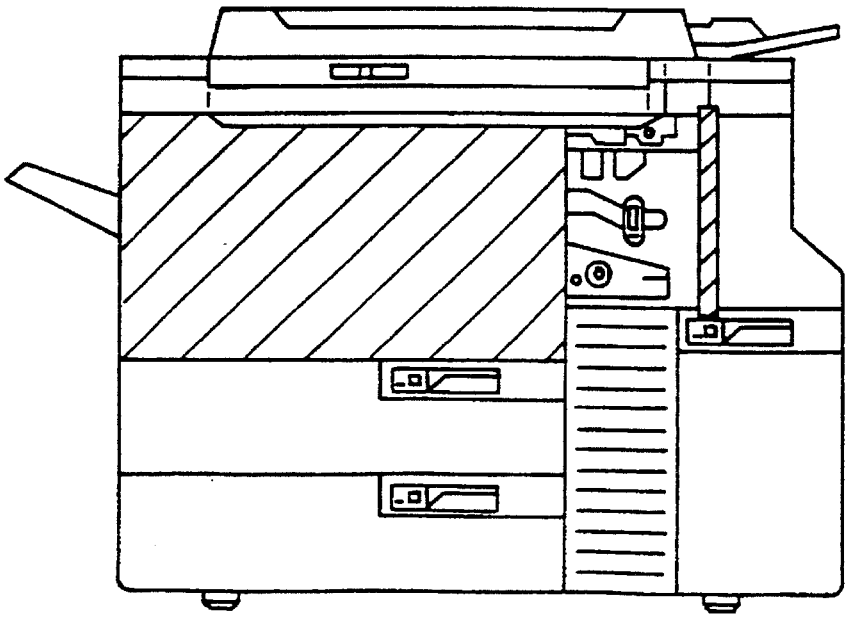
FIG. 44 is a view explaining a cell 4 for performing the door open guidance display by the jam removing procedure display apparatus of the above embodiment.
Figure 45:
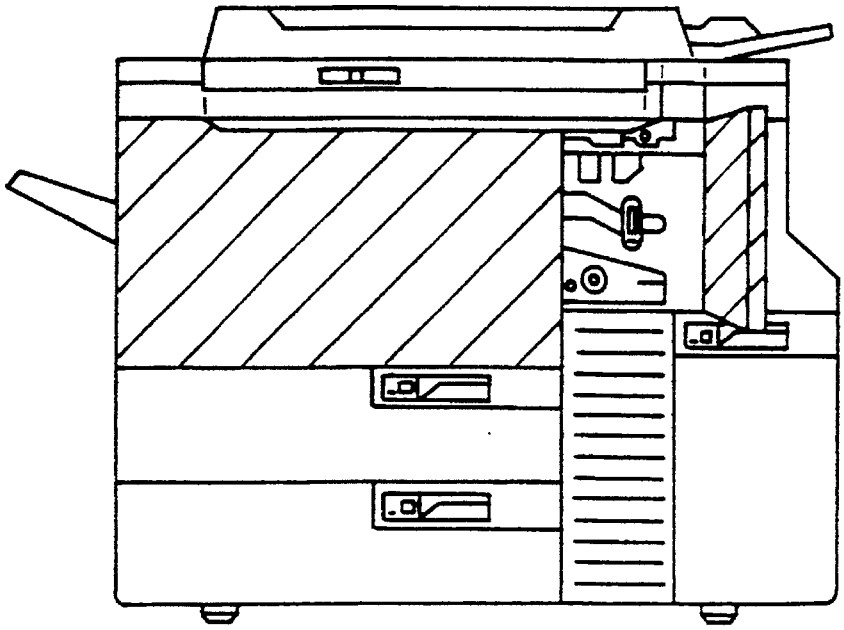
FIG. 45 is a view explaining a cell 5 for performing the door open guidance display by the jam removing procedure display apparatus of the above embodiment.
Figure 46:
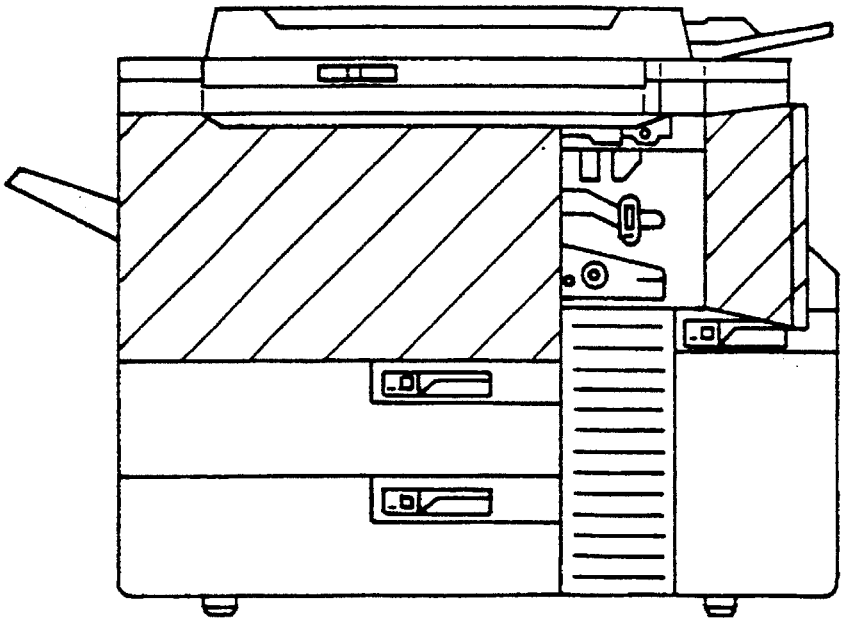
FIG. 46 is a view explaining a cell 6 for performing the door open guidance display by the jam removing procedure display apparatus of the above embodiment.
Figure 47:
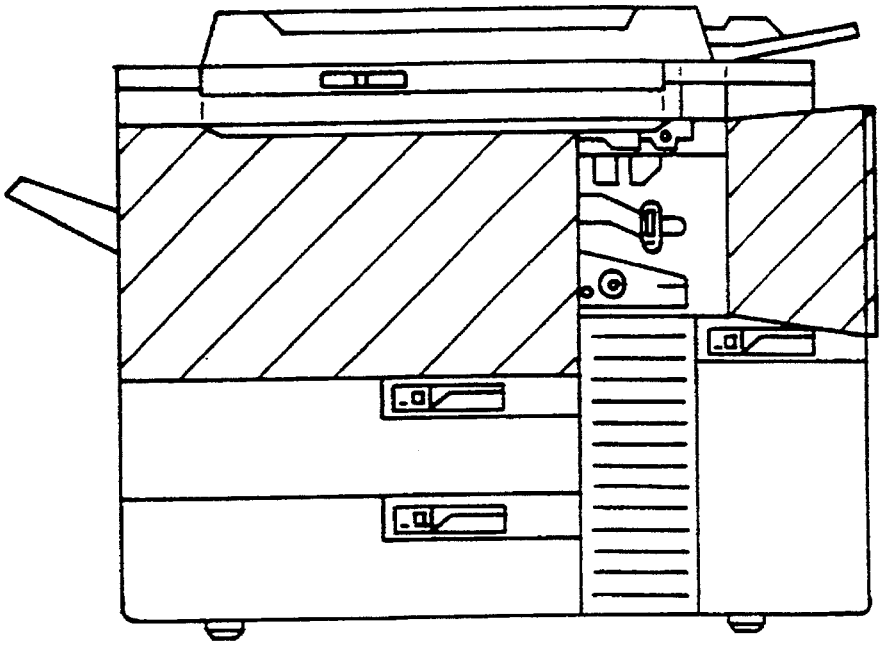
FIG. 47 is a view explaining a cell 7 for performing the door open guidance display by the jam removing procedure display apparatus of the above embodiment.
Figure 48:
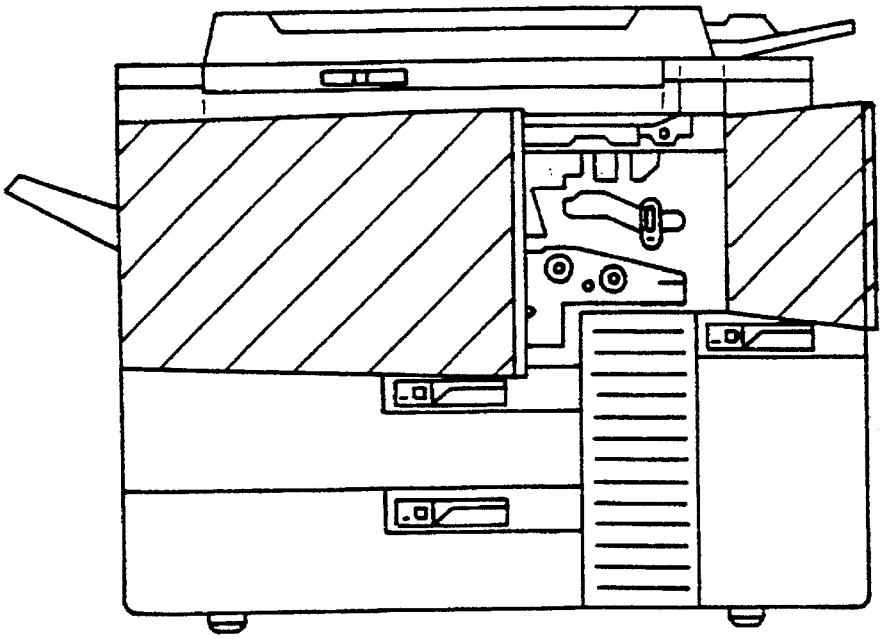
FIG. 48 is a view explaining a cell 8 for performing the door open guidance display by the jam removing procedure display apparatus of the above embodiment.
Figure 49:
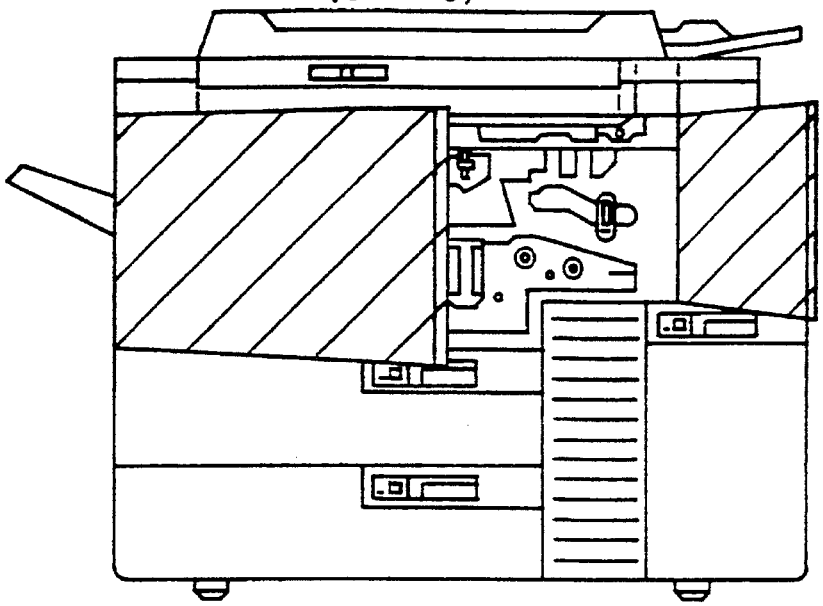
FIG. 49 is a view explaining a cell 9 for performing the door open guidance display by the jam removing procedure display apparatus of the above embodiment.
Figure 50:
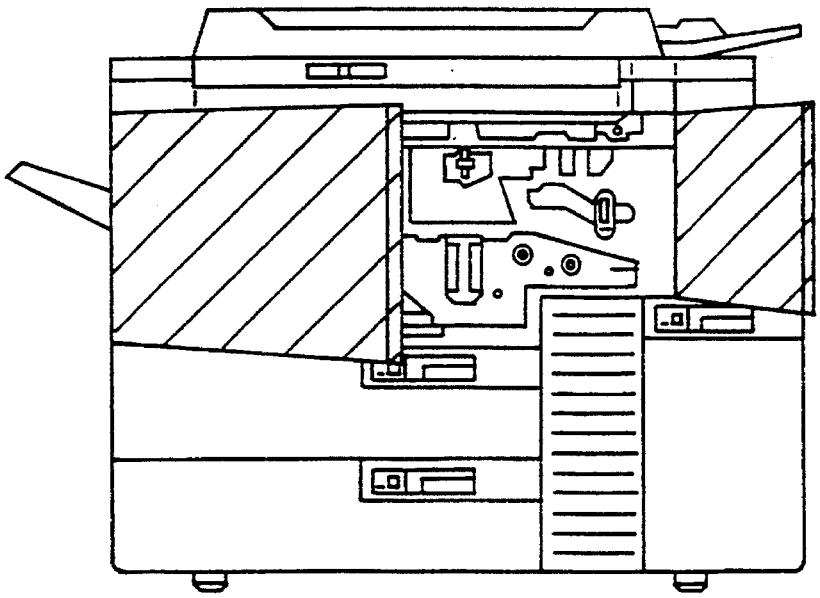
FIG. 50 is a view explaining a cell 10 for performing the door open guidance display by the jam removing procedure display apparatus of the above embodiment.
Figure 51:
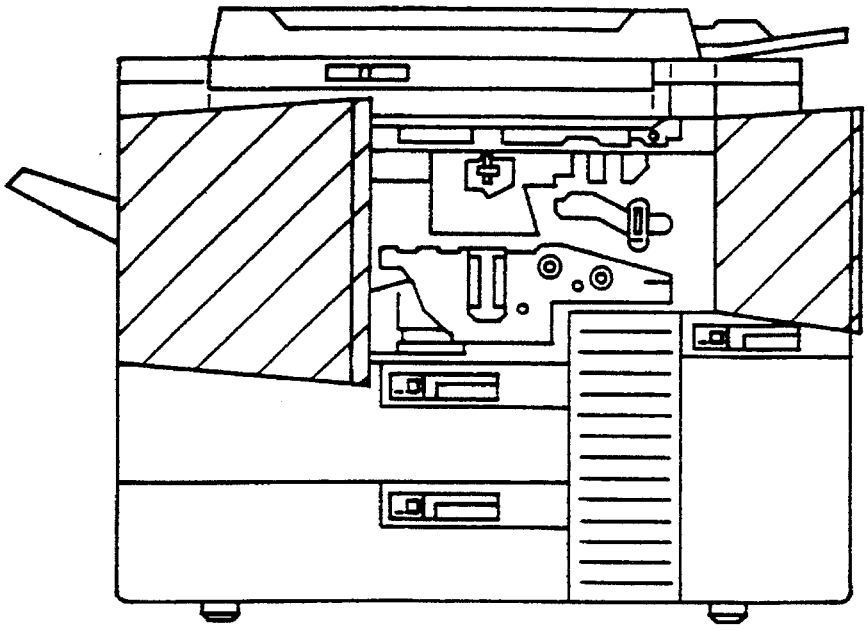
FIG. 51 is a view explaining a cell 11 for performing the door open guidance display by the jam removing procedure display apparatus of the above embodiment.
Figure 52:
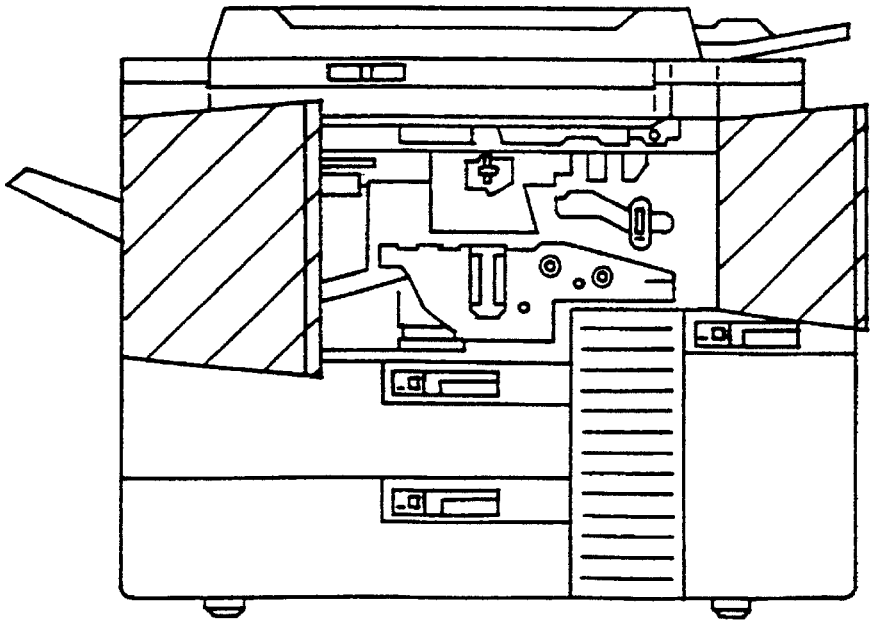
FIG. 52 is a view explaining a cell 12 for performing the door open guidance display by the jam removing procedure display apparatus of the above embodiment.
Figure 53:
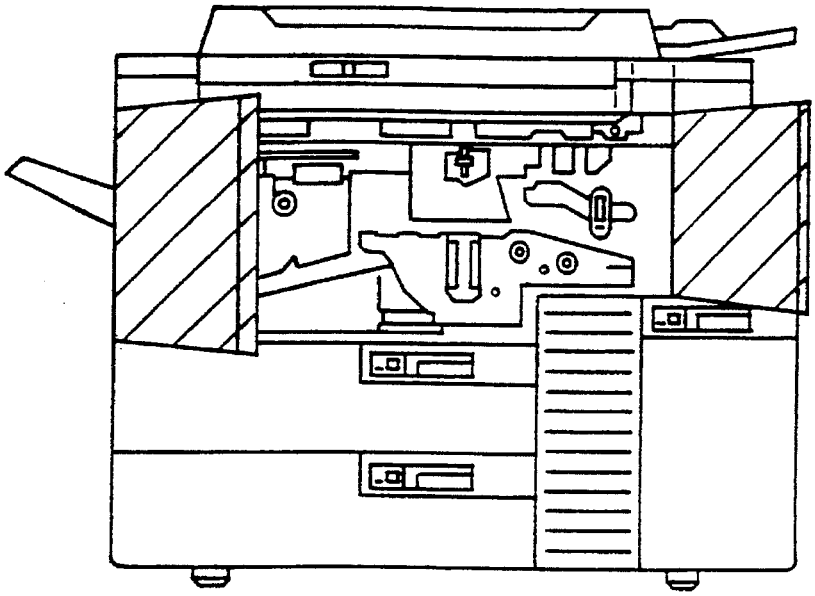
FIG. 53 is a view explaining a cell 13 for performing the door open guidance display by the jam removing procedure display apparatus of the above embodiment.
Figure 54:
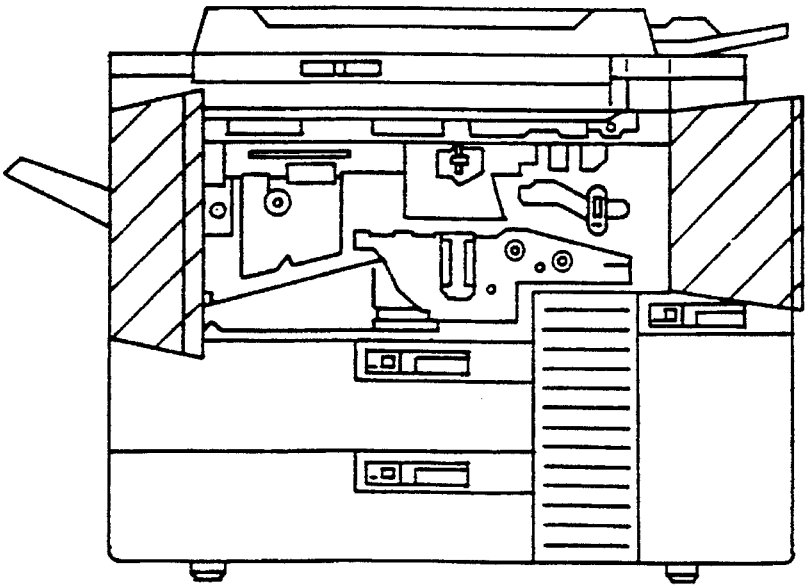
FIG. 54 is a view explaining a cell 14 for performing the door open guidance display by the jam removing procedure display apparatus of the above embodiment.
Figure 55:
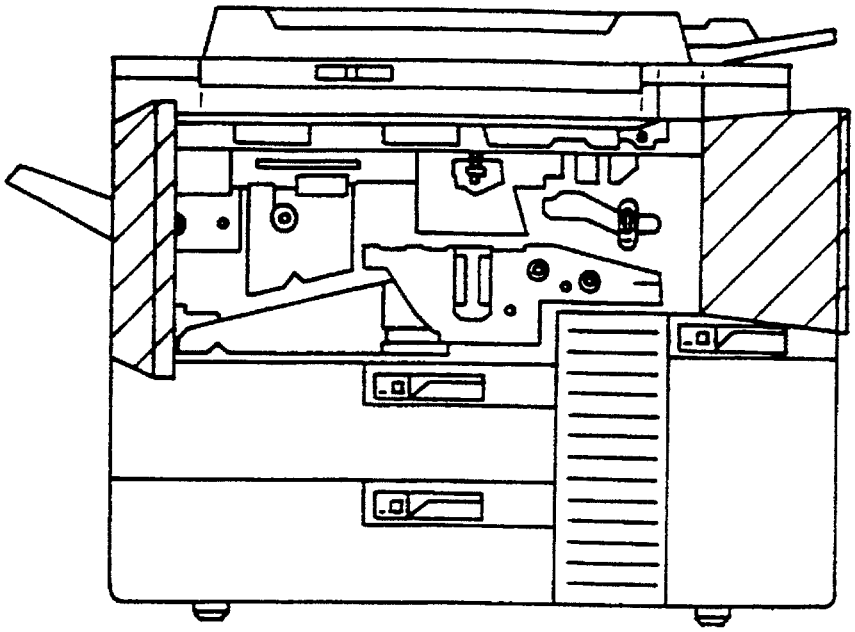
FIG. 55 is a view explaining a cell 15 for performing the door open guidance display by the jam removing procedure display apparatus of the above embodiment.
Figure 56:
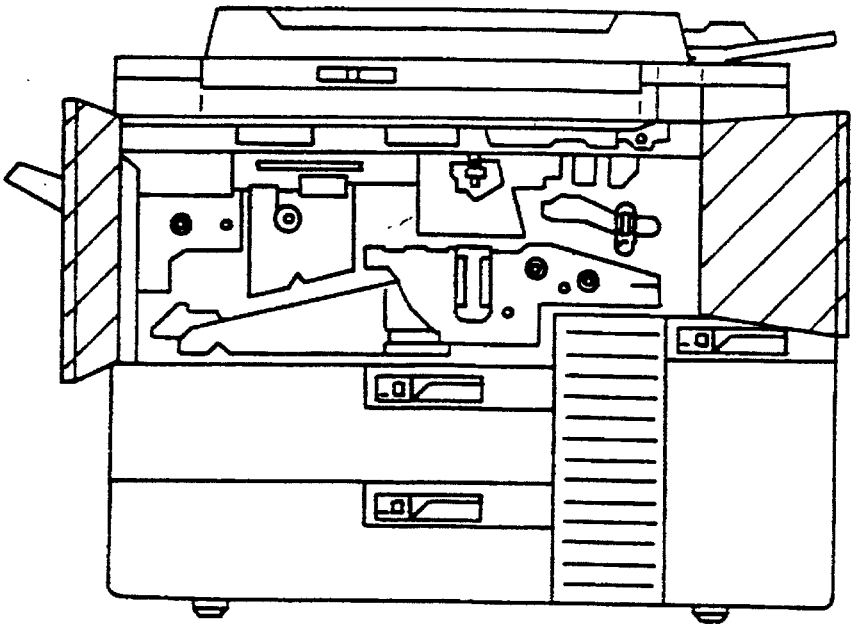
FIG. 56 is a view explaining a cell 16 for performing the door open guidance display by the jam removing procedure display apparatus of the above embodiment.
Figure 57:
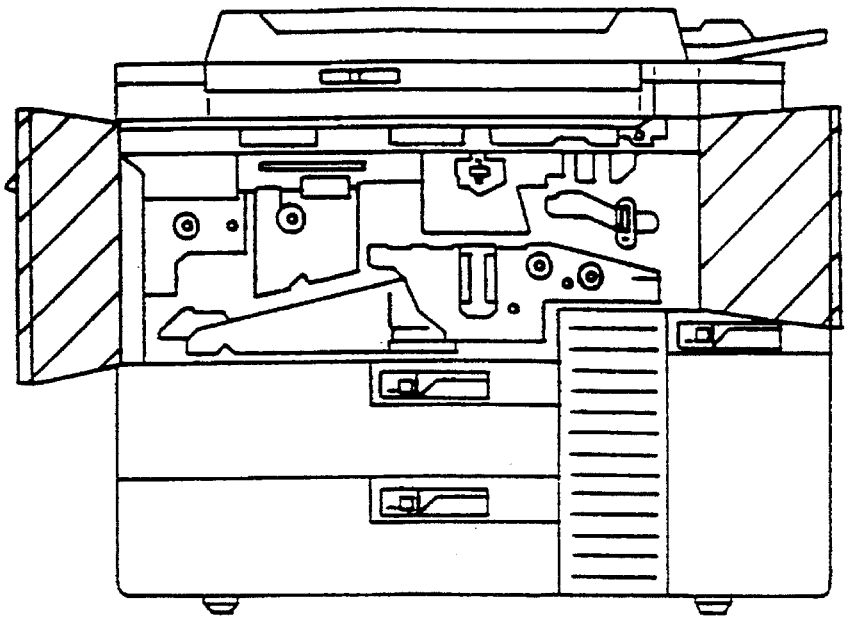
FIG. 57 is a view explaining a cell 17 for performing the door open guidance display by the jam removing procedure display apparatus of the above embodiment.
Figure 58:
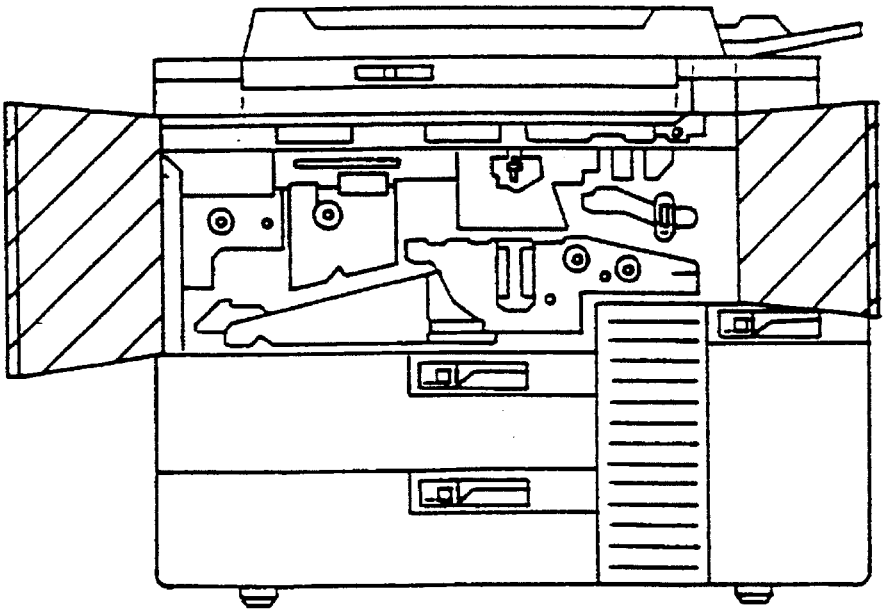
FIG. 58 is a view explaining a cell 18 for performing the door open guidance display by the jam removing procedure display apparatus of the above embodiment.

In addition, in the copying apparatus, as shown in FIG. 40, when jam occurs (S1) and a jam silhouette is displayed (S2), the automatic progressive key 104 is turned ON. Then, among the door open guidance (S3) through the sorter guidance (S9), jam guidance in a section where sheets remain is successively and automatically switched so as to be displayed. In this case, each jam guidance is automatically and circularly displayed until the operation guide key 105 is turned ON. When the operation guide key 105 is turned ON, display of the LCD 102 is switched to a normal image, namely, the jam silhouette.

As mentioned above, in the jam removing procedure display apparatus of the copying apparatus, since moving operations of each section for removal of jam is displayed as a dynamic image, a portion which should be operated and a way of operating this portion become clear. Moreover, since the procedures for removing jam are successively displayed, all the procedures for removing jam in respective jam positions can be easily grasped. Therefore, in the case where an operator is inexperienced in a copying apparatus, even if a copying apparatus where a complicated operation is required for the removal of jam or a copying apparatus where the procedures for the removal of jam is hard to understand is used, jam can be easily and safely removed.

In addition, in the case where the jam guidance in jam positions is successively switched by the operation of the progressive key 103, the jam guidance can be displayed according to progress of the procedure for removing jam in each jam position. Therefore, the procedure for removing jam in respective jam positions is easily grasped, so the operator can perform a secure operation.

In addition, after occurrence of jam, in the case where the automatic progressive key 104 is operated, since procedures for removing jam in all positions where jam occurred are automatically and successively displayed, an operator can previously grasp all operations which should be performed for removing jam. Therefore the operator can remove jam safely and efficiently without feeling uneasiness.

Here, the present embodiment described only the jam guidance of the copying apparatus main body 1, but similarly, the arrangement of the present embodiment also makes it possible to display jam guidance of the RDH 2.

Embodiment 2

The following will discuss another embodiment of the present invention referring to FIGS. 1, 6, 13, 15, 36 through 38 and 40. Here, for convenience of explanation, those members that have the same arrangement and functions, and that are described in the aforementioned embodiment are indicated by the same reference numerals and the description thereof is omitted.

In a jam removing procedure display apparatus of the present embodiment, display of jam guidance in each jam position is automatically and successively switched to display which shows a next operation every time respective operations in procedures for removing jam are performed. In other words, in the case where the jam guidance is displayed, a portion which is displayed on an LCD 102 as a dynamic image is operated, and when this operation is detected by state sensors Sb.Sd, the dynamic image which has been previously displayed is switched to a dynamic image for a moving operation to be performed. Procedures for removing jam in a jam position are displayed by the above displaying operation.

In this case, a judgement is made by a CPU 125 of an operation controlling section 124 according to input from a main body section sensor Sb and a RDH section sensor Sd which are state sensors shown in FIG. 1 as to whether each operation in the procedures for removing jam exists or not. Next, when each operation is performed, a CPU 143 of a display controlling section 128 writes data of a message and a dynamic image which designate a next operation to V-RAMs 145.146. Successively, an LCD controller 150 reads out the data from the V-RAMs 145.146 through a CG-ROM 147 and a graphic ROM 148 so as to display the data on the LCD 102.

The following will describe the above displaying operation in the case where a jam position is a carrying unit 43. In a state where opening operations of the first and second doors 39.40 shown in FIG. 15 are displayed on the LCD 102, when being performed, the operations are detected by door switches $Sb_1.Sb_2$ shown in FIG. 6. As a result, display of the LCD 102 is switched to a moving operation of the carrying unit 43 shown in FIGS. 36 and 37. Next, when the moving operation is performed, the operation is detected by a carrying unit draw detecting switch $Sb_7$ shown in FIG. 6. As a result, display of the LCD 102 is switched to an opening operation of a cover shown in FIG. 38. This makes it possible to remove sheets from an inside of the carrying unit 43.

In the above-mentioned display of the jam guidance, since the display is automatically switched to a next operation after completion of the operation displayed on the LCD 102, procedures for operations becomes further comprehensible and an error in operation hardly occurs. As a result, even in the case where an operator is inexperienced in a copying apparatus, in the case of a copying apparatus which requires complicated procedures for removing jam, or in the case of a copying apparatus where procedures for removing jam are hard to understand, jam can be easily and safely removed.

In addition, from that point of view, when the display of the LCD 102 is the dynamic image, jam is easily removed, but even when a static image, jam can be removed satisfactorily. As to the display by a static image, for example, only a dynamic image cell which shows a final state in each moving operation may be displayed on the LCD 102.

Here, the above-mentioned operations for displaying jam guidance can be used by incorporating them in the operations for displaying jam guidance in the operating procedures shown in FIG. 13 or 40 in the aforementioned embodiment 1.

In addition, the present embodiment described only the display of the jam guidance of the copying apparatus main body 1, but the arrangement of the present embodiment also makes it possible to display jam guidance of the RDH2.

Embodiment 3

The following will discuss still another embodiment of the present invention referring to FIGS. 1, 13, 36 through 38 and 41 through 58. Here, for convenience of explanation, those members that have the same arrangement and functions, and that are described in the aforementioned embodiment are indicated by the same reference numerals and the description thereof is omitted.

In a jam removing procedure display apparatus of the present embodiment, in the case where the images of the jam guidance mentioned in the embodiments 1 and 2 are displayed, an operation designating section shown as a dynamic image to be operated by an operator is displayed in a different color from of the other non-operation designating section.

In order to perform the above operation, an LCD 102 shown in FIG. 1 can display an image in colors. Moreover, when display data stored in V-RAMs 145.146 are displayed on the LCD 102, an LCD controller 150 takes out display colors from a color palette 149 according to color information of the display data about a place displayed on the LCD 102 so as to display an image in colors.

The above-mentioned display operations of the door open guidance shown in FIG. 13 are shown in FIGS. 41 through 58. First and second doors 39.40 represented by slanted lines in the drawings are the operation designating section of the jam guidance. On the screen of the LCD 102, the slanted line portions are displayed in red, for example, and a shape of the copying apparatus other than the slanted line portions are displayed in black, for example.

Figure 37:
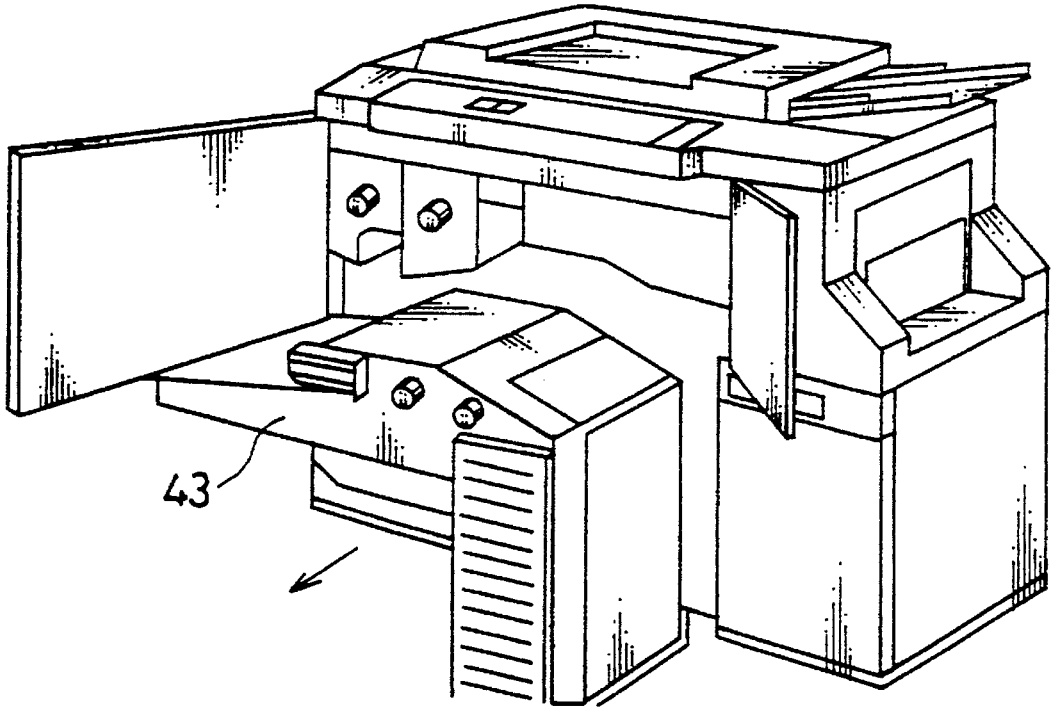
FIG. 37 is an explanatory drawing of dynamic image display following the dynamic image display shown in FIG. 36.
Figure 38:
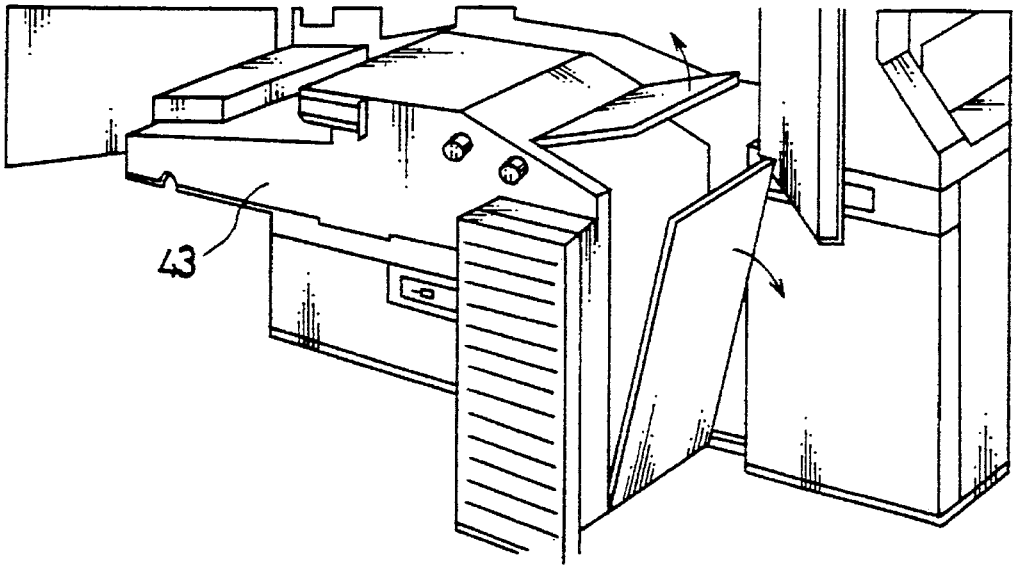
FIG. 38 is an explanatory drawing of dynamic image display following the dynamic image display shown in FIG. 37.

In addition, in the case where another jam guidance, for example, sheet feeding tray guidance shown in FIG. 35 is displayed, a pressure releasing button 44 and sheets P are shown by a same color, red, and a shape of the copying apparatus other than the above are displayed in black. Moreover, in the case where sheet carrying unit guidance shown in FIGS. 36 through 38 is displayed, a carrying unit 43 is displayed in red, and the shape of the copying apparatus other than the carrying unit 43 are displayed in black.

In the case of the above jam guidance display, an operation designating section which is operated at the time of removing jam and non-operation designating section other than the operation designating section are clearly distinguished so as to be displayed, so the procedures of operation becomes easier to understand for an operator, thereby making it possible to decrease errors in operation. As a result, even in the case where the operator is inexperienced in the copying apparatus, in the case of a copying apparatus which requires complicated operation for removing jam, or in the case of a copying apparatus where operations for removing jam are hard to understand, jam can be easily and safely removed.

Here, colors of the operation designating sections and the non-operation designating sections in the jam guidance display are not limited to red and black, so they can be suitably set. Moreover, the display of the operation designating section and the non-operation designating section in the jam guidance display may be clearly distinguished, so it is not limited to the above-mentioned display in different colors. Therefore, jam guidance may be displayed in different statuses, display by different shade, display by slanted line portions and non-slanted line portions, display by a blink and non-blink. In the case where such display is carried out, the LCD 102 may carry out only monochrome display.

Embodiment 4

Figure 59:
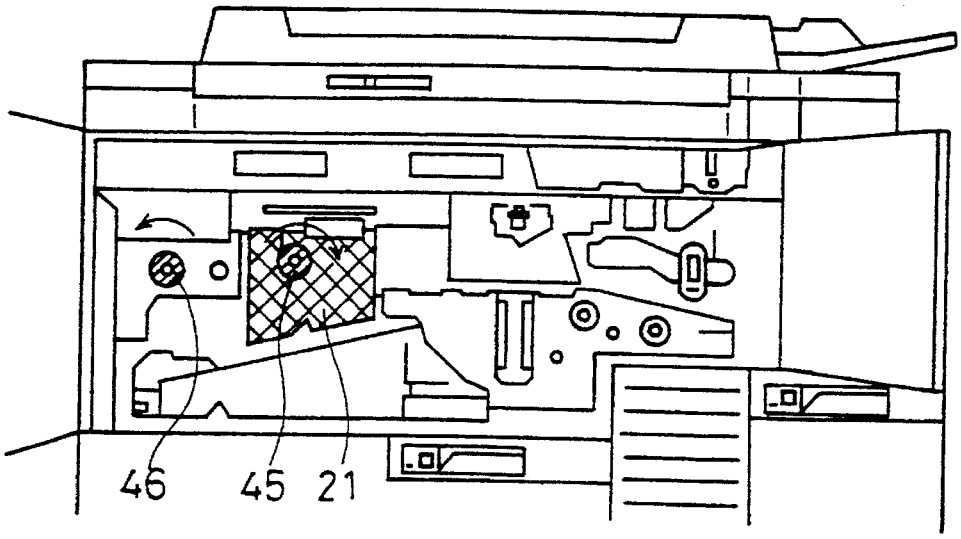
FIG. 59 is a view explaining a display example of a jam guidance display by a jam removing procedure display apparatus in accordance with another embodiment of the present invention.

The following will discuss still another embodiment of the present invention referring to FIGS. 1 and 59. Here, for convenience of explanation, those members that have the same arrangement and functions, and that are described in the aforementioned embodiment are indicated by the same reference numerals and the description thereof is omitted.

In a jam removing procedure display apparatus of the present embodiment, in the case where the jam guidance mentioned in the embodiment 1 or 2 is displayed, at least an operation designating section to be operated by an operator and an operation inhibit section are displayed in different colors.

In order to perform the above operation, an LCD 102 shown in FIG. 1 can carry out display in colors. Moreover, when display data stored in V-RAMs 145.146 are displayed on the LCD 102, an LCD controller 150 takes out display colors from a color palette 149 according to color information of the display data about a place displayed on the LCD 102 so as to display an image in colors.

The above-mentioned display example is shown in FIG. 59. Rotational operation knobs 45.46 which is slanted line portions in the drawing are operation designating sections, a body of equipment of a fixing unit 21 which is a meshed portion is a a place with a high temperature which should be cared, namely, an operation inhibit section. On a screen of the LCD 102, the slanted line portions are displayed in blue, for example, and a meshed portions is displayed in red, for example. Moreover, a shape of the copying apparatus other than the slanted line portions and the meshed portion is displayed in black, for example. Here, the rotational operation knob 45 rotates a fixing roller of the fixing unit 21 and the rotational operation knob 46 rotates a carrying roller.

In the case of the above-mentioned jam guidance display, since the operation designating section which is operated at the time of removing jam and the operation inhibit section are clearly distinguished so as to be displayed, an operator can accurately grasp and hardly make a mistake in operation. As a result, even in the case where the operator is inexperienced in the copying apparatus, in the case of a copying apparatus which requires complicated operations for removing jam, or in the case of a copying apparatus where operations for removing jam is hard to understand, jam can be easily and safely removed.

Here, colors of the operation designating sections and the operation inhibit sections in the jam guidance display are not limited to blue and red, so they can be suitably set. Moreover, the display of the operation designating section and the operation inhibit section in the jam guidance display may be clearly distinguished, so it is not limited to the above-mentioned display in different colors. Therefore, jam guidance may be displayed in different statuses, display by different shade, display by slanted line portions and non-slanted line portions, display by a blink and non-blink. In the case where such display is carried out, the LCD 102 may carry out only monochrome display.

Embodiment 5

The following will discuss still another embodiment of the present invention referring to FIGS. 1, 3, 4 and 60 through 66. Here, for convenience of explanation, those members that have the same arrangement and functions, and that are described in the aforementioned embodiment are indicated by the same reference numerals and the description thereof is omitted.

In a jam removing procedure display apparatus of the present embodiment, in the case where jam of documents occurs in a copying apparatus main body 1 or in an RDH 2 during copy of plural documents using the RDH 2, namely, during copy in an RDH mode, document return guidance is displayed.

The document return guidance designates a method of returning a document to a document storing section 51 of the RDH 2 shown in FIG. 3. In other words, in the case of copying in the RDH 2 mode, when a copying operation is suspended due to jam, it is necessary that documents on the document storing section 51 are returned to their initial state. Here, after resumption of copying, copied documents are fed forward without being copied, and non-copied documents are copied. In order to perform this operation, a counter for counting a number of documents which have been fed by the RDH 2 is usually provided to the copying apparatus main body 1 or the RDH 2, and the copying operation is controlled based upon the counted value.

Figure 60:
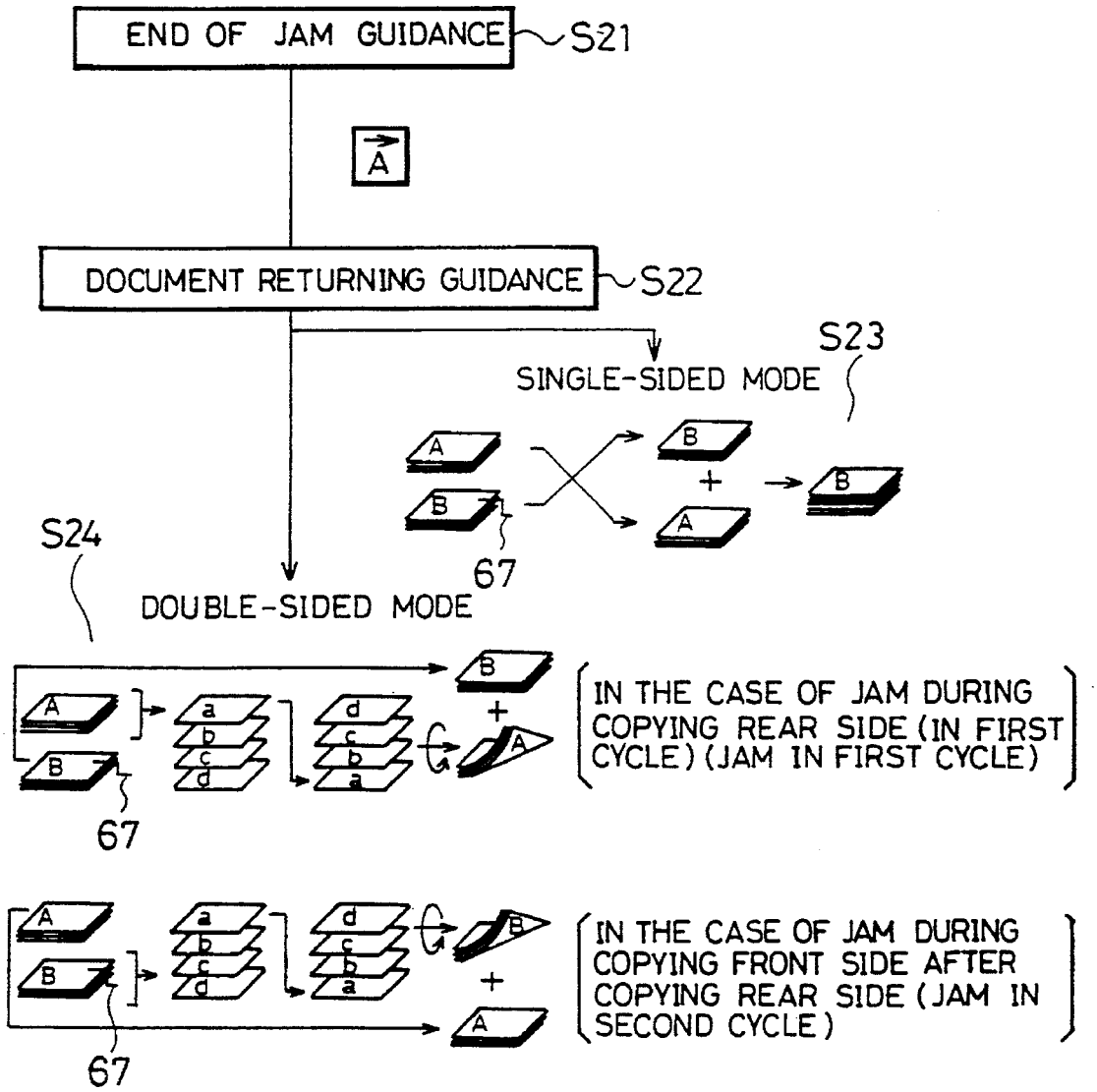
FIG. 60 is a flowchart detailing a document return guidance operation by a jam removing procedure display apparatus in accordance with another embodiment of the present invention.

Methods of returning documents at the time when jam occurs are different for the case of the both-sided mode for copying both-sided documents on both sides of sheets and the case of the single-sided mode for copying single-sided documents on one side of sheets or copying single-sided documents on both sides of sheets. Moreover, the RDH 2 circulates a plurality of documents on the document storing section 51 a first page of which is on the top with its front side facing upward so that copying is carried out starting from a rear side of a bottom document. Therefore, even in the both-sided mode, the method of returning documents is different for the case of jam at a first circulation, namely, during copying of a rear side (first circulation jam) and the case of jam of a second circulation, namely, during copying of a front side after the rear side (second circulation jam). Therefore, as shown in FIG. 60, the display of the document return guidance varies with the above-mentioned cases. Moreover, each mode is set by a operation of a copy mode setting section 112 of an operation panel 101 shown in FIG. 4.

Since the method of returning documents in the case of jam of the single-sided mode does not reverse documents, as shown in FIG. 60, a document group A on a detecting section **67*a* of a recycle sensor 67 which have been copied may be simply returned under a document group B under the detecting section 67*a*** which is not copied.

In the method of returning documents in the case of the first circulation jam in the both-sided mode, the document group A on the detecting section **67*a* whose rear sides have been copied and face upwards is first rearranged so that an up-and-down direction of the documents are reversed, namely, the document on the top comes to the bottom, and thereafter, the whole document group A is reversed so as to be returned under the document group B under the detecting section 67*a*** which is not copied.

In the method of returning documents in the case of the second circulation jam in the both-sided mode, the document group B under the detecting section **67*a* only whose rear sides have been copied and face upwards is first rearranged so that an up-and-down direction of the documents are reversed, and thereafter, the whole document group B is reversed so as to be returned on the document group A on the detecting section 67*a*** whose both sides have been copied.

When the copying is started, the detecting section **67*a* of the recycle sensor 67 moves to a top section of a document group stored on the document storing section 51. As a result, the detecting sensor 67*a* detects a cycle of feeding of documents in the document circular feeding operation of the RDH 2**.

In order to perform the above display operation, furthermore, a data ROM 142 shown in FIG. 1 previously stores data of messages represented by characters which show the procedures of operations for returning documents. Moreover, a graphic ROM 148 previously stores data of dynamic images which show the procedure of operations for returning documents. Concretely, the graphic ROM 148 stores data which show an outline of the RDH 2 as well as cell patterns shown in FIGS. 61 and 62 for the operations of documents, cell patterns shown in FIGS. 63 through 65, etc. A CPU 143 and an LCD controller 150 makes document returning guidance display on the LCD 102 based upon the above data or cell patterns by a similar operation to that mentioned in the aforementioned embodiment.

With the above arrangement, as shown in FIG. 60, in the apparatus, when a progressive key 103 shown in FIG. 4 is operated after the jam guidance is completed (S21), document returning guidance is displayed respectively according to the case of the jam in the single-sided mode, the case of the first circulation jam in the both-sided mode and the second circulation jam in the both-sided mode (S22).

For example, in the document returning guidance in the case of the jam in the single-sided mode, as shown in FIGS. 61(*a*) through 61(*d*) and FIGS. 62(*a*) through 62(*f*), a message which instructs operations for documents and dynamic images of the cells 1 through 10 which show a moving operation for documents are displayed. These displayed images show the procedure for the method of retuning documents, and FIGS. 61(*a*) through 61(*c*) show an operation for picking up the document group A from the document storing section 51 of the RDH 2. Moreover, FIGS. 61(*d*) and 62(*a*) and 62(*b*) show operations for picking up the document group B from the document storing section 51, and FIGS. 62(*c*) and 62(*d*) show operations for positioning the document group A under the document group B. FIGS. 62(*e*) and 62(*f*) show operations for positioning the document groups B and A which have been combined on the document storing section 51.

Here, The message which shows the operation for documents are shown in only FIG. 61(*a*), but on the screen of the LCD 102, the message is displayed in a state shown in the other drawings.

In addition, for example, in the document returning guidance in the case of the first circulation jam in the both-sided mode, as shown in FIGS. 63(*a*) through 63(*f*), FIGS. 64(*a*) through 64(*f*) and FIGS. 65(*a*) through 65(*d*), a message which instructs the operation for documents (not shown) and the dynamic images of the cells 1 through 16 which show the moving operation for documents are displayed. These displayed images show the procedure of the method of returning documents, and FIGS. 63(*a*) and 63(*b*) show operations for picking up the document group A from the document storing section 51 of the RDH 2. The FIGS. 63(*c*) through 63(*f*) and FIG. 64(*a*) show an operation for rearranging a up-and-down direction of the document group A, and FIGS. 64(*b*) and 64(*c*) show an operation for reversing a front/rear side of the document group A. Moreover, FIGS. 64(*d*) through 64(*f*) show an operation for picking up the document group B from the document storing section 51, and FIGS. 65(*a*) and 65(*b*) show an operation for positioning the document group A under the document group B. FIGS. 65(*c*) and 65(*d*) show an operation for positioning the document groups B and A which have been combined on the document storing section 51.

Here, the message which shows the operation for documents are not shown in the above drawings, but similarly to the case of jam in the single-sided mode, in the display of the LCD 102, the message is displayed in each state shown in the above drawings. Moreover, the document returning guidance in the case of the second circular jam in the both-sided mode is also displayed in a similar manner.

In addition, the document returning guidance which shows the procedures of the document returning method is circularly displayed repeatedly until an input key for copying is operated. The input key for copying is a copy start key 110 shown in FIG. 4 or each key of a copy mode setting section 112, for example.

Figure 66:
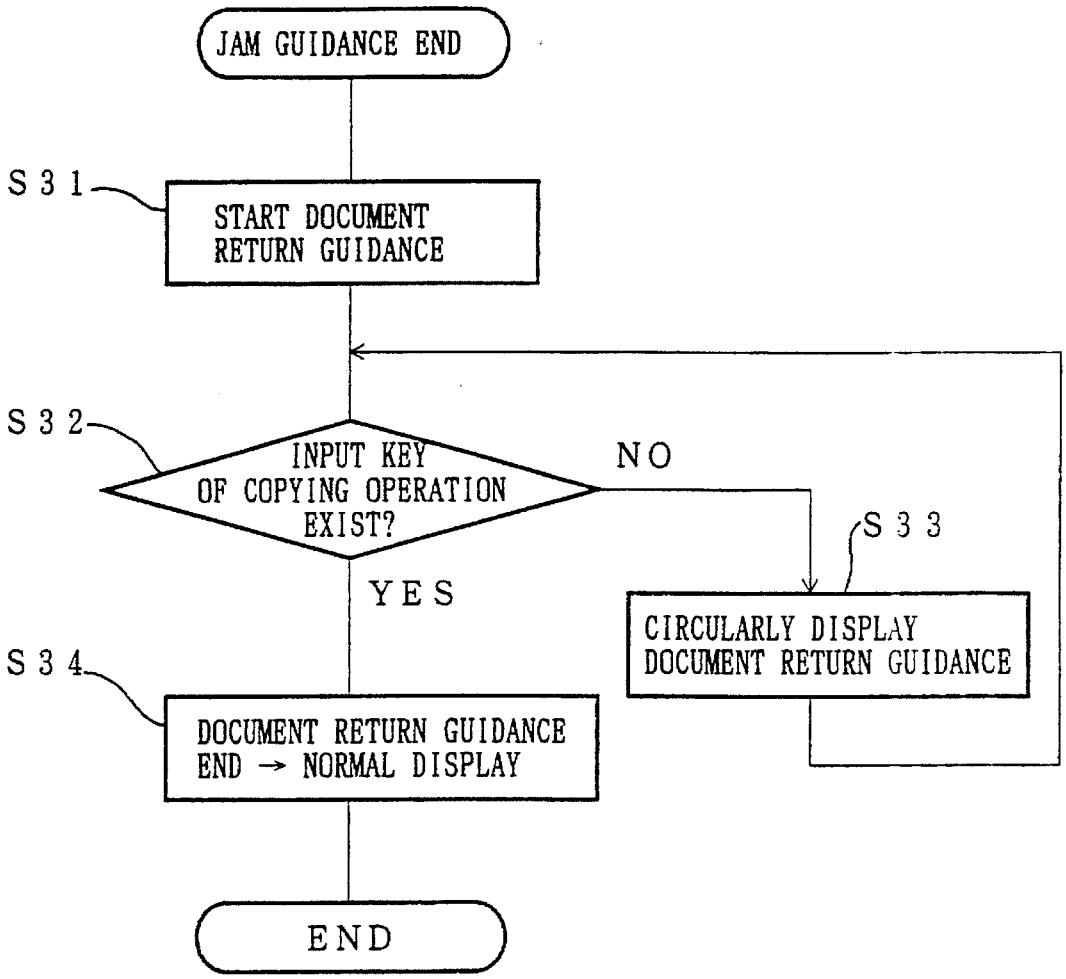
FIG. 66 is a schematic flowchart showing a display operation of the document return guidance by the above jam removing procedure display apparatus.

The above operations are shown in FIG. 66 as a flow chart. In other words, after the display of the jam guidance is completed, when the progressive key 103 is turned ON, for example, the document returning guidance is started to display (S31) and the guidance is circularly displayed (S32). Thereafter, when an operation for returning document is completed and the input key for copying is turned ON (S33), the display of the document returning guidance is completed so as to be switched to normal display (S34).

In the case of the jam in each copy mode using the RDH 2, the document returning guidance makes it possible to easily and accurately return documents. In other words, in the case where the document returning method is simply displayed only as a message or a still image, it is difficult for an operator to understand the document returning method, and the operator is liable to make a mistake in operation. This problem is remarkable particularly when jam is removed in the both-sided mode which requires the above-mentioned complicated operations. On the contrary, if the procedure for returning documents is displayed as a dynamic image like the document returning guidance, the operator can easily understand the procedure and accurately perform its operation.

In addition, since the document returning guidance can be displayed on the LCD 102 successively after the jam guidance, the procedure for removing jam from the copying apparatus main body 1 side to the RDH 2 side can be easily and efficiently carried out.

Embodiment 6

The following will discuss still another embodiment of the present invention referring to FIGS. 1 and 67 through 71. Here, for convenience of explanation, those members that have the same arrangement and functions, and that are described in the aforementioned embodiment are indicated by the same reference numerals and the description thereof is omitted.

In a jam removing procedure display apparatus of the present embodiment, on a screen where the document returning guidance is displayed, a portion where an operator performs a moving operation in a dynamic image is displayed in a different color from of an unmoving portion other than the moving portion.

In order to perform the above operation, the LCD 102 shown in FIG. 1 is capable of displaying images in colors. Moreover, when making display data stored in V-RAMs 145/146 display on the LCD 102, an LCD controller 150 makes the data display in colors by taking out colors from a color palette 149 based upon color information of a portion to be displayed on the LCD 102 in the display data.

The above display operation is shown in FIGS. 67 and 68 as the document returning guidance shown in FIGS. 61 and 62, for example. A document shown by slanted lines in the drawings is a portion on which the moving operation should be performed in the document returning guidance. On the screen of the LCD 102, the slanted line portion is displayed in red, for example, documents and a RDH 2 shape section other than the red portion are displayed in black, for example.

In addition, the above display operation is shown in FIGS. 69 through 71 as the document returning guidance shown in FIGS. 63 through 65. Documents shown by upper-right slanted lines are documents on which the moving operation should be performed in the document returning guidance, and documents shown by lower-right slanted lines are documents on which the moving operation is not performed. On the screen of the LCD 102, the upper-light slanted line portion is displayed in red, for example, the lower-right slanted line portion is displayed in blue, for example, and the RDH 2 shape portion other than the above two portions is displayed in black, for example.

With the above document returning guidance, since an operation designating section to be operated in the document returning process, namely, a document to be operated is clearly distinguished from an non-operation designating section other than the document to be operated, namely, a document not to be operated, it is easier for an operator to understand the procedure of the operation, so the operator hardly makes a mistake in the operation. As a result, the operator can easily and accurately perform the document returning operation when jam occurs.

Here, colors of the operation designating portion and the non-operation designating section in the above document returning guidance can be suitably set without being limited to red and black. Moreover, since the operation designating portion and the non-operation designating portion in the document returning guidance may be clearly distinguished, they may be displayed in various states such as in different depth, by slanted lines and non-slanted lines, by blinking and unblinking without being limited to display in different colors. In the case of display in the above ways, the LCD 102 may display images in only black and white.

Embodiment 7

The following will discuss still another embodiment of the present invention referring to FIGS. 1 and 72 through 74. Here, for convenience of explanation, those members that have the same arrangement and functions, and that are described in the aforementioned embodiment are indicated by the same reference numerals and the description thereof is omitted.

In a jam removing procedure display apparatus of the present embodiment, on a screen where the document returning guidance mentioned in the embodiments 5 and 6 is displayed, when jam of documents occurs in a RDH 2 side, a page of documents which causes jam, namely, a number of a page which is counted in an order that the documents are fed is informed to an operator by a message.

In order to perform the above operation, a CPU 125 of an operation controlling section 124 shown in FIG. 1 is provided with a counter which counts a number of fed documents and transmits a counted value to a CPU 143 of a display controlling section 128 when jam occurs. Moreover, data for displaying the above-mentioned page number by means of a message are stored in a data ROM 142. The CPU 143 reads out the data of the page number and writes them to V-RAMs 145.146 when jam of documents occurs, and an LCD controller 150 makes the data of the page number stored in the V-RAMs 145.146 display on an LCD 102 together with the dynamic images which show the document returning procedure.

The above-mentioned display operations are shown in FIGS. 72 through 74 as the document returning guidance shown in FIGS. 63 through 65. In the drawings, the case where a 5th document is jammed is shown. Messages for displaying jammed documents are not shown in the drawings other than FIG. 72(*a*), but messages with same contents are displayed in the drawings other than FIG. 72(*a*).

With the above-mentioned document returning guidance, an operator can verify a state of a jammed document, so states which causes jam of a document, such as curling, a wrinkle, can be also removed. Therefore, a recurrence of jam can be prevented, and the operation for returning documents becomes easier.

Embodiment 8

The following will discuss still another embodiment of the present invention referring to FIGS. 1 through 3, FIG. 12, FIGS. 15 through 33, FIGS. 41 through 58 and FIGS. 75 through 164. Here, for convenience of explanation, those members that have the same arrangement and functions, and that are described in the aforementioned embodiment are indicated by the same reference numerals and the description thereof is omitted.

Figure 75:
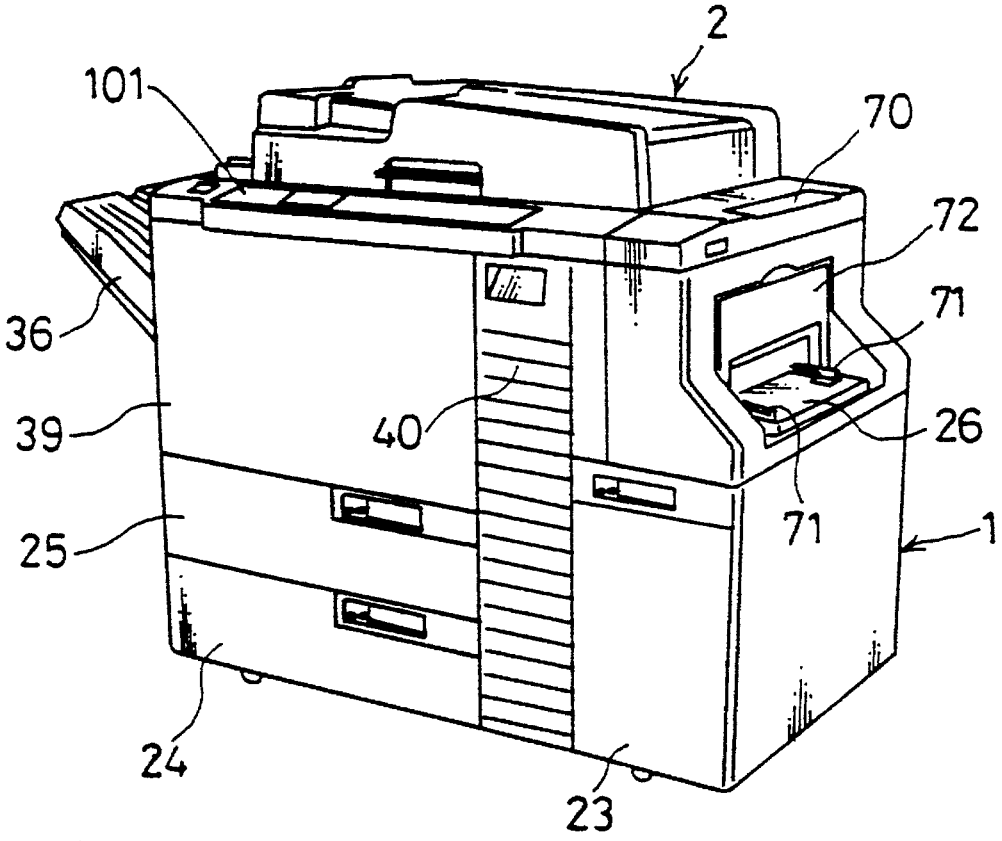
FIG. 75 is a perspective view showing a copying machine in accordance with another embodiment of the present invention.

A manual insertion sheet guide 71 for adjusting a widthwise direction of sheets stored on a manual insertion sheet feeding tray 26 and an auxiliary tray 72 which is used as the occasion demands are provided in the vicinity of the manual insertion sheet feeding tray 26 shown in FIG. 2 (See FIG. 75).

A disposed toner bottle 75 for collecting toner which has been scraped off by a cleaning unit 18 in the copying process section 22 is provided below a finisher 33 shown in FIG. 2.

Figure 76:
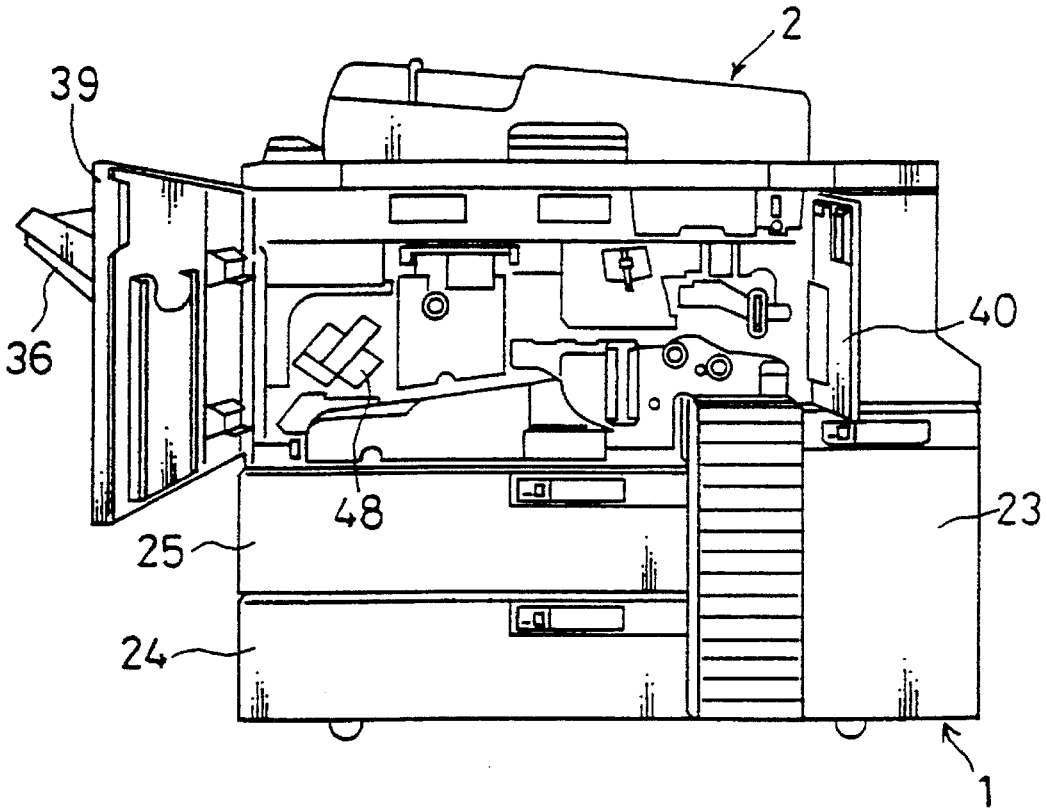
FIG. 76 is a front view showing the internal structure of the above copying machine when its front door is open.
Figure 77:
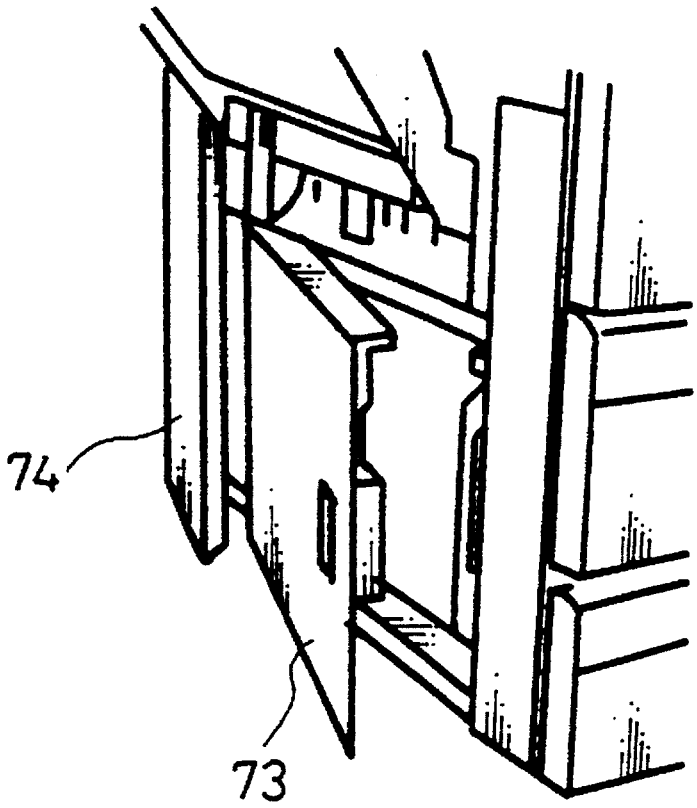
FIG. 77 is an enlarged view of the major part of the side surface of the above copying machine.

In addition, as shown in FIGS. 75 and 76, first and second doors 39.40 are provided on a front side of the copying apparatus main body 1, and as shown in FIG. 77, a left side face cover 73 (which is same as the third door 41 shown in FIG. 7) and a disposed toner bottle unit conver 74 which is opened and closed when the disposed toner bottle 75 is replaced are provided on a left side. Moreover, as shown in FIG. 75, a toner hopper cover 70, which is opened and closed when toner is supplied to the toner hopper 47, is provided on an upper face side of the copying apparatus main body 1 together with the RDH 2.

Figure 78:
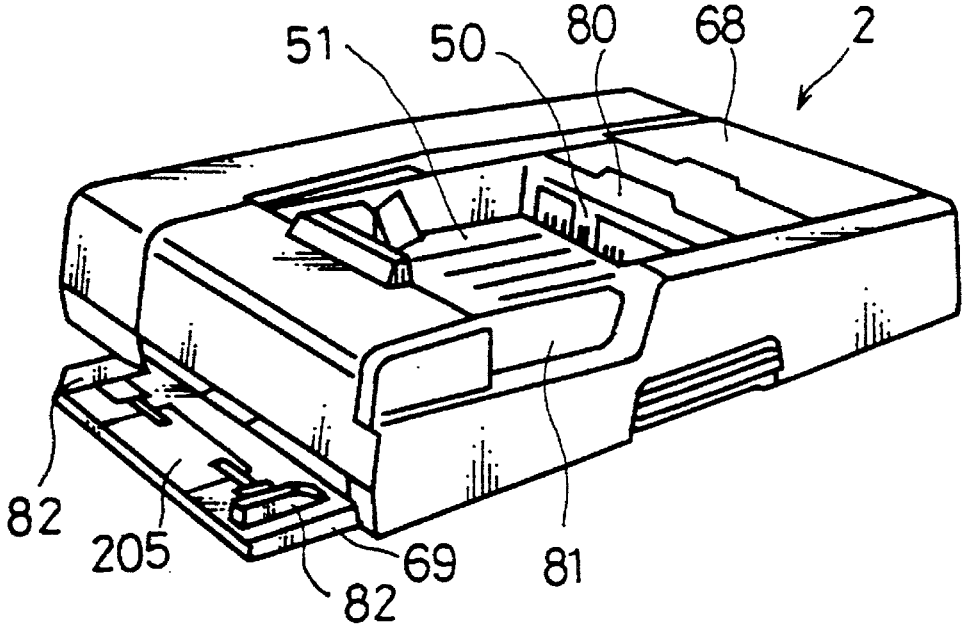
FIG. 78 is a perspective view of the RDH shown in FIG. 2.

Meanwhile, as shown in FIG. 78 or FIG. 3, the RDH 2 includes a document storing section 51 where a plurality of documents are stored on its upper surface and a manual insertion document set platen 69. The document storing section 51 is provided with a document backward end guide 80 for adjusting a lengthwise direction of stored documents and a document guide 81 for adjusting a widthwise direction of documents. The manual insertion document set platen 69 is provided with a manual insertion document guide 82 and an auxiliary tray 205 which is used as the need arises.

Figure 79:
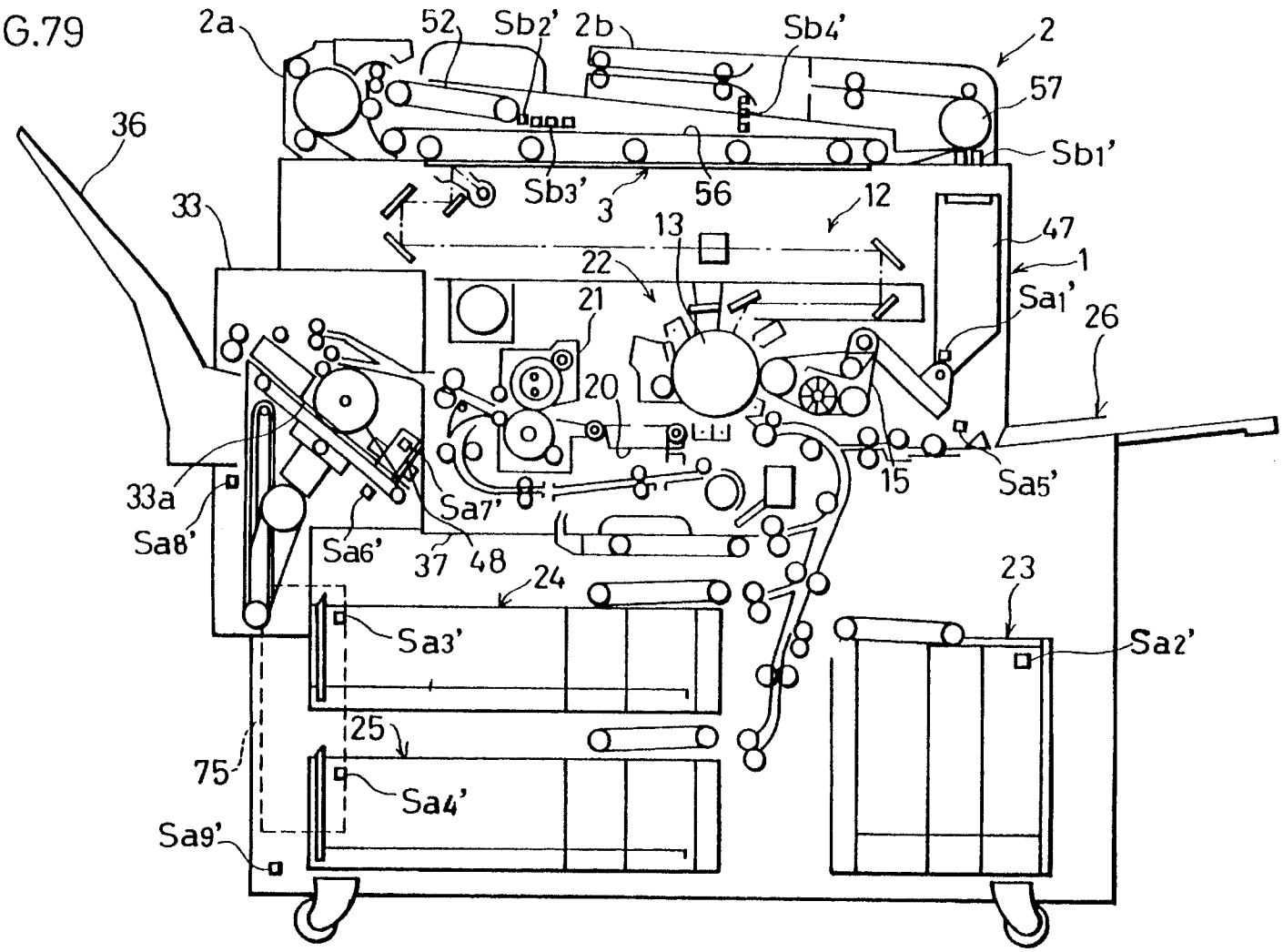
FIG. 79 is a view explaining the installation of sensors within the above copying machine.

In addition, a plurality of state sensors for detecting states of each section in the copying apparatus are provided in the copying apparatus. As shown in FIG. 79, as the state sensors, a toner empty sensor $Sa_1'$ which is turned OFF when toner exist in the toner hopper 47 and is turned ON when toner runs out is provided in the toner hopper 47. Moreover, as the state sensors, sheet backward end detecting sensors $Sa_2'.Sa_3'.Sa_4'$ which are turned ON when detecting a backward end of sheets set in sheet feeding trays 23.24.25 and is turned OFF when sheets run out are provided in sheet feeding trays 23.24.25. Moreover, as the state sensor, a sheet detecting sensor $Sa_5'$ which is turned ON when sheets exist on the tray 26 and is turned OFF when sheets run out is provided in an inner part of the manual sheet feeding tray 26.

In addition, as the state sensors, a home position detecting sensor $Sa_6'$ which is turned ON when the stapler unit 48 is in a home position and is turned OFF during working of the stapler is provided in the finisher 33, and a staple detecting sensor $Sa_7'$ which is turned ON when a staple is set in the unit 48 and is turned OFF when a staple runs out is provided in the stapler unit 48 of the finisher 33. Moreover, as the state sensor a discharge tray lower position detecting sensor $Sa_8'$, which is turned OFF until the discharge tray 36 reaches a lower position and is turned ON when the tray 36 falls down as sheets increase and the tray 36 reaches the lower position, is provided in the finisher 33.

In addition, as the state sensor, a disposed toner full detecting sensor $Sa_9'$, which is turned OFF when the disposed toner bottle 75 is light because of the empty disposed toner bottle 75 and is turned ON when the bottle 75 is heavy because of the filled bottle 75, is provided below the disposed toner bottle 75 of the copying apparatus main body 1.

In addition, a lot of state sensors are provided also in the RDH 2. As the state sensor, an open/close detecting sensor $Sb_1'$, which is turned OFF when the RDH 2 is in an opened state for the document exposing section 3 and is turned ON when in a closed state, is provided on an opposite face side to the document exposing section 3. Here, the open/close detecting sensor $Sb_1'$ is also provided to an original cover which is provided instead of the RDH 2, and has a same function. Moreover, as the state sensor, a document set detecting sensor $Sb_2'$, which is turned OFF when document are not set on the RDH 2 and is turned ON when documents are set on the RDH 2, is provided in the vicinity of the sending belt 52. Moreover, as the state sensor, a document length detecting sensor $Sb_3'$ and a document width detecting sensor $Sb_4'$ for detecting a size of documents are provided above the carrying belt 56.

In addition, the copying apparatus has an operation panel 101 shown in FIG. 9. The operation panel 101 is provided with an LCD 102 as display means, a reduction/equality/enlargement key 103', a magnification automatically selecting key 104', a zoom key 114, an operation guide key 105, a copy set number display section 106, a copy completion number display section 107, a copy number set key 108 for inputting numerals 0 through 9, a clear key 109 for clearing a set number by the copy number set key 108, a sheet feeding tray selecting key 115, and a copy start key 110 for commanding a start of copying. Moreover, the operation panel 101 is provided with a finisher function setting section 111 for setting process, such as a staple process, in the finisher 33, a copy mode setting section 112 for setting a copy mode, such as the both-sided mode or one-sided mode, a function setting section 113 for setting copying by various functions, such as, copying with guard sheets being inserted, copying with a binding margin, copying with borders being removed.

Furthermore, the copying apparatus has a control circuit shown in FIG. 12. In FIG. 12, a sensor 121 is sensors including the state sensors Sa.Sb and a sensor for detecting jam, not shown, provided to the copying apparatus main body 1 and the RDH 2. A key 122 includes various keys provided on the operation panel 101. The sensors 121 and the keys 122 are connected to a CPU (Central Processing Unit) 125 of an operation controlling section 124 through an input/output (I/O) interface 123. A ROM (Read Only Memory) 126 and a RAM (Random Access Memory) 127 are connected to the CPU 125, and also a display controlling section 128, a motor driver 129 and a clutch driver 131 are connected thereto through the I/O interface 123.

The display control section 128 controls a display driver provided therein so as to display a numerical value, copying conditions, copying functions, states of the copying apparatus, such as occurrence of jam, a procedure of their operations, or procedures of each operation in the case where an operator should performs prescribed operations, such as out of sheets, out of toner, on the LCD 102 and a copy setting number display section 106 and a copying completion number display section 107, etc. provided to the operation panel 101.

As shown in FIG. 1, the display control section 128 for controlling the LCD 102 includes a program ROM 141, a data ROM 142, a CPU 143, an attribute RAM 144, V-RAMs 145.146, a CG-ROM 147, a graphic ROM 148 as dynamic data storing means, a color palettes 149, and an LCD controller 150.

The data ROM 142 preliminarily stores data of messages represented by characters which show a sequence of procedures required to be performed by an operator in order to carrying out next copying in each section of the copying apparatus main body 1 and the RDH 2, and an storage address, display color information, etc. of dynamic data in the graphic ROM 148. Namely, a function as message data storing means is added to the data ROM 142. The graphic ROM 148 preliminarily stores dynamic data which show a sequence of procedures required to be performed by an operator when copying operation is carried out.

With the above arrangement, in the copying apparatus, in the case where a prescribed operation by an operator is required when next copying is carried out, on the LCD 102 of the operation panel 101, a dynamic image of operation guidance for the operation is displayed superimposed on an image processing screen representing image processing information. In this case, the dynamic image of the operation guidance is reduced so as to be displayed in an upper blank portion without covering the image processing screen.

Figure 82:
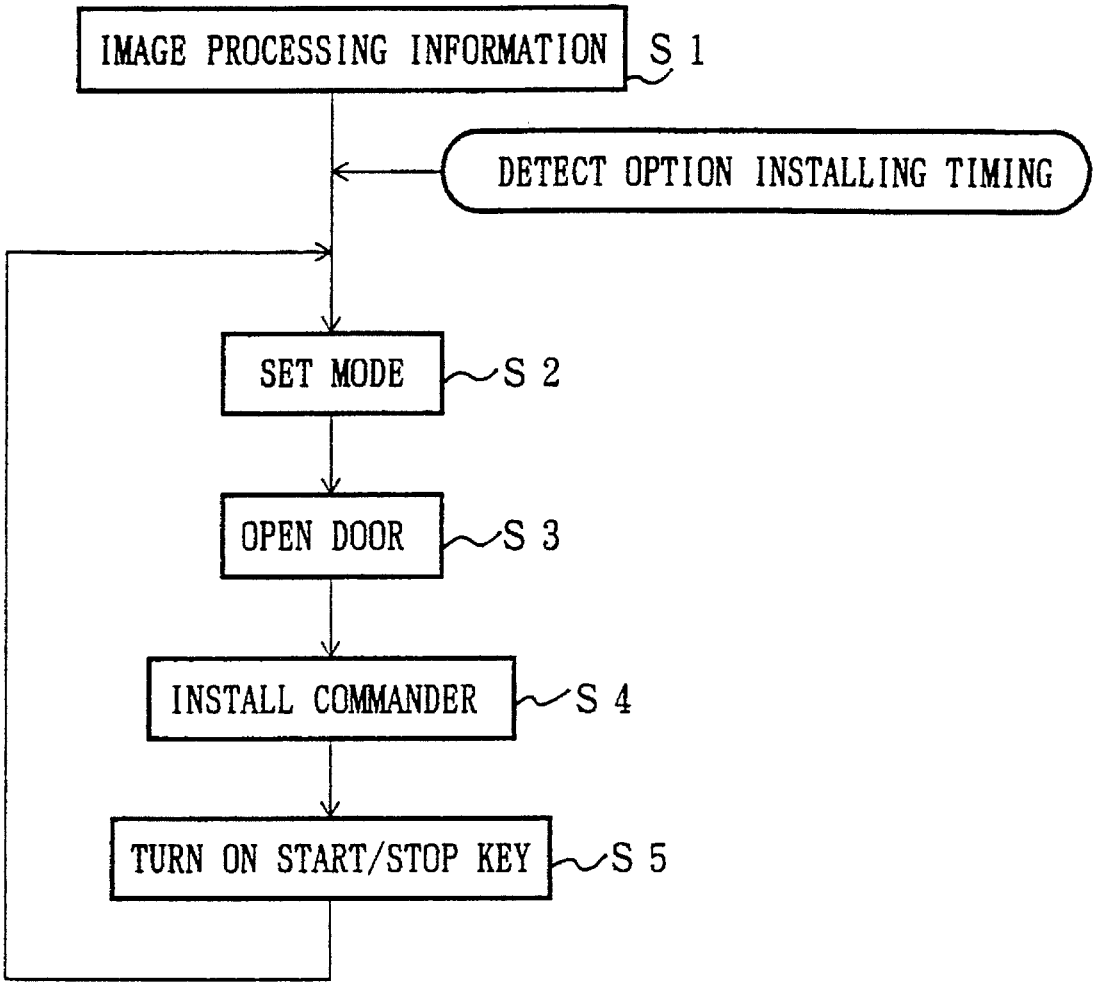
FIG. 82 is a flowchart detailing an option installing operation guidance display by a operation guidance display apparatus in the above embodiment.

In the case where it is necessary for an operator to connect a printer in order to print out manager data, such as a number of copied sheets, jam data, for example, in the copying apparatus, option installing operation guidance for option installation shown in FIG. 82 is displayed. The option installing operation guidance shows a procedure for option installation, and in this case, it is a procedure for connecting a printer as a commander for printing out the manager data.

The copying apparatus is previously set so that the manager data are printed out per one hundred thousand sheets, so necessity for commander connection which is an option is detected per one hundred thousand sheets. In other words, when a counter, not shown, which is provided to the copying apparatus main body 1 counts a prescribed number of copied sheets, timing of option installation is detected and the option installing operation guidance is started to display.

Figure 81:
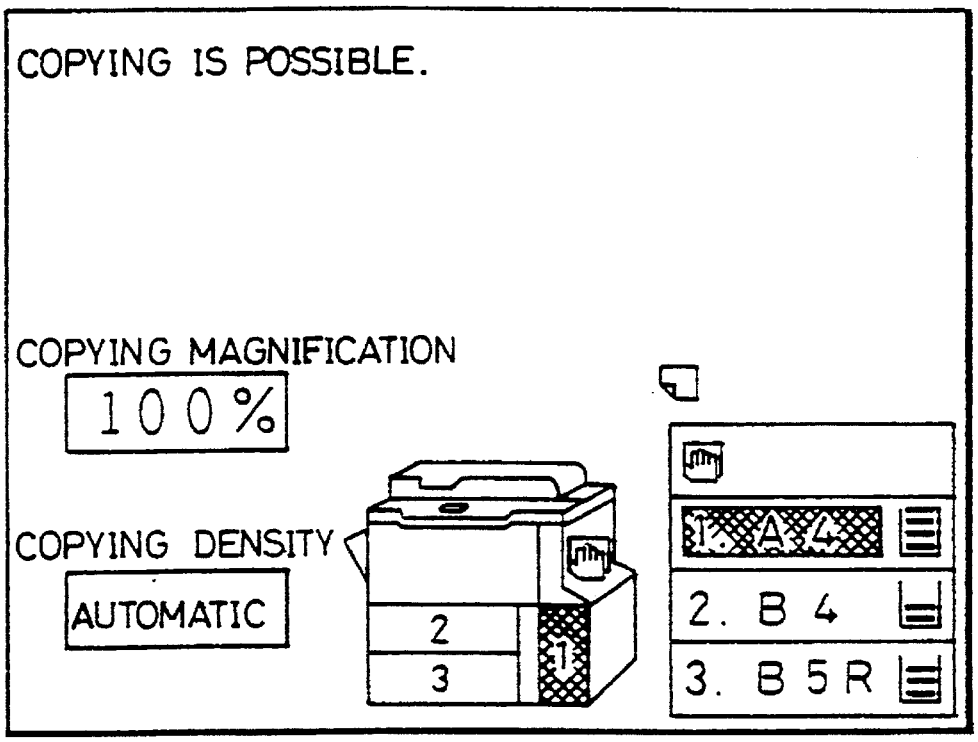
FIG. 81 is a view explaining an image processing screen.

At S1 in the drawing, only image processing information shown in FIG. 81 is displayed on the LCD 102 of the operation panel 101. This is the image processing screen mentioned above. With this picture, copying depth is automatically set, a copying magnification is set for an magnification of 100% and the first sheet feeding tray 23 is selected. Moreover, a size of sheets set on the sheet feeding trays 23 through 25 is shown, and a message "Copying is possible" is displayed so that copying can be performed.

When the timing of option installation is detected, the operation controlling section 124 designates the display controlling section 128 to display option installing operation guidance through a communication interface. After that, the CPU 143 reads out data of a message to be displayed from the data ROM 142 as well as a storage address, display color information, and writes them into the V-RAMs 145.146.

Next, the LCD controller 150 reads out the data stored in the V-RAMs 145.146 through CG-ROM 147 and the graphic ROM 148, and designates the LCD 102 to display the data.

Figure 83:
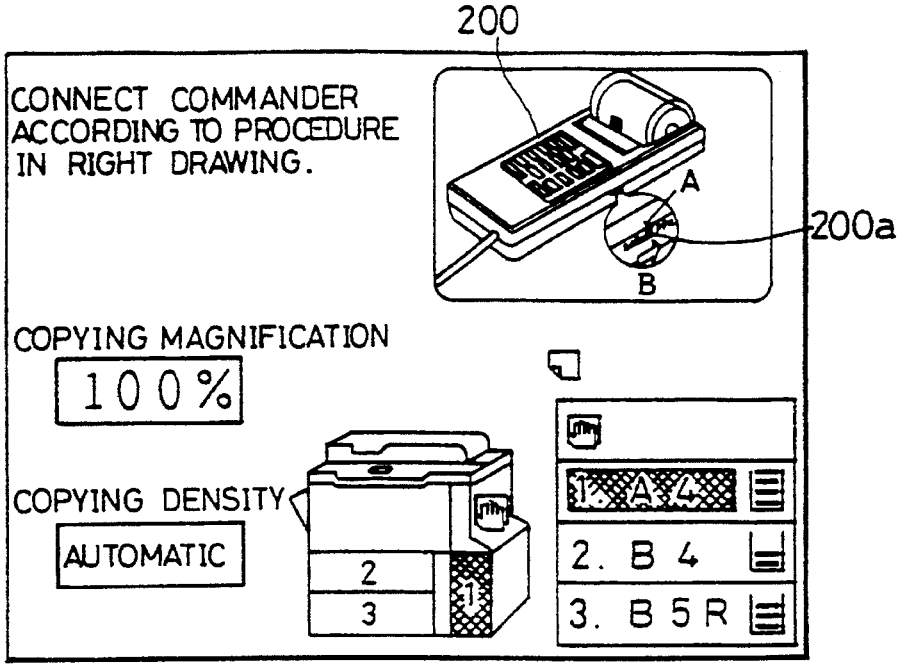
FIG. 83 is a view explaining a screen displaying a moving picture (S2) showing a mode setting operation in the option installing operation guidance display shown in FIG. 82.
Figure 84:
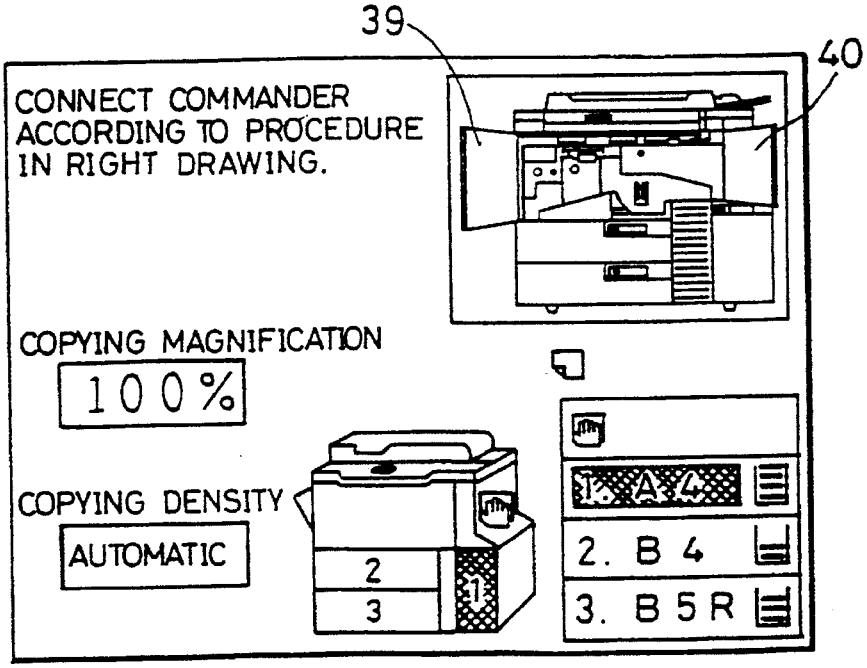
FIG. 84 is a view explaining a screen displaying a moving picture (S3) showing a door opening operation in the option installing operation guidance display shown in FIG. 82.
Figure 85:
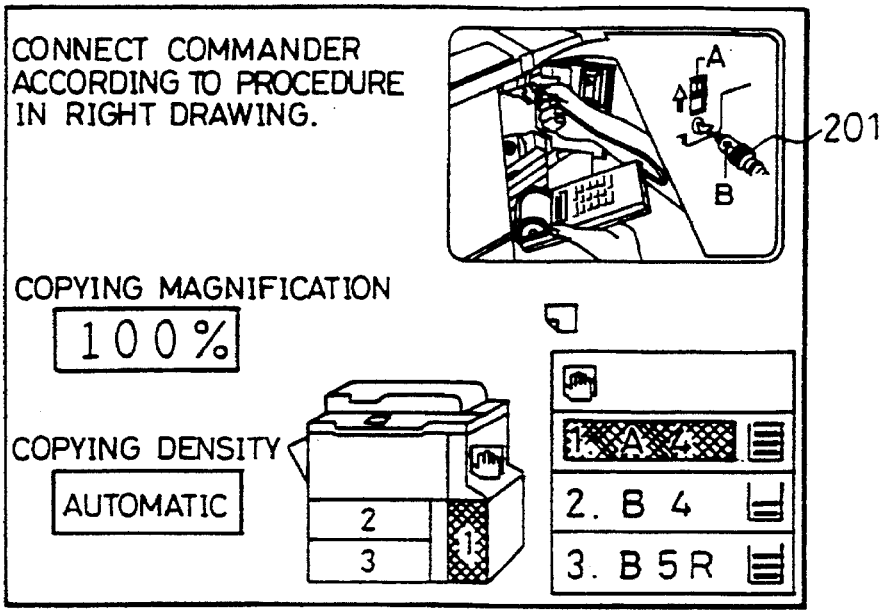
FIG. 85 is a view explaining a screen displaying a moving picture (S4) showing a commander installing operation in the option installing operation guidance display shown in FIG. 82.
Figure 86:
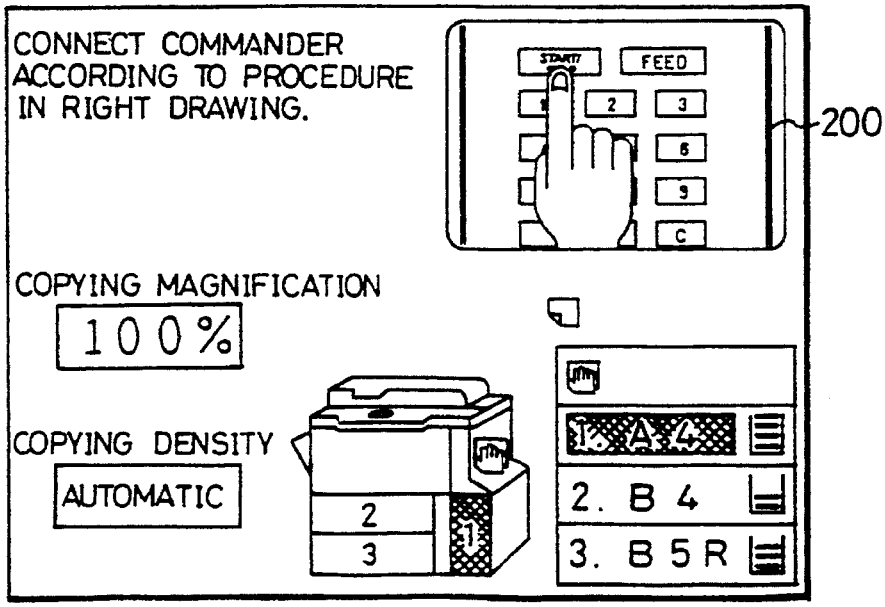
FIG. 86 is a view explaining a screen displaying a moving picture (S5) showing a start/stop key turning on operation in the option installing operation guidance display shown in FIG. 82.

As a result, instead of the message "Copying is possible", as shown in FIGS. 83 through 86, a message "Connect commander according to procedure shown in the right drawing" is displayed on the LCD 102, and a dynamic image of FIG. 83 showing a mode setting operation, a dynamic image of FIG. 84 showing a door opening operation, a dynamic image of FIG. 85 showing a commander installation and a dynamic image of FIG. 86 showing an ON operation of a start/stop key are circularly displayed in this order in a blank portion in the image processing screen of the LCD 102 (S2 through S5 of FIG. 82). Here, FIGS. 83 through 86 mentioned here show pictures which are displayed on the LCD 102 at a certain moment.

As shown in FIG. 15, the dynamic image showing the door opening operation at S3 is used for graphically displaying the opening operation of the first and second doors 39.40, and it is obtained by animating cells 1 through 18 shown in FIGS. 16 through 33 by a transition time t. In order to display this dynamic image, data representing an outline of a copying apparatus as well as the above-mentioned cells which are used for the dynamic image of the door opening operation are stored in the program ROM 141, and the program ROM 141 is controlled such that only a portion of the dynamic image for an active door is rewritten by a program. Here, the suitable transition time t is approximately 70 to 200 ms as mentiontioned above, in order to display the dynamic images smoothly.

Here, the dynamic image showing the mode setting at S2 (see FIG. 83) shows an operation for switching a mode switch 200*a* of the commander 200 to a PPC mode, and simple messages "PPC" and "mode switch" are displayed in a portion A of the dynamic image and in a portion B of the dynamic image respectively. This makes the operation easier. The dynamic image showing the commander installation at S4 shows an operation for moving a connector cover towards a direction of an arrow so as to insert it with the arrow marked on the connector 201 facing upward. Simple messages "Connector cover" and "Arrow upward" are displayed in a portion A of the dynamic image and in a portion B of the dynamic image are displayed respectively, and this makes the operation easier.

In this manner, when the timing of the option installation is detected and the option installing operation guidance is automatically displayed as dynamic images, even if an operator first connects the commander 200 which is an option or it is hard for the operator to understand its operation, the operator can grasp a summary of its whole operation, thereby making it possible to safely and securely perform the operation.

Figure 87:
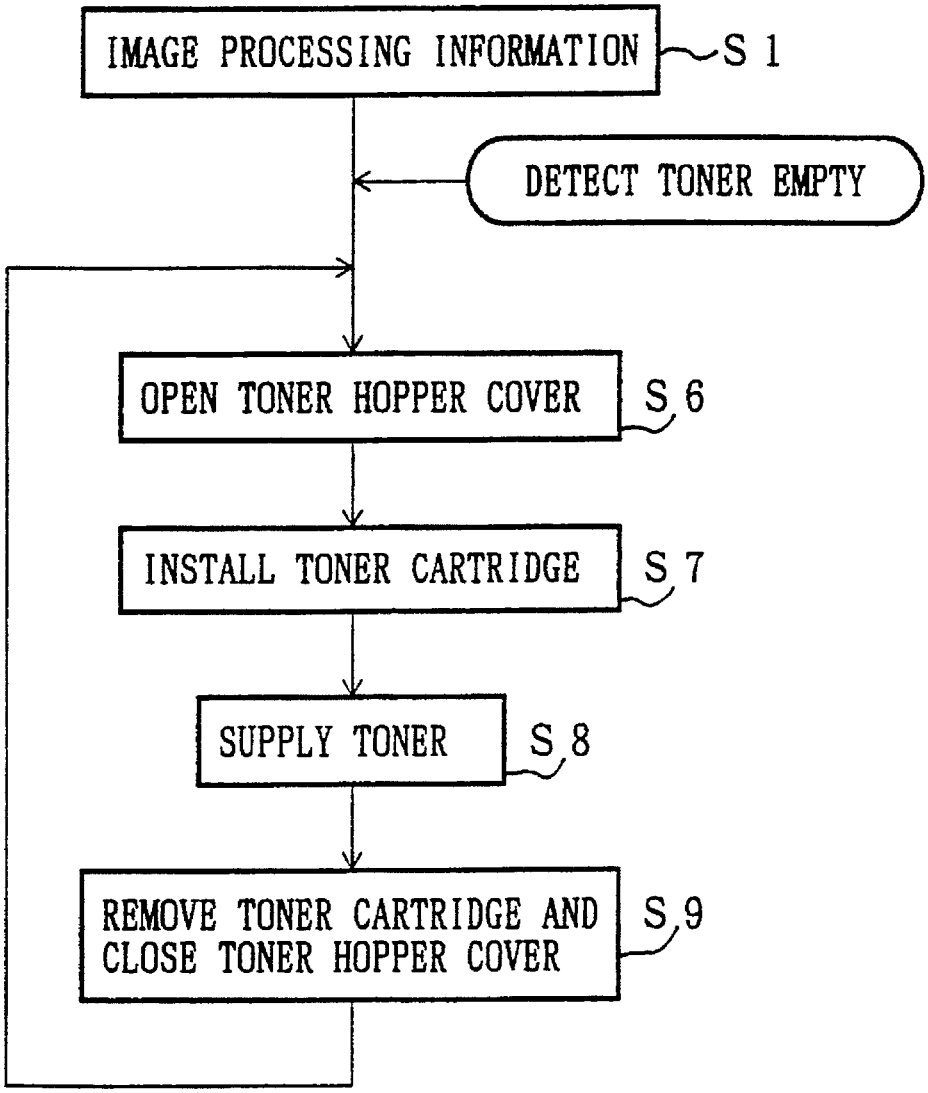
FIG. 87 is a flowchart detailing a toner supplying operation guidance display by the operation guidance display apparatus in the above embodiment.

In addition, in the case where toner runs out in the toner hopper 47 and the operator should supply toner, in the copying apparatus, toner supplying operation guidance for supplying toner shown in FIG. 87 is displayed. After the toner empty sensor $Sa_1'$ is switched from OFF to ON and toner empty is detected, such operation guidance is displayed.

Figure 88:
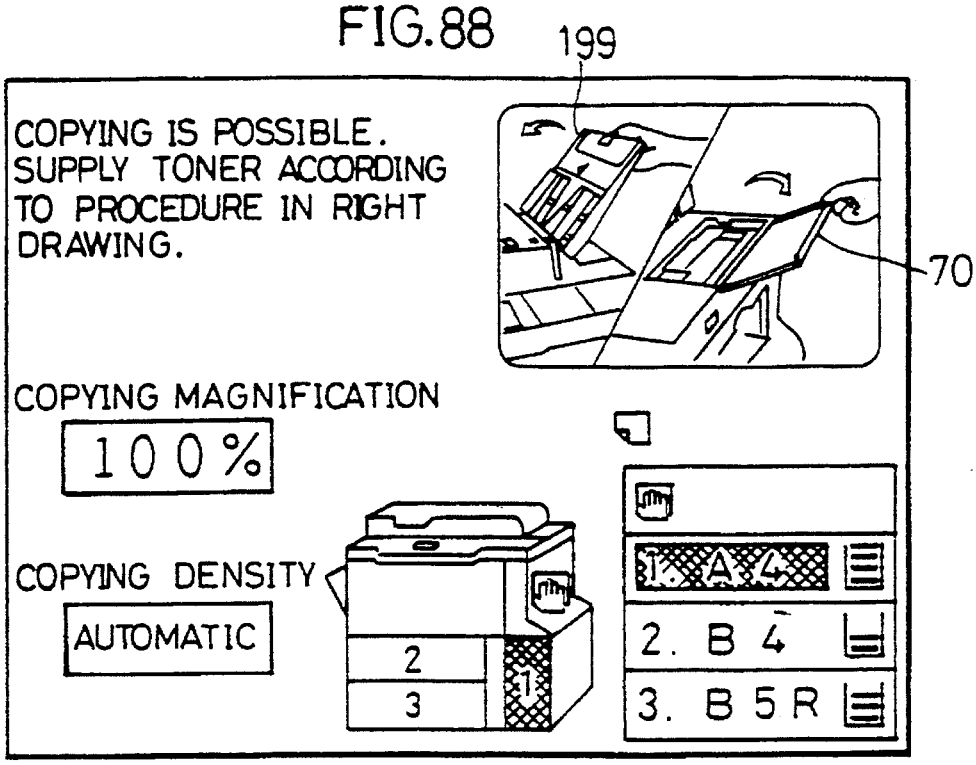
FIG. 88 is a view explaining a screen displaying a moving picture (S6) showing a toner hopper cover opening operation in the toner supplying operation guidance display shown in FIG. 87.
Figure 89:
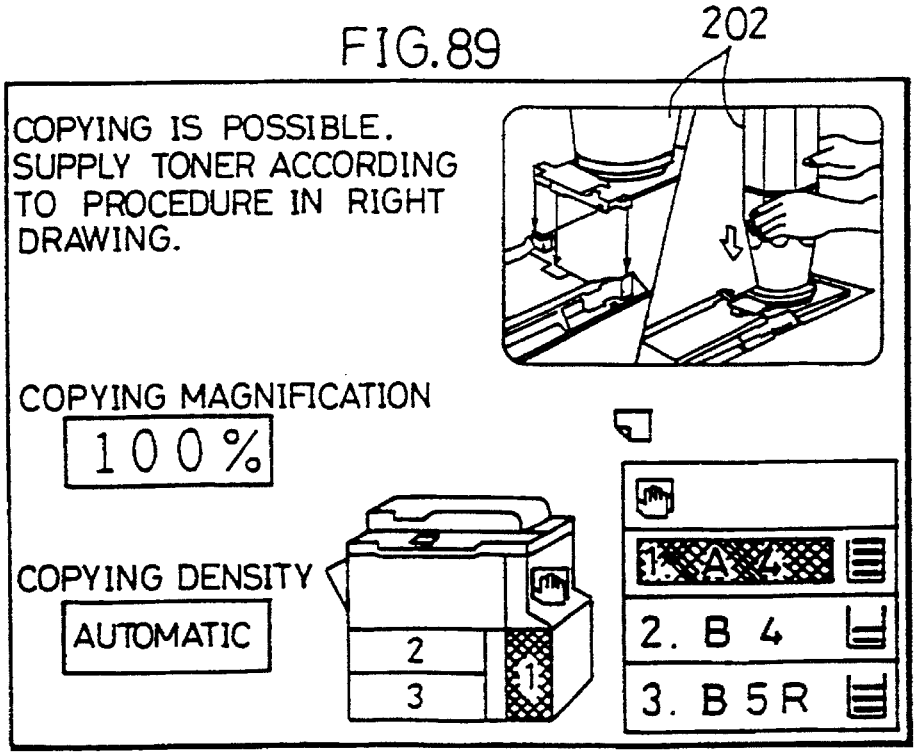
FIG. 89 is a view explaining a screen displaying a moving picture (S7) showing a toner cartridge installing operation in the toner supplying operation guidance display shown in FIG. 87.
Figure 90:
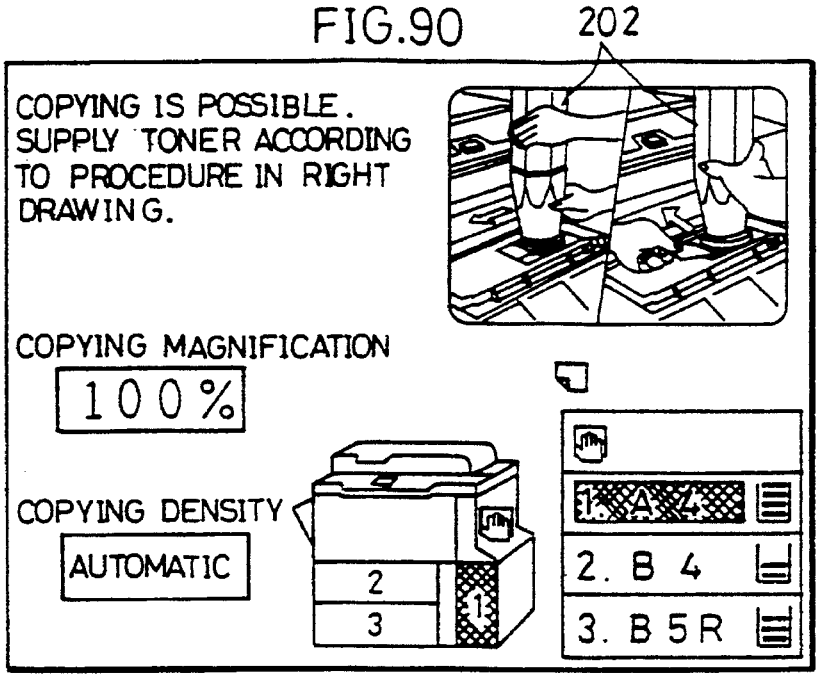
FIG. 90 is a view explaining a screen displaying a moving picture (S8) showing a toner replenishing operation in the toner supplying operation guidance display shown in FIG. 87.
Figure 91:
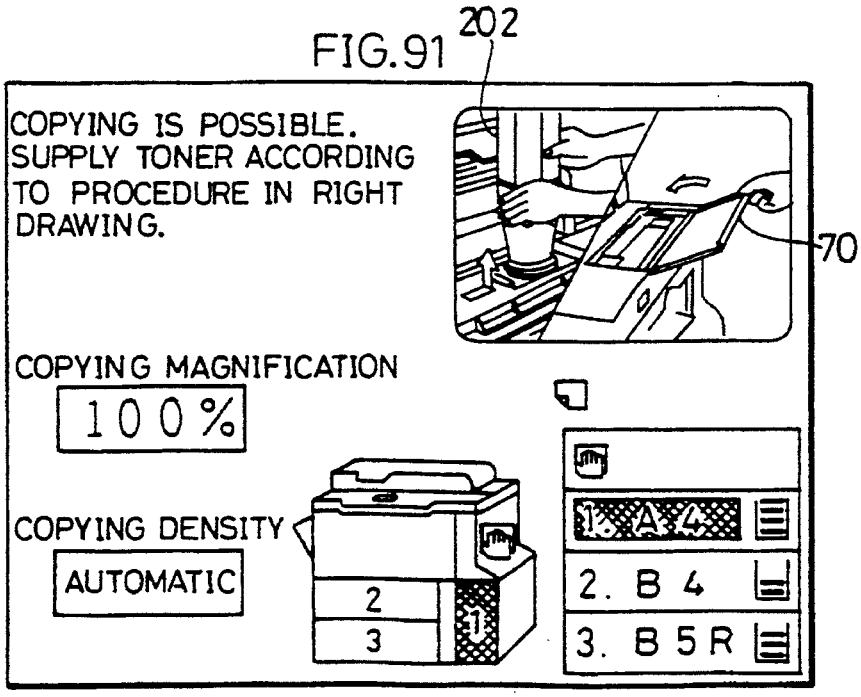
FIG. 91 is a view explaining a screen displaying a moving picture (S9) showing an operation for removing a toner cartridge and closing the toner hopper cover in the toner supplying operation guidance display shown in FIG. 87.

The above-mentioned toner supplying operation guidance shows the procedure for supplying toner. At S6 through S9, on the image processing screen displayed on the LCD 102, a message "Supply toner according to procedure shown in right drawing" is displayed as shown in FIGS. 88 through 91 successively below the message "Copying is possible". Moreover, an dynamic image of FIG. 88 showing an operation for standing a tray 199 and for opening the toner hopper cover 70, a dynamic image of FIG. 89 which shows an operation for installing a toner cartridge 202 to a supplying port while being positioned, a dynamic image of FIG. 90 which shows an operation for supplying toner from the toner cartridge 202 into the toner hopper 47, a dynamic image of FIG. 91 which shows an operation for closing the toner hopper cover 70 by removing the toner cartridge 202 are displayed circularly in a blank portion of the image processing screen. Here, FIGS. 88 through 91 shown here show images which are displayed on the LCD 102 at a certain moment. Moreover, the toner supplying operation guidance is displayed in the same manner as of the above-mentioned option installing guidance. Furthermore, the tray 199 is provided to a copying apparatus where an original cover is used, so it is not provided to the copying apparatus of the present embodiment.

In such a manner, when toner empty is detected and the toner supplying operation guidance is automatically displayed as dynamic images, even if an operator first supplies the toner or it is hard for the operator to understand its operation, the operator can grasp a summary of its whole operation, thereby making it possible to safely and securely perform the operation.

Figure 92:
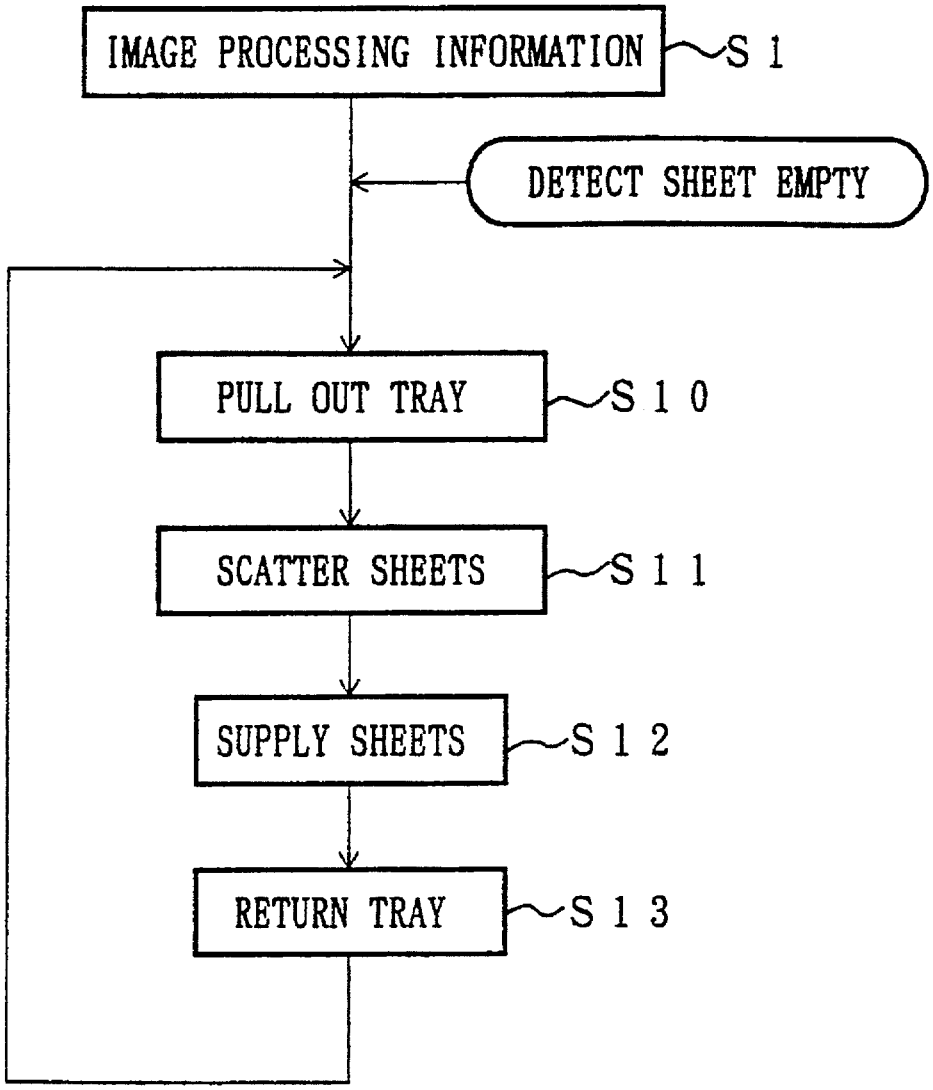
FIG. 92 is a flowchart detailing a sheet supplying operation guidance display by the operation guidance display apparatus of the above embodiment.
Figure 93:
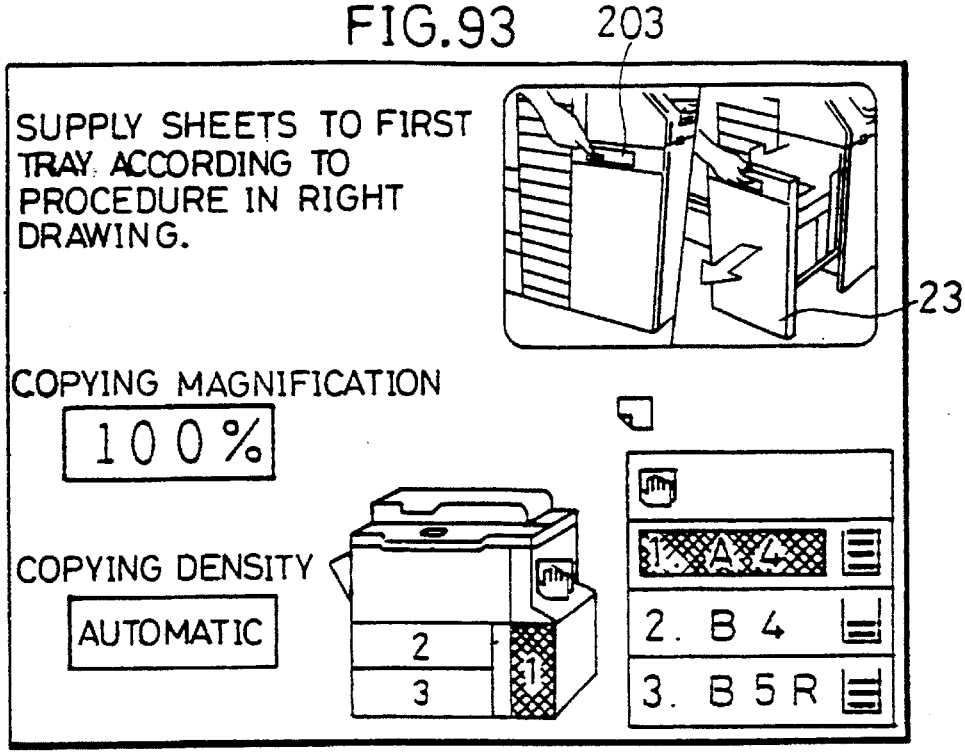
FIG. 93 is a view explaining a screen displaying a moving picture (S10) showing a tray pulling-out operation in the sheet supplying operation guidance display shown in FIG. 92.
Figure 94:
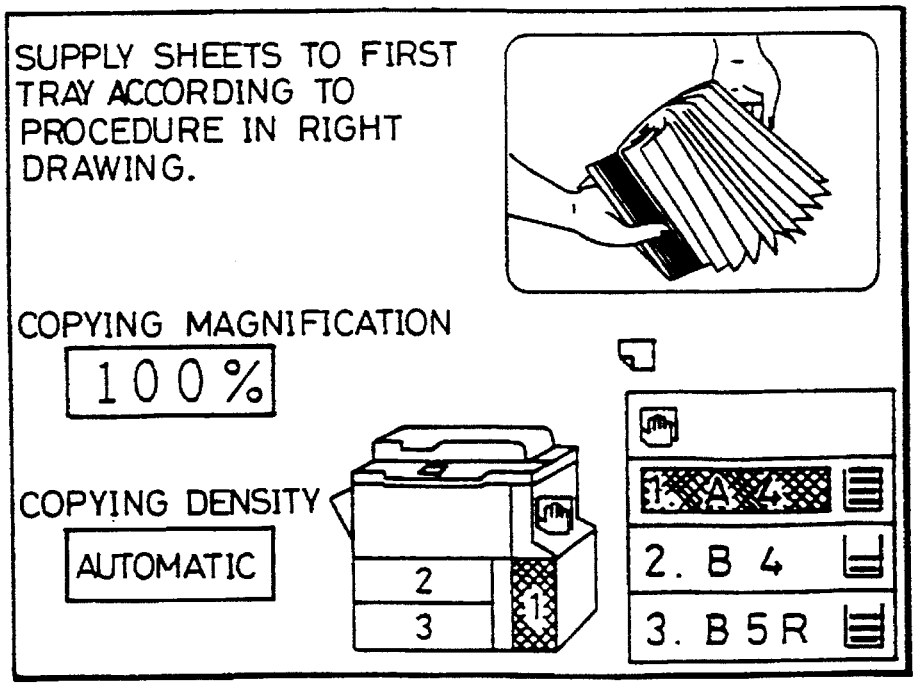
FIG. 94 is a view explaining a screen displaying a moving picture (S11) showing a sheet separating operation in the sheet supplying operation guidance display shown in FIG. 92.
Figure 95:
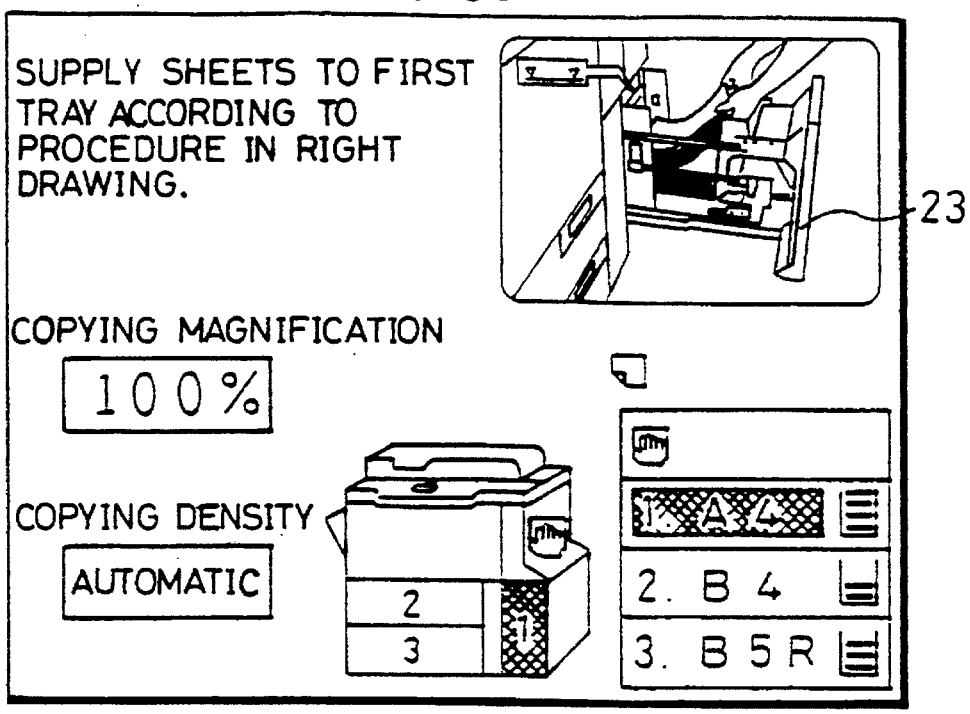
FIG. 95 is a view explaining a screen displaying a moving picture (S12) showing a sheet feeding operation in the sheet supplying operation guidance display shown in FIG. 92.
Figure 96:
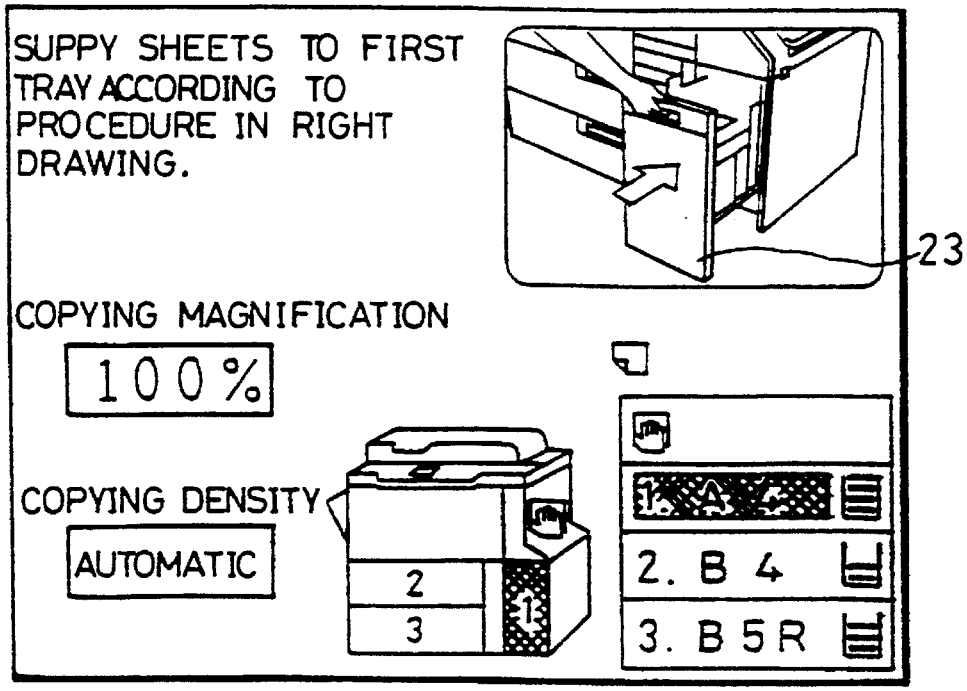
FIG. 96 is a view explaining a screen displaying a moving picture (S13) showing a tray inserting operation in the sheet supplying operation guidance display shown in FIG. 92.
Figure 97:
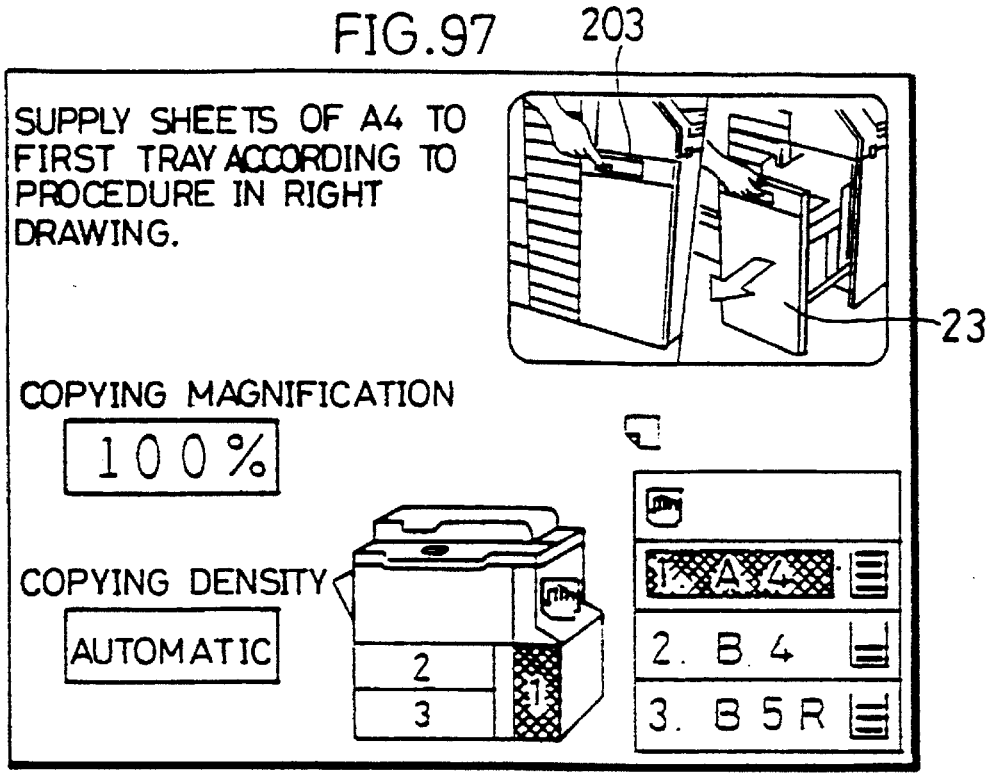
FIG. 97 is a view explaining a screen displaying a moving picture (S10) showing a tray pulling-out operation in a sheet supplying operation guidance display by a operation guidance display apparatus in accordance with another embodiment of the present invention.
Figure 98:
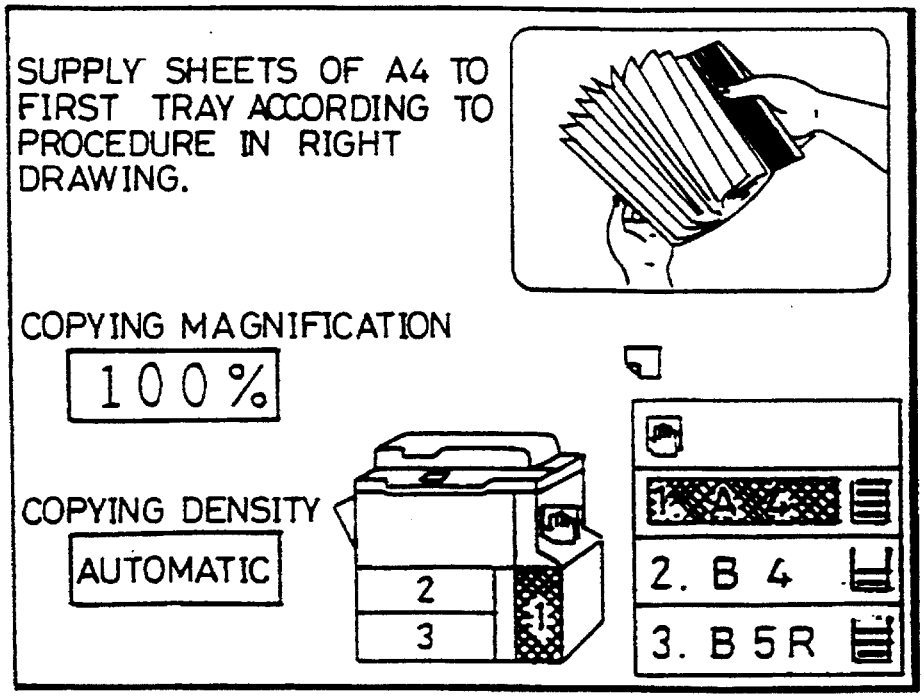
FIG. 98 is a view explaining a screen displaying a moving picture (S11) showing a sheet separating operation in the sheet supplying operation guidance display shown in FIG. 97.
Figure 99:
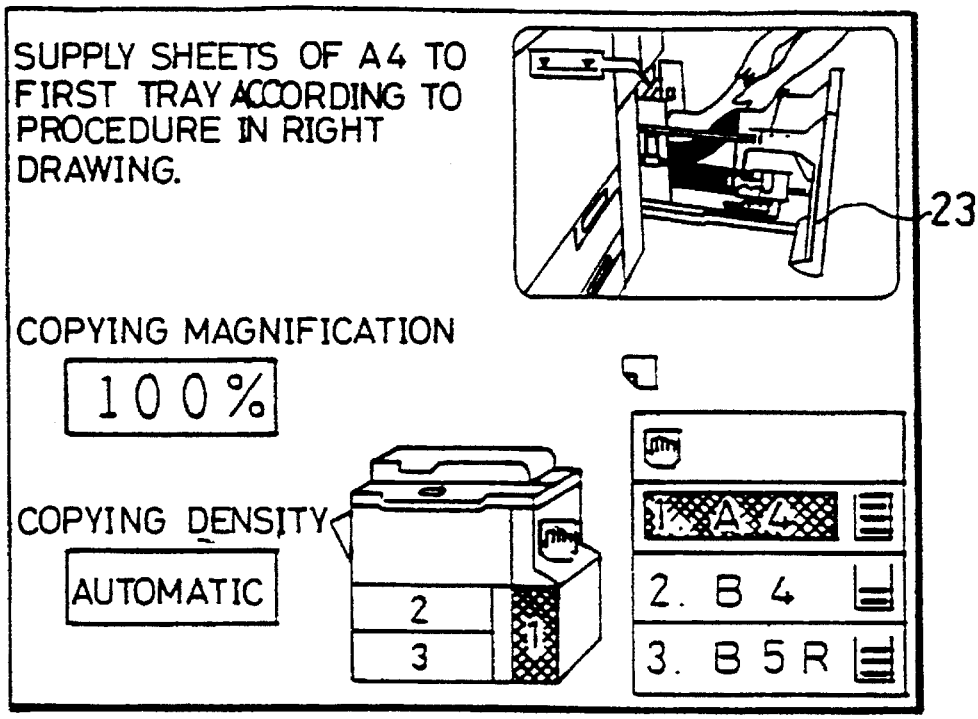
FIG. 99 is a view explaining a screen displaying a moving picture (S12) showing a sheet feeding operation in the sheet supplying operation guidance display shown in FIG. 97.
Figure 100:
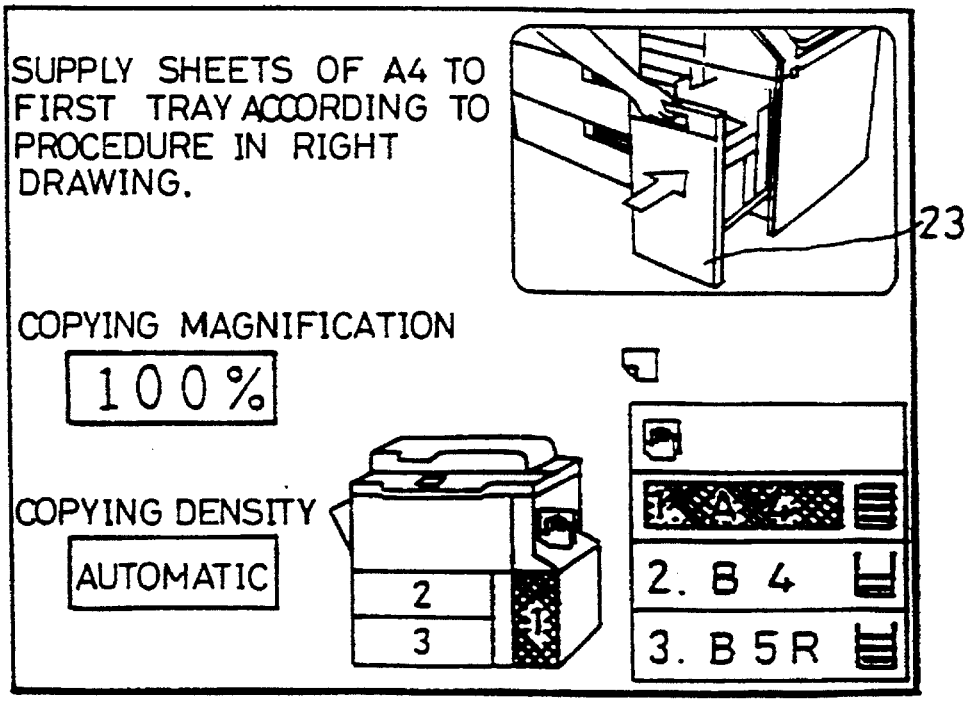
FIG. 100 is a view explaining a screen displaying a moving picture (S13) showing a tray inserting operation in the sheet supplying operation guidance display shown in FIG. 97.

In addition, in the case where sheets run out in the selected first sheet feeding tray 23 and an operator should supply sheets, in the copying apparatus, sheet supplying operation guidance for supplying sheet shown in FIG. 92 is displayed. Such operating guidance is displayed when sheet empty which switches the sheet backward end detecting sensor $Sa_2'$ from ON to OFF is detected.

The above-mentioned sheet supplying operation guidance shows a procedure for supplying sheets. At S10 through S13, on the image processing screen displayed on the LCD 102, instead of the message "Copying is possible", as shown in FIGS. 93 through 96, a message "Supply sheets on the first tray according to the procedure shown in right drawing" is displayed. Moreover, a dynamic image of FIG. 93 which shows an operation for pulling out the first sheet feeding tray 23 by pushing an open button 203, a dynamic image of FIG. 94 which shows an operation for scattering sheets to be supplied, a dynamic image of FIG. 95 which shows an operation for supplying the scattered sheets to the first sheet feeding tray 23, a dynamic image of FIG. 96 which shows an operation for returning the first sheet feeding tray 23 are circularly displayed in a blank portion of the image processing screen. Here, FIGS. 93 through 96 shown here show images which are displayed on the LCD 102 at a certain moment. Moreover, the sheet supplying operation guidance is displayed in a same manner as of the above-mentioned option installing guidance.

In such a manner, when the sheet empty is detected and the sheet supplying operation guidance is automatically displayed as dynamic images, even if an operator first supplies sheets to the sheet feeding tray 23 and or it is hard for the operator to understand its operation, the operator can grasp a summary of its whole operation, thereby making it possible to safely and securely perform the operation.

In addition, in this case, in order to achieve easier operation for the operator, at S10 through S13, instead of the aforementioned message "Supply sheets to the first tray according to the procedure shown in right drawing", as shown in FIGS. 97 through 100, a message "Supply sheets of A4 to the first tray according to the procedure shown in right drawing" which specifies a size of sheets to be supplied may be displayed. As a result, sheet can be supplied more securely.

Figure 101:
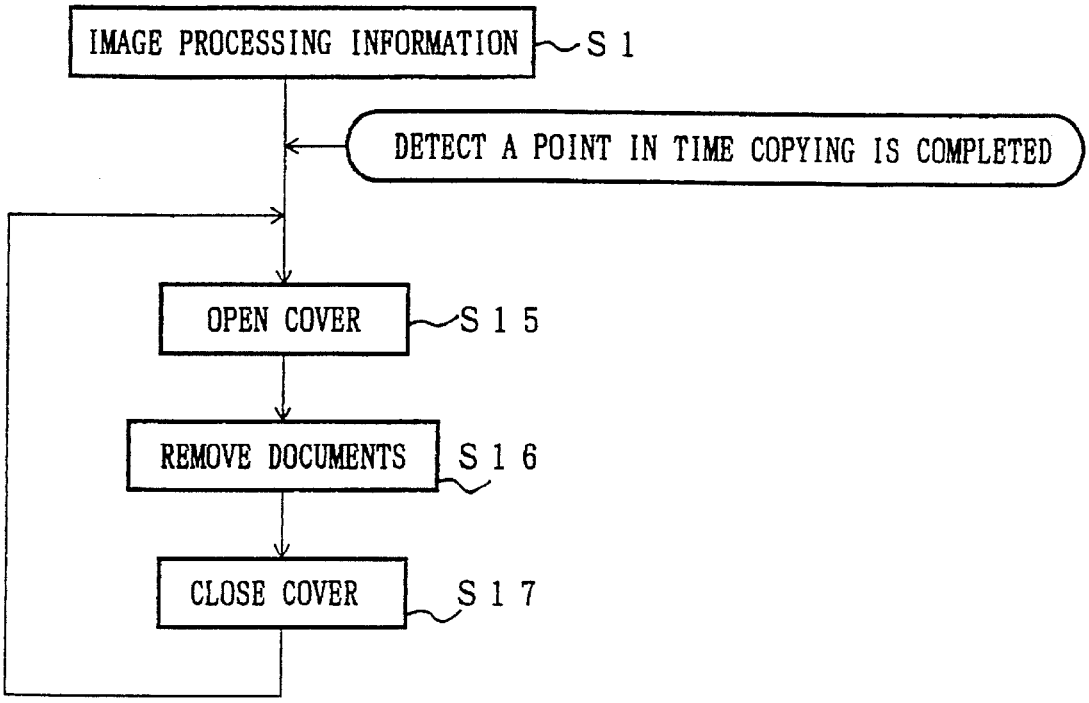
FIG. 101 is a flowchart detailing a first document removing operation guidance display by the operation guidance display apparatus of the above embodiment.

In addition, in the aforementioned explanation, the copying apparatus is arranged so as to include the RDH 2, but in the case where the copying apparatus includes an original cover instead of the RDH 2, when the original cover is opened so that copying is completed in a copying mode that a document directly stores on a document platen of the document exposing section 3 so as to be copied, and thereafter, an operator should remove the documents, in the copying apparatus of the present embodiment, first document removing operation guidance of FIG. 101 for removing documents is displayed. Such operation guidance is displayed when a point in time copying is completed is detected, as mentioned later.

Figure 102:
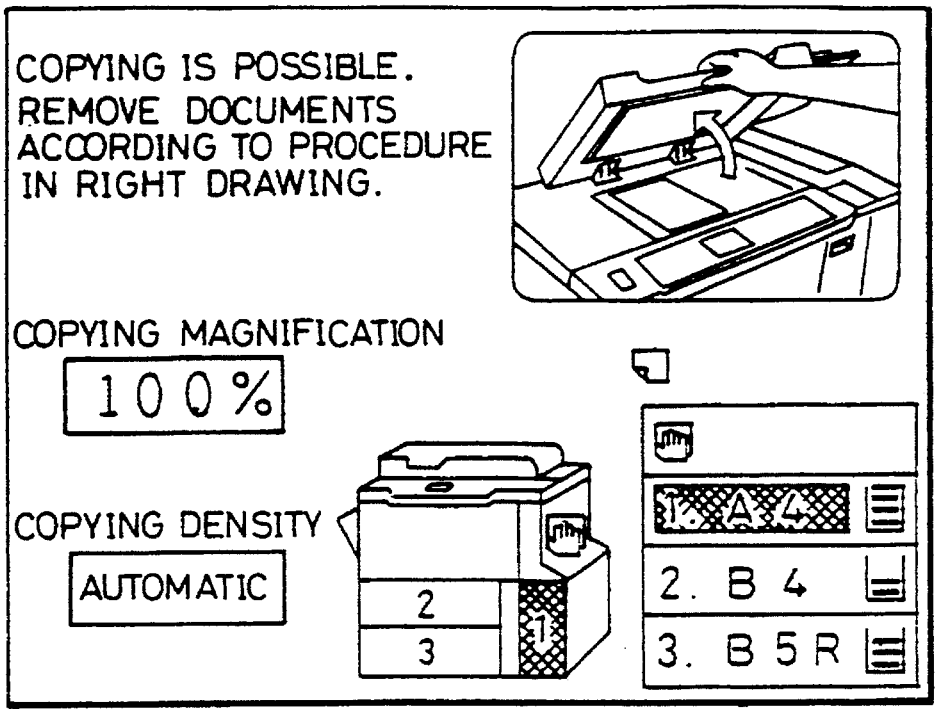
FIG. 102 is a view explaining a screen displaying a moving picture (S15) showing a cover opening operation in the first document removing operation guidance display show in FIG. 101.
Figure 103:
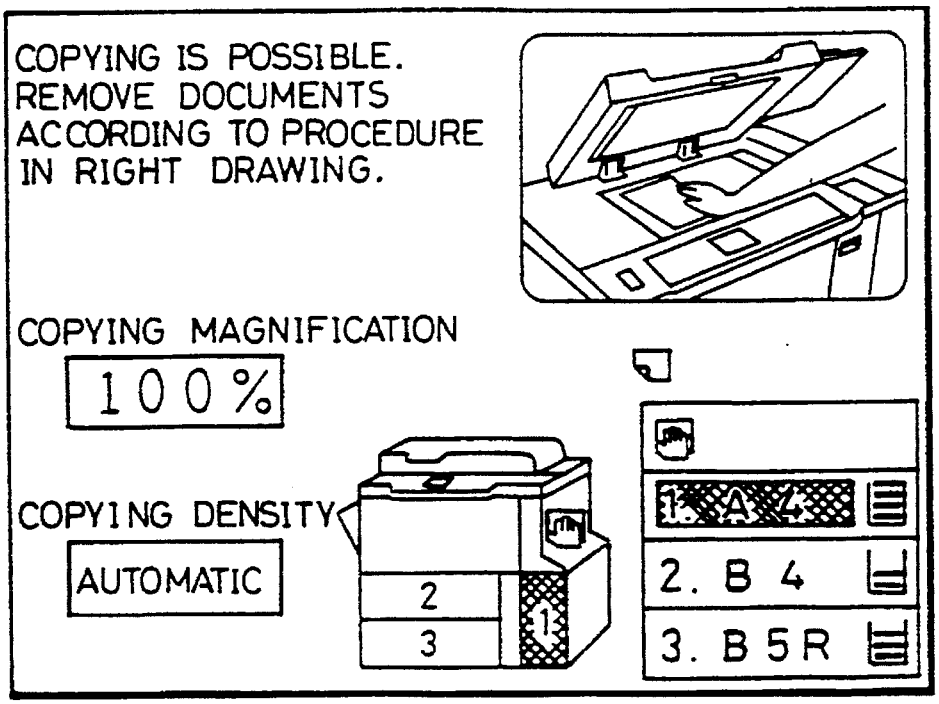
FIG. 103 is a view explaining a screen displaying a moving picture (S16) showing a document removing operation in the first document removing operation guidance display shown in FIG. 101.
Figure 104:
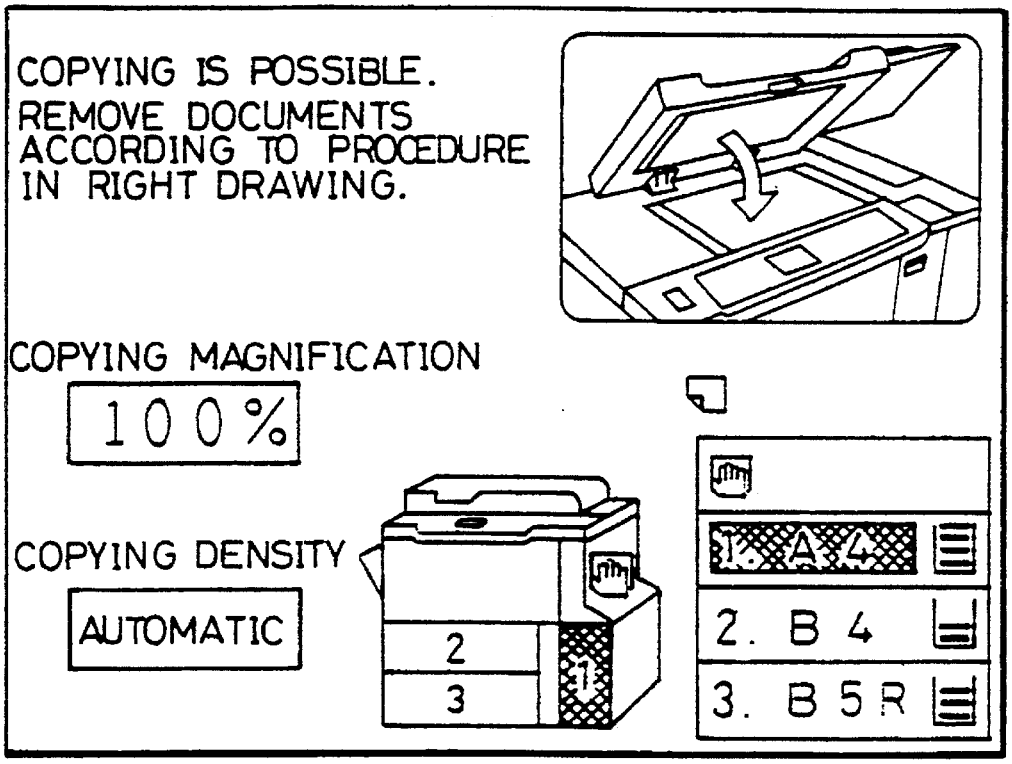
FIG. 104 is a view explaining a screen displaying a moving picture (S17) showing a cover closing operation in the first document removing operation guidance display shown in FIG. 101.

The above first document removing operation guidance shows a procedure for removing documents from the document platen. At S15 through S17, on the image processing screen displayed on the LCD 102, as shown in FIGS. 102 through 104, a message "Remove documents according to a procedure shown in right drawing" is displayed below the message "Copying is possible". Moreover, a dynamic image of FIG. 102 which shows an operation for opening the original cover, a dynamic image of FIG. 103 which shows an operation for removing documents and a dynamic image of FIG. 104 which shows an operation for closing the original cover are circularly displayed in a blank portion of the image processing screen. Here, FIGS. 102 through 104 shown here show images which are displayed on the LCD at a certain moment. Moreover, the first document removing operation guidance is displayed in a same manner as of the above option installing guidance.

In such a way, when a point in time copying is completed is detected and the first document removing operation guidance is automatically displayed as dynamic images, it is restrained that an operator forget to remove documents, so a secure operation is possible even when the operator first carries out copying.

Figure 105:
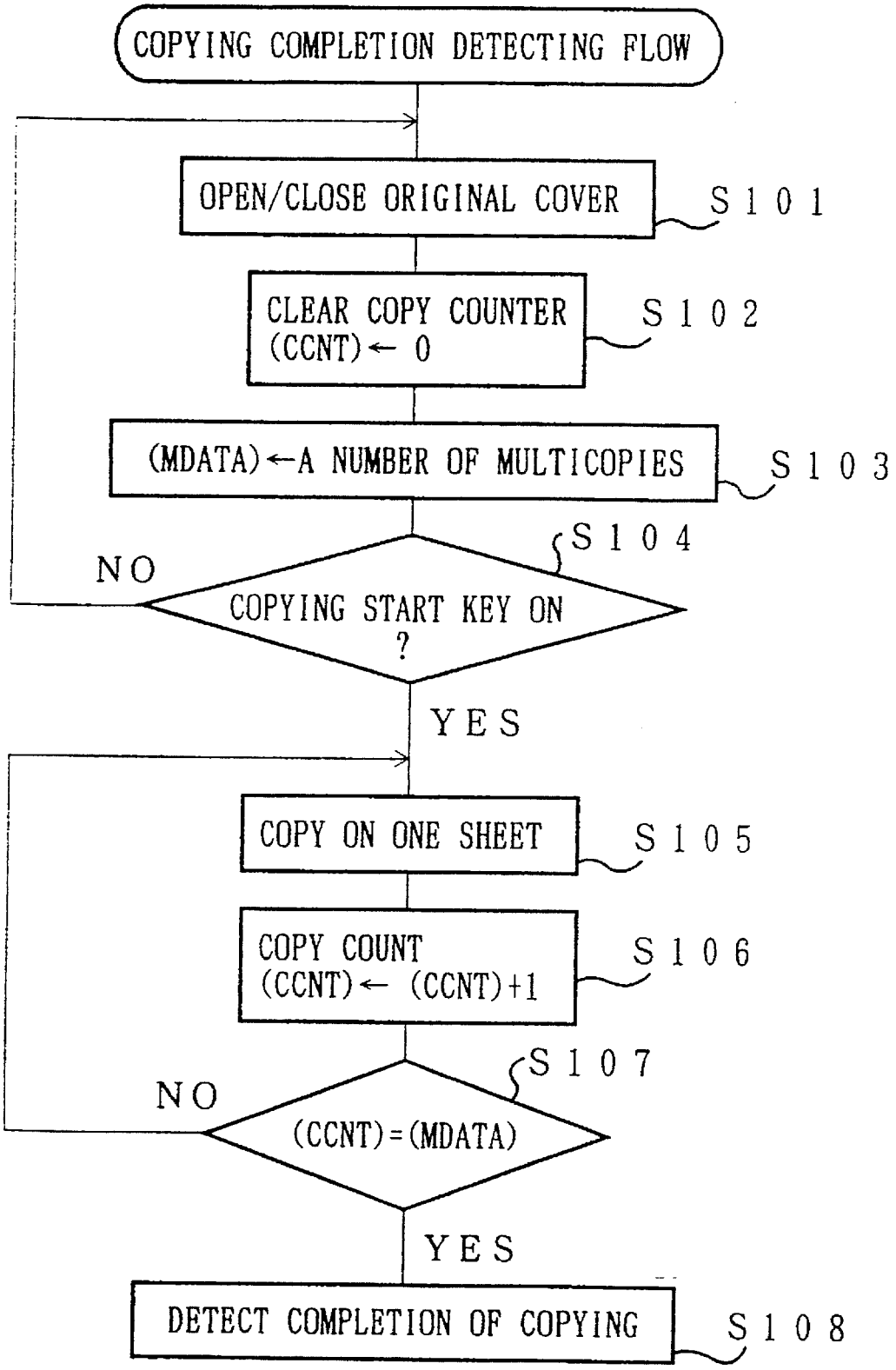
FIG. 105 is a flowchart detailing the procedure for detecting a time when copying is completed in a mode where a copy is made by opening an original cover.

The detection at the point in time copying is completed is performed according to the procedure shown in a flow chart of FIG. 105. In other words, when the open/close detecting sensor $Sb_1$' is switched ON - OFF -ON and detects that the original cover is opened and closed (S101), a copy counter (CCNT) for counting a number of copied sheets is cleared (S102), and a number of multi-copies is set as (MDATA) (S103). The sequences S101 through S103 are repeated (S104) until a judgement is made that a copying start key is turned ON. When the copying start key is turned ON, the counter counts up one by one every time when one copy is completed until a relationship: CCNT=MDATA holds (S105 through S107), and a point in time the relationship CCNT=MDATA holds at S107 is detected as the point in time the copying is completed (S108).

Figure 106:
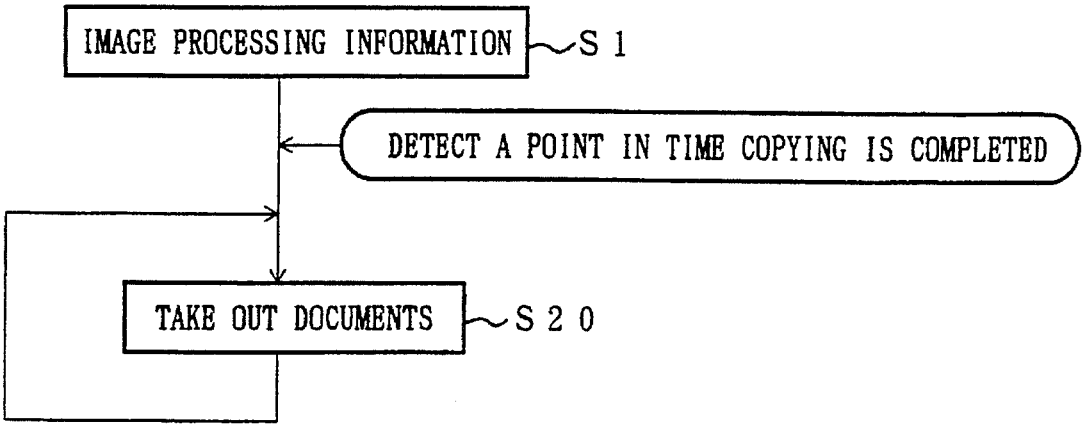
FIG. 106 is a flowchart detailing a second document removing operation guidance display by the operation guidance display apparatus of the above embodiment.

In addition, in the case where the copying in the copying mode for carrying out copying with automatic document feeding by the RDH 2 and an operator should remove the documents, in the copying apparatus, second document removing operation guidance for removing documents from the RDH 2 shown in FIG. 106 is displayed. Such operation guidance is displayed when a point in time copying is completed is detected, as mentioned later.

Figure 107:
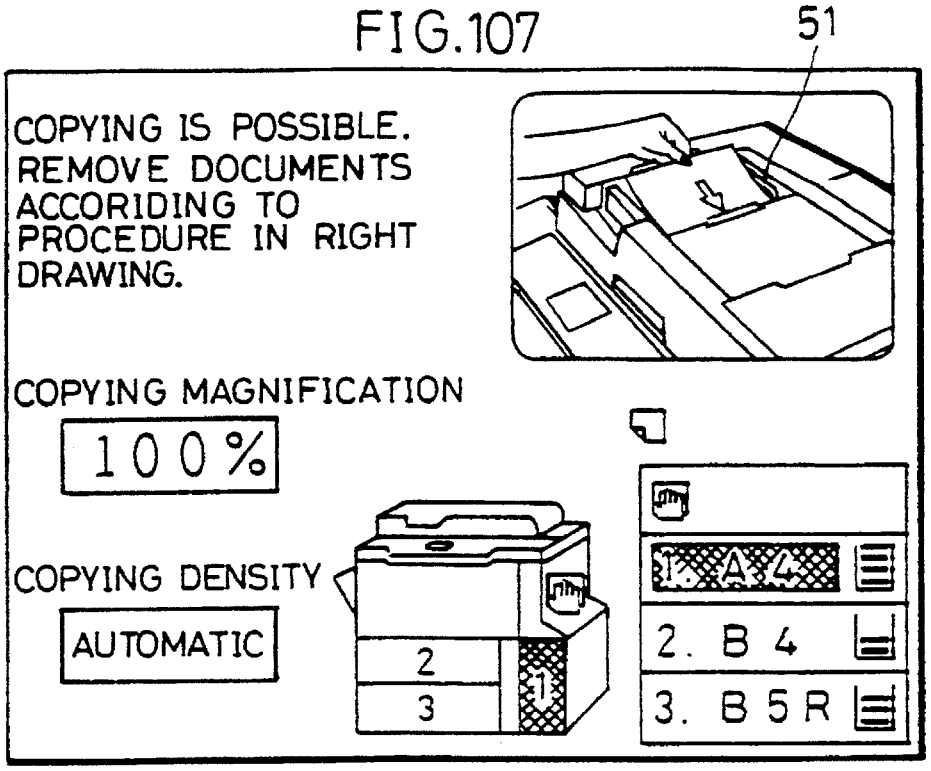
FIG. 107 is a view explaining a screen displaying a moving picture (S20) showing a document removing operation in the second document removing operation guidance display shown in FIG. 106.
Figure 108:
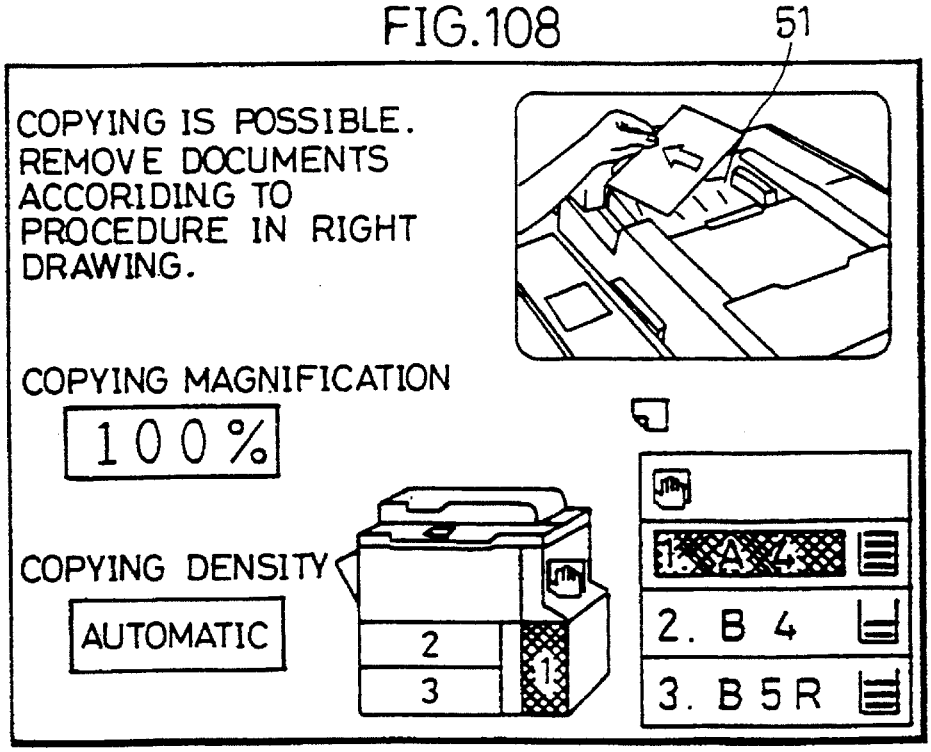
FIG. 108 is a view explaining a screen displaying the moving picture (S20) showing the document removing operation in the second document removing operation guidance display shown in FIG. 106.

The aforementioned second document removing operation guidance shows a procedure for removing documents from the document storing section 51 of the RDH 2. At S20, on the image processing screen displayed on the LCD 102, as shown in FIGS. 107 through 108, a message "Remove documents according to procedure shown in right drawing" is displayed below the message "Copying is possible". Dynamic images of FIGS. 107 and 108 which show an operation for removing the document from the document storing section 51 are displayed in a blank portion of the image processing screen. Here, FIGS. 107 and 108 shown here show images which are displayed on the LCD 102 at a certain moment. Moreover, the second document removing operation guidance is displayed in a same manner as of the above-mentioned option installing guidance.

In this way, when a point in time copying is completed is detected in a mode using the RDH 2 and the second document removing operation guidance is automatically displayed as dynamic images, it is restrained that an operator forget to remove documents, so a secure operation is possible even when an operator first carries out copying using the RDH 2.

Figure 109:
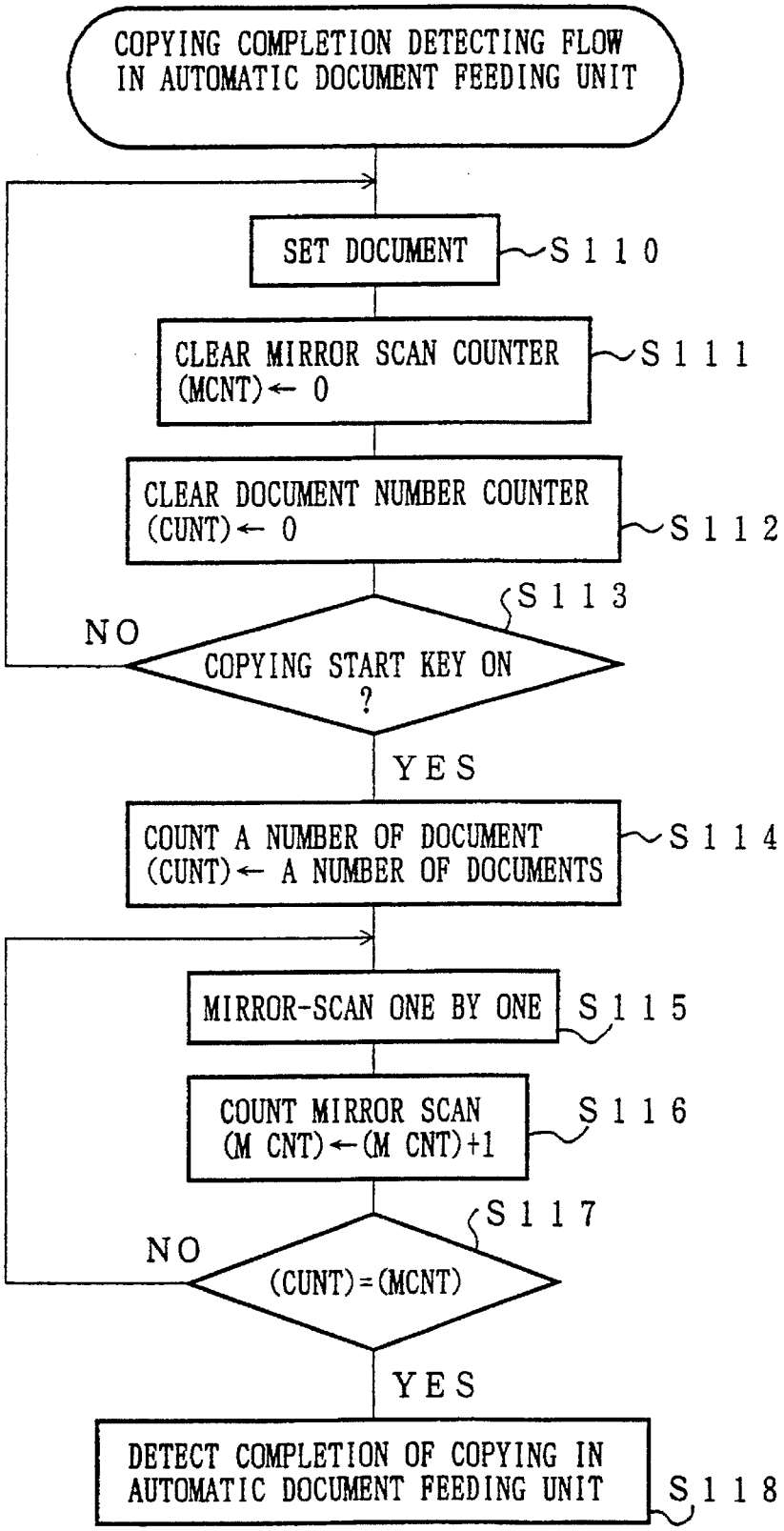
FIG. 109 is a flowchart detailing the procedure for detecting a time when copying is completed in a mode where a copy is made by automatic document feeding.

Such a detection at the point in time copying is completed using the RDH 2 is made according to the procedure shown in a flow chart of FIG. 109. In other words, when documents are set on the document storing section 51 (S110), a mirror scan counter (MCNT) for counting a number of scanning by a mirror is cleared (S111), and a document number counter (CUNT) is cleared (S112). The sequences S110 through S112 is repeated until a judgement is made that the copy start key is turned ON (S113), and when the copy start key is turned ON, a number of documents is counted by CUNT (S114). Mirror scanning is carried out on each document, and the counter counts up one by one every time the scanning is completed until a relationship: CUNT=MCNT holds (S115 through S117). A point in time when the relationship: CUNT=MCNT is detected as the point in time the copying is completed using the RDH 2 (S118).

Figure 110:
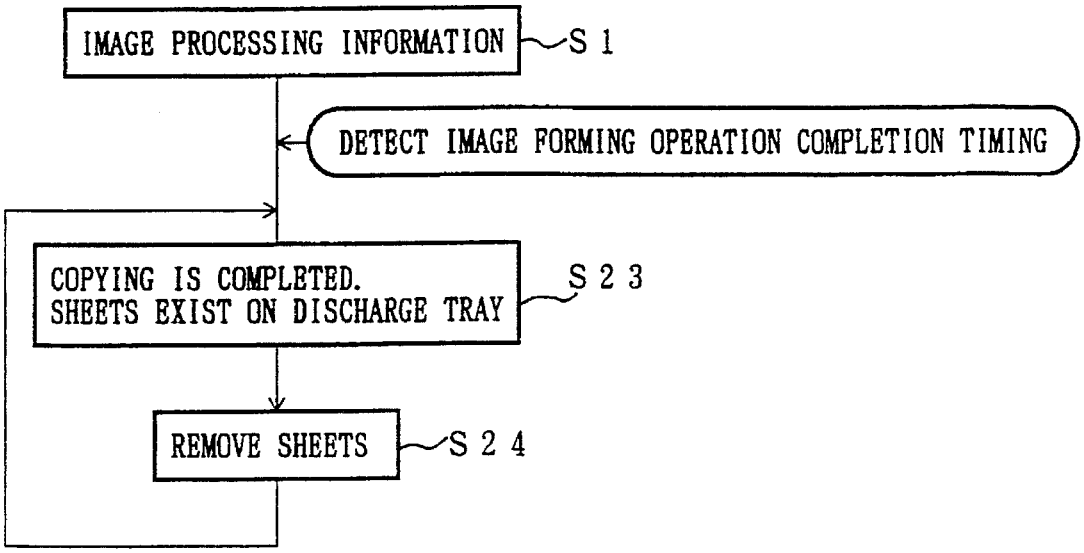
FIG. 110 is a flowchart detailing a first discharged sheet removing operation guidance display by the operation guidance display apparatus in the above embodiment.

In addition, in the copying apparatus, in the case where an image forming operation at a discharge section is completed and an operator should remove discharge sheets, first discharge sheet removing operation guidance of FIG. 110 for removing discharge sheets is displayed. Such operation guidance is displayed when timing the image forming operation is completed is detected as mentioned later.

Figure 111:
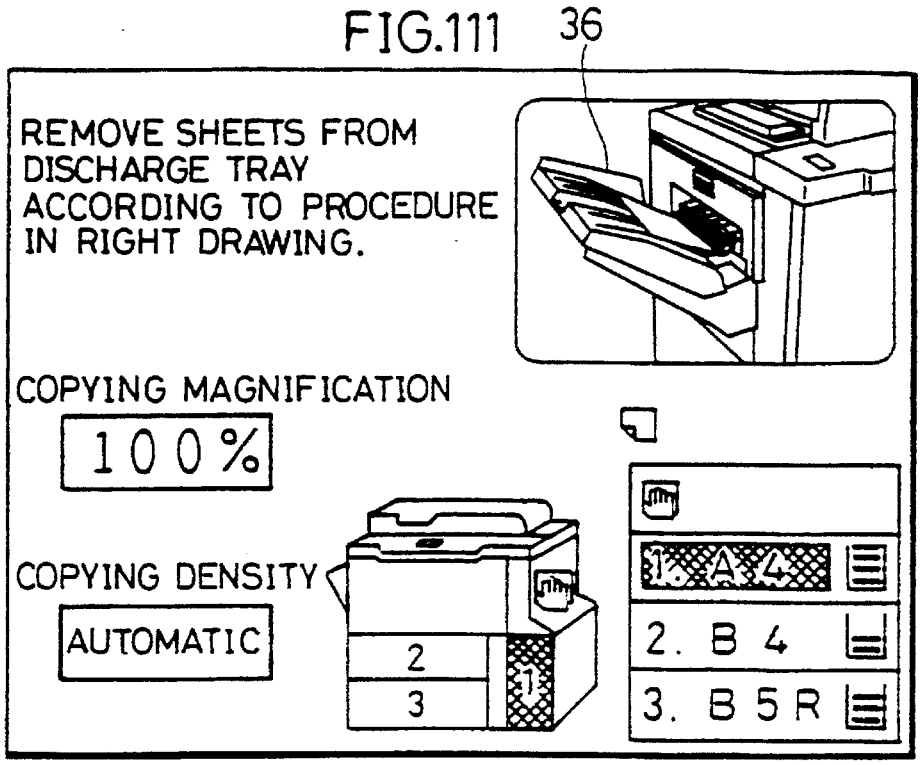
FIG. 111 is a view explaining a screen displaying a moving picture (S23) showing a state that there is a sheet on a releasing tray when the copying is completed in the first discharged sheet removing operation guidance display shown in FIG. 110.
Figure 112:
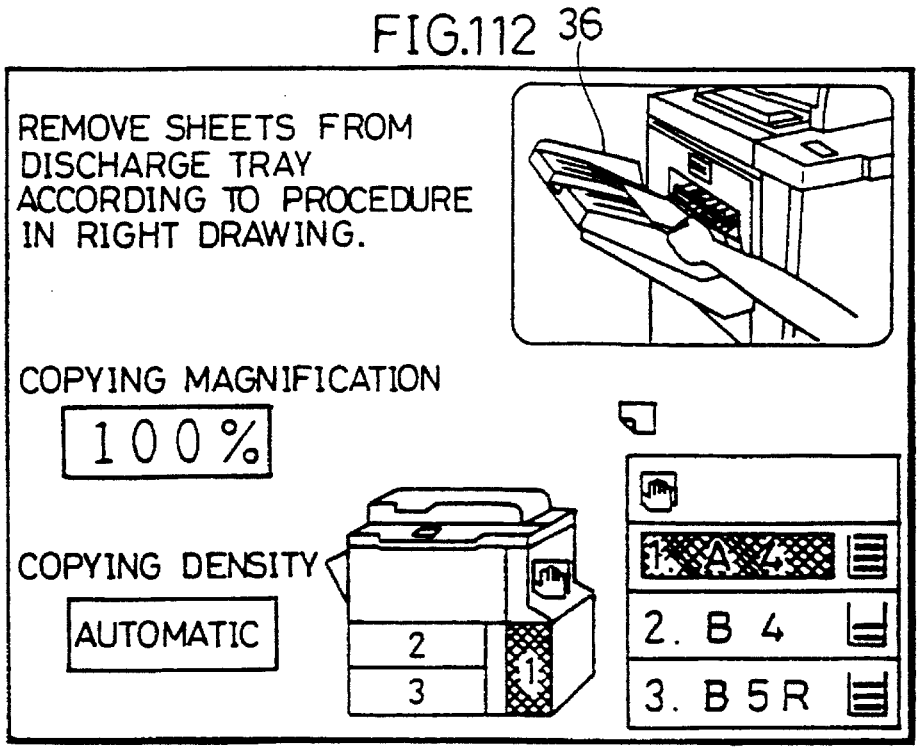
FIG. 112 is a view explaining a screen displaying a moving picture (S24) showing an operation for removing the sheet from the releasing tray when the copying is completed in the first discharged sheet removing operation guidance display shown in FIG. 110.
Figure 113:
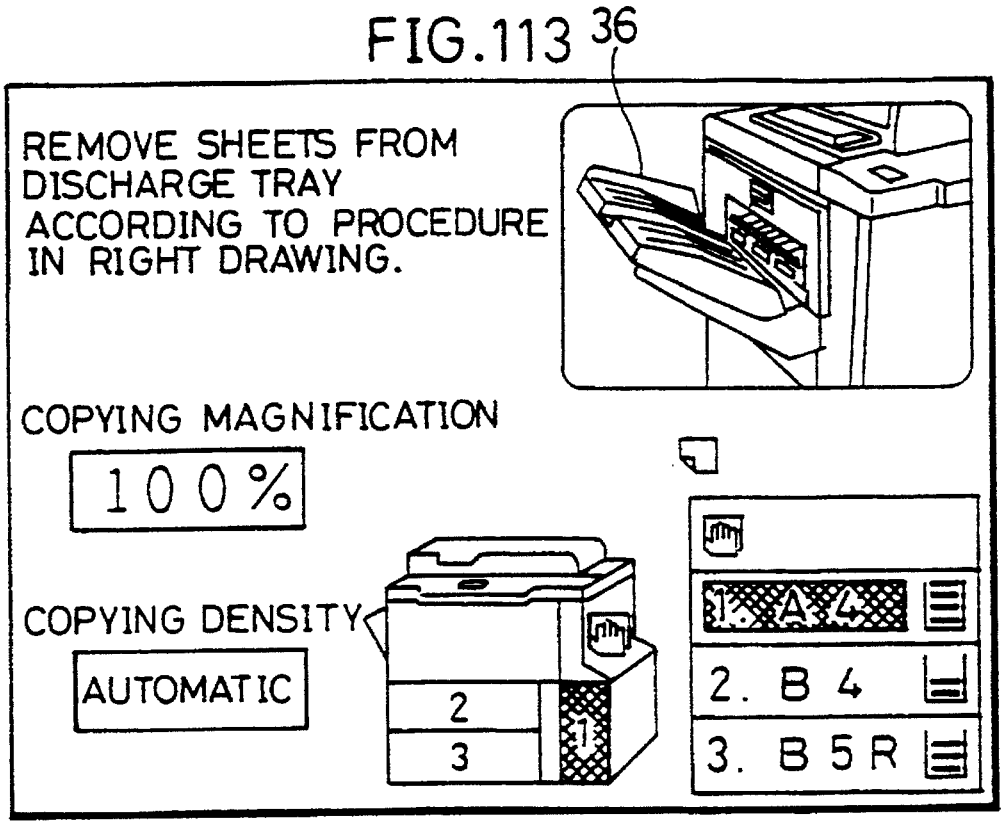
FIG. 113 is a view explaining a screen displaying the moving picture (S24) showing the operation for removing the sheet from the releasing tray when the copying is completed in the first discharged sheet removing operation guidance display shown in FIG. 110.

The first discharge sheet removing operation guidance shows a procedure for removing discharge sheets. At S23 and S24, on the image processing screen displayed on the LCD 102, as shown in FIGS. 111 through 113, a message "Remove sheets from discharge tray according to procedure in right drawing" is displayed instead of the message "Copying is possible". Moreover, a dynamic image of FIG. 111 which shows a state that sheets are stored on the discharge tray 36, and a dynamic image of FIGS. 112 and 113 which shows an operation for removing sheets are circularly displayed in a blank portion of the image processing screen. Here, FIGS. 111 through 113 shown here show images displayed on the LCD 102 at a certain moment. Further, the first discharge sheet removing operation guidance is displayed in a same manner as of the option installing guidance.

In such a way, when completion of the image forming operation in the discharge section is detected and the first discharge sheet removing operation guidance as the dynamic images is automatically displayed, an operator can safely and securely perform the operation without damaging the documents.

Figure 114:
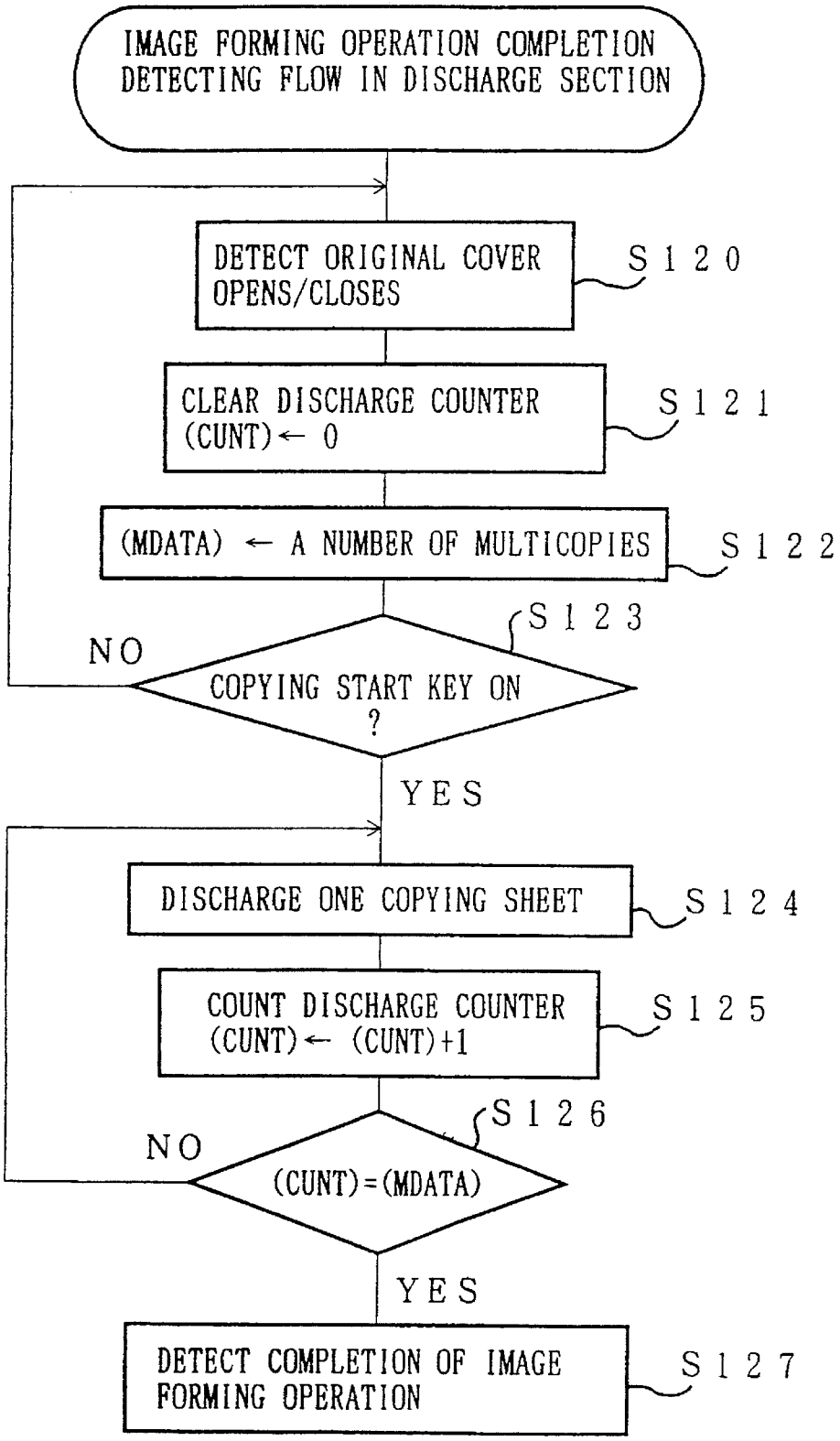
FIG. 114 is a flowchart detailing the procedure for detecting the completion of an image forming operation by a releasing unit.

Such detection of the completion of the image forming operation in the discharge section is carried out according to a procedure shown in a flow chart of FIG. 114. In other words, the open/close detecting sensor $Sb_1'$ is switched ON - OFF - ON, and when a detection is made that the original cover is opened and closed (S120), a discharge counter (CUNT) for counting a number of discharge sheets is cleared (S121), and a number of multi-copies is set as (MDATA) (S122). The procedures S120 through S122 is repeated until a judgement is made that the copy start key is turned ON (S123), and when the copy start key is turned ON, the counter counts up one by one every time a copied sheet is discharged (S124 through S126) until a relationship: CUNT=MDATA holds. when the relationship: CUNT=MDATA holds at S126, a detection is made that the image forming operation is completed in the discharge section (S127).

Figure 115:
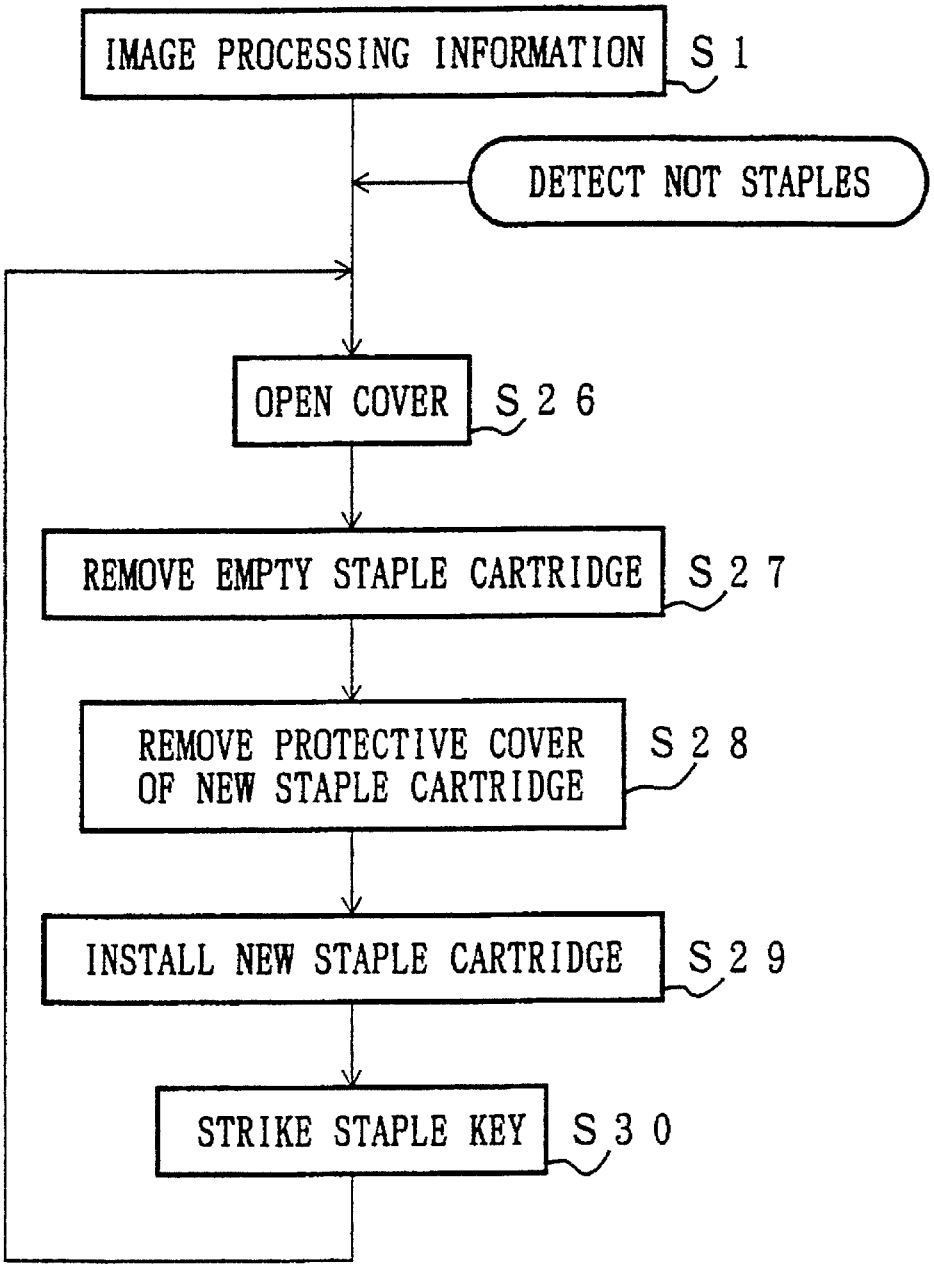
FIG. 115 is a flowchart detailing a staple supplying operation guidance display by the operation guidance display apparatus of the above embodiment.
Figure 116:
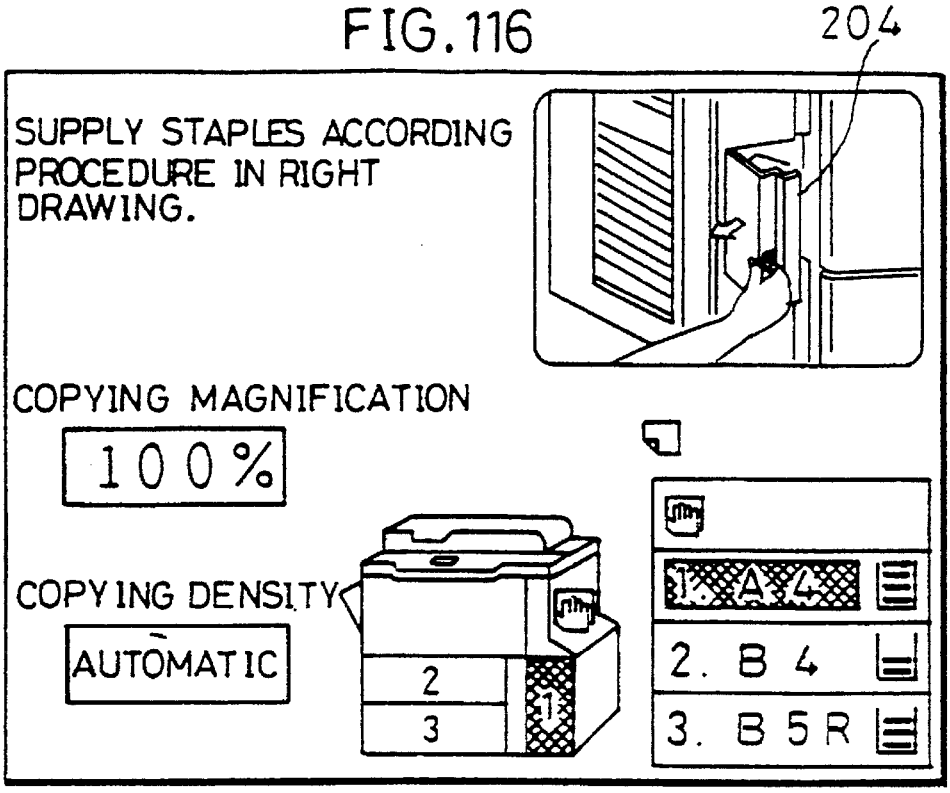
FIG. 116 is a view explaining a screen displaying a moving picture (S26) showing a cover opening operation in the staple supplying operation guidance display shown in FIG. 115.
Figure 117:
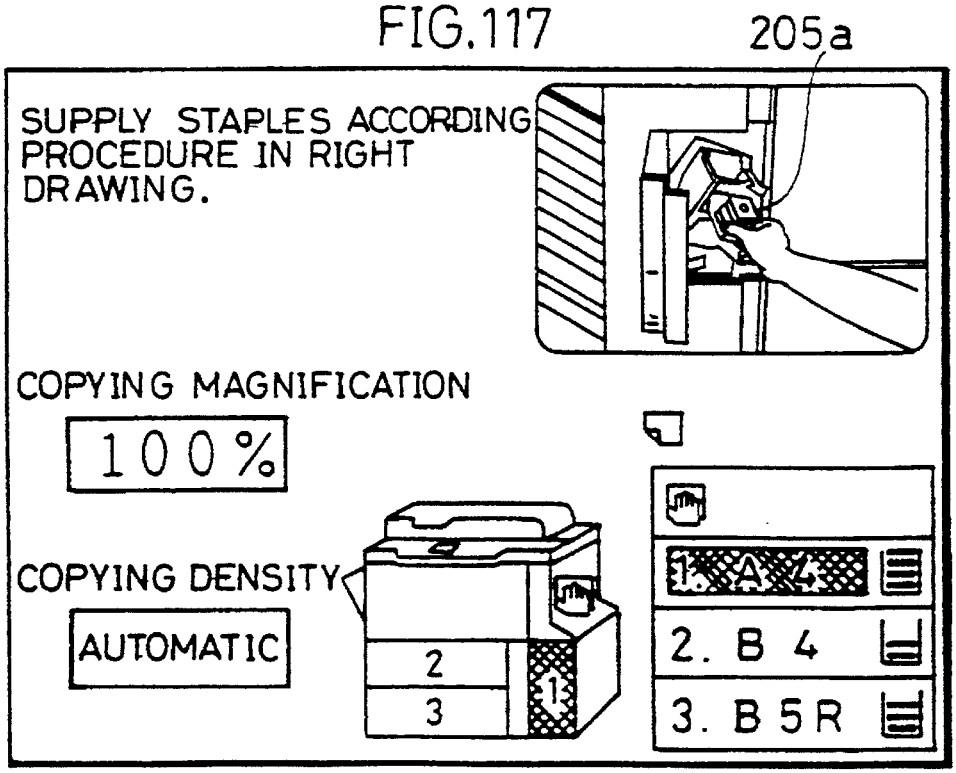
FIG. 117 is a view explaining a screen displaying a moving picture (S27) showing an operation for removing an empty staple cartridge in the staple supplying operation guidance display shown in FIG. 115.
Figure 118:
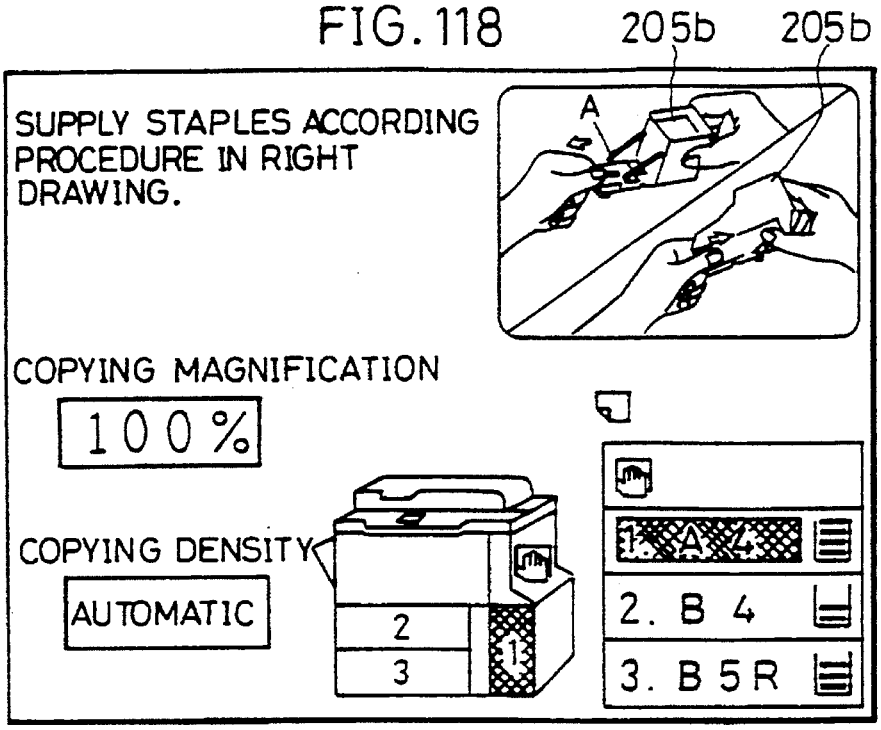
FIG. 118 is a view explaining a screen displaying a moving picture (S28) showing an operation for removing a protecting cover of a new staple cartridge in the staple supplying operation guidance display shown in FIG. 115.
Figure 119:
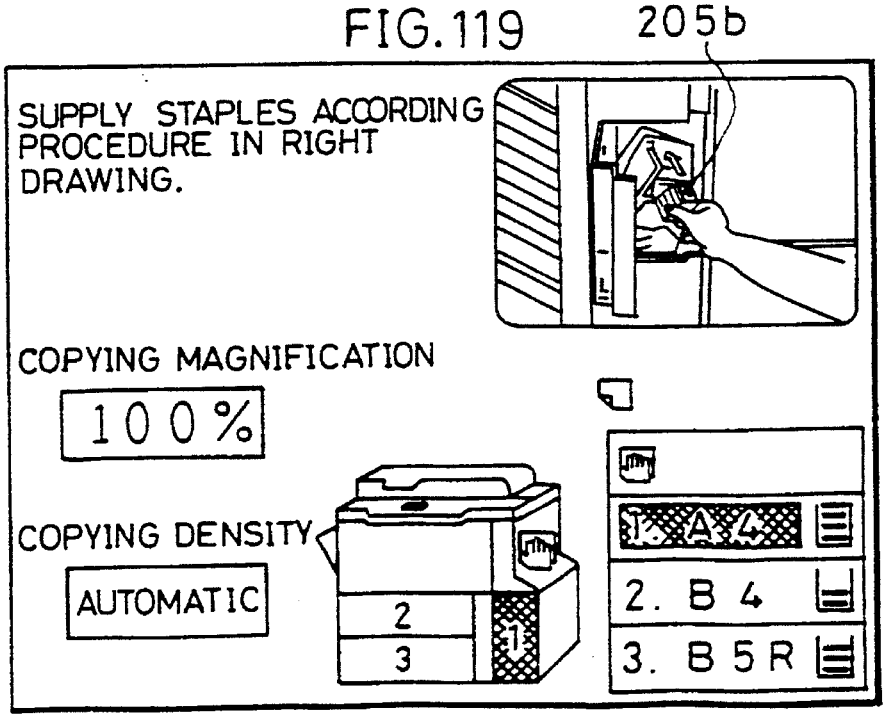
FIG. 119 is a view explaining a screen displaying a moving picture (S29) showing a new staple cartridge installing operation in the staple supplying operation guidance display shown in FIG. 115.
Figure 120:
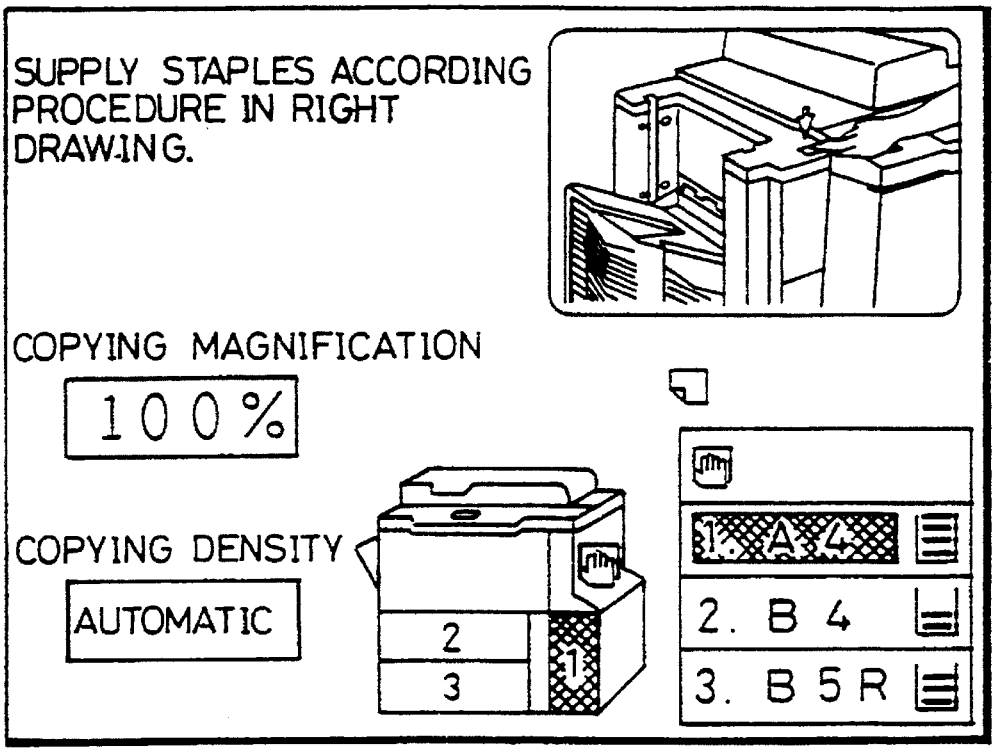

In addition, in the case where staples run out in the stapler unit 48 and the operator should supply staples, in the copying apparatus, staple supplying operation guidance of FIG. 115 for supplying staples is displayed. The above operation guidance is displayed when the staple detecting sensor $Sa_7'$ in the stapler unit 48 is switched from ON from OFF so as to detect non-existence of staples.

The above staple supplying operation guidance shows a procedure for supplying staples. At S26 through S30, on the image processing screen displayed on the LCD 102, as shown in FIGS. 116 through 120, a message "Supply staples according to procedure shown in right drawing" is displayed instead of the message "Copying is possible". Moreover, a dynamic image of FIG. 116 which shows an operation for opening a cover 204 in the vicinity of the stapler unit, a dynamic image of FIG. 117 which shows an operation for removing an empty staple cartridge 205*a*, a dynamic image of FIG. 118 which shows an operation for removing a protective cover of a new staple cartridge 205*b*, a dynamic image of FIG. 119 which shows an operation for installing the new staple cartridge 205*b* and a dynamic image of FIG. 120 which shows an operation for pushing a staple key are circularly displayed in a blank portion of the image processing screen. Furthermore, a simple message "Protective conver" is also displayed in a portion A of the dynamic image of FIG. 118. Here, FIGS. 116 through 120 shown here show images displayed on the LCD 102 at a certain moment. Moreover, the staple supplying operation guidance is displayed in a same manner as of the option installing guidance.

In this way, when the non-existence of staples is detected and the staple supplying operation guidance is automatically displayed as dynamic images, even if an operator first supplies staples or it is hard for the operator to understand its operation, the operator can safely and securely perform the operation seeing the dynamic images.

Figure 121:
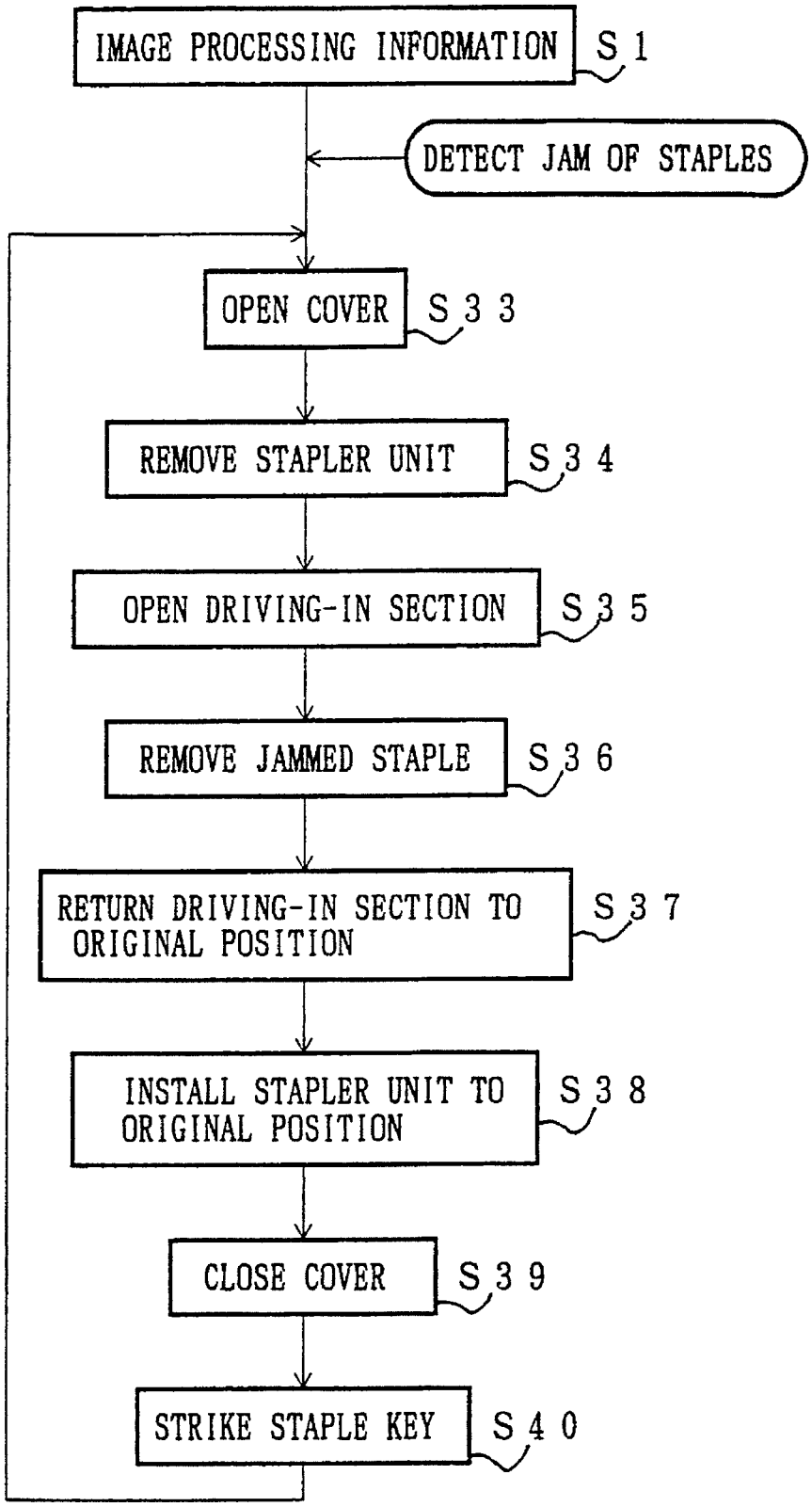
Figure 122:
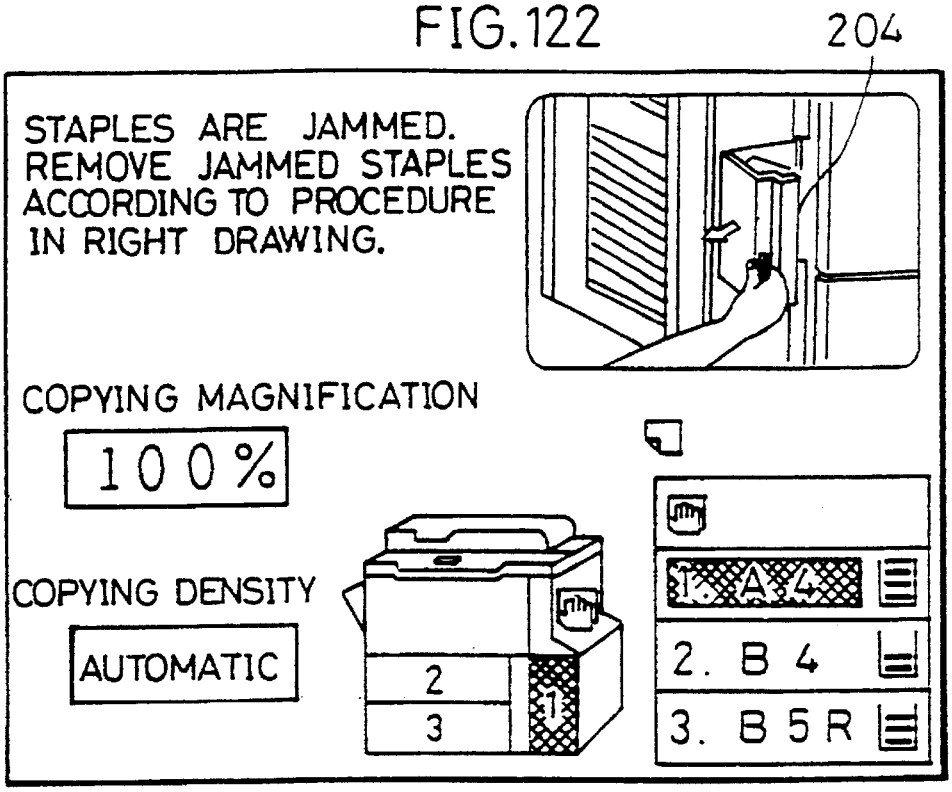
Figure 123:
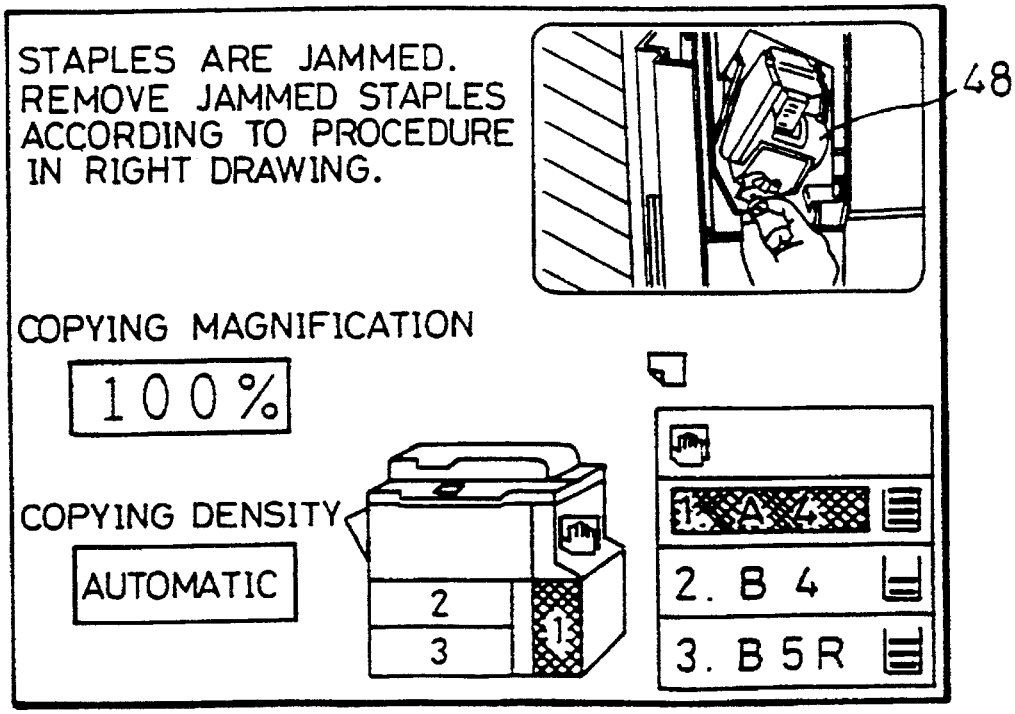
Figure 124:
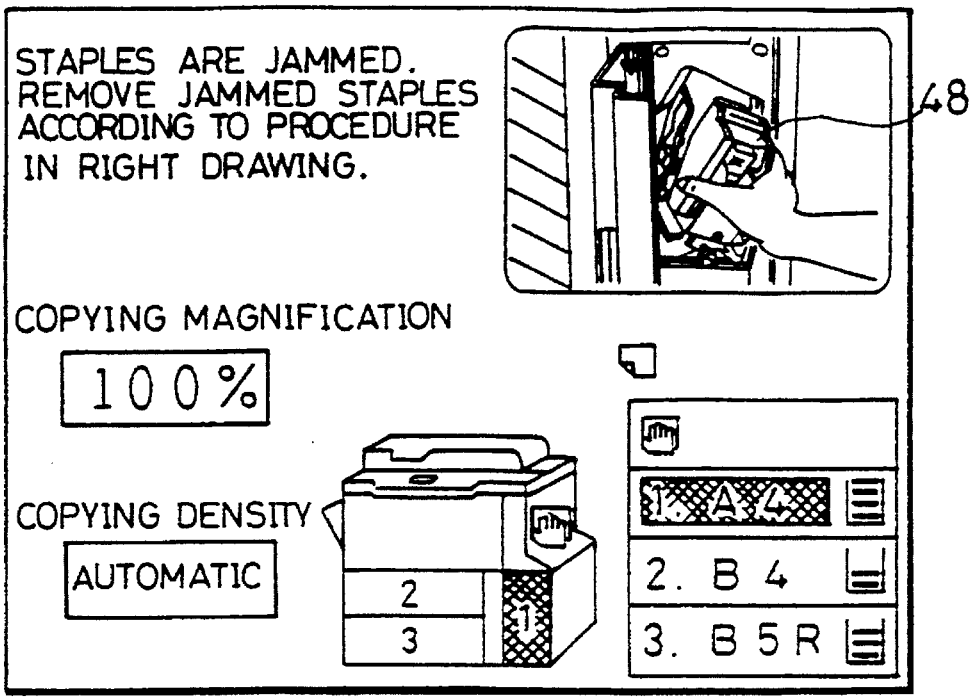
Figure 125:
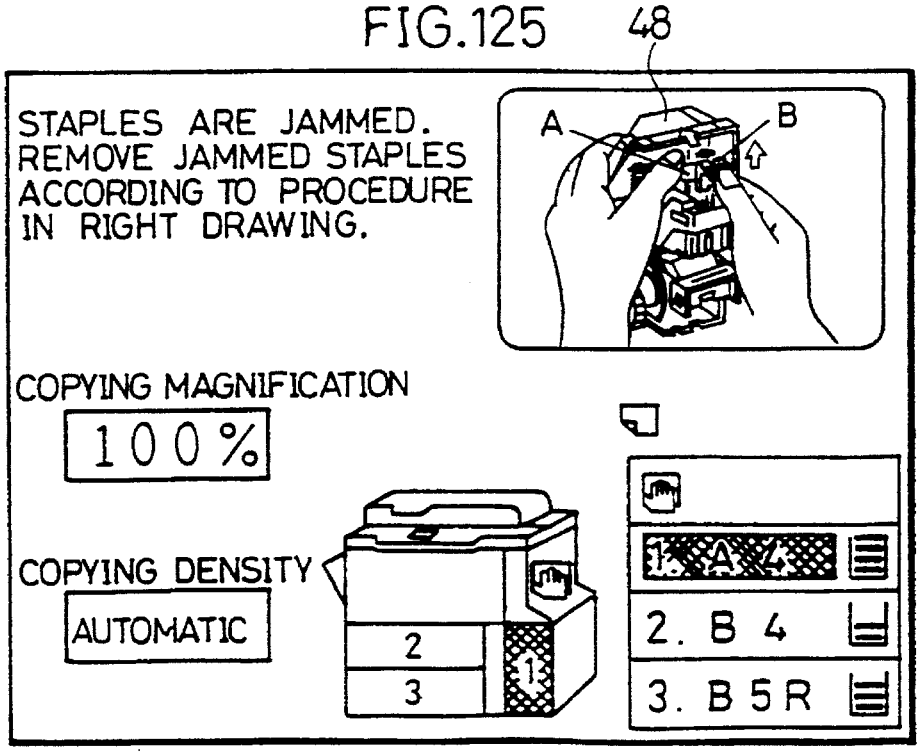
Figure 126:
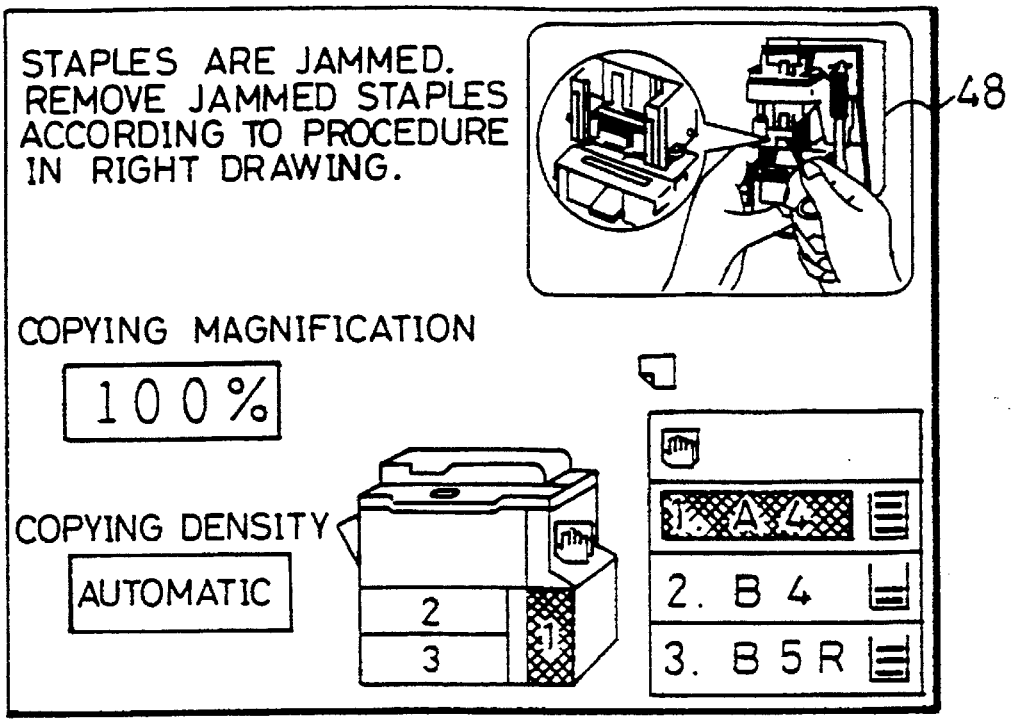
Figure 127:
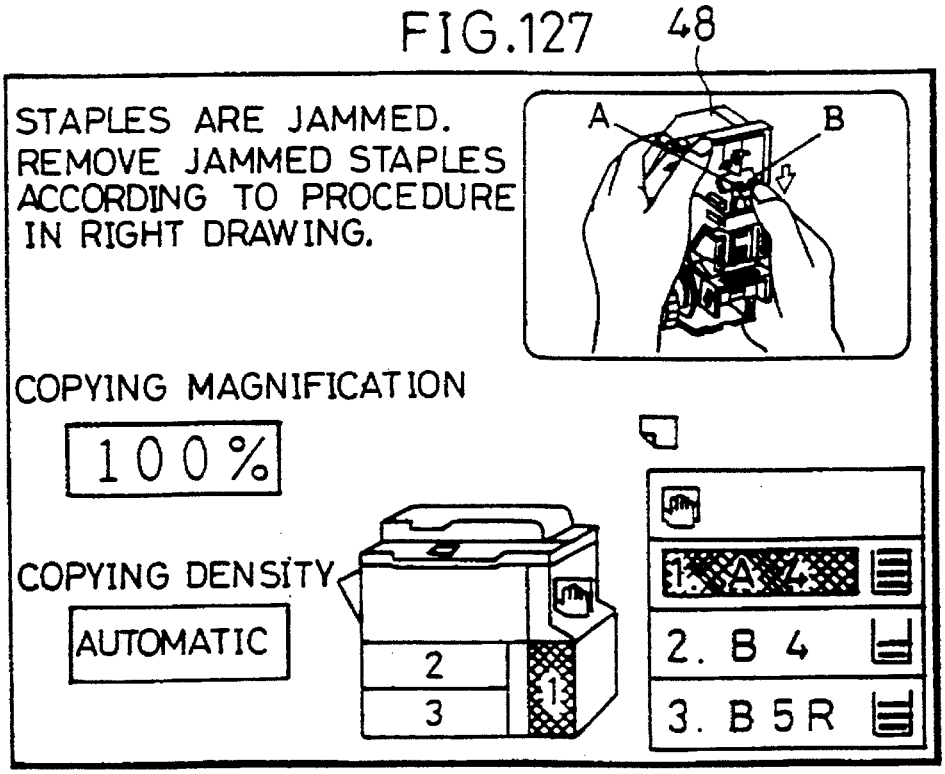
Figure 128:
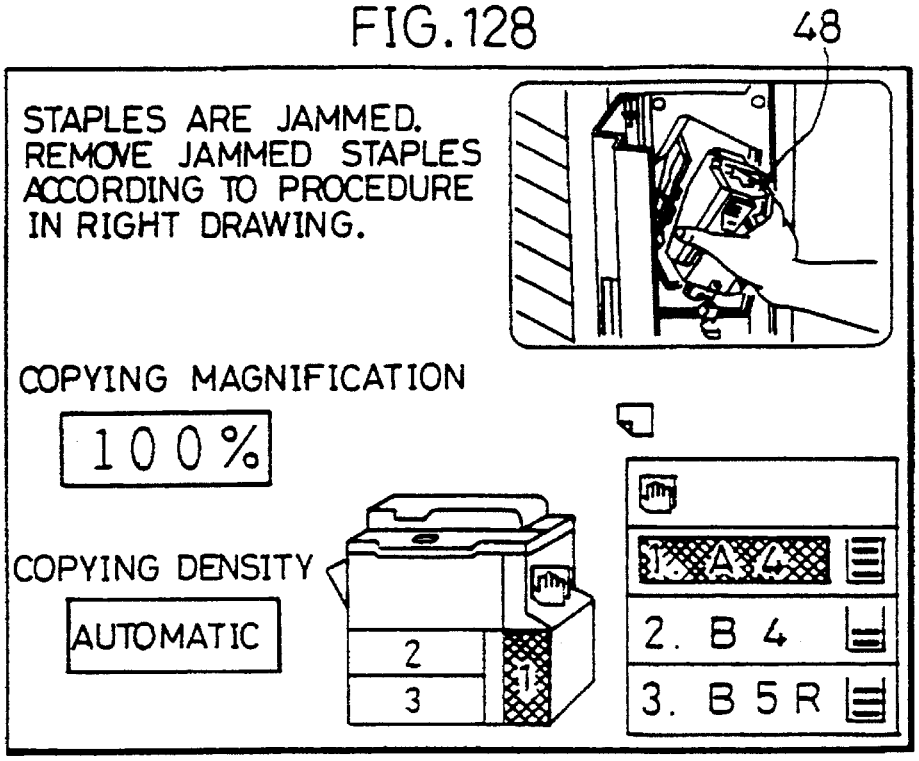
Figure 129:
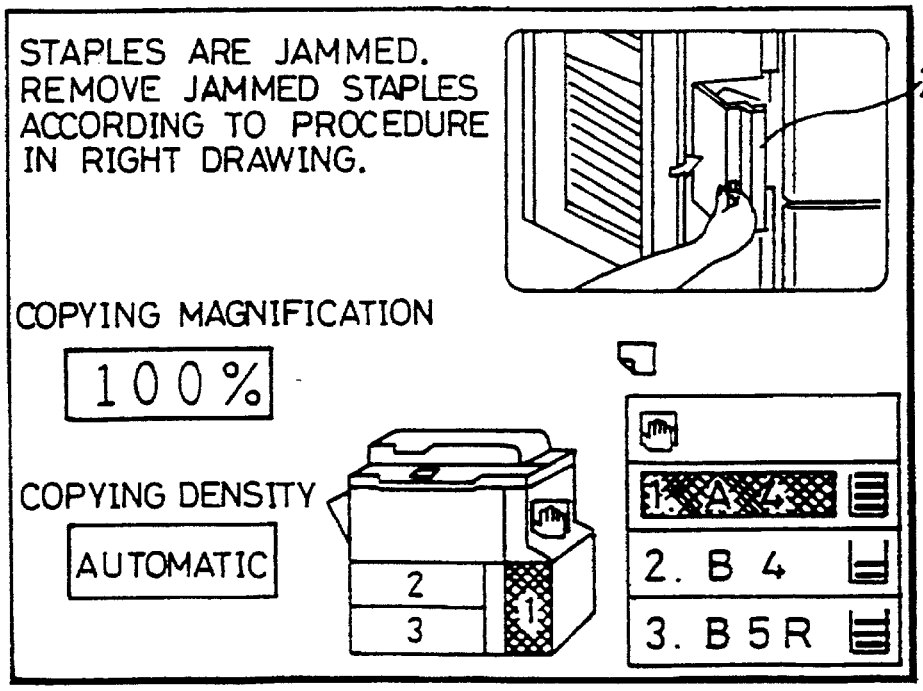
Figure 130:
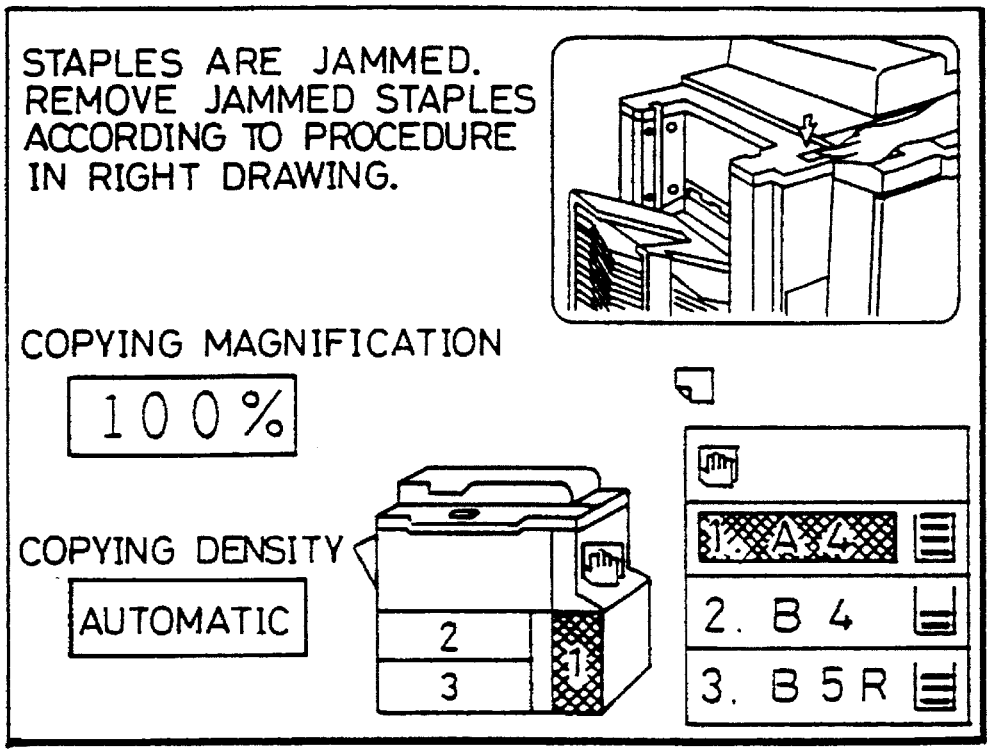

In addition, in the case where jam of staples occurs in the stapler unit 48 and an operator should remove the jammed staples, in the copying apparatus, staple restoring operation guidance of FIG. 121 for removing the jam of staples is displayed. The above guidance is displayed when the jam of staples is detected in the case where the home position detecting sensor $Sa_6'$ provided in the finisher 33 is not turned ON because the stapler unit 48 does not return to its home position within prescribed time after a stapling operation.

The above staple restoring operation guidance shows a procedure for dispelling jam of staples by removing jammed staples. At S33 through S40, on the image processing screen displayed on the LCD 102, as shown in FIGS. 122 through 130, a message "Staples are jammed. Remove staples according to procedure in right drawing" is displayed instead of the message "Copying is possible". Moreover, a dynamic image of FIG. 122 which shows an operation for opening the cover 204 in the proximity of the stapler unit, a dynamic image of FIGS. 123 and 124 which shows an operation for removing the stapler unit 48, a dynamic image of FIG. 125 which shows an operation for opening a driven section in the stapler unit 48, a dynamic image of FIG. 126 which shows an operation for removing jammed staples, a dynamic image of FIG. 127 which shows an operation for returning the driven section to an original position, a dynamic image of FIG. 128 which shows an operation for installing the stapler unit 48 to the original position, a dynamic image of FIG. 129 which shows an operation for closing the cover 204 and a dynamic image of FIG. 130 which shows an operation for pushing the staple key are circularly displayed in a blank portion of the image processing screen. Furthermore, simple messages "Green release lever" and "Green lever", etc. are also displayed in a portion A and B of the dynamic images in FIGS. 125 and 127 respectively, and this makes the operation easier. Here, FIGS. 122 through 130 shown here show images displayed on the LCD 102 at a certain moment. Moreover, the staple restoring operation guidance is displayed in a same manner as of the option installing guidance.

In this way, when the jam of staples is detected and the staple restoring operation guidance is automatically displayed as dynamic images, even if an operator first removes jammed staples or it is hard for the operator to understand its operation, the operator can safely and securely perform the operation seeing the dynamic images.

Figure 80:
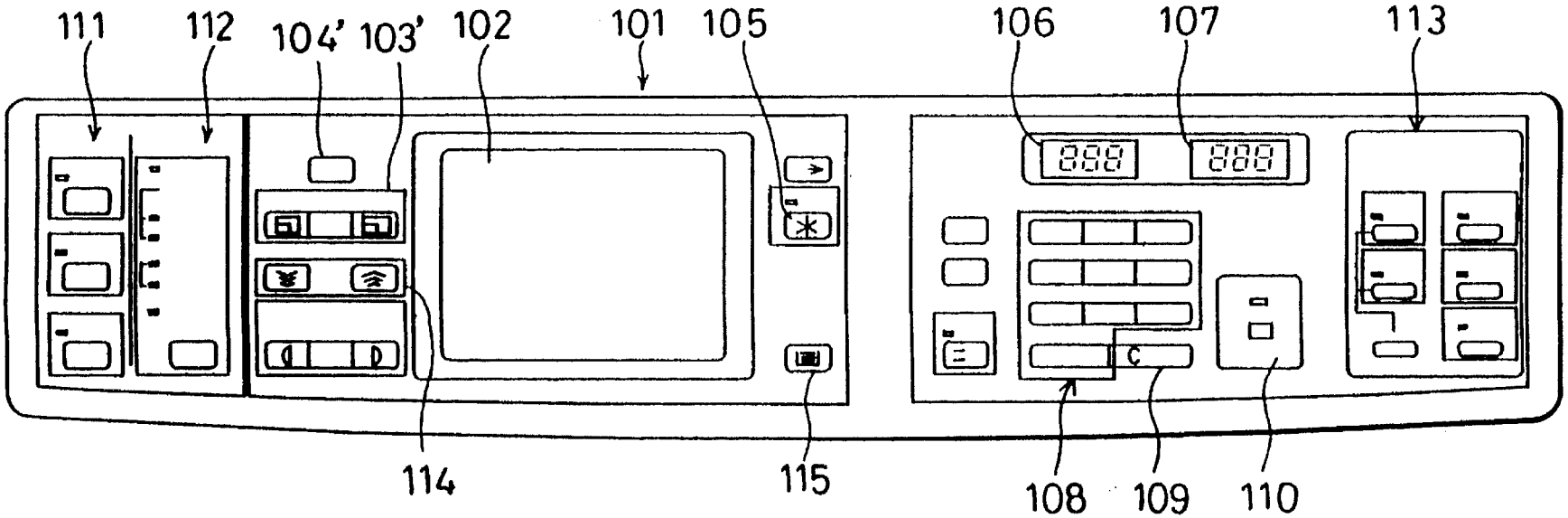
FIG. 80 is a front view of a manipulation panel provided for the copying machine shown in FIG. 2.

In addition, in the case where the disposed toner bottle 75 is full and an operator should replace the disposed toner bottle 75, in the copying apparatus, disposed toner bottle replacing operation guidance of FIG. 80 for replacing the disposed toner bottle 75 is displayed. The above operation guidance is displayed when the disposed toner full detecting sensor $Sa_9'$ is switched from OFF to ON so as to detect that the disposed toner bottle 75 is full.

The disposed toner bottle replacing operation guidance shows a procedure for replacing the disposed toner bottle 75 for a new one. At S42 through S45, on the image processing screen displayed on the LCD 102, as shown in FIGS. 132 through 135, a message "Full of disposed toner. Remove disposed toner according to a procedure shown in right drawing" is displayed instead of the message "Copying is possible". Moreover, a dynamic image of FIG. 132 which shows an operation for opening the disposed toner bottle unit cover 74, a dynamic image of FIG. 133 which shows an operation for taking out the old disposed toner bottle 75*a*, a dynamic image of FIG. 134 which shows an operation for installing the new disposed toner bottle 75*b* and a dynamic image of FIG. 135 which shows an operation for closing the disposed toner bottle unit cover 74 are circularly displayed in a blank portion of the image processing screen. Furthermore, a simple message "Cap" is also displayed in a portion A of the dynamic image in FIG. 133, this makes the operation easier. Here, FIGS. 132 through 135 shown here show images displayed on the LCD 102 at a certain moment. Moreover, the disposed toner bottle replacing operation guidance is displayed in a same manner as of the option installing guidance.

In this way, when a detection is made that the disposed toner bottle is full and the disposed toner bottle replacing operation guidance is automatically displayed as dynamic images, even if an operator first replaces the disposed toner bottle and or it is hard for the operator to understand its operation, the operator can grasp a summary of its whole operation, thereby making it possible to safely and securely perform the operation.

In addition, in the case where in a copying mode using the manual document storing section 69 of the RDH 2, a detection is made that documents are stored and an operator should adjust a document storing state, in the copying apparatus, document storing state adjusting operation guidance of FIG. 136 for adjusting a document storing state of the manual document storing section 69 is displayed. The above operation guidance is displayed when the document sensor $Sb_2'$ provided to the RDH 2 is switched OFF to ON so as to detect documents. A size of documents is detected by the document length detecting sensor $Sb_3'$ and the document width detecting sensor $Sb_4'$.

The document storing state adjusting operation guidance shows a procedure for setting documents in a proper position of the manual document storing section 69. At S47 through S50, on the image processing screen displayed on the LCD 102, as shown in FIGS. 137 through 140, a message "Adjust document storage according to procedure shown in right drawing" is displayed below the message "Copying is possible". Moreover, a dynamic image of FIG. 137 which shows for an operation for confirming that documents do not remain on the document platen of the document exposing section 3 under the RDH 2, a dynamic image of FIG. 138 which shows an operation for adjusting the document backward end guide 80 and the document guide 81 of the document storing section 51 in the RDH to a maximum size, a dynamic image of FIG. 139 which shows an operation for adjusting the manual insertion document guide 82 of the manual insertion storing section 69 to a size of documents and a dynamic image of FIG. 140 which shows an operation for inserting documents on the manual document storing section 69 with its surface facing downward are circularly displayed in a blank portion of the image processing screen. Moreover, simple messages "Document guide" and "Document backward end guide" are also displayed in a portion A and B of the dynamic image shown in FIG. 138. Here, FIGS. 137 through 140 shown here show images displayed on the LCD 102 at a certain moment. Furthermore, the document storing state adjusting operation guidance is displayed in a same manner as of the option installing guidance.

In this way, when in the copying mode using the manual insertion document storing section 69 in the RDH 2, detection is made that documents are stored and the document storing state adjusting operation guidance is automatically displayed as dynamic images, even if an operator first carries out copying using the RDH 2, the operator can securely set documents.

In addition, in the case where in the automatic magnification setting mode or the automatic sheet selecting mode using the manual document storing section 69 in the RDH 2, detection is made that documents are stored and an operator should change a direction of documents, in the copying apparatus, document direction changing operation guidance of FIG. 141 for changing a direction of document is displayed.

The above document direction changing operation guidance is displayed when the document sensor $Sb_2'$ provided to the RDH 2 is switched from OFF to ON so as to detect documents. A size of documents is detected by the document length detecting sensor $Sb_3'$ and the document width detecting sensor $Sb_4'$. The automatic magnification setting mode is a mode for automatically setting a magnification according to a size of documents and a selected size of documents, and the automatic sheet selecting mode is a mode for automatically selecting sheets according to a magnification and a size of documents.

The document direction changing operation guidance shows a procedure for restoring the documents in a proper direction of the manual document storing section 69. At S52 through S54, on the image processing screen displayed on the LCD 102, as shown in FIGS. 142 through 144, a message "Change direction of document according to procedure shown in right drawing" is displayed below the message "Copying is possible". Moreover, a dynamic image of FIG. 142 which shows an operation for taking out documents from the manual document storing section 69, a dynamic image of FIG. 143 which shows an operation for opening the auxiliary tray 205 and a dynamic image of FIG. 144 which shows an operation for setting documents are circularly displayed in a blank portion of the image processing screen. For example in the case where the automatic magnification setting mode is set, a size of a document is A4 and a size of a sheet is A3, a magnification is automatically set as 141%, and the guidance for setting a direction of the document as an A4R direction is displayed. Here, FIGS. 142 through 144 shown here show images displayed on the LCD 102 at a certain moment. Moreover, the document direction changing operation guidance is displayed in a same manner as of the option installing guidance.

In this way, when in the automatic magnification setting mode or the automatic sheet selecting mode using the manual document storing section 69 in the RDH 2, detection is made that documents are stored and the document direction changing operation guidance is automatically displayed as dynamic images, an operator can securely obtain a desired copy, so secure copying work is possible.

In addition, in the case where the discharge tray 36 is full of sheets and an operator should remove sheets from the discharge tray 36, in the copying apparatus, second discharge sheet removing operation guidance of FIG. 145 for removing discharge sheets which fill the discharge tray 36 is displayed. The above operation guidance is displayed when the discharge tray lower position detecting sensor $Sa_8'$ is switched from OFF to ON so as to detect that the discharge tray is filled with sheets.

The second discharge document removing operation guidance shows a procedure for removing discharge sheet which fill the discharge tray 36. At S56 and S57, on the image processing screen displayed on the LCD 102, as shown in FIGS. 146 through 148, a message "Discharge tray is full. Remove sheets according to procedure shown in right drawing" is displayed instead of the message "Copying is possible". Moreover, a dynamic image of FIG. 146 which shows a state that sheets fill the discharge tray 36 and dynamic images of FIGS. 147 and 148 which show operations for removing sheets which fill the discharge tray 36 are circularly displayed in a blank portion of the image processing screen. Here, FIGS. 146 through 148 shown here show images displayed on the LCD 102 at a certain moment. Moreover, the second discharge sheet removing operation guidance is displayed in a same manner as of the option installing guidance.

In this way, when the detection is made that the discharge tray 36 is filled with paper and the second discharge sheet removing operation guidance is automatically displayed, an operator can securely perform a necessary operation so as to continue the copying operation.

In addition, in the case where an operator should supply cover sheets/guard sheets in a a cover sheet/guard sheets mode, in the copying apparatus, cover sheets/guard sheets supplying operation guidance of FIG. 149 for supplying cover sheets/guard sheets is displayed. The above cover sheets/guard sheets supplying operation guidance is supplied when the sheet detecting sensor $Sa_5'$ is switched from ON to OFF so as to detect timing of supplying sheets.

The covers sheets/guard sheets supplying operation guidance shows a procedure for supplying cover sheets/guard sheets. At S59 through S61, on the image processing screen displayed on the LCD 102, as shown in FIGS. 150 through 152, a message "Supply cover sheets/guard sheets according to procedure shown in right drawing" is displayed instead of the message "Copying is possible". Moreover, a dynamic image of FIG. 150 which shows an operation for opening the auxiliary tray 72, a dynamic image of FIG. 151 which shows an operation for adjusting the manual insertion sheet guide 71 to a size of sheets, a dynamic image of FIG. 152 which shows an operation for inserting sheets are circularly displayed in a blank portion of the image processing screen. Moreover, a simple message "Auxiliary tray" is also displayed in a portion A of the dynamic image of the FIG. 150, and this makes the operation easier. Here, FIGS. 150 through 152 shown here show images displayed on the LCD 102 at a certain moment. Furthermore, the cover sheets/guard sheets supplying operation guidance is displayed in a same manner as of the option installing guidance.

In this way, when the cover sheets/guard sheets supplying timing is detected and the cover sheets/guard sheets supplying operation guidance is automatically displayed, even if an operator first inserts cover sheets/guard sheets so as to carrying out copying, or it is difficult for the operator to understand its operation, an operator can easily and securely carrying out the cover sheets/guard sheets copying.

In addition, in the case where the operator selects the cover sheets/guard sheets mode or a mode for obtaining both-sided copies or one-sided copies from both-sided documents and it is necessary to use RDH 2 for copying, for example, in the copying apparatus, RDH document storing operation guidance of FIG. 153 for storing documents on the RDH 2 is displayed. The above RDH document storing operation guidance is displayed when a document number counting mode which requires the RDH 2 is used so that timing of storing documents is detected.

The above RDH document storing operation guidance shows a procedure for storing documents on the RDH 2. At S63 through S66, on the image processing screen displayed on the LCD 102, as shown in FIGS. 154 through 157, a message "Set documents according to procedure shown in right drawing" is displayed below the message "Copying is possible". Moreover, a dynamic image of FIG. 154 which shows an operation for confirming that documents do not exist on the document platen of the document exposing section 3, a dynamic image of FIG. 155 which shows an operation for adjusting the document guide 81 of the document storing section 51 in the RDH 2 to a size of documents, a dynamic image of FIG. 156 which shows an operation for adjusting the document backward end guide 80 of the document storing section 51 to a size of documents and a dynamic image of FIG. 157 which shows an operation for setting documents on the document storing section 51 with its surface facing upwards are circularly displayed in a blank portion of the image processing screen. Here, FIGS. 154 through 157 shown here show images displayed on the LCD 102 at a certain moment. Moreover, the RDH document storing operation guidance is displayed in a same manner as of the option installing guidance.

In this way, when document storing timing is detected and the RDH document storing operation guidance is automatically displayed, even if an operator first performs such an operation or it is difficult to understand the operation, the operator can securely performs the operation.

As mentioned above, in the operation guidance display apparatus of the copying apparatus, since an operation to be performed by an operator is displayed as dynamic images in a blank portion of the image processing screen at prescribed timing, a necessary operation, a portion on which the operation should be performed and a way of its operation become clear. Therefore, in the case where the operator first performs the operation or it is difficult for the operator to understand the operation, the operator can easily and safely perform the operation, thereby making it possible to improve operability of the copying machine by providing the present apparatus.

Furthermore, in the present embodiment, since dynamic images which shows operations as well as messages according to the operations are displayed, more secure operation is possible, thereby making it possible to further improve the operability of the copying apparatus by providing the present apparatus.

Here, the operation guidance display apparatus of the embodiment 8 is arranged so that operation guidance is displayed being superimposed on a blank portion of the image processing screen, but may be arranged so that the image processing screen and the operation guidance display screen are alternately displayed.

In other words, for example, the case where the option installing timing is detected will be explained as follows. As shown in FIG. 158, when the option installing timing is detected, a dynamic image of FIG. 159 which shows an operation for setting a mode, a dynamic image of FIG. 160 which shows an operation for opening doors, a dynamic image of FIG. 161 which shows installation of a commander and a dynamic image of FIG. 162 which shows an operation for turning ON the start/stop key are circularly displayed on the whole LCD 102 at S2 through S5 from the image processing screen which shows the image processing information of S1. Thereafter, the image processing screen of S1 is displayed again, so S1 and S2 through S5 are alternately displayed. It is suitable that its switching speed is 200 msec to 500 msec which makes it possible to discriminate the both screens.

As shown in FIG. 163, when the option installing timing is detected, a timer (TIM) is set to 500 msec (S130), and option installing information where the message "Connect commander" is displayed at S131 is displayed on the image processing screen of FIG. 164 until time is over at 132. When the time is over at S132, the timer (TIM) is again set to 500 msec (S133) and the dynamic images in FIG. 163 of the procedure for installing the commander at S2 through S5 are circularly displayed at S135 until the time is over. Then, the procedure is again returned to S130, and the procedures of S130 through S135 is repeated.

It is excellent to alternatively display the images because a lot of messages can be displayed in the case where a lot of messages of the image processing information on the image processing screen are desired to be given to an operator together with the operating information.

In addition, in the operating guidance display apparatus of the present embodiment, the operation designating section to be operated by an operator and the non-operation designating section are displayed in a same color as dynamic images, but they may be in different colors, for example. In order to perform the above operation, the LCD 102 shown in FIG. 1 is capable of displaying images in colors. Moreover, when display data stored in the V-RAMs 145.146 is displayed on the LCD 102, the LCD controller 150 takes out display colors from the color palette 149 according to color information of portions of the display data to be displayed on the LCD 102 and display data are displayed in colors.

The displaying operations mentioned above are shown in FIGS. 41 through 58 as dynamic images of opening doors shown in FIG. 84, for example. The first and second doors 39.40 which is represented by slanted lines in the drawing are the operation designating sections in the option installing operation guidance. The above slanted line sections are displayed in red, for example, on the screen of the LCD 102, and the copying apparatus shape section is displayed in black, for example. As a result, since the operation designating section to be operated and the non-operation designating section are clearly distinguished so as to be displayed, even in the case where an operator first perform the operation or it is difficult for the operator to understand the operation, the operator can more easily perform the operation.

Here, colors of the operation designating section and the non-operation designating section in the above operation guidance displaying can be suitably set without being limited to red and black. Moreover, since the operation designating section and the non-operation designating section in the above operation guidance displaying may be clearly distinguished, they are not limited to displaying in different colors, so they may be in different states, such as displaying at different depths, displaying as a slanted line section and the a non-slanted line section, displaying by blinking and unblinking. In order to carrying out such displaying, the LCD 102 may provide black and white displaying.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An operation guidance display apparatus of an image forming apparatus, comprising:

state detecting means for detecting that said image forming apparatus requires a prescribed operation by an operator;

dynamic image data storing means for storing dynamic image data which show a sequence of a procedure for the prescribed operation to be detected by said state detecting means;

display means for displaying operation guidance; and display control means for when said state detecting means detects that said image forming apparatus requires the prescribed operation, displaying the dynamic image data of necessary operation on said display means as dynamic images.

2. The operation guidance display apparatus as defined in claim 1, wherein said state detecting means includes jam detecting means for detecting jam in a plurality of sheet passing sections, wherein said dynamic image data storing means stores the dynamic image data which show a sequence of a procedure for an operation for removing jam in the sheet passing sections, wherein said display control means displays the dynamic image data which show the procedure for removing jam in the sheet passing sections where said jam detecting means detects remaining of sheets as dynamic images on said display means when said jam detecting means detects jam.

3. The operation guidance display apparatus as defined in claim 2, further comprising:

a progressive key for switching the dynamic image data to be displayed by said display means, wherein said display control means successively switches the dynamic image data for each sheet passing section where said jam detecting means detects remaining of sheets each time said progressive key is operated so as to display the dynamic image data on said display means when said state detecting means detects jam.

4. The operation guidance display apparatus as defined in claim 2, further comprising:

an automatic progressive key for automatically switching the dynamic image data to be displayed on said display means, wherein said display control means automatically switches the dynamic image data successively for each sheet passing section where said jam detecting means detects remaining of sheets so as to display the dynamic image data on said display means when said jam detecting means detects jam and said automatic progressive key has been operated.

5. The operation guidance display apparatus as defined in claim 1, wherein the dynamic image data to be displayed on said display means which are stored in said dynamic image data storing means are set such that a portion of its display image to be moved and the other portion are displayed in different states.

6. The operation guidance display apparatus as defined in claim 5, wherein the dynamic image data are set such that the portion of the display image to be moved and the other portion are displayed in different colors.

7. The operation guidance display apparatus as defined in claim 2, wherein the dynamic image data are set such that an operation designating section to be operated in order to remove jam in the display image of the dynamic image data is displayed in a different state from an operation forbidding section.

8. The operation guidance display apparatus as defined in claim 7, wherein the dynamic image data are set such that a portion of the display image to be moved and the other portion are displayed in different colors.

9. The operation guidance display apparatus as defined in claim 2, wherein said image forming apparatus includes automatic document feeding means for feeding a plurality of document sheets stored in a document storing position to a document reading position and performing a document feeding/collecting operation which collects the document sheets from the document reading position to a collecting position so as to suspend the document feeding/collecting operation at the time jam occurs during the document feeding/collecting operation or on an image forming apparatus main body side, wherein said dynamic image data storing means stores the dynamic image data which shows a sequence of a procedure for returning fed and collected document sheets and documents sheets before feeding by rearranging them in a correct order at the time of restarting the document feeding/collecting operation when the document feeding/collecting operation of said automatic document feeding means is suspended, wherein said display control means displays the dynamic image data relating to rearrangement of document sheets on said display means as dynamic image when the document feeding/collecting operation of said automatic document feeding means is suspended due to the occurrence of jam.

10. The operation guidance display apparatus as defined in claim 9, wherein said display control means displays a page of documents where jam occurs in said automatic document feeding means side on said display means.

11. The operation guidance display apparatus as defined in claim 9, wherein said display control means displays the dynamic image data relating to the rearrangements of document sheets on said display means as dynamic images after completion of removing the jam.

12. The operation guidance display apparatus as defined in claim 11, wherein said display control means displays a page of documents where jam occurs in said automatic document feeding means side on said display means.

13. The operation guidance display apparatus as defined in claim 1, wherein said display control means;

displays only image processing information relating to image processing operations on said display means when the operation guidance is not displayed, and displays the dynamic image data about necessary operations in a blank portion of said display means with the dynamic image data being reduced so that the dynamic image data are not superimposed on a display area of the image processing information when said state detecting means detects that said image forming apparatus requires a prescribed operation.

14. The operation guidance display apparatus as defined in claim 13, wherein the dynamic image data to be displayed on said display means which are stored in said dynamic image data storing means are set such that a portion of its display image to be moved and the other portion are displayed in different states.

15. The operation guidance display apparatus as defined in claim 1, wherein said display control means;

displays only image processing information relating to image processing operations on said display means when the operation guidance is not displayed, and alternately displays the image processing information and the dynamic image data about a necessary operation at prescribed intervals when said state detecting means detects that said image forming apparatus requires a prescribed operation.

16. The operation guidance display apparatus as defined in claim 13, wherein the dynamic image data to be displayed on said display means which are stored in said dynamic image data storing means are set such that a portion of its display image to be moved and the other portion are displayed in different states.

17. The operation guidance display apparatus as defined in claim 1, further comprising:

message data storing means for storing message data according to a necessary operation, wherein said display control means displays also a message according to a necessary operation on said display means together with the dynamic images when said state detecting means detects that said image forming apparatus requires a prescribed operation.

18. The operation guidance display apparatus as defined in claim 1, wherein:

said state detecting means includes means for detecting timing of installing an optional attached unit to said image forming apparatus, said dynamic image data storing means stores dynamic image data which show a procedure of operations for installing the optional attached unit, said display control means displays dynamic image data which show a procedure of operations for installing the optional attached unit on said display means as dynamic images when said state detecting means detects the timing of installing the optional attached unit.

19. The operation guidance display apparatus as defined in claim 1, wherein:

said state detecting means includes a toner empty sensor for detecting that no toner exists in a toner hopper, said dynamic image data storing means stores dynamic image data which show a procedure of operations for supplying toner, said display control means displays the dynamic image data which show the procedure for supplying toner on said display means as dynamic images when said state detecting means detects that no toner exists.

20. The operation guidance display apparatus as defined in claim 1, wherein:

said state detecting means includes means for detecting no sheets are left in a feeding section, said dynamic image data storing means stores dynamic image data which shows a procedure for supplying sheets to the feeding section, said display control means displays the dynamic image data which show the procedure for supplying sheets on said display means as dynamic images when said state detecting means detects that no sheets are left.

21. The operation guidance display apparatus as defined in claim 20, further comprising:

message data storing means for storing message data which show a size of sheets to be supplied, wherein said display control means displays also a message which show a size of sheets to be supplied on said display means together with the dynamic images when said state detecting means detects that no sheets are left.

22. The operation guidance display apparatus as defined in claim 1, wherein:

said image forming apparatus includes an original cover which covers documents stored on a document platen, said image forming apparatus having a copying mode for after the original cover is opened, copying the documents, which have been directly stored on the document platen, said state detecting means includes means for detecting the copying in the copying mode is completed, said dynamic image data storing means stores dynamic image data which show a procedure for removing documents on the document platen, said display control means displays the dynamic image data which show the procedure for removing documents on said display means as dynamic images when said state detecting means detects that copying in the copying mode is completed.

23. The operation guidance display apparatus as defined in claim 1, wherein:

said image forming apparatus includes an automatic document feeding unit which automatically feeds documents to a document reading section, said image forming apparatus having a copying mode for carrying out a copying operation by means of said automatic document feeding unit, said state detecting means includes means for detecting the copying in the copying mode is completed, said dynamic image data storing means stores dynamic image data which show a procedure for removing documents from said automatic document feeding unit, said display control means displays the dynamic image data which show the procedure for removing documents on said display means as dynamic images when said state detecting means detects that copying in the copying mode is completed.

24. The operation guidance display apparatus as defined in claim 1, wherein:

said state detecting means includes means for after an image forming operation is completed, detecting all sheets where images have been formed are discharged to a discharge section of said image forming apparatus, said dynamic image data storing means stores dynamic image data which show a procedure for removing sheets discharged from the discharge section, said display control means displays the dynamic image data which show the procedure for removing discharged sheets on said display means as dynamic images when said state detecting means detects that discharging of the image-formed sheets where images have been formed is completed.

25. The operation guidance display apparatus as defined in claim 1, wherein:

said image forming apparatus includes a stapler unit which staples sheets using staples, said state detecting means includes means for detecting no staples exist in a stapler unit, said dynamic image data storing means stores dynamic image data which show a procedure for supplying staples, said display control means displays the dynamic image data which show the procedure for supplying staples on said display means as dynamic images when said state detecting means detects that no staples exist.

26. The operation guidance display apparatus as defined in claim 1, wherein:

said image forming apparatus includes a stapler unit which staples sheets using staples, said state detecting means includes means for detecting jam of staples occurs in a stapler unit, said dynamic image data storing means stores dynamic image data which show a procedure for removing the staples which have been jammed in the stapler unit, said display control means displays the dynamic image data which show the procedure for removing the staples on said display means as dynamic images when said state detecting means detects the jam of staples.

27. The operation guidance display apparatus as defined in claim 1, wherein:

said state detecting means includes means for detecting a disposed toner collecting bottle is full, said dynamic image data storing means stores dynamic image data which show a procedure for replacing the disposed toner collecting bottle for new one, said display control means displays the dynamic image data which show the procedure for replacing the disposed toner collecting bottle on said display means as dynamic images when said state detecting means detects the disposed toner collecting bottle is full.

28. The operation guidance display apparatus as defined in claim 1, wherein:

said image forming apparatus includes an automatic document feeding unit which automatically feeds documents to a document reading section, said state detecting means includes means for detecting a state of the documents which have been set in the automatic document feeding unit, said dynamic image data storing means stores dynamic image data which show a procedure for adjusting a state of document setting, said display control means displays the dynamic image data, which show the procedure for adjusting the state of the document setting based upon detected output of the state of document setting by said state detecting means, on said display means as dynamic images.

29. The operation guidance display apparatus as defined in claim 1, wherein:

said image forming apparatus is capable of carrying out a copying operation by means of an automatic magnification setting mode for automatically setting a copying magnification based upon a size of documents and a size of selected sheets, said state detecting means includes means for when the automatic magnification setting mode is selected, detecting a direction in which the documents have been set should be changed, said dynamic image data storing means stores dynamic image data which show a procedure for changing the set direction of the documents to a correct direction, said display control means displays the dynamic image data which show the procedure for changing the direction of the documents on said display means as dynamic images when said state detecting means detects that the direction where the documents have been set should be changed.

30. The operation guidance display apparatus as defined in claim 1, wherein:

said image forming apparatus is capable of carrying out a copying operation by means of an automatic sheet selecting mode for automatically selecting sheets based upon a copying magnification and a size of documents, said state detecting means includes means for when the automatic sheet selecting mode is selected, detecting a direction in which the documents have been set should be changed, said dynamic image data storing means stores dynamic image data which show a procedure for changing the set direction of the documents to a correct direction, said display control means displays the dynamic image data which show the procedure for changing the direction of the documents on said display means as dynamic images when said state detecting means detects that the direction where the documents have been set should be changed.

31. The operation guidance display apparatus as defined in claim 1, wherein:

said state detecting means includes means for detecting that a discharge tray is full, said dynamic image data storing means stores dynamic image data which show a procedure for removing discharged sheets from the discharge tray, said display control means displays the dynamic image data which show the procedure for removing the discharged sheets on said display means as dynamic images when said state detecting means detects that the discharge tray is full.

32. The operation guidance display apparatus as defined in claim 1, wherein:

said image forming apparatus is capable of carrying out a copying operation by means of a cover sheets/guard sheets mode, said state detecting means includes means for detecting timing of supplying cover sheets/guard sheets to said image forming apparatus, said dynamic image data storing means stores dynamic image data which show a procedure for supplying the cover sheets/guard sheets to said image forming apparatus, said display control means displays the dynamic image data which show the procedure for supplying the cover sheets/guard sheets on said display means as dynamic images when said state detecting means detects the timing of supplying the cover sheets/guard sheets.

33. The operation guidance display apparatus as defined in claim 1, wherein:

said image forming apparatus includes an automatic document feeding unit which automatically feeds documents to a document reading section, said image forming apparatus having a copying mode using the automatic document feeding unit, said state detecting means includes means for detecting timing of storing documents on the automatic document feeding unit in the case where the above mode is selected, said dynamic image data storing means stores dynamic image data which show a procedure for storing the documents on the automatic document feeding unit, said display control means displays the dynamic image data which show the procedure for storing the documents on said display means as dynamic images when said state detecting means detects the timing of storing the documents on the automatic document feeding unit.

34. An operation guidance display apparatus of an image forming apparatus, comprising:

jam detecting means for detecting jam in a plurality of sheet passing sections;

operation existence/non-existence detecting means for detecting whether each operation in a series of a procedure for removing jam in each sheet passing section has been performed or not;

dynamic image data storing means for storing dynamic image data which show a series of the procedure for removing jam in each sheet passing section;

display means for displaying the procedure for removing jam; and display control means for when said jam detecting means detects jam, successively switching dynamic images which show each operation in a series of the procedure for removing jam in the sheet passing sections where said jam detecting means detects remaining of sheets to a dynamic image showing a next operation every time said operation existence/non-existence detecting means detects a performance of each operation so as to display the dynamic images on said display means based upon the dynamic image data stored in said dynamic image data storing means.

35. The operation guidance display apparatus as defined in claim 34, wherein the dynamic image data to be displayed on said display means which are stored in said dynamic image data storing means are set such that a portion of its display image to be moved and the other portion are displayed in different states.

36. The operation guidance display apparatus as defined in claim 34, wherein the dynamic image data are set such that an operation designating section to be operated in order to remove jam in the display image of the dynamic image data and an operation forbidding section are displayed in different states.

* * * * *